US006257412B1

(12) United States Patent
Yamamoto et al.

(10) Patent No.: US 6,257,412 B1
(45) Date of Patent: Jul. 10, 2001

(54) FOLDED CUSHIONING MATERIAL FOR PACKAGING

(75) Inventors: Masahiro Yamamoto, Osaka; Yoshimasa Yokoyama, Kohbe, both of (JP)

(73) Assignees: Hitachi Zosen Corporation; Yokoyama Sankoh Co., Ltd., both of (JP)

( * ) Notice: Subject to any disclaimer, the term of this patent is extended or adjusted under 35 U.S.C. 154(b) by 0 days.

(21) Appl. No.: 09/380,048

(22) PCT Filed: Mar. 2, 1998

(86) PCT No.: PCT/JP98/00859

§ 371 Date: Dec. 2, 1999

§ 102(e) Date: Dec. 2, 1999

(87) PCT Pub. No.: WO98/38113

PCT Pub. Date: Sep. 3, 1998

(30) Foreign Application Priority Data

Feb. 28, 1997 (JP) ..... 9-062345

(51) Int. Cl.[7] ..... B65D 81/05; B65D 85/00
(52) U.S. Cl. ..... 206/586; 206/320
(58) Field of Search ..... 206/320, 521, 206/586, 588, 591, 592, 587

(56) References Cited

U.S. PATENT DOCUMENTS

| | | | |
|---|---|---|---|
| 2,538,671 | 1/1951 | Crowe . | |
| 3,281,050 | 10/1966 | Suchodolski . | |
| 3,434,400 | 3/1969 | Hochfeld . | |
| 4,200,032 | 4/1980 | Roda . | |
| 4,248,350 * | 2/1981 | Gilbert | 206/586 |
| 4,425,111 | 1/1984 | Chazelas . | |
| 4,578,052 | 3/1986 | Engel . | |
| 4,792,085 | 12/1988 | Waring, III et al. . | |
| 5,117,973 | 6/1992 | Lo Duca . | |
| 5,200,013 | 4/1993 | Traber . | |
| 5,398,808 * | 3/1995 | Chen et al. | 206/320 |
| 5,669,204 | 9/1997 | Blaisdell . | |
| 5,692,672 | 12/1997 | Hunt . | |
| 5,709,771 | 1/1998 | Fritzman . | |
| 5,755,078 | 5/1998 | Hurtig, Jr. et al. . | |
| 5,772,025 * | 6/1998 | Chen et al. | 206/320 |

FOREIGN PATENT DOCUMENTS

| | | | |
|---|---|---|---|
| 3303180 * | 8/1984 | (DE) | 206/586 |
| 4637998 | 12/1925 | (JP) . | |
| 53-83377 | 7/1978 | (JP) . | |
| 58-61768 | 4/1983 | (JP) . | |
| 59-186263 | 12/1984 | (JP) . | |
| 59-191356 | 12/1984 | (JP) . | |
| 2-108823 | 8/1990 | (JP) . | |
| 7-31664 | 6/1995 | (JP) . | |

* cited by examiner

*Primary Examiner*—Byron P. Gehman
(74) *Attorney, Agent, or Firm*—Lorusso & Loud

(57) ABSTRACT

A cushioning material for packaging is provided, which is used when an article having a rectangular cross section or a cubic shape is packaged in an outer case, such as a corrugated cardboard box. The cushioning material is suitable for packaging the article therewith in an outer case while an end portion, which has a pair of corner sections, of the article is inserted into and supported by the cushioning. The cushioning material is provided with a grooved retainer (1) and a pair of end support members (2,2) disposed so as to close the ends of both end portions of the grooved retainer (1). The grooved retainer has a raised bottom (10) and two side walls (11,11) and is adapted to receive one inserted end portion of the article having a rectangular cross section or a cubic shape. The end support members each have a plurality of hollow portions (20), which are arranged in parallel in a predetermined direction, and a rectangular cross-section orthogonal to the longitudinal direction of the hollow portions (20). The grooved retainer (1) and end support members (2,2) are formed by folding a single sheet a of a predetermined planar shape along valley-forming folding lines (a1) and ridge-forming folding lines (a2) formed on the sheet. This enables to provide a cushioning material for packaging which has a simple structure and a low bulk specific gravity, and is not likely to deform.

11 Claims, 77 Drawing Sheets

Fig. 83
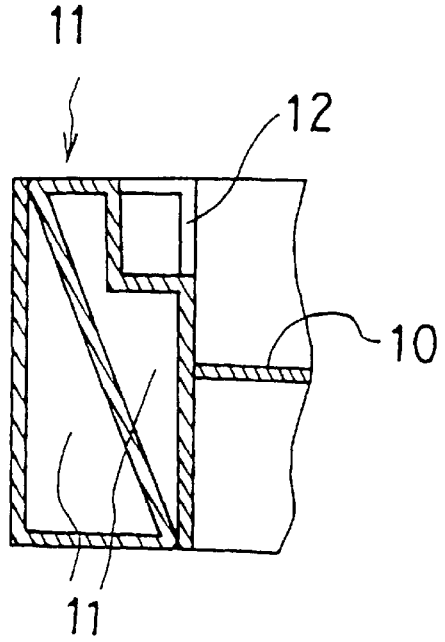
Fig. 84(A)
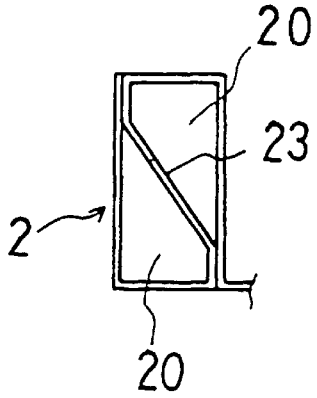
Fig. 84(C)
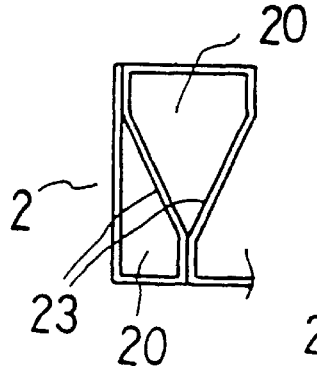
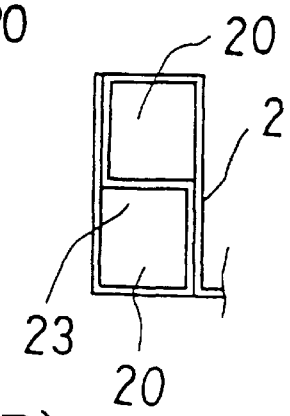
Fig. 84(B)

FOLDED CUSHIONING MATERIAL FOR PACKAGING

FIELD OF THE INVENTION

This invention relates to a cushioning material for packaging. More specifically, it relates to a cushioning material for packaging suitable for packing an article having a hexahedral or cubic shape, such as a notebook type personal computer or image scanner, into a case (chest) such as a corrugated cardboard case or the like, with each of opposing ends of the article inserted in and supported by the cushioning material.

TECHNICAL BACKGROUND

Recently, cushioning materials or spacers for packaging, made of a reusable sheet such as corrugated cardboard sheet or the like, have been proposed as substitutes for cushioning materials of styrene foam, which cannot be recycled or reused and adversely affect the life environment when discarded, as described in, for example, Japanese Patent Application laid-open No. H4-267769.

The cushioning material disclosed in the aforementioned Patent Application is constructed so as to support and protect the corners of an article when packed in a case, and every part thereof is composed of stacked (layered) corrugated cardboard.

When every part of a cushioning material is composed of stacked corrugated cardboard like this, the structure becomes simple but the bulk density (weight per unit volume) thereof increases and the cost becomes high.

To solve these problems, a cushioning material for packaging which uses a square cylindrical hollow body made of corrugated cardboard has been proposed, for example, in Japanese Patent Application laid-open No. H8-58842.

The cushioning material for packaging described in the above-mentioned Official Gazette Publication consists of a hollow body 6 having a square cross section, as shown in FIGS. 85 and 86, where parallel cuts 60, 61 are formed on both side portions so as to intersect at right angle with one edge of the body and a cut portion is formed on the edge between these cuts 60, 61 so as to form a plurality of symmetrical recesses 62 and protrusions 63. On two sides of the body 6 sandwiching the edge, flaps 66, 67 are made by forming folding lines 64, 66 extending between the ends of the cuts 60, 61 and a recess portion 60*a* is formed by folding the flaps 66, 67 inside and interlocking the aforementioned recesses 62 and protrusions 63 with each other.

The subject article is packed into a case with opposing edges of the article guided and supported by the recess portion 60*a* of this cushioning material.

Alternatively, as shown in FIG. 86, a pair of the bodies 6, 6 are united so that the recesses 60*a*, 60*a* are arranged in parallel to form a grooved recess 60*a*, 60*a*. The edges of the article 4 are guided and supported by the recess 60*a*, 60*a* and in this state the article 4 is packed in a case (not shown in FIG. 86).

Although the cushioning material for packaging disclosed in the above-mentioned Japanese Patent Application laid-open No. H8-58842 has a small bulk density as a whole and a simple structure, since it mainly consists of the hollow body 6, it has the following problems.

First, since the body has a square cross section and only a single hollow, it is liable to deform until a part of the article 4 is put into the recess 60*a* and packed in a case, which restricts movement of each body 6. This makes packaging difficult when the article 4 is packed into the case together with the cushioning material.

A second problem is that the bottom flaps 67 are weak, since, in the state shown in FIG. 86, the side of each bottom flap 67, 67 is connected to the side wall flap 66, 66 only by interlocking of a plurality of recess-protrusion portions 62, 63 and the weight of the article rests mainly on a central leg portion 68 of the bottom of the groove. Accordingly, only a very light article can be packaged.

DISCLOSURE OF INVENTION

An object of this invention is to provide a cushioning material for packaging which is composed of recyclable and foldable sheets as a whole, has a hollow structure and relatively small bulk density, and is not likely to deform before the cushioning material is mounted on an article and packed into a case.

Another object of this invention is to provide a cushioning material for packaging which can be used for an article that is somewhat heavy.

Yet another object of this invention is to provide a cushioning material for packaging which can be fabricated by a mechanical means.

To attain these objects, the cushioning material for packaging according to this invention is constructed as follows.

Specifically, a cushioning material for packaging according to a first aspect of the present invention comprises;

- a grooved retainer 1 having a raised bottom 10 and two side walls 11, 11, in which a part of an article 4 having a hexahedral or rectangular shape is inserted,
- at least a pair of end support members 2, 2 arranged so as to close the opposite ends of the grooved retainer 1,
- wherein each end support member 2 has a plurality of hollow portions 20 arranged in parallel along a certain direction and consists of a hollow body having a square cross section orthogonal to the longitudinal dimension of the hollow portions 20, and the raised bottom 10, the side walls 11, 11 and the end support members 2 are formed by folding a recyclable and foldable sheet a such as a corrugate cardboard, cardboard or the like.

A cushioning material for packaging according to a second aspect of the present invention is characterized in that, in the cushioning material for packaging of the first aspect, each component composing the raised bottom 10, the side walls 11, 11 and the end support members 2 is continuous to at least one adjacent component and a whole body is formed continuously by folding a sheet a of a predetermined flat shape along valley forming folding lines a1 and ridge forming folding lines a2 formed thereon.

A cushioning material for packaging according to a third aspect of the present invention is characterized in that, in the cushioning material for packaging of the second aspect, each end support member 2 is provided with a partition sheet 23 which is inclined relative to the surrounding wall and divides the hollow interior of each end support members 2 into two (2) hollow portions 20.

A cushioning material for packaging according to a fourth aspect of the present invention is characterized in that, in the cushioning material for packaging of the third aspect, each hollow portion 20 of the end support member 2 has a triangular section.

A cushioning material for packaging according to a fifth aspect of the present invention is characterized in that, in the cushioning material for packaging of the fourth aspect, the lower portion of each end support member 2 is continuous to the corresponding end of the raised bottom 10 and each side wall 11 is continuous to the corresponding side of the raised bottom 10.

A cushioning material for packaging according to sixth aspect of the present invention is characterized in that, in the cushioning material for packaging of the fourth aspect, each side wall 11 is continuous to the corresponding side of the raised bottom 10, one of the end support members 2 is continuous to the corresponding end of one of the side walls and the other end support member 2 is continuous to the corresponding end of either of the side walls.

A cushioning material for packaging according to a seventh aspect of the present invention is characterized in that, in the cushioning material for packaging of the fourth aspect, the lower portion of each end support member 2 is continuous to the corresponding end of the raised bottom 10, one end of one of the side walls 11 is continuous to the corresponding end of one of the end support members 2 and one end of the other side wall 11 is continuous to the corresponding end of either of the end support members 2.

A cushioning material for packaging according to an eighth aspect of the present invention is characterized in that, in the cushioning material for packaging of the fourth aspect, the lower portion of each end support member 2 is continuous to the corresponding end of the raised bottom 10, one end of one of the side walls 11 is continuous to the corresponding end of one of the end support members 2 and the other side wall 11 is continuous to the corresponding side of the raised bottom 10.

A cushioning material for packaging according to a ninth aspect of the present invention is characterized in that, in the cushioning material for packaging of the fourth aspect, each side wall 11 is continuous to the corresponding side of the raised bottom 10, a lower portion of one of the end support members 2 is continuous to the corresponding end of the raised bottom 10 and the other end support member 2 is continuous to the corresponding end of one of the side walls 11.

A cushioning material for packaging according to a tenth aspect of the present invention is characterized in that, in the cushioning material for packaging of the fourth aspect, one end of one of the side walls 11 is continuous to the corresponding end of one of the end support members 2, the lower portion of the one end support member 2 is continuous to the corresponding end of the raised bottom 10, the other side wall 11 is continuous to the corresponding side of the raised bottom 10, and an end of the other side wall 11 is continuous to the corresponding end of the other end support member 2.

A cushioning material for packaging according to an eleventh aspect of the present invention is characterized in that, in the cushioning material for packaging of the fourth aspect, one end of each side wall 11 is continuous to the corresponding end of one of the end support members 2, the other end of one of the side walls 11 is continuous to the corresponding end of the other end support member 2 and one end of the raised bottom 10 is continuous to the lower portion of either of the end support members 2.

A cushioning material for packaging according to a twelfth aspect of the present invention is characterized in that, in the cushioning material for packaging of the fourth aspect, one end of each side wall 11 is continuous to the corresponding end of one of the end support members 2, the other end of one of the side walls 11 is continuous to the corresponding end of the other end support member 2 and either of the side walls 11 is continuous to the corresponding side of the raised bottom 10.

A cushioning material for packaging according to a thirteenth aspect of the present invention is characterized in that, in the cushioning material for packaging of the fourth aspect, one of the end support members 2 is continuous to the corresponding end of one of the side walls 11, one end of the raised bottom 10 is continuous to the other end of the one side wall 11, the other end of the raised bottom 10 is continuous to the corresponding end of the other side wall 11 and the other end support member 2 is continuous to the other end of the other side wall 11.

According to the first aspect of the present invention, there can be provided the cushioning material for packaging which has a small bulk density, is not likely to deform, and has a simple structure, since the end support members 2, 2, which are formed on the opposite ends of the grooved retainer 1 and positioned at the corners of the case, have a plurality of hollow portions 20.

In the cushioning material for packaging according to the second aspect of the present invention, fabrication can be performed smoothly and easily, since the grooved retainer 1 and the end support members 2, 2 on the opposite ends thereof are fabricated from a single sheet a continuously and successively.

Further, when this cushioning material for packaging is reused or recycled, it can be stored and handled easily, since it can be developed into a single sheet very easily by peeling apart adhered portions.

In the cushioning material for packaging according to the third aspect of the present invention, since each end support member 2 has the partition 23, which is inclined relative to the surrounding wall and separates each of the hollow interiors of end support members 2, 2 into two hollow portion 20 and the other, the brace effect of the partitions 23 increases resistance to deformation of the end support members 2, 2.

In the cushioning material for packaging according to the fourth aspect of the present invention, since each hollow portion of each end support member 2 has a triangular section, the end support members 2, 2 have even stronger resistance to deformation. In addition, when the end support members 2, 2 are formed into a solid body by mechanical fabrication, it is easy to fabricate the end support members 2 so as to make the section square. This is because the hollow solid body is fabricated by combining the hollow portions having triangular section as if a line is drawn with a single brush stroke in it's section, as will be illustrated in the preferred embodiments.

In the cushioning materials for packaging according to the fifth to thirteenth aspects of the present invention, a solid body of each component can be readily formed of a single sheet by mechanical work and the whole body can be fabricated smoothly.

BRIEF EXPLANATION OF DRAWINGS

FIG. 83 is a partial sectional view of the cushioning material of FIG. 82

FIG. 84 shows modified embodiments of the end support member, where (A) is a partial end view of one modified embodiment, (B) is a partial end view of another modified embodiment and (C) is a partial end view of yet another modified embodiment.

PREFERRED EMBODIMENT OF THE INVENTION

Cushioning materials for packaging of preferred embodiments of the present invention will be explained in detail with the reference to FIG. 1–FIG. 84.

1st Embodiment

A cushioning material for packaging corresponding embodiment the first to of the present invention is shown in FIGS. 1–5.

Figure 1:
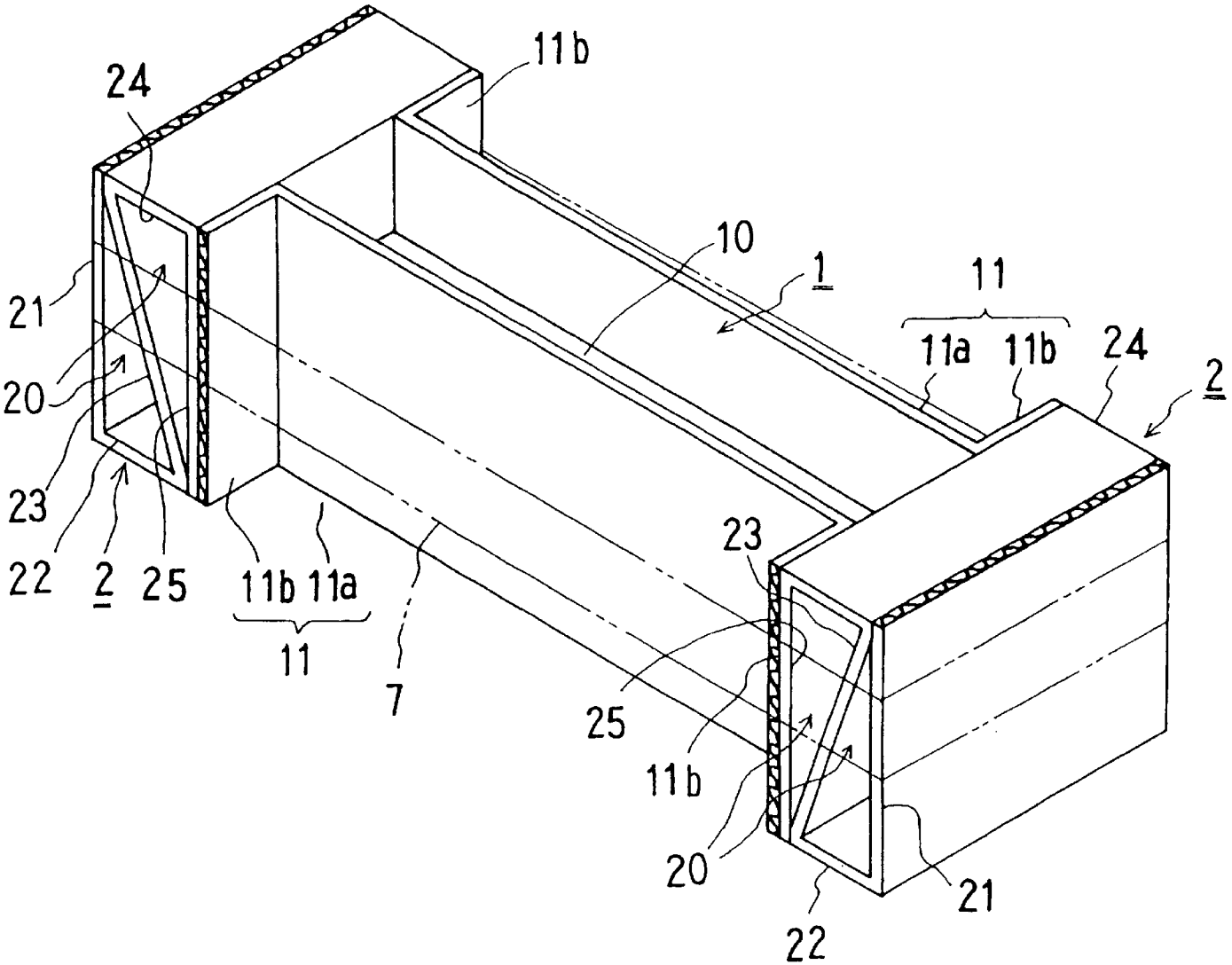
FIG. 1 is a perspective view of a first embodiment of the cushioning material for packaging according to the present invention.
Figure 2:
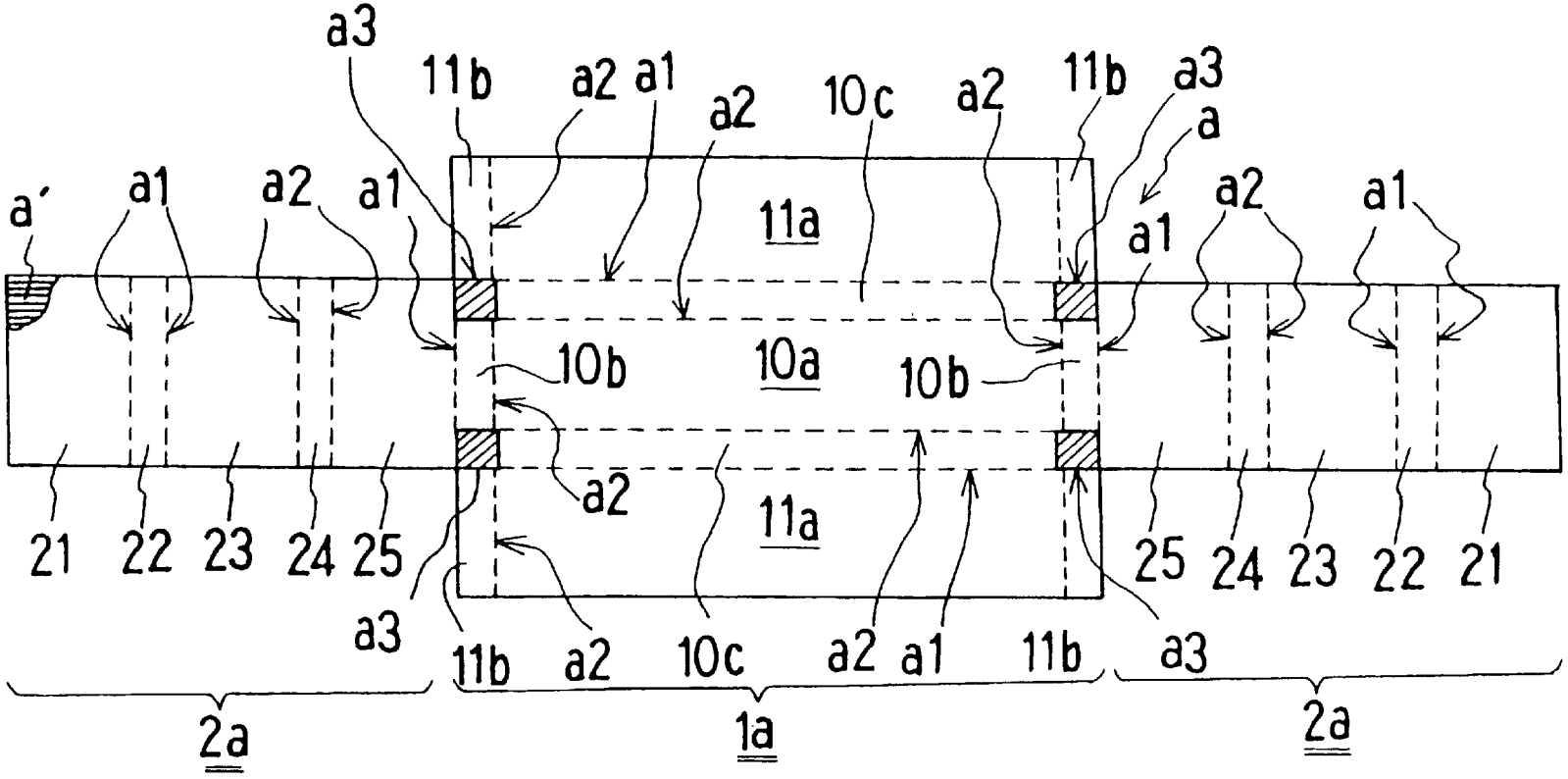
FIG. 2 is a reduced plan view of the developed (unfolded) cushioning material of FIG. 1.
Figure 3:
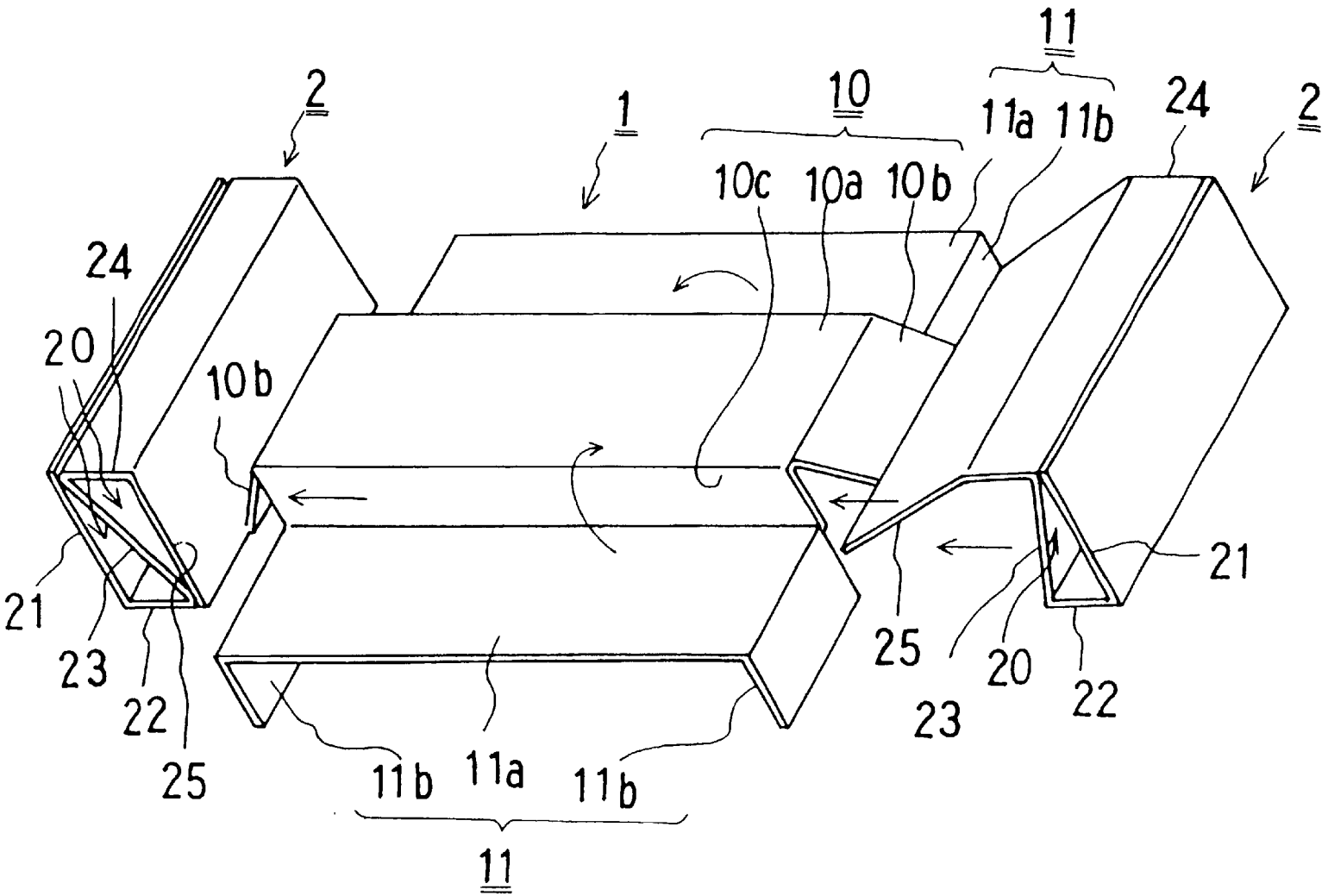
FIG. 3 is a perspective view explaining the fabrication of the cushioning material of FIG. 1.
Figure 4:
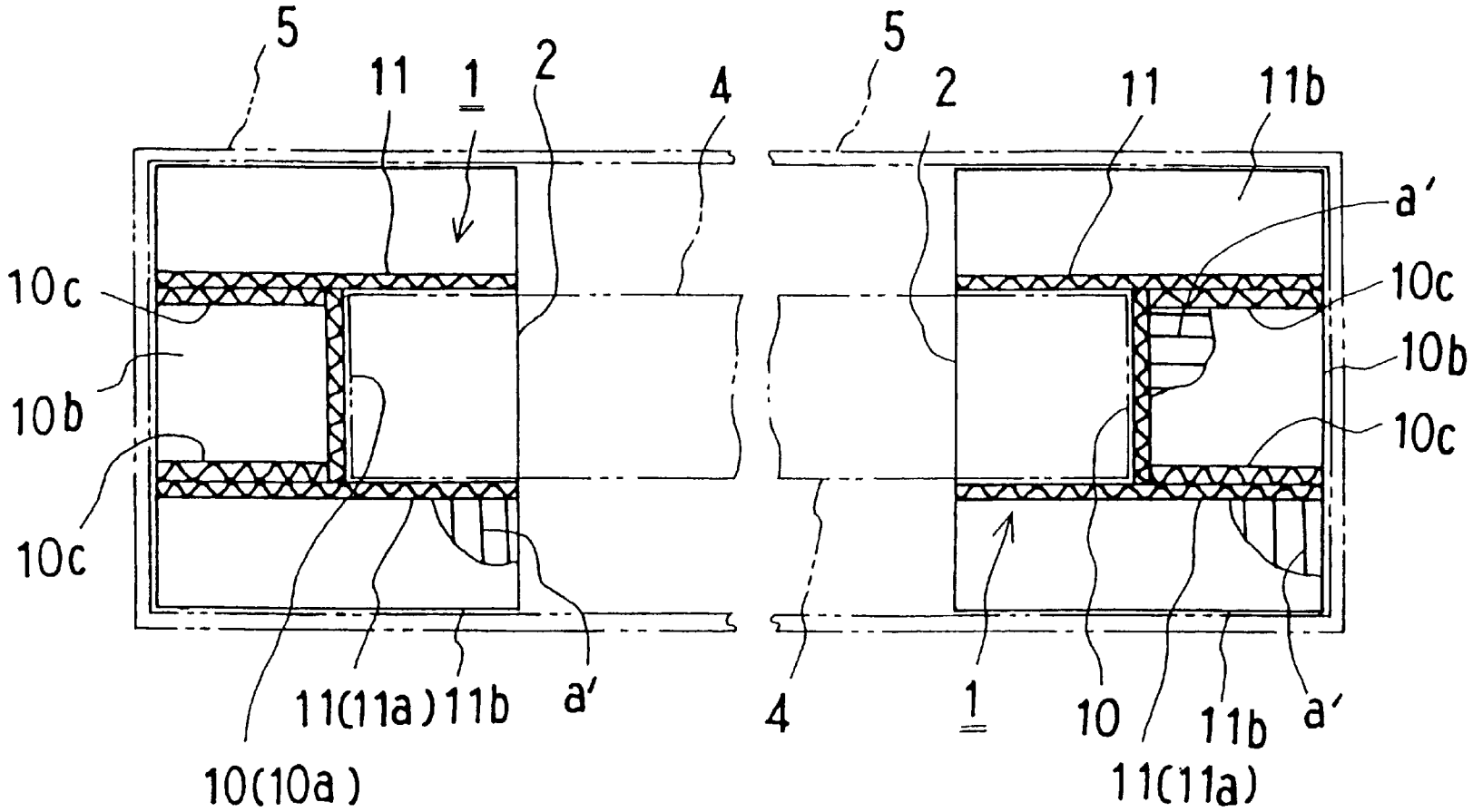
FIG. 4 is a sectional view explaining the use of the cushioning material of FIG. 1.
Figure 5:
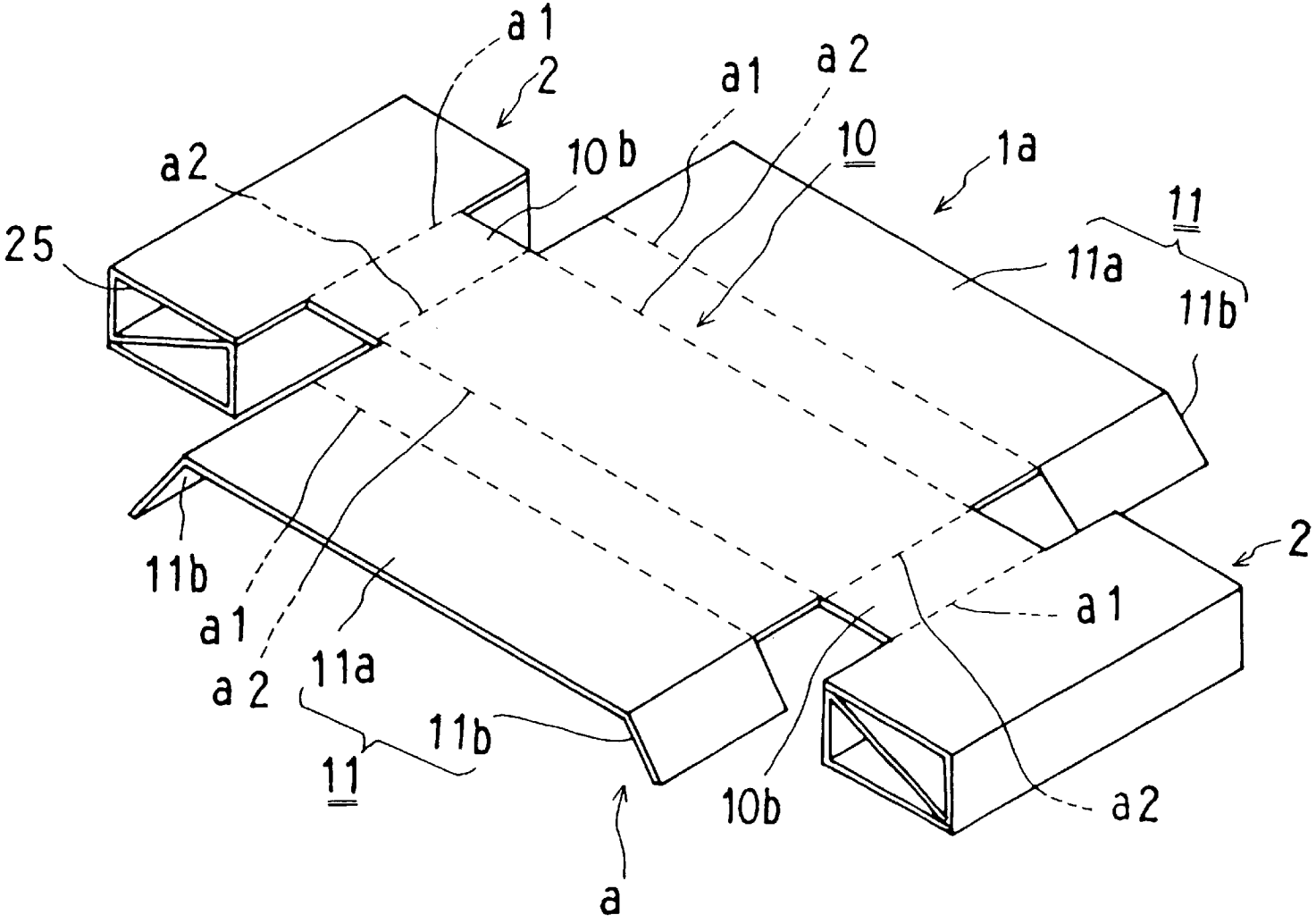
FIG. 5 is the end support perspective view of the cushioning material of FIG. 1, where a member of the cushioning material have been formed into a solid body and the other part is developed.

FIG. 1 is a perspective view thereof, FIG. 2 is a reduced plan view showing the cushioning material for packaging of FIG. 1 and FIG. 3 is a schematic view showing the state that the cushioning material is being fabricated from the developed state. FIG. 4 is a sectional view showing the state that the cushioning material is used and FIG. 5 is a perspective view showing that each portion is formed into a solid body and developed.

Reference numeral 1 designates a grooved retainer which has a raised bottom 10 and two side walls 11, 11. End support members 2, 2 are continuous to the opposite ends of the grooved retainer 1 so as to block the ends of the groove.

The groove retainer 1 has an H shape in a section orthogonal to the longitudinal direction. The raised bottom 10 of the grooved retainer 1 is continuous to each end support member 2 to form T shape in a plan view.

Each of end support members 2, 2 is rectangular in a section along the groove width direction of the grooved retainer 1 and has two hollow portions 20, 20 along the groove width direction of the grooved retainer 1.

The hollow portions 20, 20 of each end support member 2, 2 are separated by a partition sheet 23, which is inclined relative to the surrounding wall, and the sectional shapes of the hollow portions are two opposed right-angled triangles.

The cushioning material for packaging of this embodiment is fabricated sequentially from a single corrugated cardboard sheet. The sheet a, which is cut into a shape such as shown in FIG. 2, consists of a central portion 1*a* for forming the retainer (retainer forming portion) and continuous end portions 2*a*, 2*a* for forming the support members (support member forming portions).

The corrugation a' of the sheet a is along the direction in which the retainer forming portion 1*a* is continuous to the support member forming portion 2*a*.

Each support member forming portion 2*a* of the sheet a consists of an outside sheet part 21, a bottom sheet part 22, a partition sheet part 23, a top sheet part 24, and an inside sheet part 25 continuous to the grooved retainer 1, which are arranged in this order from the end of each support member forming portion 2*a*.

At the boundary between the outside sheet part 21 and the bottom sheet part 22 and the boundary between the bottom sheet part 22 and partition sheet part 23, there are formed folding lines a1 to form valley-like folds (V shape folds) in the following folding process.

At the boundary between the partition sheet part 23 and top sheet part 24 and the boundary of between the top sheet part 24 and the inside sheet part 25, there are formed folding lines a2 to form ridge-like folds (inverted V shape folds) in the following folding process.

The retainer forming sheet portion 1*a* of the sheet a consists of a raised bottom sheet part 10*a* and side wall sheet parts 11*a*. The raised bottom sheet part 10*a* has end legs 10*b*, 10*b* at the opposite ends in the longitudinal direction and side legs 10*c*, 10*c* on the opposite sides along the longitudinal direction. Each side wall sheet part 11*a* is continuous to the opposite side legs 10*c*, 10*c* respectively and has side wall reinforcing parts 11*b*, 11*b*, which function as jointing means to the respective inside sheet parts 25, at the opposite ends in the longitudinal direction.

At the boundaries between the inside sheet parts 25, 25 of the support member forming portions 2*a* and the end legs 10*b*, 10*b*, and the boundaries between the side legs 10*c*, 10*c* and the side wall sheet portions 11*a*, 11*a*, there are formed valley-forming folding lines a1.

At the boundaries between the side legs 10*c*, 10*c* and the raised bottom sheet portion 10*a*, and the boundaries between each side wall sheet portion 11*a* and the side wall reinforcing parts 11*b*, 11*b*, there are formed ridge-forming folding lines a2.

The parts surrounded by each inside sheet part 25, an edge of each side leg part 10*c* and an edge of each end leg part 10*b* are punched to form holes a3.

In this embodiment, the width of the support member forming portions 2*a* in a direction orthogonal to the corrugation a' is so designed that it is approximately the same as the sum of the widths of the both side leg parts 10*c* and that of the raised bottom sheet part 10*a*.

Cutting of the sheet a and forming of press lines or perforated lines (or intermittent cutting lines) for ridge forming folding lines a1 and valley forming folding lines a2 are conducted in the same process using, for example, a rotary cutter etc. (not shown in the Figure).

After the sheet a has been prepared as shown in FIG. 2, directional permanency of folding is imparted to each valley forming folding line a1 so that the corresponding part of the sheet a is folded into V shape along the folding line a1 smoothly. Directional permanency of folding is also imparted to each ridge forming folding line a2 so that the corresponding part of the sheet a is folded into a ridge along the folding line a2 smoothly.

After the sheet a has been thus processed, the retainer forming portion 1*a* and the support forming portions 2*a* are folded into a solid body as shown in FIG. 3 along the folding lines a1, a2 of FIG. 2, using a folding apparatus (not shown in the figures).

Then, the back surface of the upper end of each outside sheet part 21 and the corresponding upper end of the partition sheet part 23, the lower end of each partition sheet part 23 and the corresponding back surface of the lower end of the inside sheet part 25, the base and forward end portion of each side wall reinforcing part 11*b* and the corresponding surface of the inside sheet part 25, and the upper end of each side leg sheet part 10*c* and the necessary part of each side wall sheet part 11*a* are bonded to build the cushioning material.

Prior to bonding the necessary portions as described above, starch or glue (not shown in the figures) is applied to the necessary portions of the sheet a using a bonding apparatus (not shown in the figures) after directional permanency has been imparted to the sheets along the folding lines a1, a2 shown in FIG. 2.

Instead of bonding the necessary portions as mentioned above, the whole body may be bound by, for example, a thin belt 7 of synthetic resin extending over the opposite end support members 2, 2, which is depicted by a one long and two short dashed line in FIG. 1, after each part has been built into a solid body. Alternatively, the whole body may be shrink-wrapped after built into a solid body. These ways of binding or fixing the whole body can be applied similarly to the other embodiments.

The cushioning material fabricated as shown in FIG. 1 is so designed that the length of each end support member 2 in the direction orthogonal to the longitudinal direction of the grooved retainer 1 is approximately equal to the width of the grooved retainer 1 including the side wall reinforcing portions 11*b*, and the height of each end support member 2 is approximately equal to the height of the side walls 11 including the side wall reinforcing portions 11*b*.

The cushioning material of the first embodiment is used for packaging a hexahedral article 4, which is comparatively small in the thickness (height) and light, such as a notebook type personal computer.

Specifically, two cushioning materials are used in combination as shown in FIG. 4 and a part of the article 4 is inserted into each grooved retainer 1 so as to be held thereby. Then, the article 4 is packed into a case 5, where the article 4 is protected by the buffering effect of sheet portions.

The cushioning material of the first embodiment provides the following advantages.

First, the hollow end support members 2, 2 are not likely to deform since they have a plurality of hollow structures 20. Especially, since the partition 23 between the hollow portions 20 is inclined relative to the surrounding wall, the deformation of the support member 2 can be prevented more effectively and, in addition, the cushioning material can be fabricated smoothly from a single sheet a by mechanical means.

Secondly, since the grooved retainer 1 and the end support members 2, 2 at the opposite ends of the retainer are continuously formed of a single sheet a, the fabrication process can be carried out smoothly and readily. Further, when the cushioning material is reused or recycled, it can be stored and handled easily because the cushioning material can be developed to a single sheet very easily by peeling apart the adhered portions.

Thirdly, when the cushioning material is fabricated (made into a solid body) in the factory, the cushioning material can be transported without occupying a large space, with only the end support members 2, 2 made into solid and the retainer forming portion 1*a* of the sheet a unfolded as shown in FIG. 5.

Fourthly, the cushioning material has an extremely small bulk density as a whole and can be produced at a low cost, since the structure of the developed sheet a shown in FIG. 2 is very simple.

Fifthly, since no cut edge of the sheet a is exposed inside the grooved retainer 1 in which the article 4 is inserted, the article 4 is not damaged.

Sixthly, when the case 5 is shipped with its bottom (lower side of FIG. 4) downward and the load of the article 4 mainly applied to one of the side walls 11 of the grooved retainer 1, the corrugation a' in the side wall reinforcing parts 11*b*, 11*b* of the side walls 11 is aligned in the load direction, whereby the article 4 can be supported steadily.

Seventhly, when the case 5 is shipped in a posture where the load is applied in the right or left direction in FIG. 4 and the raised bottom 10 of the grooved retainer 1 mainly receives the load of the article 4, the corrugation a in the end legs 10*b*, 10*b* of the raised bottom 10 is aligned in the load direction, whereby the article 4 can be supported steadily.

Eighthly, when the cushioning material is used in a posture where the load is mainly applied to one of the end support members 2, the corrugation a' in the bottom and top sheet parts 22, 24 of the end support member 2 is aligned in the load direction, whereby the article 4 can be supported steadily.

Ninthly, if an impact acts to the cushioning material in the state shown in FIG. 4, it can be absorbed and buffered by bowing action of each sheet portions positioned in the direction in which the impact is received.

The cushioning material of the first embodiment is generally packed into the case 5 together with the article 4 as shown in FIG. 4. However, when the thickness of the article 4 is somewhat smaller than that shown in FIG. 4, the cushioning material is arranged in a mirror image of FIG. 4 and the end portion of the article 4 is inserted between the side leg portions 10*c*, 10*c*.

In this condition, the article 4 is supported by the overlapped parts of the side wall sheet portions 11*a* and side leg sheet portions 11*c*, and is therefore supported steadily.

2nd Embodiment

Figure 6:
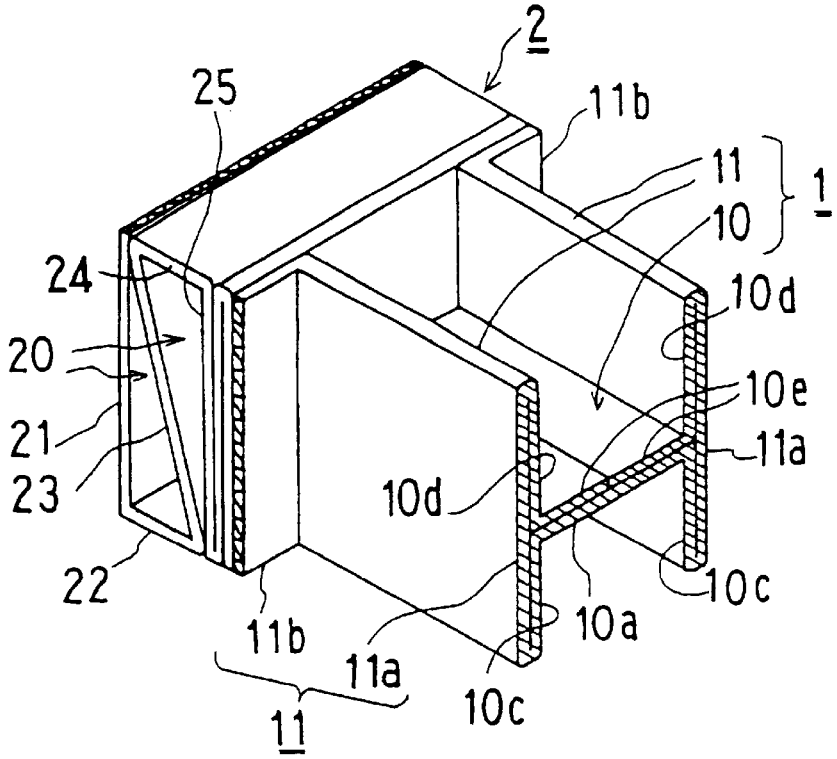
FIG. 6 is a partial perspective view of a second embodiment of the cushioning material for packaging according to the present invention.

The cushioning material for packaging of another embodiment corresponding to the fifth aspect of the invention is shown in FIG. 6. FIG. 6 is a partial perspective view thereof.

In the cushioning material of FIG. 6, inside sheet part 25 of the end support member 2 is composed of a plurality of sheet (layered structure), which is formed by folding a part of sheet and bonding the outside of the folded part to that of adjacent layer.

The raised bottom sheet part 10*a* of the grooved retainer 1 is continuous to the upper end of the respective side wall sheet parts 11*a* and raised bottom reinforcing parts 10*d*, 10*d* are folded on each half of the raised bottom sheet part 10*a* to form a double sheet layer.

According to this embodiment, since the inside sheet portion 25 of each end support member 2 is composed of a layered structure, the article is supported more steadily when used in a state where the load is applied mainly to the end support member 2.

In addition, since the raised bottom sheet portion 10*a* consists of a double layered structure, the article is supported more steadily and more cushioning effect can be obtained in the state shown in FIG. 4.

Other functions, effects and configurations of the second embodiment are similar to those of the first embodiment and explanation thereof is omitted.

3rd Embodiment

Figure 7:
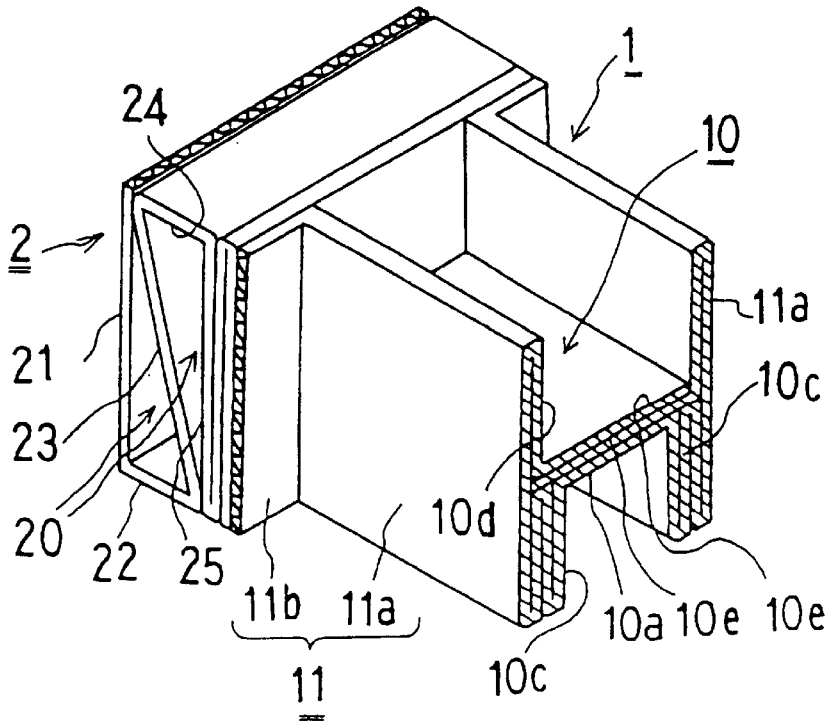
FIG. 7 is a partial perspective view of a third embodiment of the cushioning material for packaging according to the present invention.

Another embodiment of the cushioning material corresponding to the fifth aspect of the invention is shown in FIG. 7.

FIG. 7 is a partial perspective view of the cushioning material, in which each side leg 10*c* of the raised bottom 10 is composed of a plurality of layers formed by folding a part of sheet. Raised bottom reinforcing sheet parts 10*d*, 10*d*, which are continuous to the upper side leg sheet parts 11*a*, are stacked on the raised bottom sheet part 10*a*. Thereby, the raised bottom sheet part 10*a* becomes to have a layered structure.

Each of the side legs 10*c*, 10*c* of the raised bottom 10 is composed of a layered structure, which is formed by folding a necessary part of the sheet.

Other parts are constructed similarly to those of the cushioning material of the second embodiment.

According to the cushioning material of this embodiment, since each side leg 10*c* of the raised bottom 10 is composed of plural layers of sheet, even an article having a larger weight can be supported and larger cushioning effect can be obtained in the state shown in FIG. 4, where the load of the article 4 is mainly applied to the raised bottom 10.

Other functions, effects and configurations of this embodiment are similar to those of the second embodiment and explanation thereof is omitted.

4th Embodiment

Figure 8:
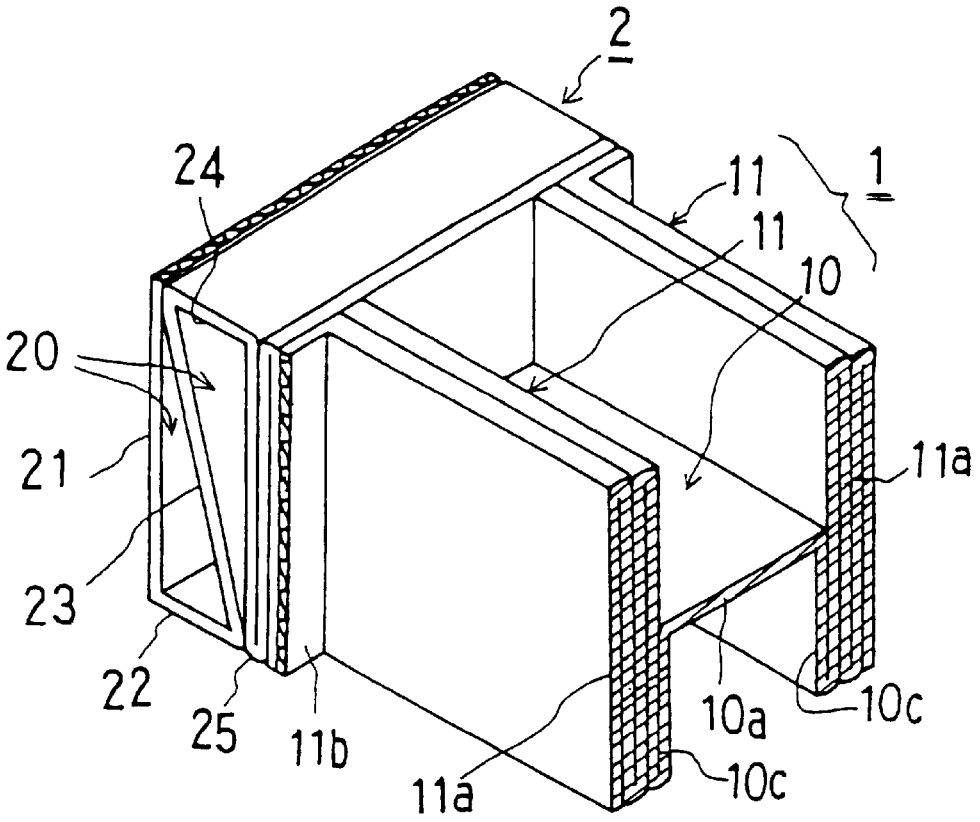
FIG. 8 is a partial perspective view of a 4th embodiment of the cushioning material for packaging according to the present invention.

Yet another embodiment of the cushioning material corresponding to fifth aspect of the invention is shown in FIG. 8.

FIG. 8 is a partial perspective view of the cushioning material. In this cushioning material, since the inside sheet portion 25 of each end support member 2 is constructed similarly to that of the cushioning of the second embodiment, similar functions and effects to that of the cushioning material of the second embodiment can be obtained with regard to the reinforced end support members 2.

Side wall sheet part 11*a* of each side wall 11 is composed of a layered sheet, which is formed by folding a part of sheet sequentially along the outside direction of the grooved retainer 1, and top and bottom edges of adjacent layers are bonded at the outside of the fold.

In the cushioning material of this embodiment, since each side wall sheet part 11*a* is reinforced by a layered sheet, the article can be supported more steadily and a larger cushioning effect can be obtained.

Other functions, advantages and configurations of the fourth embodiment are similar to those of the first embodiment and explanation thereof is omitted.

Figure 9:
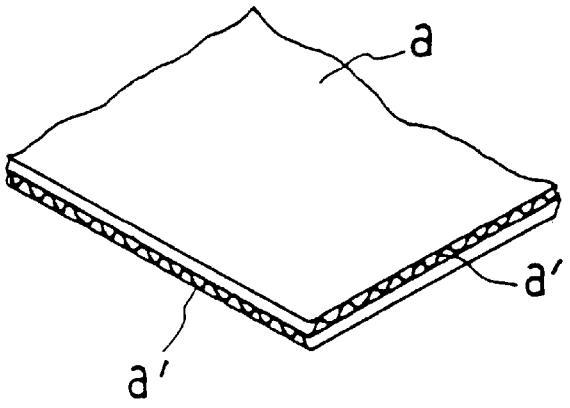
FIG. 9 is a partial perspective view of another embodiment of sheet material for the cushioning material for packaging according to the present invention.

The cushioning material of these embodiments according to the present invention may be formed of a double-surfaced corrugated cardboard, which is, as shown in FIG. 9, formed by bonding two sheets of one-surface corrugated cardboard so that corrugations a' of the corrugated cardboard intersect at a certain angle.

The cushioning material manufactured by using such a double surface corrugated board can sustain larger load applied in various directions.

5th Embodiment

Figure 10:
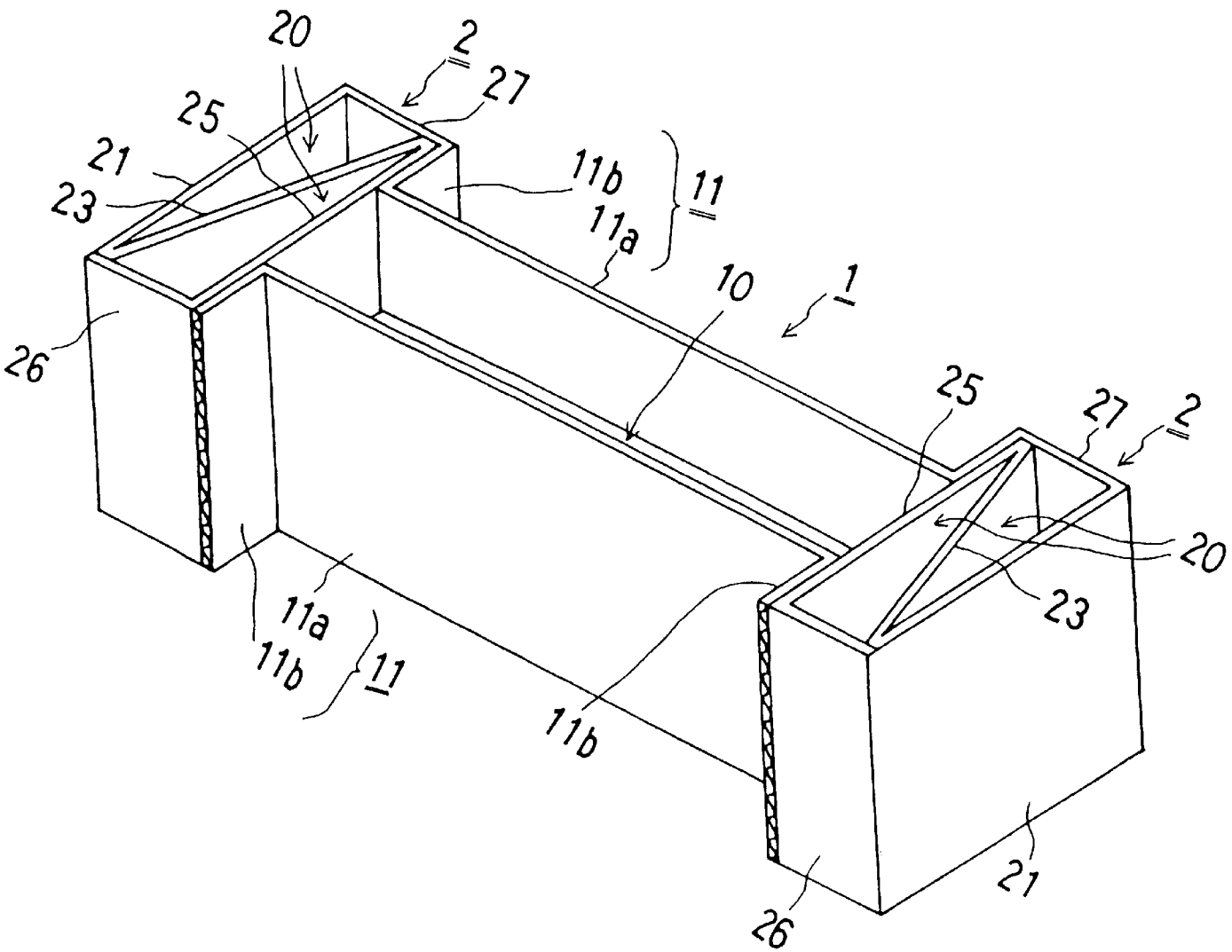
FIG. 10 is a perspective view of a 5th embodiment of the cushioning material for packaging according to the present invention.
Figure 11:
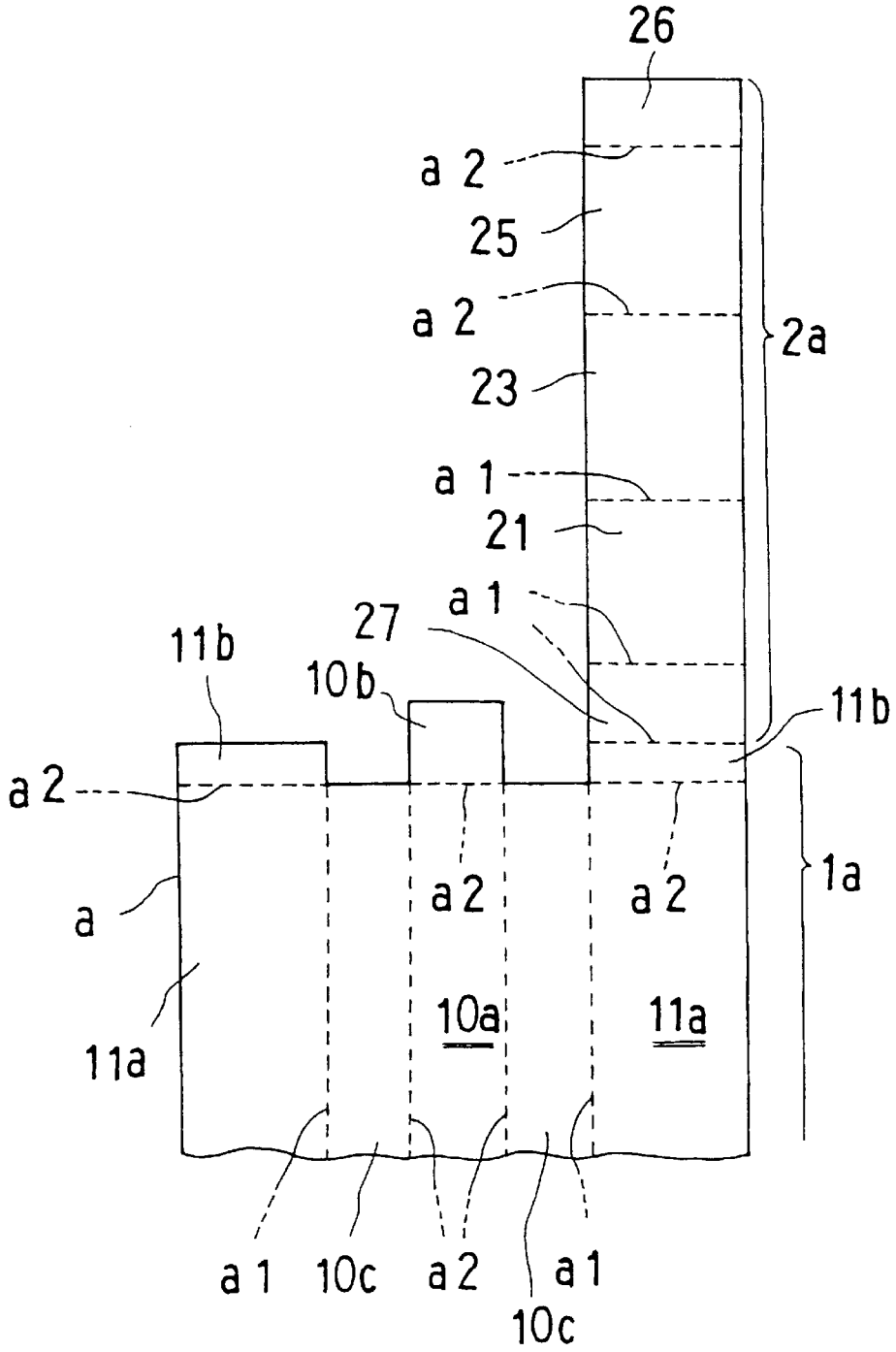
FIG. 11 is a partial plan view of the developed cushioning material of FIG. 10.
Figure 12:
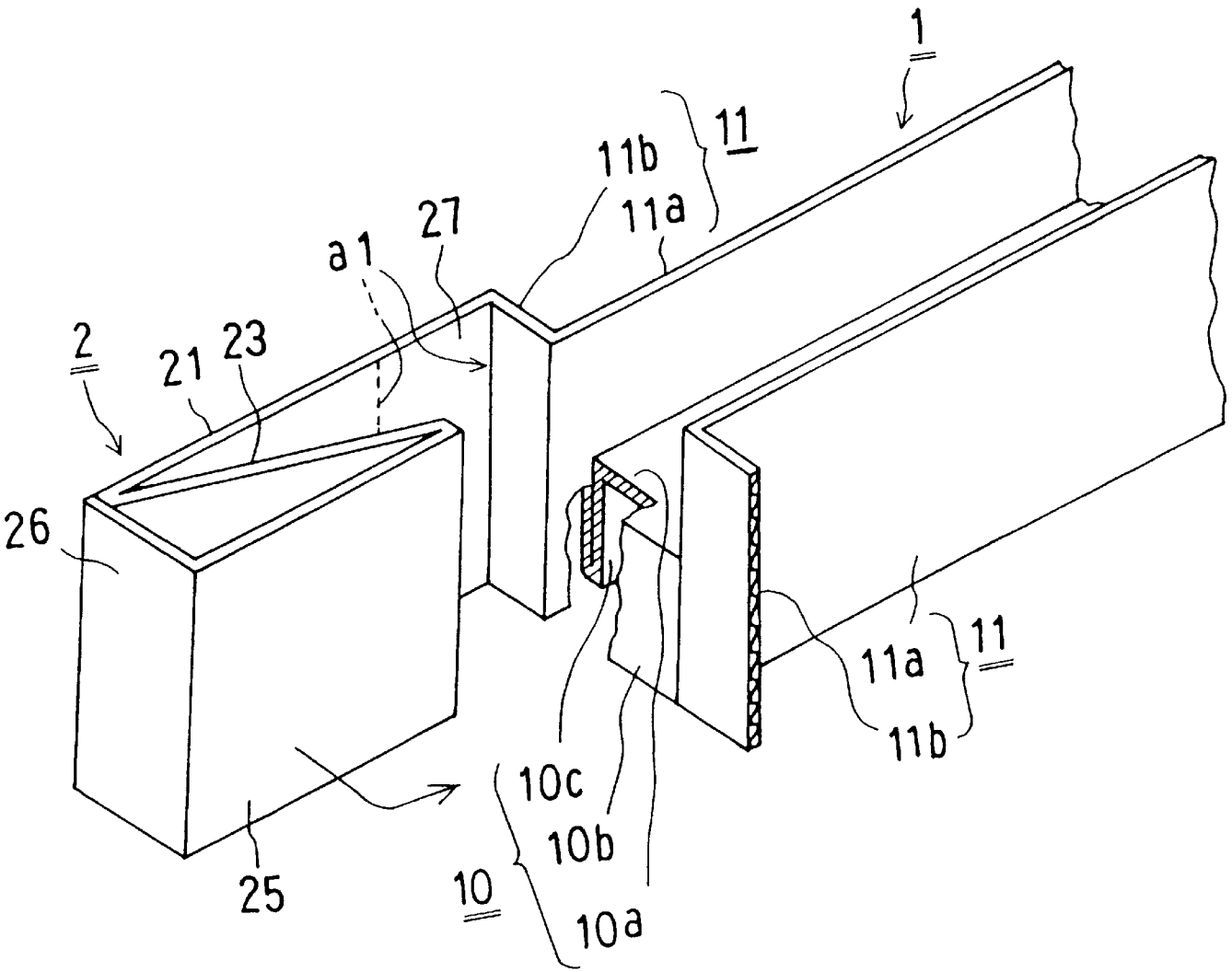
FIG. 12 is a partial perspective view explaining the fabrication of the cushioning material of FIG. 10.

An embodiment of the cushioning material corresponding to the sixth aspect of the invention is shown in FIGS. 10–12.

FIG. 10 is a perspective view of the cushioning material for packaging, FIG. 11 is a reduced perspective view of a part of the unfolded cushioning, and FIG. 12 is a cut-away perspective view of a part of the cushioning material, which is being fabricated.

In this embodiment, the raised bottom 10 of the grooved retainer 1 has, as shown in FIGS. 11, 12, raised bottom sheet 10*a*, approximately vertical end legs 10*b*, 10*b* formed downward and continuously to the opposite ends of the raised bottom sheet 10*a*, and approximately vertical side legs 10*c*, 10*c* formed downward and continuously to the opposite sides of the raised bottom sheet 10*a*.

Each side wall 11 of the grooved retainer 1 has an approximately vertical side wall sheet 11*a* and reinforcing portions 11*b*, 11*b* formed continuously to the opposite sides of the side wall sheet 11*a*.

In each end support member 2, hollow portions 20, 20 are formed along the depth direction of the grooved retainer 1. These hollow portions 20, 20 have cross section of two opposed right-angled triangles and, therefore, the end support member 2 has a rectangular section across the hollow portions 20.

Each end support member 2 has a width side sheet 26, an inside sheet 25 continuous to the width side sheet 26, a partition sheet 23 continuous to the inside sheet 25, an outside sheet 21 continuous to the partition sheet 23, and another width side sheet 27 continuous to the outside sheet 21.

The lower end of the side wall sheet 11*a* of each side wall 11 is continuous to the bottom of the side leg 11*c*. One side reinforcing portion 11*b* of one of the side walls 11 is continuous to the width sheet 27 of one of the end support members 2 and the other side reinforcing portion 11*b* of the one side wall 11 is continuous to the width sheet 27 of the other end support member 2.

As shown in FIG. 11, one side wall sheet 11*a* of the retainer forming portion 1*a* of sheet a is continuous straight to the both support member forming portions 2*a*, 2*a* with the same width.

In each support member forming portion 2*a* of sheet a, the one width side sheet 26, the inside sheet 25, the partition sheet 23, the outside sheet 21 and the other width side sheet 27 are arranged in this order from the end of the portion 2*a* a ridge forming folding line a2 or a valley forming folding line a1.

Either side wall sheet 11*a* of the retainer forming portion 1*a* is continuous to the width side sheet 27 of each support member forming portion 2*a* via the valley forming folding line a1, side wall reinforcing portion 11*b* and ridge forming folding line a2.

At one side of the side wall sheet 11*a*, there are provided with the one side leg 10*c*, raised bottom sheet 10*a*, another side leg 10*c* and the other side wall sheet 11*a* sequentially via a ridge forming fold a2 or a valley forming fold a1.

At the opposite ends of the raised bottom sheet 10*a*, end legs 10*b* are formed continuously via ridge forming folding lines a2. At the opposite ends of the other side wall sheet 11*a*, side wall reinforcing portions 11*b* are formed continuously via ridge forming folding lines a2.

The cushioning material shown in FIG. 1. is manufactured by imparting directional permanency to each folding lines a1, a2 of FIG. 11, folding sheet a along the folding lines a1, a2 according to the design, and bonding necessary portions or binding the whole body by a band 7 as shown in FIG. 1.

Other functions, effects and configurations of this embodiment are similar to those of the first embodiment.

In the cushioning material of this embodiment too, the raised bottom sheet 10*a*, the side legs 10*c*, or the side wall sheets 11*a* may be composed of a layered sheet.

Moreover, in the cushioning material of the 5th embodiment, the right side wall reinforcing portion 11*b* of the front side wall sheet 11*a* of FIG. 10 may be arranged to be continuous to a front side of the right end support member 2.

6th Embodiment

Figure 13:
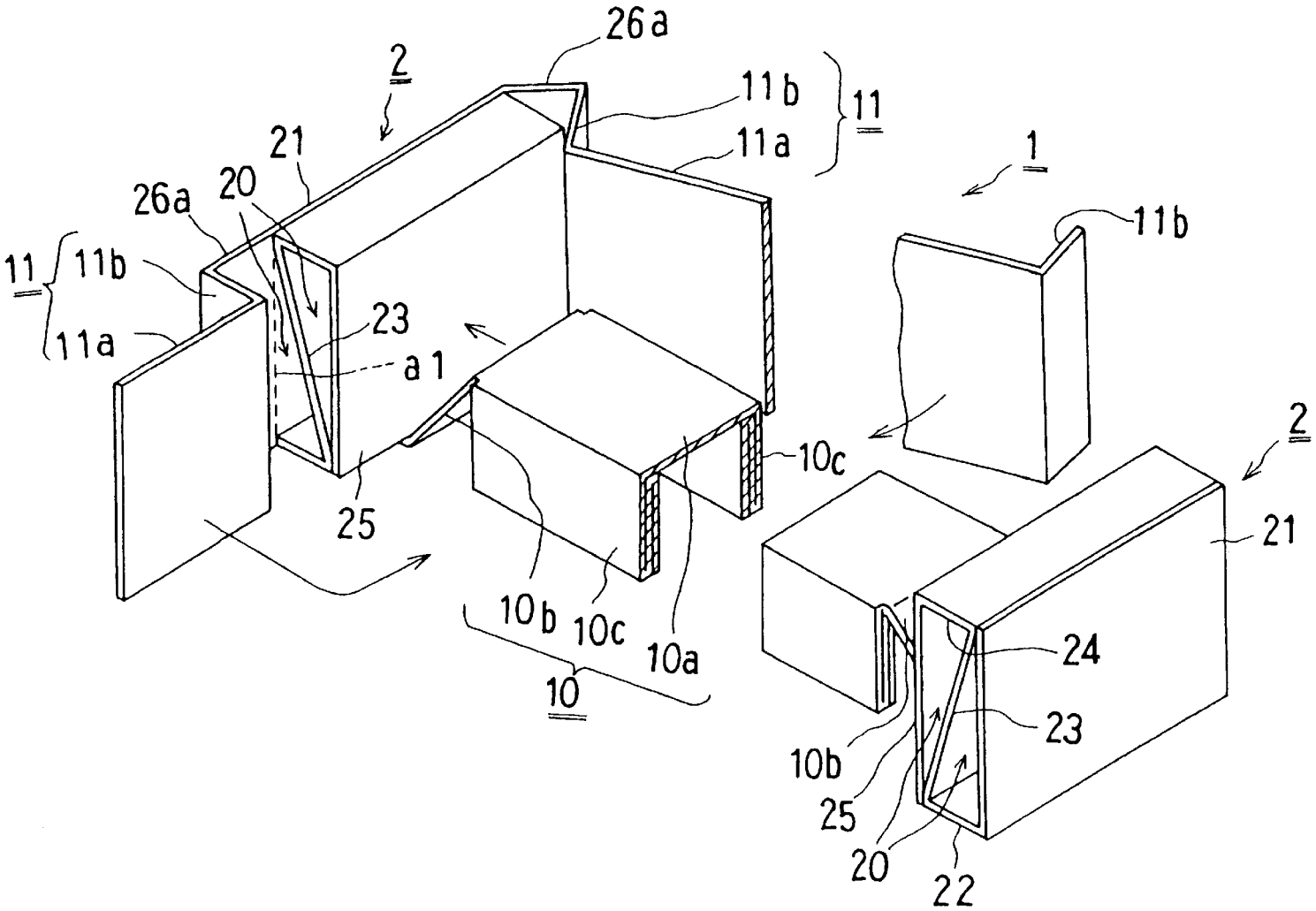
FIG. 13 is a partial perspective view of a 6th embodiment of the cushioning material for packaging according to the present invention.

An embodiment of the cushioning material corresponding to the 7th aspect of the present invention is shown in FIG. 13.

Each end support member 2 is constructed similarly to that of the cushioning material of the first embodiment.

The raised bottom 10 of the grooved retainer 1 is provided with a raised bottom sheet 10*a*, end legs 10*b*, 10*b* formed continuously to the opposite ends of the raised bottom sheet 10*a*, and side legs 10*c*, 10*c* formed continuously to the opposite sides of the raised bottom sheet 10*a* and composed of a layered sheet, which is formed by folding a necessary portion of the sheet.

The raised bottom 10 is continuous to the lower central part of the inside sheet 25 of each end support members 2 via the end leg 10*b*, 10*b*.

The side walls 11, each of which consists of approximately vertical side wall sheet 11*a* and side wall reinforcing portions 11*b*, 11*b* formed continuously to the opposite sides of the side wall sheet 11*a*, are continuous to the opposite ends of the outside sheet 21 of one of the end support members 2 via connecting sheet portion 26*a*.

Each side wall sheet 11*a* is bonded to the side of the corresponding side leg 10*c* from the state shown in the figure. Each side wall sheet 11*b* is bonded to the inside sheet 25 of the corresponding end support member 2 at the side of the corresponding end leg 10*b*.

Instead of bonding, the whole body may be bound by a band designated by reference number 7 in FIG. 1. Such configuration may be also employed that one side wall sheet 11*a* is continuous to one end support member 2 and the other side wall sheet 11*a* is continuous to the other end support member 2.

According to the cushioning material of this embodiment, since the side legs 10*c*, 10*c* of the raised bottom 10 are reinforced by a layered sheet, an article can be supported more steadily and the cushioning effect can be enhanced.

In this embodiment too, the inside sheet 25 of each end support member 2 and the side wall sheet 11*a* may be composed of a layered sheet as well as the cushioning material of the fourth embodiment. In addition, the raised bottom sheet 10*a* may be composed of a layered sheet similarly to the third embodiment.

Other functions, effects and configurations of this embodiment are similar to those of the first embodiment and explanation thereof is omitted.

7th Embodiment

Figure 14:
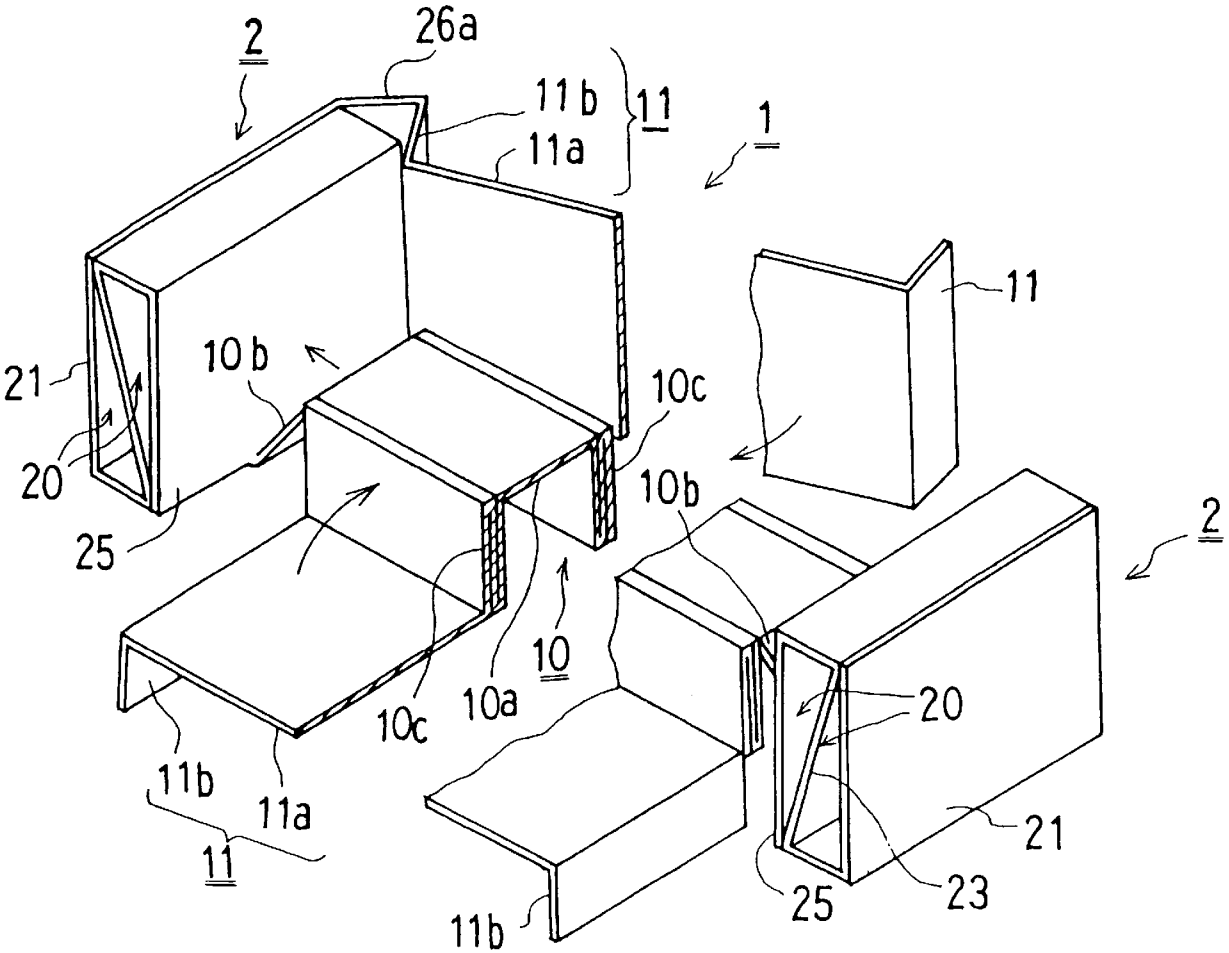
FIG. 14 is a partial, fragmentary perspective view of a 7th embodiment of the cushioning material for packaging according to the present invention.

An embodiment of the cushioning material for packaging corresponding to the eighth aspect of the present invention is shown in FIG. 14.

The end support members 2, 2, raised bottom portion 10 and side walls 11 are constructed similarly to those of the cushioning material of the sixth embodiment. Each of the opposite ends of the raised bottom sheet 10*a* is continuous to the lower center part of the inside sheet part 25 of the corresponding end support member 2, 2 via the end leg part 10*b* similarly to the sixth embodiment.

One end of one of the side wall sheet parts 11*a* is continuous to the outside sheet part 21 of one of the end support members 2 via the side reinforcing part 11*b* and a connecting sheet part 26*a*. The lower end of the other side wall sheet part 11*a* is continuous to the lower portion of one of the side legs 10*c* of the raised bottom 10.

The cushioning material is fabricated, from the state shown in the figure, so that each side wall sheet part 11*a* is in contact with the corresponding side leg 10*c* of the raised bottom 10 and each side reinforcing part 11*b* is in contact with the inside sheet part 25 of the corresponding end support member 2.

In this embodiment too, the inside sheet parts 25 of the end support members 2, the side wall sheet parts 11*a* and the raised bottom sheet part 10*a* may be composed of plural layers.

Other functions, effects and configurations of this embodiment are similar to those of the sixth embodiment and explanation thereof is omitted.

8th Embodiment

Figure 15:
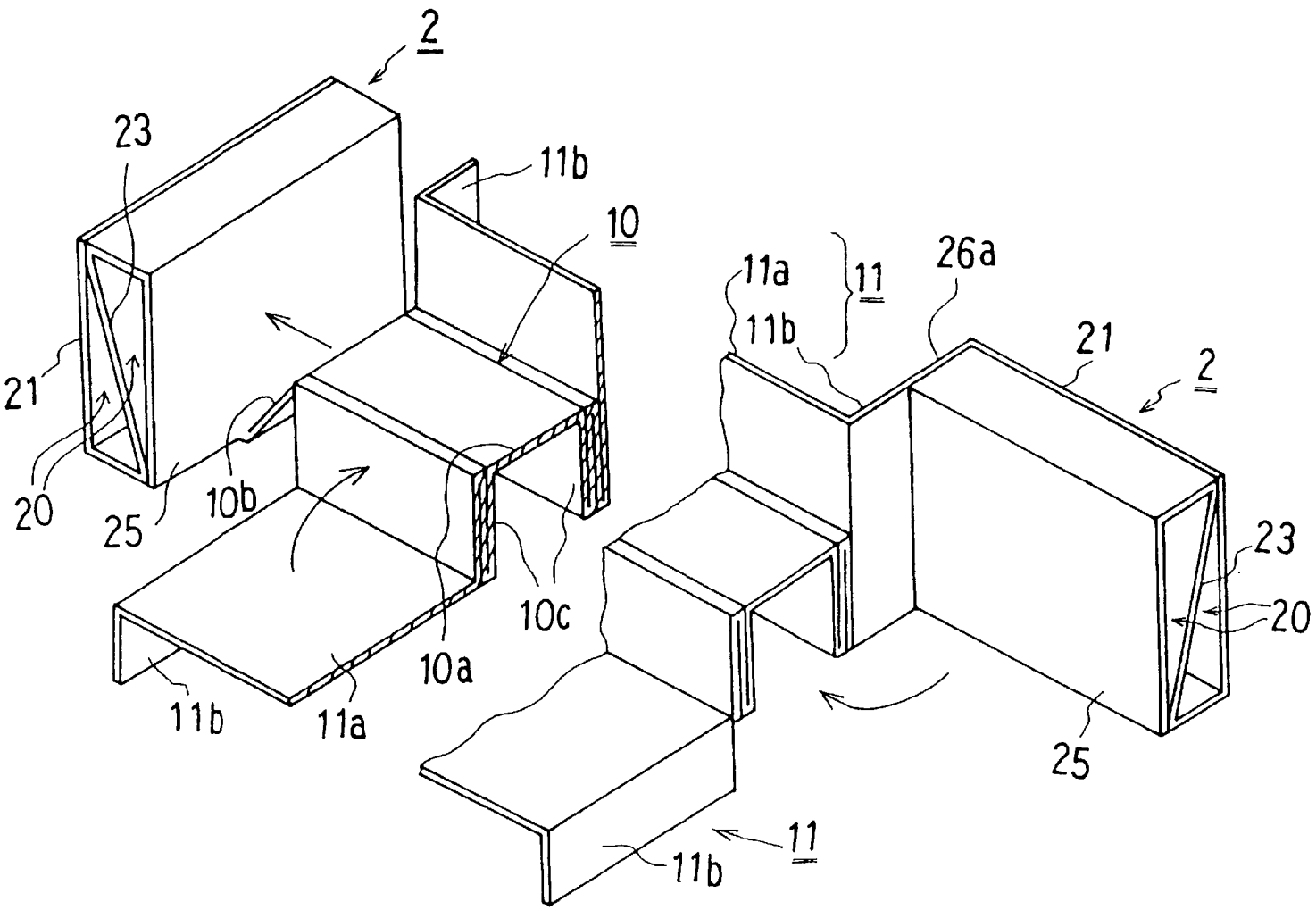
FIG. 15 is a partial, fragmentary perspective view of a 8th embodiment of the cushioning material for packaging according to the present invention.

An embodiment of the cushioning material for packaging corresponding to the ninth aspect of the present invention is shown in FIG. 15.

The end support members 2, 2 and side walls 11 are constructed similarly to those of the cushioning material of the seventh embodiment. The end leg 10*b* of the raised bottom 10 is formed only at one end of the raised bottom sheet part 10*a*, which is continuous to the lower center part of the corresponding end support member 2 via the end leg 10*b*.

Each of the side wall sheet parts 1*a* is continuous to the lower portion of the corresponding side leg 10 of the raised bottom sheet 10*a*. The outside sheet part 21 of one of the end support members 2 is continuous to the end of one of the side wall sheet parts 11*a* via the corresponding side reinforcing part 11*b* and the connecting sheet part 26*a*.

The cushioning material is fabricated from the state shown in the figure so that each side wall sheet part 11*a* is in contact with the corresponding side leg 10*c* of the raised bottom 10 and each side reinforcing part 11*b* is in contact with the inside sheet part 25 of the corresponding end support member 2.

In this embodiment too, the inside sheet parts 25 of the end support members 2, the side wall sheet parts 11*a* and the raised bottom sheet part 10*a* may be composed of plural layers.

Other functions, effects and other configurations of this embodiment are similar to those of the seventh embodiment and explanation thereof is omitted.

9th Embodiment

Figure 16:
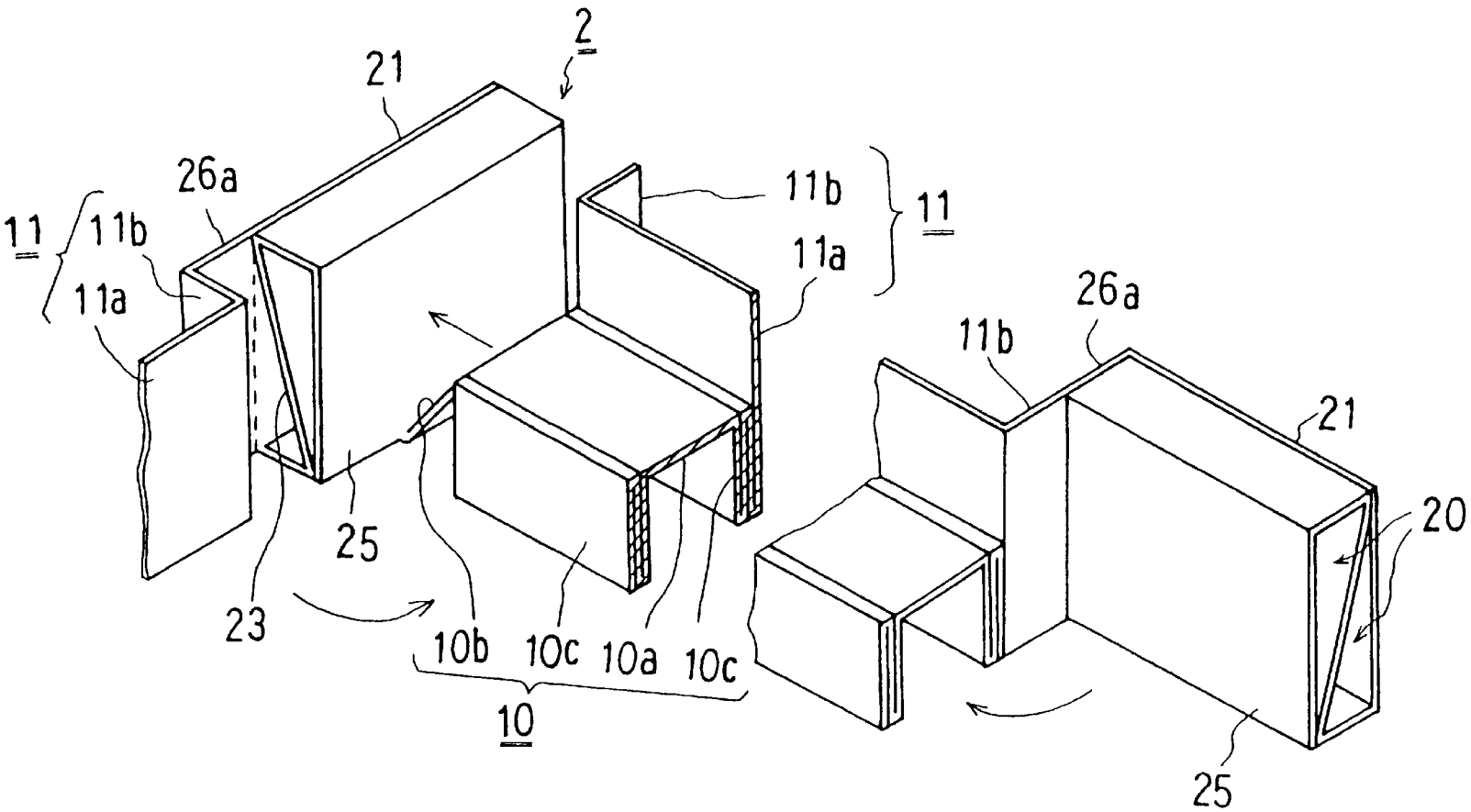
FIG. 16 is a partial, fragmentary perspective view of a 9th embodiment of the cushioning material for packaging according to the present invention.

An embodiment of the cushioning material for packaging corresponding to the tenth aspect of the present invention is shown in FIG. 16.

The end support members 2, 2, the raised bottom portion 10 and side walls 11 are constructed similarly to those of the cushioning material of the eighth embodiment. One end of the raised bottom 10 is continuous to the lower central part of the corresponding end support member 2 via the end leg 10*b*.

One of the side wall sheet parts 1*a* is continuous to the lower portion of the corresponding side leg 10 of the raised bottom sheet 10*a*. The outside sheet part 21 of one of the end support members 2 is continuous to one end of one of the side wall sheet parts 11*a* via the corresponding side reinforcing part 11*b* and connecting sheet part 26*a*.

The outside sheet part 21 of the other end support member 2 is continuous to one end of the other side wall sheet parts 11*a* via the corresponding side reinforcing part 11*b* and connecting sheet part 26*a*.

The cushioning material is fabricated from the state shown in the figure so that each side wall sheet part 11*a* is in contact with the corresponding side leg 10*c* of the raised bottom 10 and each side reinforcing part 11*b* is in contact with the inside sheet part 25 of the corresponding end support member 2.

In this embodiment too, the inside sheet parts 25 of the end support members 2, the side wall sheet parts 11*a* and the raised bottom sheet part 10*a* may be composed of plural layers.

Other functions, effects and configurations of this embodiment are similar to those of the eighth embodiment and explanation thereof is omitted.

10th Embodiment

Figure 17:
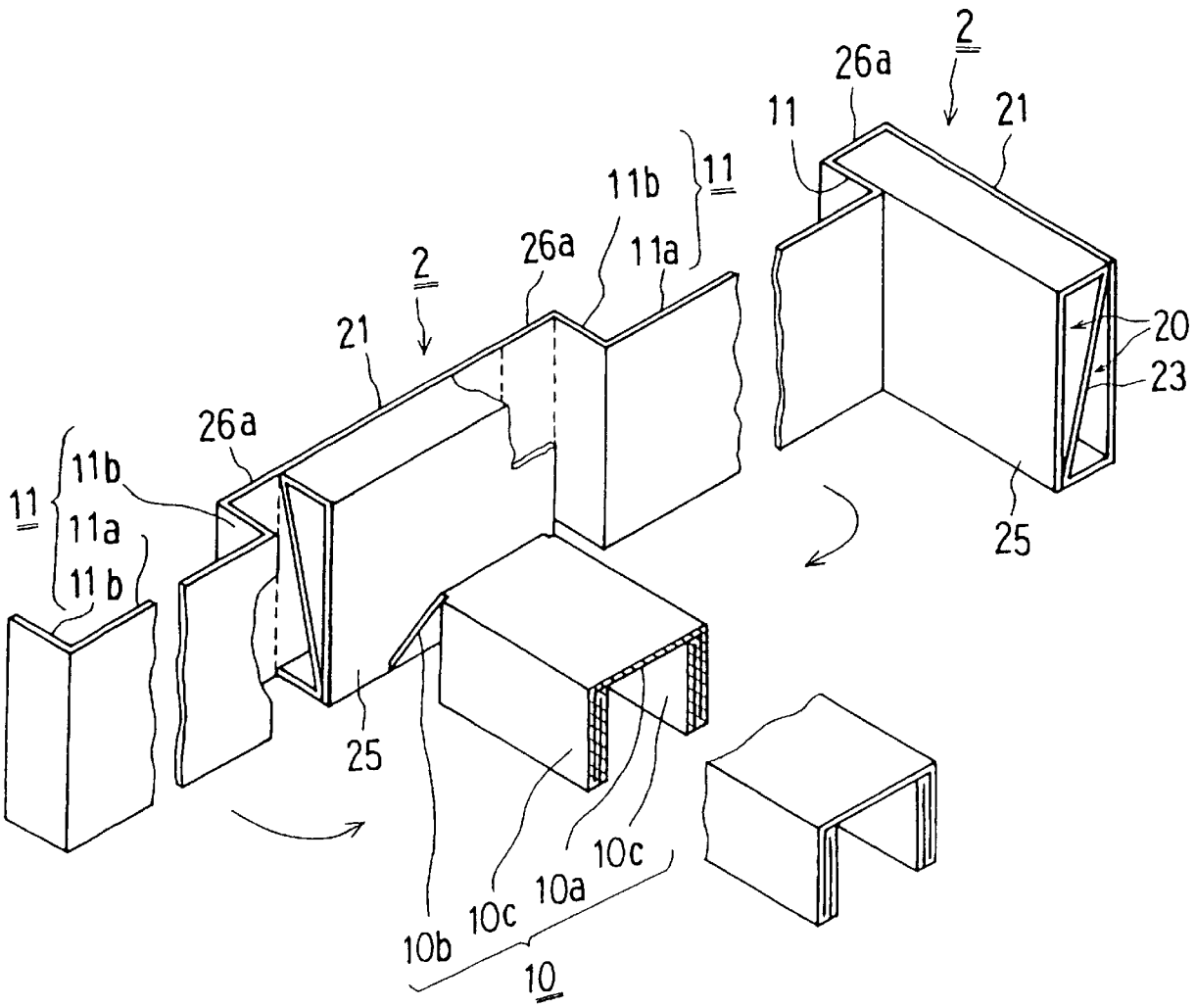
FIG. 17 is a partial, fragmentary perspective view of a 10th embodiment of the cushioning material for packaging according to the present invention.

An embodiment of the cushioning material for packaging corresponding to the eleventh aspect of the present invention is shown in FIG. 17.

The end support members 2, 2, the raised bottom portion 10 and side walls 11 are constructed similarly to those of the cushioning material of the ninth embodiment. One end of the raised bottom 10 is continuous to the lower central part of the corresponding end support member 2 via end leg 10*b*.

At the opposite ends of one of the end support members 2, the side reinforcing part 11*b* of each side wall sheet part 11*a* is continuous to the outside sheet part 21 respectively via the connecting sheet part 26*a*. At one end of the other end support member, one end of one of the side wall sheet parts 11*a* is continuous to the outside sheet part 21 via the connecting sheet part 26*a*.

The cushioning material is fabricated from the state shown in the figure so that each side wall sheet part 11*a* is in contact with the corresponding side leg 10*c* of the raised bottom 10 and each side reinforcing part 11*b* is in contact with the inside sheet part 25 of the corresponding end support member 2.

In this embodiment too, the inside sheet parts 25 of the end support members 2, the side wall sheet parts 11*a* and the raised bottom sheet part 10*a* may be composed of plural layers.

Other functions, effects and configurations of this embodiment are similar to those of the ninth embodiment and explanation thereof is omitted.

In the cushioning materials of the 8th to 10th embodiments, the end legs 10*b* are formed at the opposite ends of the raised bottom sheet part 10*a*, whereby supporting and buffering effect of the raised bottom 10 can be improved.

11th Embodiment

Figure 18:
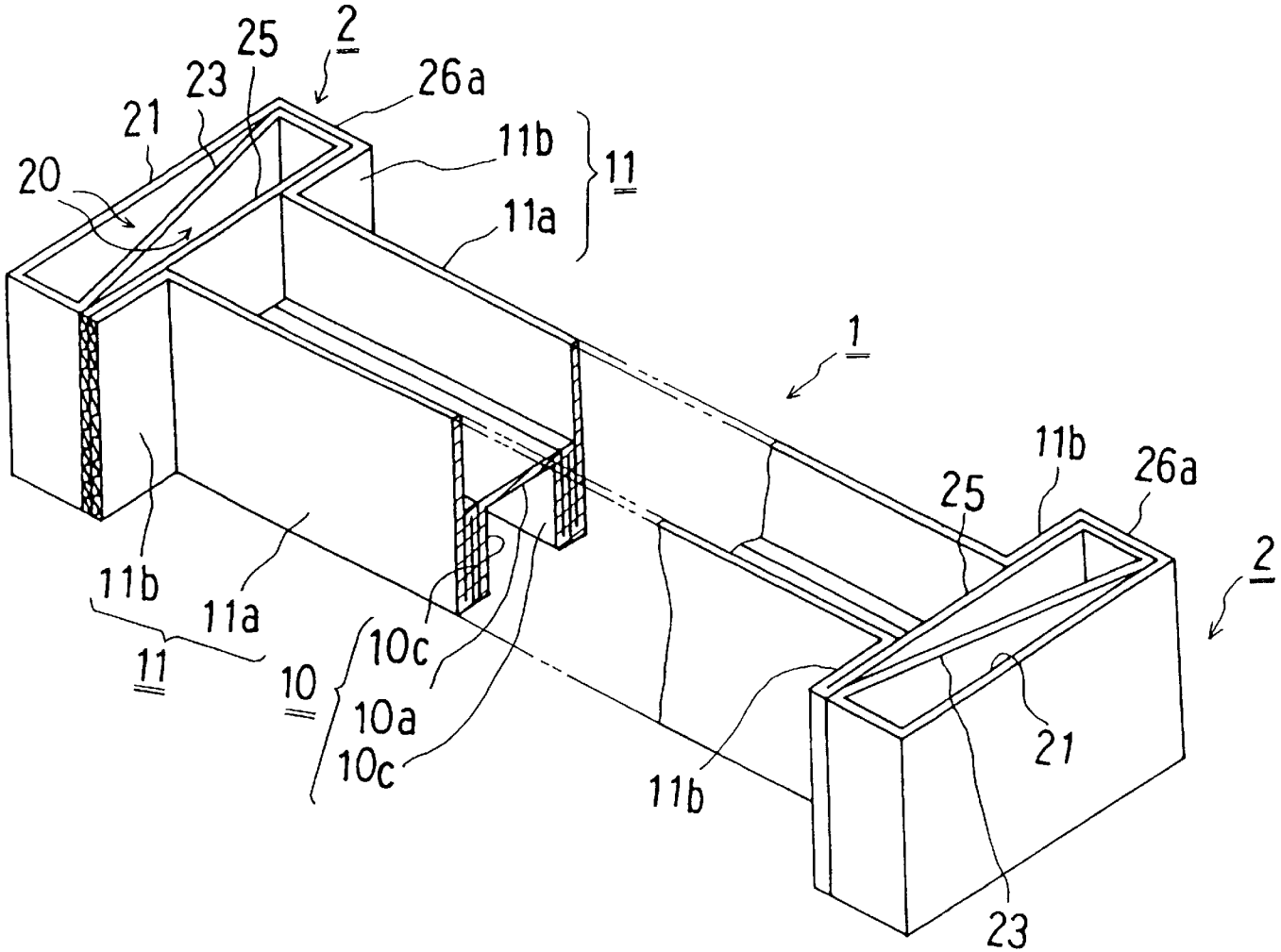
FIG. 18 is a partial, fragmentary perspective view of a 11th embodiment of the cushioning material for packaging according to the present invention.
Figure 19:
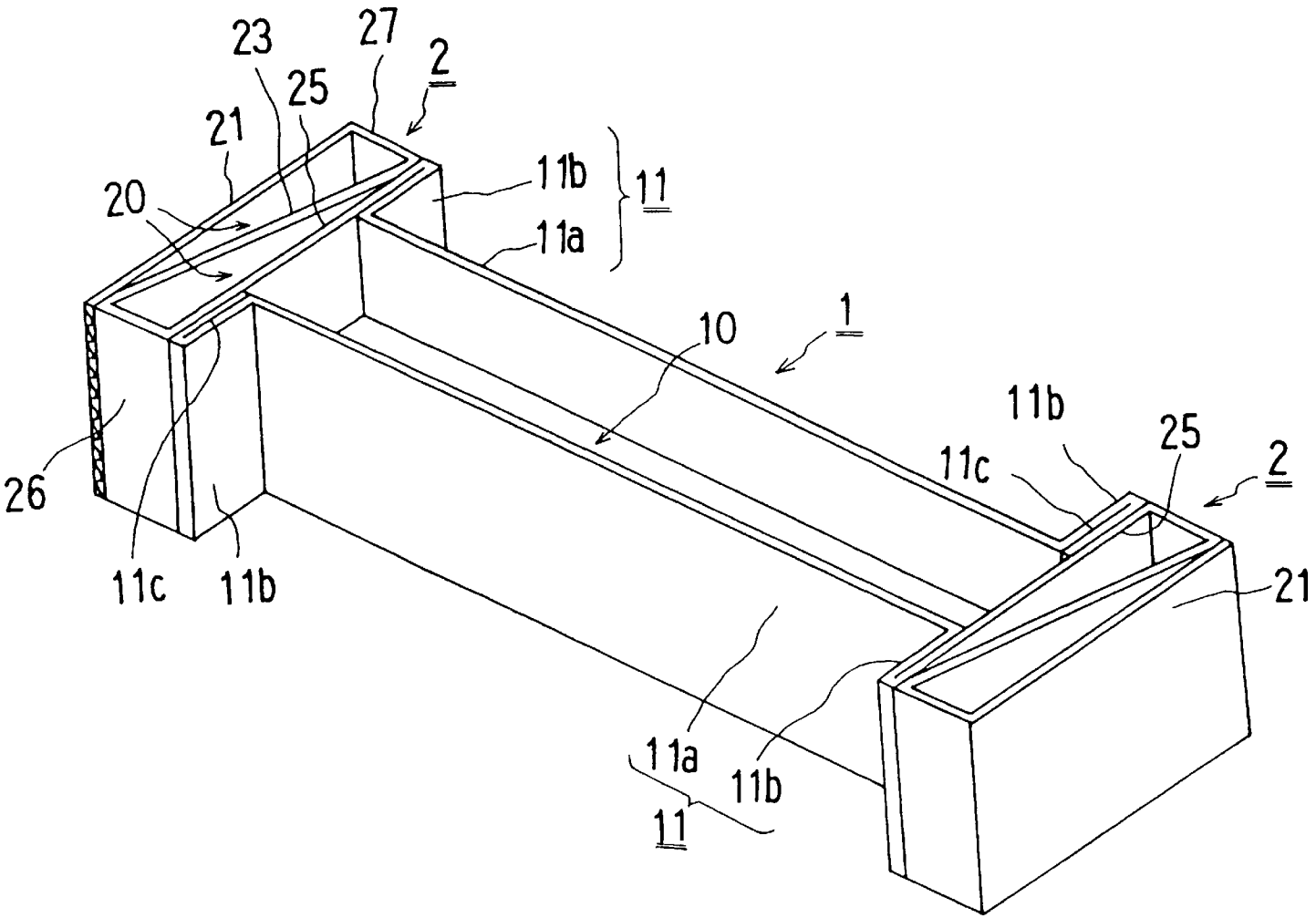
FIG. 19 is a perspective view of a 12th embodiment of the cushioning material for packaging according to the present invention.

An embodiment of the cushioning material for packaging corresponding to the twelfth aspect of the present invention is shown in FIG. 18.

The end support members 2, 2 and side walls 11 are constructed similarly to those of the cushioning material of the fifth embodiment (FIGS. 10–12). The raised bottom 10 consists of a horizontal raised bottom sheet part 10*a* and approximately vertical side legs 10*c*, 10*c* formed downward at the opposite sides of the raised bottom sheet part 10*a*. Each side leg 10*c* is composed of a plurality of layers formed by folding the necessary portion of the sheet.

Each of the side reinforcing parts 11*b* formed at the opposite sides of one of the side wall sheet parts 11*a* is continuous to the corresponding end of the outside sheet part 21 of the end support member 2 via the connecting sheet 26*a*, 26*a*. One of the side reinforcing parts 11*b* formed at the opposite ends of the other side wall sheet parts 11*a* is continuous to the inside sheet part 25 of either of the end support members 2.

The lower portion of the other side wall sheet parts 11*a* is continuous to the one of the side legs 10*c* of the raised bottom 10.

Each side wall sheet part 11*a* is in contact with the corresponding side leg 10*c* of the raised bottom 10 and each side reinforcing part 11*b* of each side wall 11 is in contact with the inside sheet part 25 of the corresponding end support member 2 at the side end of the raised bottom 10.

In this embodiment too, the inside sheet parts 25 of the end support members 2, the side wall sheet parts 11*a* and the raised bottom sheet part 10*a* may be composed of plural layers.

In the cushioning materials of this embodiments, similarly to the cushioning material of the fifth embodiment, the side legs 10*b* are formed at the opposite sides of the raised bottom sheet part 10*a*, whereby supporting and buffering effect of the raised bottom 10 can be improved.

Other functions, effects and configurations of this embodiment are similar to those of the fifth embodiment and explanation thereof is omitted.

13th Embodiment

Figure 21:
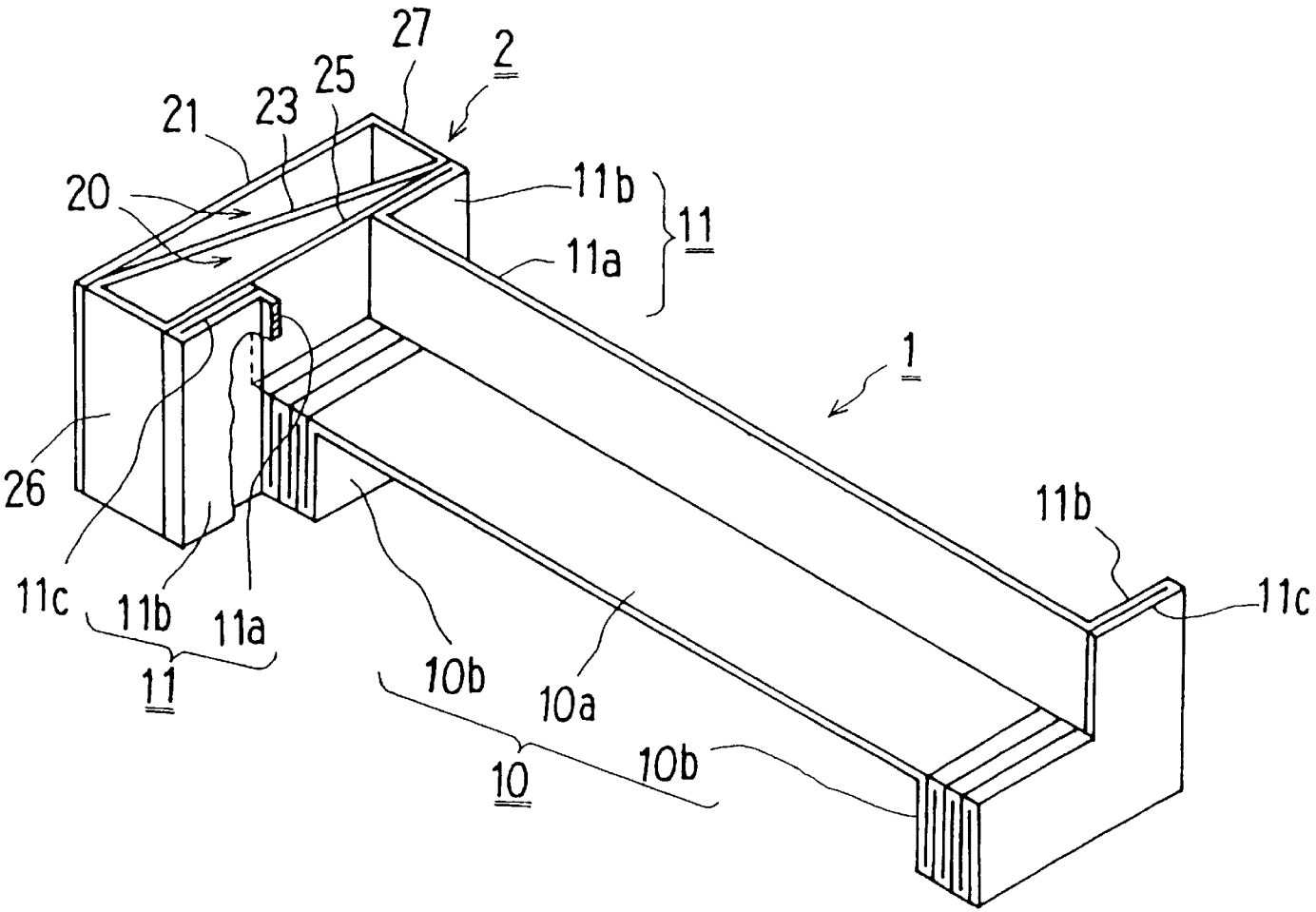
FIG. 21 is a partial, cutaway perspective view of a 13th embodiment of the cushioning material for packaging according to the present invention.

An embodiment of the cushioning material for packaging corresponding to the thirteenth aspect of the present invention is shown in FIG. 21.

In the cushioning material of this embodiment, the raised bottom 10 has a horizontal raised bottom sheet part 10*a* and end legs 10*c*, 10*c* formed downward at the opposite ends of the raised bottom sheet part 10*a*. Each end leg 10*c* is composed of a layered block formed by folding the necessary portion of the sheet.

The end of the inside sheet part 25 of one of the end support members 2 is continuous to the side reinforcing part 11*b* of one of the side wall sheet parts 11*a*. The end leg 10*b* of one end of the raised bottom 10 is continuous to the side reinforcing part 11*b* of the other end of the one side wall 11 via the connecting sheet 11*c*.

The end leg 10*b* of the other end of the raised bottom 10 is continuous to the side reinforcing part 11*b* of one of the other side wall sheet parts 11*a* via the connecting sheet 11*c*.

Other configurations are the same as those of the cushioning material of twelfth embodiment.

The cushioning material of this embodiment can support the article steadily and has an enhanced cushioning effect, since the end legs 10*b* of the raised bottom 10 are composed of a layered block. Other functions and effects are almost similar to those of the twelfth embodiment.

In this embodiment too, the inside sheet parts 25 of the end support members 2 and the side wall sheet parts 11*a* may be composed of plural layers.

14th Embodiment

Figure 22:
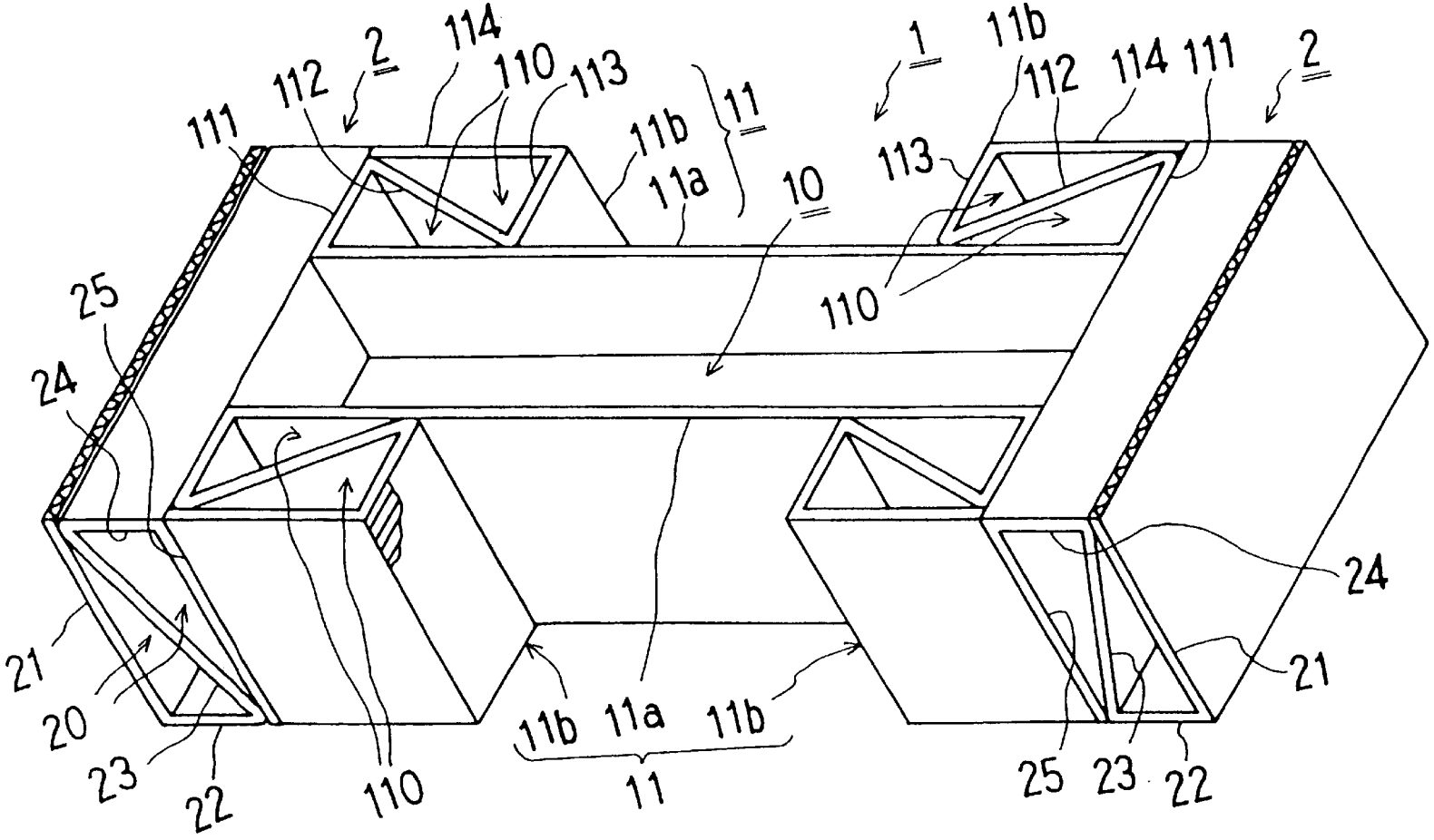
FIG. 22 is a perspective view of a 14th embodiment of the cushioning material for packaging according to the present invention.
Figure 23:
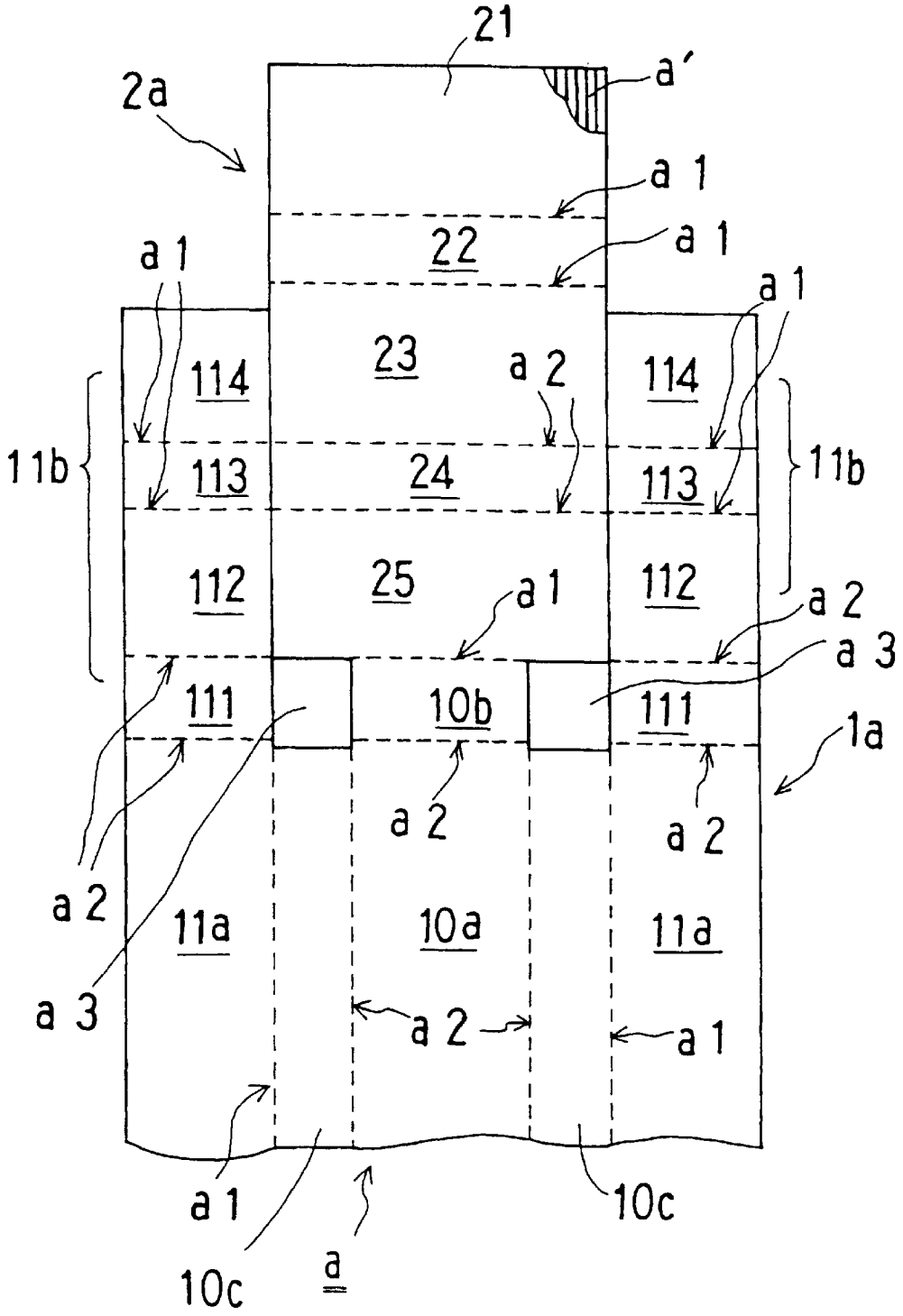
FIG. 23 is a partial plan view of the developed cushioning material of FIG. 22.
Figure 24:
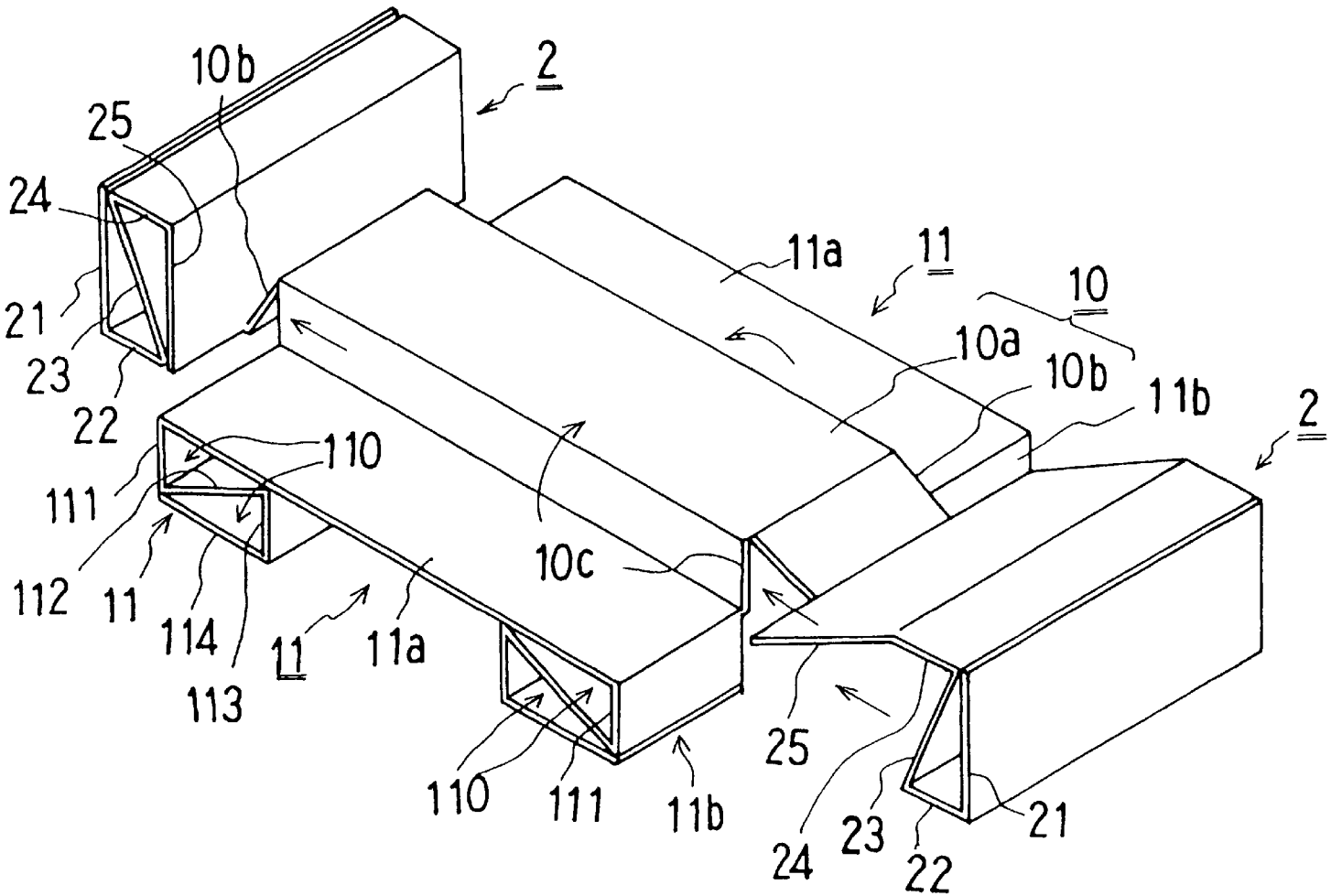
FIG. 24 is a perspective view explaining the fabrication of the cushioning material of FIG. 22.

Another embodiment of the cushioning material for packaging corresponding to the fifth aspect of the present invention is shown in FIGS. 22–24.

FIG. 22 is a partial perspective view of the cushioning material, FIG. 23 is a partial plan view of the developed cushioning material of FIG. 22 and FIG. 24 is a perspective view of the cushioning material of FIG. 22 which is being fabricated.

In the cushioning material of this embodiment, the side reinforcing parts 11*b* formed at the opposite sides of each side wall sheet part 11*a*, which constitutes the side wall 11, 11, consist of hollow blocks formed at the opposite ends of the side wall sheet 11*a*. Each of the hollow blocks have two hollow portions 110, which are arranged in parallel along the vertical direction and have the sectional shapes of two opposed right-angled triangles.

The end support members 2, 2, the raised bottom 10 of the grooved retainer 1 and other portions are constructed almost similarly to those of the cushioning member of the first embodiment (FIG. 1).

The cushioning material of this embodiment is fabricated sequentially from a single corrugated cardboard sheet. The sheet a, which is cut into a plan shape shown in FIG. 23, consists of a central retainer forming portion 1*a* and support forming portions 2*a*, 2*a* continuous to the opposite sides of the retainer forming portion 1*a*.

Each of the support member forming portion 2*a* of the sheet a, similarly to that of the sheet a of FIG. 2, consists of an outside sheet part 21, a bottom sheet part 22, a partition sheet part 23, a top sheet part 24 and an inside sheet part 25 connected to the grooved retainer 1.

At the boundary between each part 21–25, there is formed a valley forming folding line a1 or ridge forming folding line a2.

The retainer forming portion 1*a* consists of a raised bottom sheet part 10*a* and side wall sheet parts 11*a*. The bottom sheet part 10*a* has end legs 10*b* and side legs 10*c* similarly to the sheet a of FIG. 2. Each side wall sheet parts 11*a* has side reinforcing parts 11*b* at the opposite sides thereof and is continuous to either of the opposite sides of the raised bottom sheet part 10*a*.

Each of the side reinforcing parts 11*b* consists of a width sheet part 111, partition sheet part 112, another width sheet 113 and an outside sheet 114, which are arranged in this order from the end of the side wall sheet 11*a* in the direction to extend it. The end of the side wall sheet 11*a* functions as the inside sheet part too.

At the boundary between the inside sheet part 25 and the end leg 10*b* and the boundary between each side leg 10*c*, 10*c* and each side wall sheet part 11*a*, there are formed valley forming folding lines a1.

At the boundaries between the raised bottom sheet part 10*a* and the opposite side legs 10*c*, 10*c* and the boundaries between each side wall sheet part 11*a* and the opposite side reinforcing parts 11*b*, 11*b*, there are formed ridge forming folding lines a2.

At the boundary between one width sheet part 111 and the partition sheet part 112, there is formed a ridge forming folding line a2. At the boundaries between the partition sheet part 112 and the other width sheet part 113 and between the other width sheet part 113 and the outside sheet part 114, there are formed valley folding lines a1. Reference numeral 3 designates a punched hole.

The width of the support member forming portions 2*a* in the direction orthogonal to the corrugation a' of the sheet a is so designed that it is approximately equal to the sum of the width of the raised bottom sheet part 10*a* and those of the both side legs 10*c*.

Cutting of the sheet a and forming of the folding lines a1, a2 are carried out similarly to those of the first embodiment.

After the sheet a has been prepared as shown in FIG. 23, the retainer forming portion 1*a* and the support member forming portions of the sheet a are folded along the folding lines a1, a2 so that each portion is built into a solid body as shown in FIG. 24.

In parallel to folding, necessary portions of the end support members 2 are bonded to each other and necessary portions of the side reinforcing parts 11*b* are bonded to each other similarly to the first embodiment.

Then, the side walls 11, 11 are made erect along the arrow line of FIG. 24 and the upper portion of each side leg 10*c* and the corresponding side wall sheet part 11*a*, the upper portion of each end leg 10*b* and the corresponding inside sheet part 25, and the upper and lower portions of each width sheet part 111 and the corresponding inside sheet part 25 are bonded to build the cushioning material.

Instead of bonding the necessary portions of the adjacent components as shown in FIG. 24, the whole body may be bound by the belt 7 as shown in FIG. 1.

The cushioning material of the 14th embodiment is used in the same state shown in FIG. 4. When the load of the article is mainly applied to the side wall 11, the cushioning material can support even a somewhat heavy article and larger cushioning effect can be obtained, since it is provided with the side wall reinforcing part 11*b* made of hollow block at the opposite sides of each side wall 11.

Other functions, effects and configurations of this embodiment are similar to those of the first embodiment and explanation thereof is omitted.

Although, the side wall reinforcing parts 11*b* of hollow block structure have vertical hollow portions 110, in the cushioning material of the 14th embodiment, the same effect can be achieved even if the hollow portions 110 are formed along the longitudinal direction of the side wall sheet 11*a*.

In this embodiment too, the inside sheet parts 25 of the end support members 2 and the side leg parts 10*c* may be composed of plural layers.

In the 5th to 13th embodiments (FIGS. 10–21) too, the side reinforcing parts 11*b* of each side wall 11 may be composed of hollow blocks similarly to the 14th embodiment.

15th Embodiment

Figure 25:
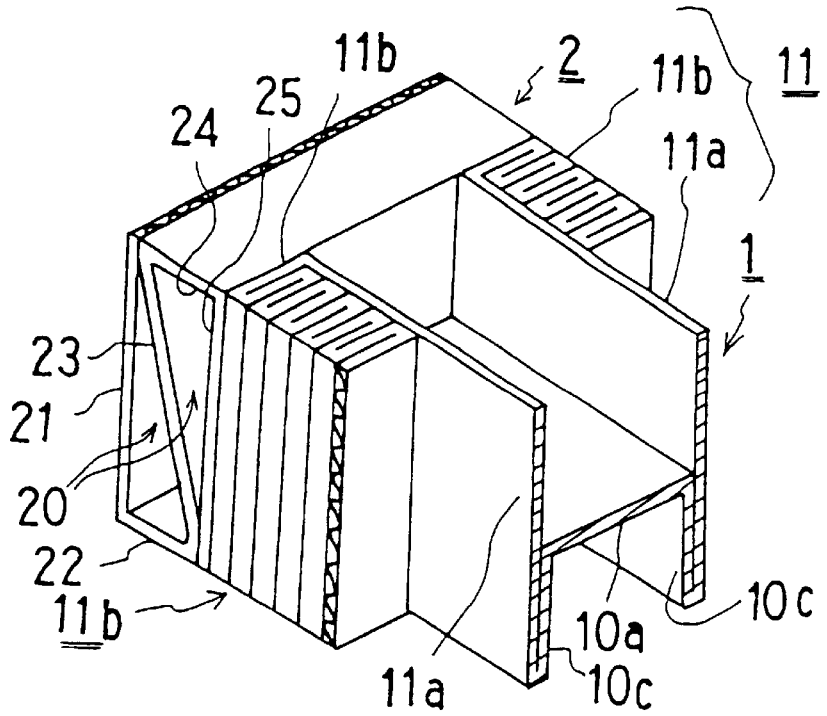
FIG. 25 is a partial perspective view of a 15th embodiment of the cushioning material for packaging according to the present invention.

Yet another embodiment of the cushioning material for packaging corresponding to the fifth aspect of the present invention is shown in FIG. 25.

This figure is a partial perspective view of the cushioning material, in which the side reinforcing parts 11 of each side wall 11, 11 are composed of layered blocks of plural layers formed by folding a part of the sheet outside the side wall sheet 11*a* (outside the groove).

Adjacent sheet layers constituting the side reinforcing part 11*b* are bonded at the folded part and the whole body of each side reinforcing part 11*b* of the layered block is bonded so as to the upper and lower ends thereof are bonded to upper and lower ends of the outside of the corresponding side wall sheet part 11*a*.

Other configurations are similar to the cushioning material of the first embodiment and explanation thereof is omitted.

Since each side reinforcing part 11*b* of the cushioning material of the 15th embodiment is composed of a layered block, even a somewhat heavy article can be sufficiently supported by the cushioning material and greater cushioning effect can be obtained when the load of the article is mainly applied to these side reinforcing parts 11*b*.

Although edge of each sheet layer constituting the side reinforcing part 11*b* of the layered block is perpendicularly in contact with the corresponding side wall sheet part 11*a* in the cushioning material of this embodiment, the same effect can be achieved even if sheet layers are stacked along the outer surface of the side wall sheet 11*a*.

Other functions and effects of the cushioning material of the 15th embodiment are similar to those of the first embodiment and explanation thereof is omitted.

In this embodiment too, the inside sheet parts 25 of the end support members 2 and the side leg parts 10*c* may be composed of plural layers.

In the 5th to 13th embodiments (FIGS. 10–21) too, the side reinforcing parts 11*b* of each side wall 11 may be composed of layered blocks similarly to the 15th embodiment.

16th Embodiment

Figure 26:
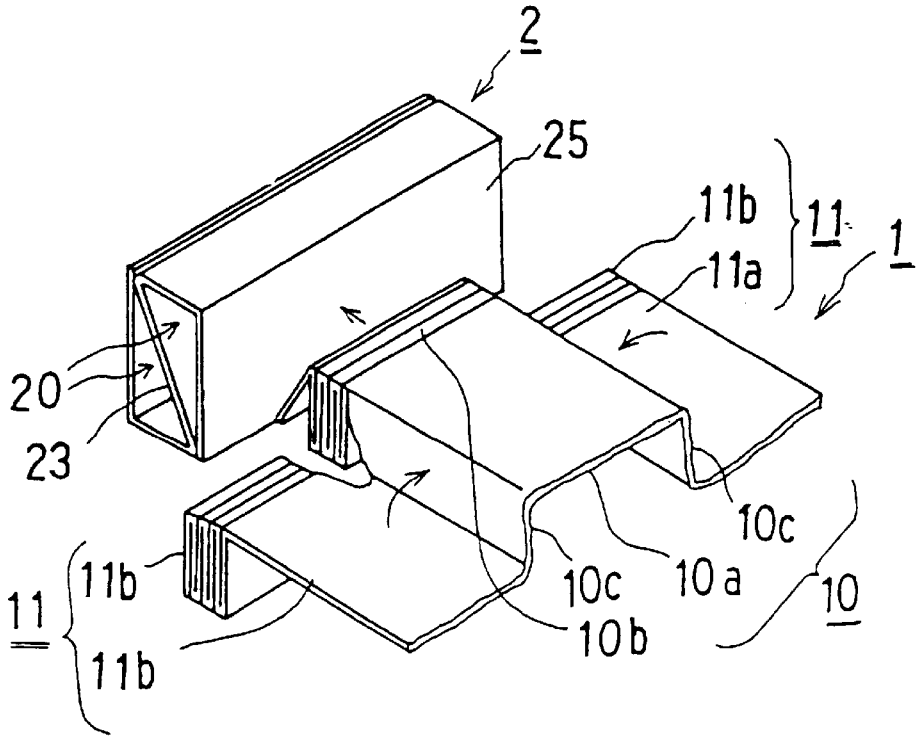
FIG. 26 is a partial perspective view of a 16th embodiment of the cushioning material for packaging according to the present invention.
Figure 27:
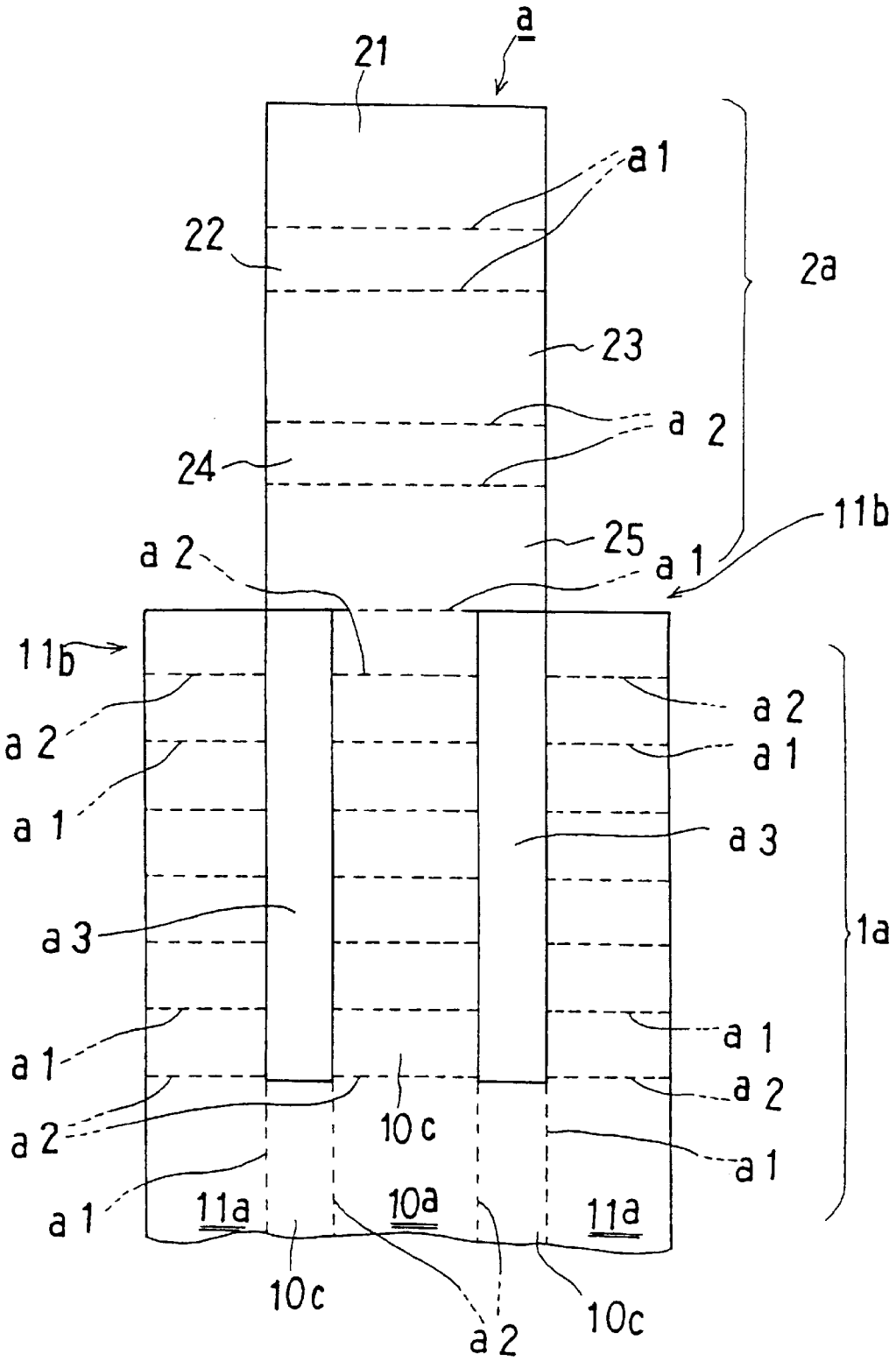
FIG. 27 is a partial plan view of the developed cushioning material of FIG. 26.

Yet another embodiment of the cushioning material for packaging corresponding to the fifth aspect of the present invention is shown in FIGS. 26 and 27.

FIG. 26 is a partial perspective view of the cushioning material which is being fabricated and FIG. 27 is a partial view of the developed cushioning material.

In this embodiment, the end legs 10*b* of the raised bottom 10 and the side reinforcing parts 11*b* of each of the side wall 11 are composed of the same numbers of layers which formed by folding a part of the sheet material.

In order to form the above-mentioned end legs 10*b* and side reinforcing parts 11*b*, as shown in FIG. 27, the end leg part 10*b* having a necessary length is formed at the end of the retainer forming portion 1*a* continuous to the support member forming portion 2*a* of the sheet a, and the side wall reinforcing parts 11*b*, 11*b* having the same length as that of the end legs 10*a* are formed at the opposite sides of the leg part 10*b* via punched holes a3, a3 (between the side legs 10*c*, 10*c* and support member forming portion 2*a*).

On the portions to form the end leg 10*b* and the side reinforcing parts 11*b*, 11*b*, there are formed ridge-forming folding lines a2 and valley-forming folding lines a1 alternately at predetermined intervals.

Other portion of the sheet a is constructed almost similarly to those of the first embodiment, necessary portions of thus prepared sheet a are folded along the folding lines a1, a2 and necessary portions are bonded to build the end support member 2, side reinforcing parts 11*b* and end legs 10*b* as shown in FIG. 26. Thereafter, the raised bottom 10, the side walls 11 and the end support members 2 are combined along the arrow line in the figure to fabricate the cushioning material.

According to the 16th embodiment, since the end legs of the raised bottom 10 and the side reinforcing parts 11*b* of each side wall 11 are composed of the same number of layers formed by folding parts of the sheet material, even a somewhat heavy article can be sufficiently supported by the cushioning material and greater cushioning effect can be obtained, when it is packed in to the case 5 with the article supported in the state shown in FIG. 4 and the load of the article is mainly applied to the raised bottom 10 or side wall 11.

In addition, on the support member forming portion 2*a*, end legs 10*b* and side reinforcing parts 11*b*, there are formed the folding lines a1, a2 having the same folding direction in line over the width of the sheet a (width in the horizontal direction of FIG. 27). Therefore, mechanical work can be conducted very smoothly in manufacturing process.

In this embodiment too, the inside sheet parts 25 of the end support members 2 may be composed of plural layers.

Other configurations, functions and effects of the cushioning material of the 16th embodiment are similar to those of the first embodiment and explanation thereof is omitted.

In the 5th to 7th embodiment (FIGS. 10–14) and 13th embodiment (FIG. 21) too, the side reinforcing parts 11*b* and end legs 10*b* may be composed of layered blocks similarly to the 16th embodiment.

17th Embodiment

Figure 28:
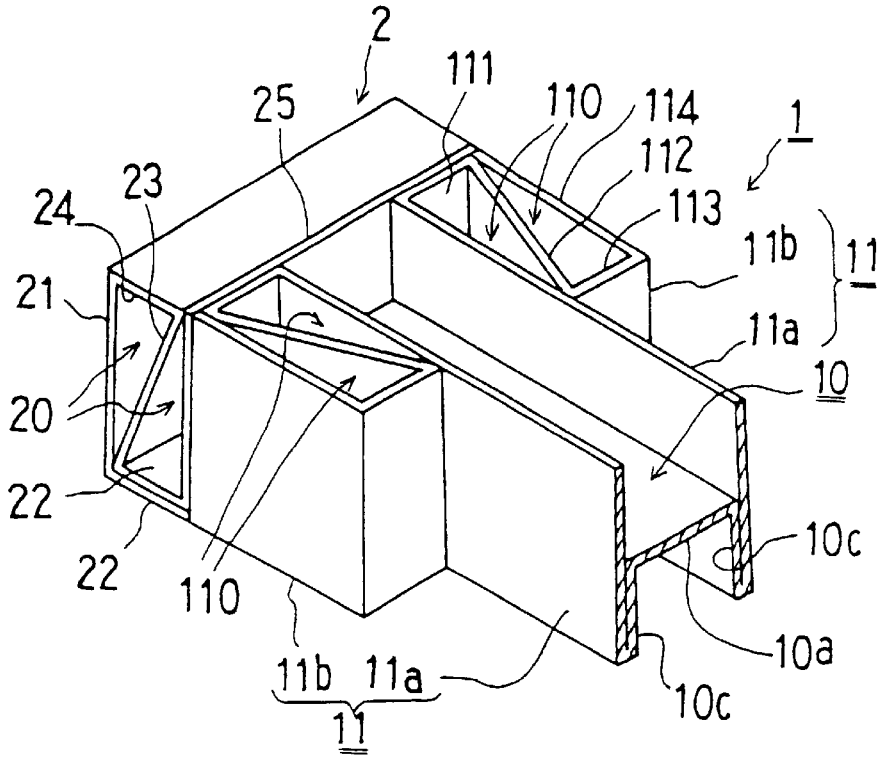
FIG. 28 is a partial perspective view of a 17th embodiment of the cushioning material for packaging according to the present invention.
Figure 30:
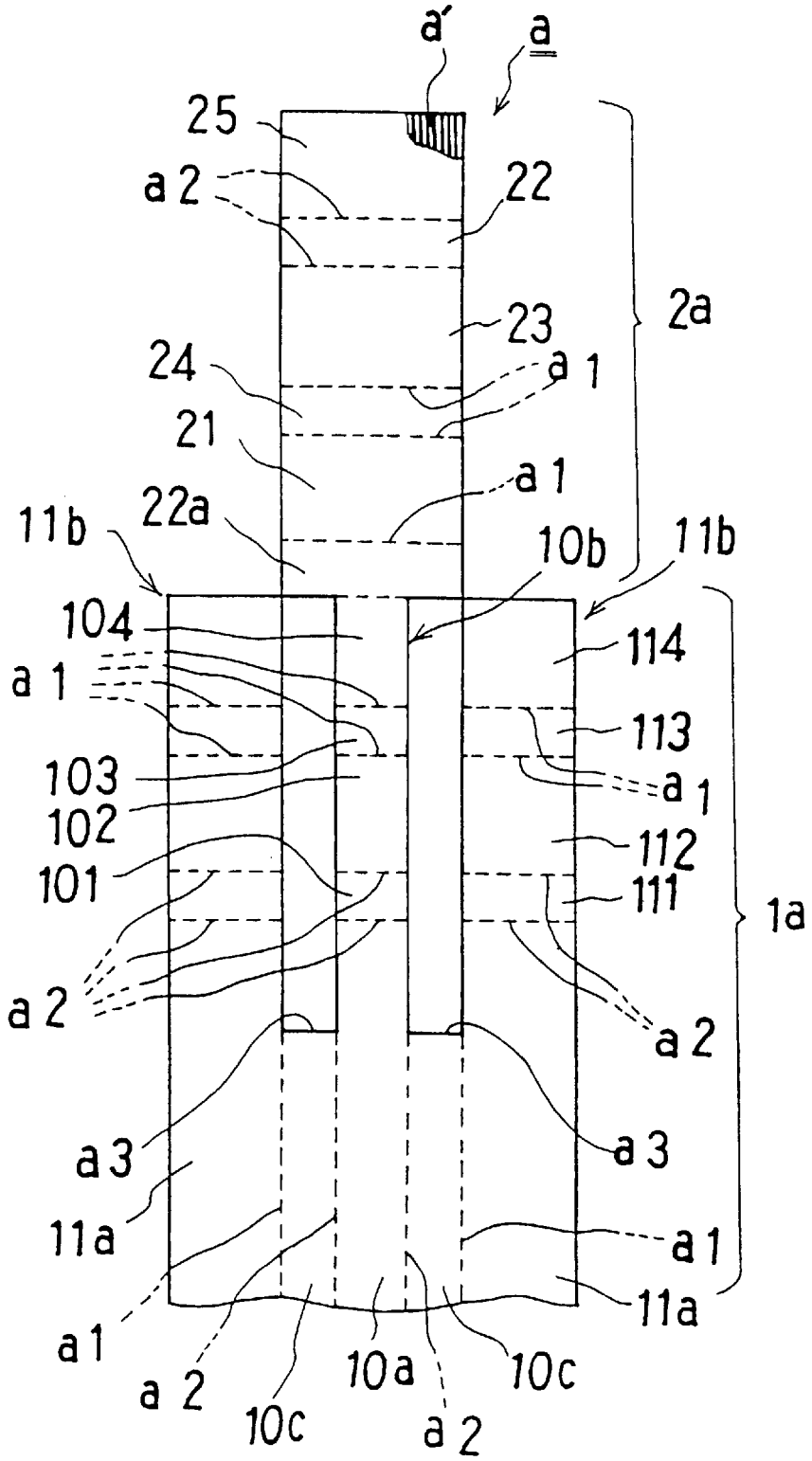
FIG. 30 is a partial plan view of the developed cushioning material of FIG. 28.
Figure 31:
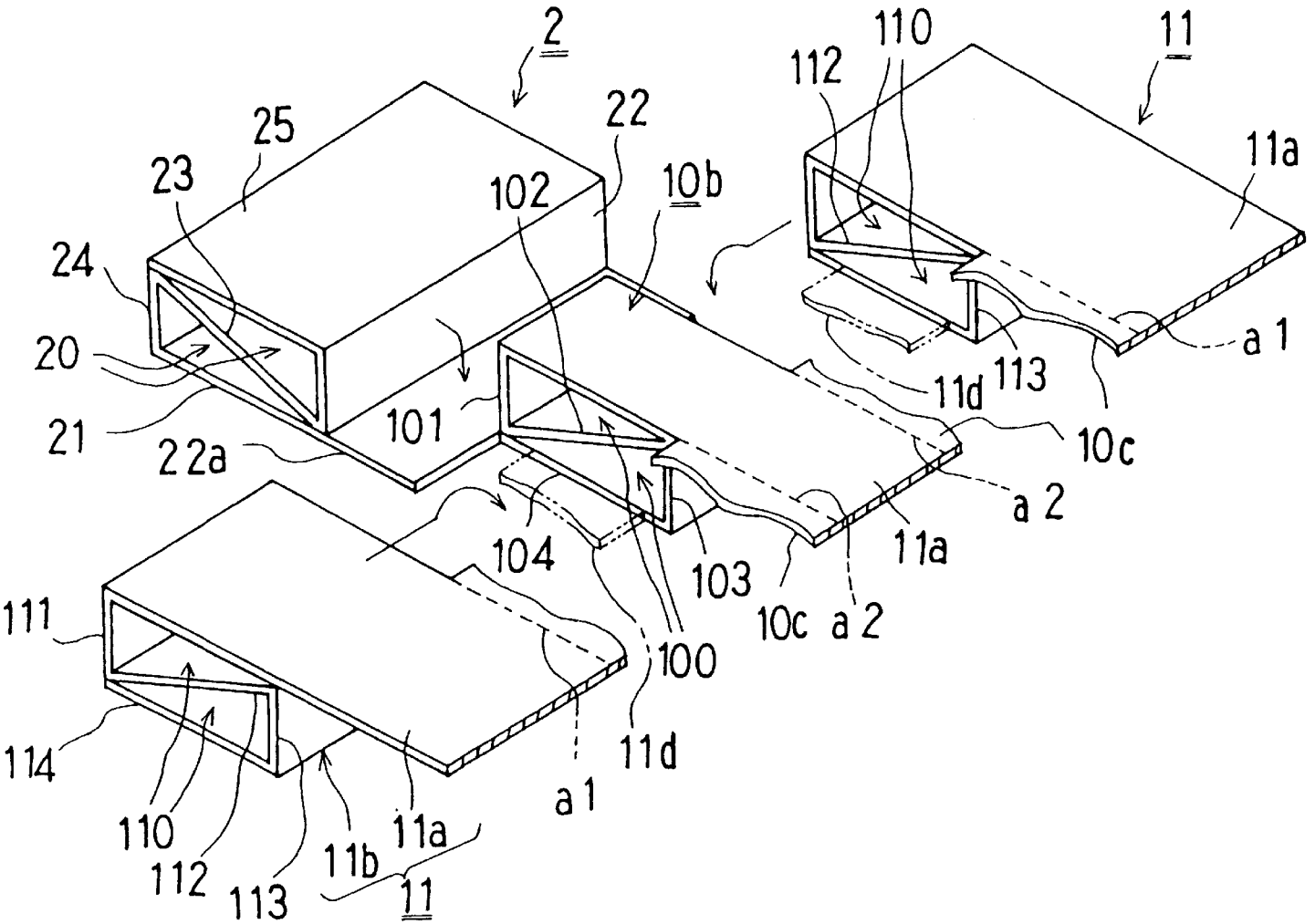
FIG. 31 is a partial perspective view of the cushioning material for packaging of FIG. 28, where a main part of the cushioning material has been fabricated into a solid body and the other part is developed.

Yet another embodiment of the cushioning material for packaging corresponding to the fifth aspect of the present invention is shown in FIGS. 28, 30 and 31.

FIG. 28 is a partial perspective view of the cushioning material, FIG. 30 is a reduced partial view of the developed cushioning material and FIG. 31 a partial perspective view of the cushioning material, where a part thereof has been built into a solid body and the rest is unfolded.

In the 17th embodiment, each end support member 2 consists of an inside sheet part 25, a bottom sheet part 22, a partition sheet part 23, a top sheet part 24, an outside sheet part 24 and a connecting sheet part 22*a* serving as doubled layered bottom sheet part, which are arranged continuously in this order.

The hollow portions 20, 20 of each end support member 2 are arranged in parallel in the direction along the width of the grooved retainer 1 and have sectional shapes of two opposed right-angled triangles of the same sizes. Therefore, the sectional shape crossing the hollow portion 20 of the end support member 2 is rectangular.

The raised bottom portion 10 consists of a raised bottom sheet part 10*a* and end legs 10*b*, 10*b* formed at the opposite ends of the raised bottom sheet part 10*a*. Each side wall 11, 11 consists of a side wall sheet part 11*a* and side wall reinforcing parts 11*b*, 11*b* formed at the opposite ends of the side wall sheet part 11*a*.

The end legs 10*b* of the raised bottom 10 and side reinforcing parts 11*b* of each side wall 11 are each composed of a hollow block having rectangular section. The hollow portions 110, 110 (FIG. 31) of the hollow block are arranged in parallel and have sectional shapes of two opposed right-angled triangles.

As shown in FIG. 30, in each support member forming part 2*a* of a single sheet a (corrugated cardboard), which is cut into a designed shape and size, an inside sheet part 25, a bottom sheet part 22, a partition sheet part 23, a top sheet part 24, an outside sheet part 21 and a connecting sheet part 22*a* are formed sequentially in this order from the end.

At the boundary between each sheet part 25–22*a*, there is formed a ridge-forming folding line a2 or valley forming folding line a1.

In the retainer forming part 1*a*, there are formed the raised bottom sheet part 10*a* having end legs 10*b* and side legs 10*c*, and the side wall sheet parts 11*a*, which are continuous to the opposite sides of the raised bottom sheet 10*a* respectively and have the side wall reinforcing parts 11*b* at the opposite sides thereof.

In each side wall reinforcing part 11*b*, there are formed a width sheet part 111, a partition sheet part 112, another width sheet part 113 and an outer surface sheet part 114 via a valley-forming folding line a1 or ridge forming folding line a2 at the end of the side wall sheet 11*a* in the direction to extend it. The end of the side wall sheet part 11*a* also serves as the inside sheet part.

At the boundary between the outside sheet part 21 and the connecting sheet part 22*a* and the boundaries between the side legs 10*c*, 10*c* and each side wall sheet part 11*a*, there are formed valley forming folding lines a1. At the boundaries between raised bottom sheet part 10*a* and the side legs 10*c*, 10*c* at the opposite sides thereof, there are formed ridge forming folding lines a2.

Punched holes a3 are formed between the opposite sides of the end legs 10*b* and the side reinforcing parts 11*b* in the direction to extend the side legs 10*c*.

In the end leg 10*b*, there are formed a height sheet part 101, a partition sheet part 102, another height sheet part 103 and a bottom sheet part 104 via a valley-forming folding line a1 or ridge forming folding line a2 in the direction to extend the end of the raised bottom sheet part 10*a*.

Cutting of the sheet a and forming of the folding lines a1, a2 are carried out similarly to those of the first embodiment.

The sheet a constructed as shown in FIG. 30 is folded using a folding apparatus (not shown in the figure) to build the end support members 2, the end legs 10*b* and side reinforcing parts 11*b* into solid bodies and necessary portions are bonded.

Then, the end support members 2 and the side walls 11 are made erect in the arrow direction of FIG. 31 to fabricate the cushioning material.

In order to finish the cushioning material as shown in FIG. 28, necessary portions of the fabricated cushioning material are bonded or the whole body is bound by the band in the same manner as shown in FIG. 1.

The end leg 10*b* and the side reinforcing parts arranged at the opposite sides of the end leg are so designed that sizes of the height sheet parts 101, 103 and the width sheet parts 111, 113, sizes of the partition sheet parts 102 and 103, sizes of the bottom sheet part 104 and the outside sheet part 114, and sizes of the part corresponding to the top sheet part of the end leg 10*b* and the part corresponding to the inside sheet part of the side reinforcing part 11*b* are equal responsively. Therefore, in the state shown in FIG. 31 (partially developed state), the side reinforcing parts 11*b* are superposed on the opposite sides of the central end leg 10*b* in the direction to extend it.

According to this embodiment, since the end legs 10*b* of the raised bottom 10 and the side reinforcing parts 11*b* of each side wall 11 are composed of the hollow blocks, even a somewhat heavy article can be sufficiently supported by the cushioning material and greater cushioning effect can be obtained, when it is packed into the case 5 with the article supported in the state shown in FIG. 4 and the load of the article is mainly applied to the raised bottom 10 or side wall 11.

In addition, on the support member forming portion 2*a*, end legs 10*b* and side reinforcing parts 11*b*, the folding lines a1, a2 having the same folding direction are formed in line over the width of the sheet a (width in the horizontal direction of FIG. 30). Therefore, mechanical work can be conducted very smoothly in manufacturing process.

Further, it is very advantageous that the cushioning material can be handled in the partially developed state as shown in FIG. 31 during transportation to users or storage.

In the cushioning material of the 17th embodiment, the side legs 10*c* of FIG. 30 can be omitted and the bottom sheet 104 of the end leg 10*b* and the opposite outer surface sheet parts 114 of the side wall reinforcing part 11*b* are connected by a connecting sheet 11*d* (shown by a one long and two short dot line in FIG. 3 1) having a width equal to the height of the side leg 10*c*.

In this embodiment too, the inside wall sheet 25 of each end support member 2 may composed of plural layers.

Other functions, effects and configurations of the 17th embodiment are similar to those of the first embodiment and explanation thereof is omitted.

18th Embodiment

Figure 29:
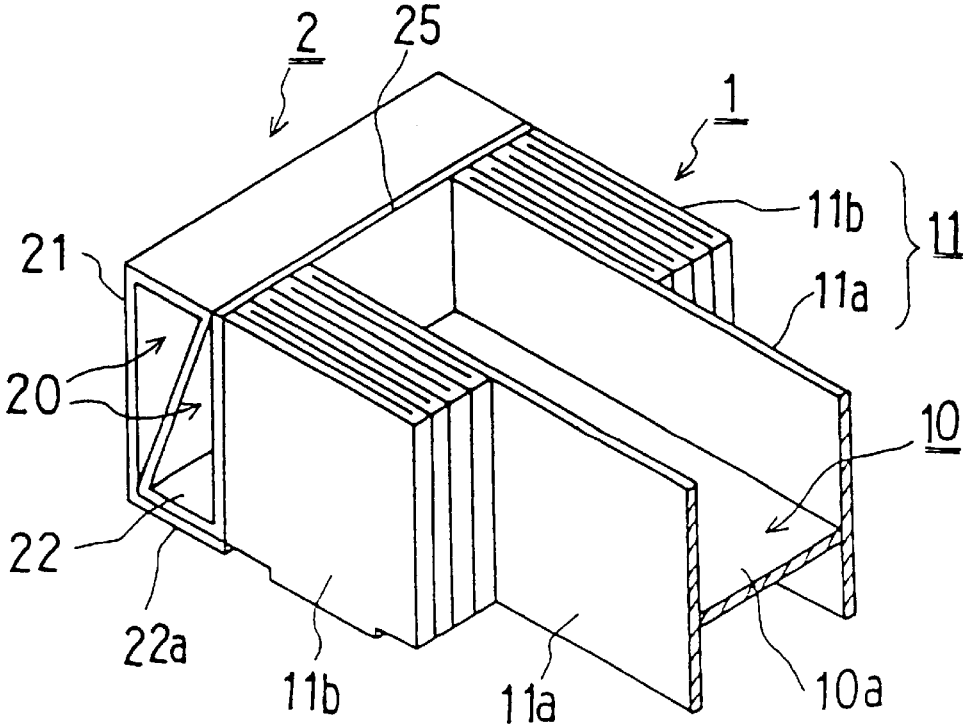
FIG. 29 is a partial perspective view of a 18th embodiment of the cushioning material for packaging according to the present invention.
Figure 32:
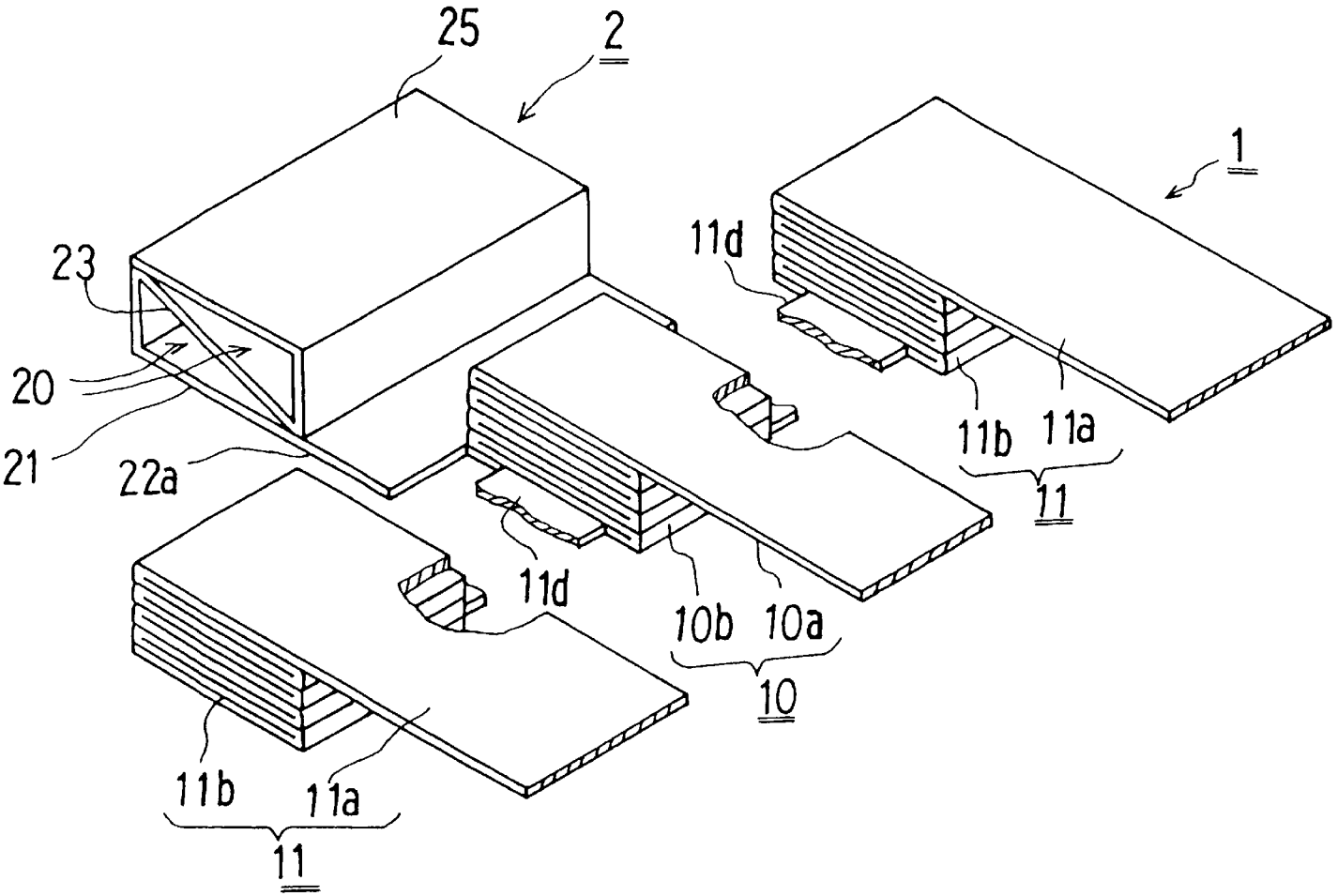
FIG. 32 is a partial perspective view of the cushioning material of FIG. 29, where a main part of the cushioning material has been fabricated into a solid body and the other part is developed.

Yet another embodiment of the cushioning material for packaging corresponding to the fifth aspect of the present invention is shown in FIGS. 29 and 32.

FIG. 29 is a partial perspective view of the cushioning material and FIG. 32 is a partial perspective view of the cushioning material where a main part thereof has been built into a solid body and the rest is unfolded.

In the 18th embodiment, the end support members 2 are constructed similarly to those of the 17th embodiment (FIG. 28).

The raised bottom 10 consists of an approximately horizontal raise bottom sheet part 10*a* and end legs 10*b*, which are formed downward at the opposite ends of the raised sheet part 10*a* and made of layered blocks formed by folding necessary portions of the material sheet vertically along the longitudinal direction of the grooved retainer 1.

Each side wall 11 is composed of an approximately horizontal side wall sheet 11*a* and the side reinforcing parts 11*b*, which are continuous to the opposite sides of the side wall sheet 11*a* respectively and made of layered blocks formed by folding necessary portions of the material sheet vertically along the longitudinal direction of the grooved retainer 1.

The bottom layer of the end leg 10*b* is continuous to the bottom of the end support member 2 via the connecting sheet 22*a* and is continuous to the bottoms of the opposite side reinforcing parts 11*b* via the connecting sheets 11*d* respectively.

The number and length of the folded layers of each end leg 10*b* are equal to those of each side reinforcing part 11*b* arranged at each side of the end leg.

According to this embodiment, since the end legs 10*b* of the raised bottom 10 and the side reinforcing parts 11*b* of the side wall 11 are each composed of the layered block, even a somewhat heavy article can be sufficiently supported by the cushioning material and greater cushioning effect can be obtained, when it is packed into the case 5 with the article 4 supported in the state shown in FIG. 4 and the load of the article is mainly applied to the raised bottom 10 or side wall 11.

As above-mentioned, since the number and length of the folded layers of each end leg 10*b* are equal to those of each side reinforcing part 11*b*, mechanical work can be carried out very smoothly in the manufacturing process of the cushioning material.

In addition, it is very advantageous that the cushioning material can be handled in the partially developed state as shown in FIG. 32 during transportation to users or storage.

In the cushioning material of the 18th embodiment, the connecting sheet part 11*d* of FIG. 32 may be omitted and, similarly to the embodiment shown in FIGS. 28, 31, the raised bottom sheet part 10*a* may be connected to each side wall sheet part 11*a* via the side leg 10*c*.

In the cushioning material of the 18th embodiment too, the inside wall sheet 25 of each end support member 2 may composed of plural layers.

Other functions, effects and configurations of this embodiment are similar to those of the first embodiment and explanation thereof is omitted.

In the cushioning materials of FIGS. 10–12 and FIG. 15, each side walls 11 are continuous to the lower part of the raised bottom sheet 10 and, therefore, the end legs 10*b* and the side reinforcing parts 11*b* may be constructed similarly to those of the cushioning material of the 18th embodiment.

19th Embodiment

Figure 33:
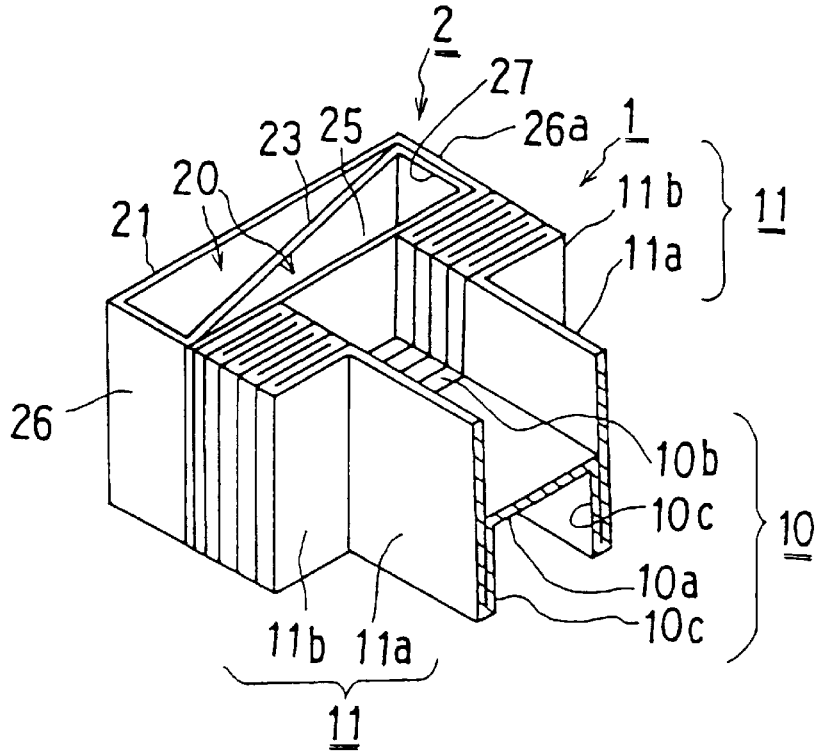
FIG. 33 is a partial perspective view of a 19th embodiment of the cushioning material for packaging according to the present invention.
Figure 35:
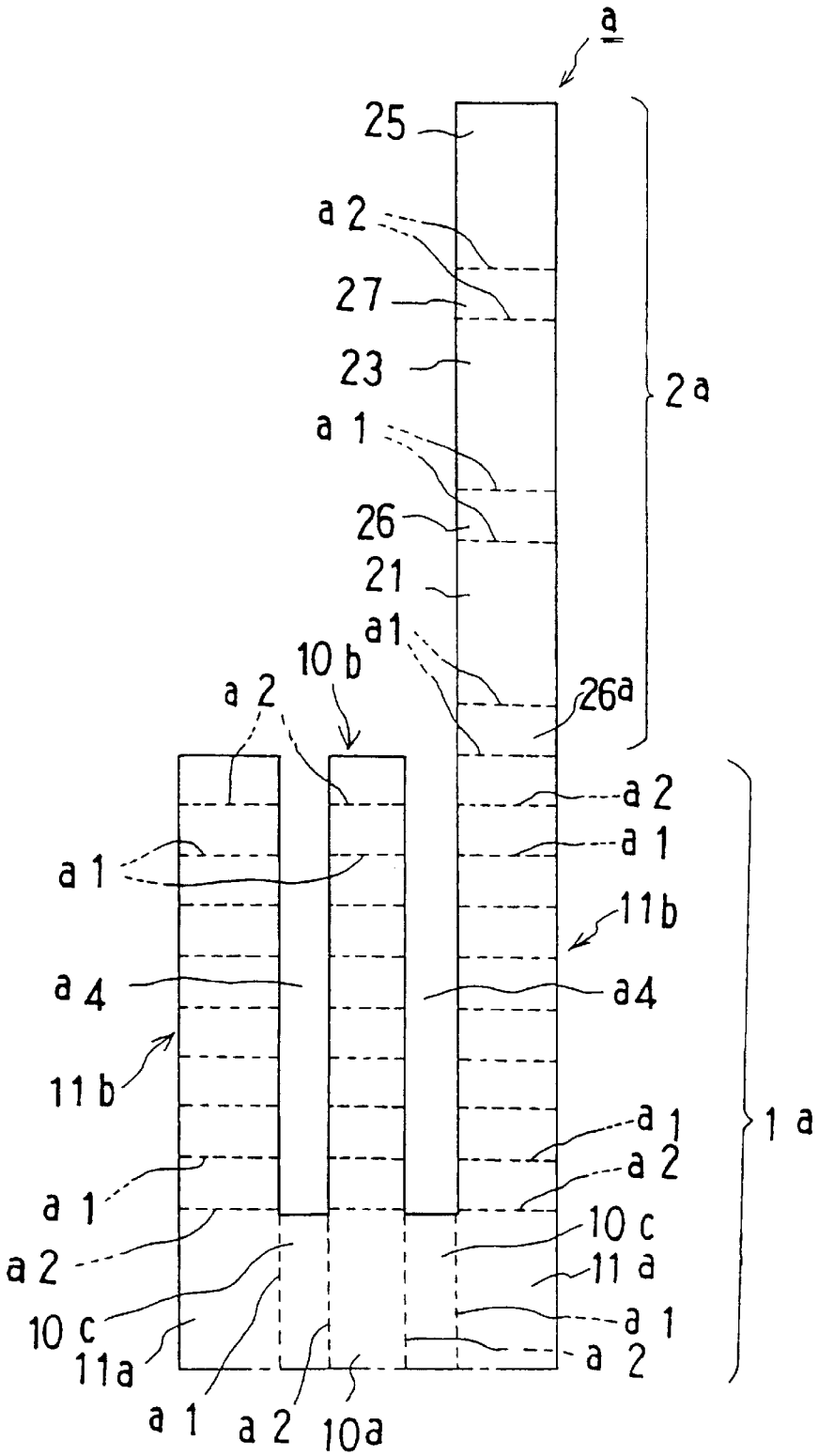
FIG. 35 is a partial plan view of the developed cushioning material of FIG. 33.
Figure 36:
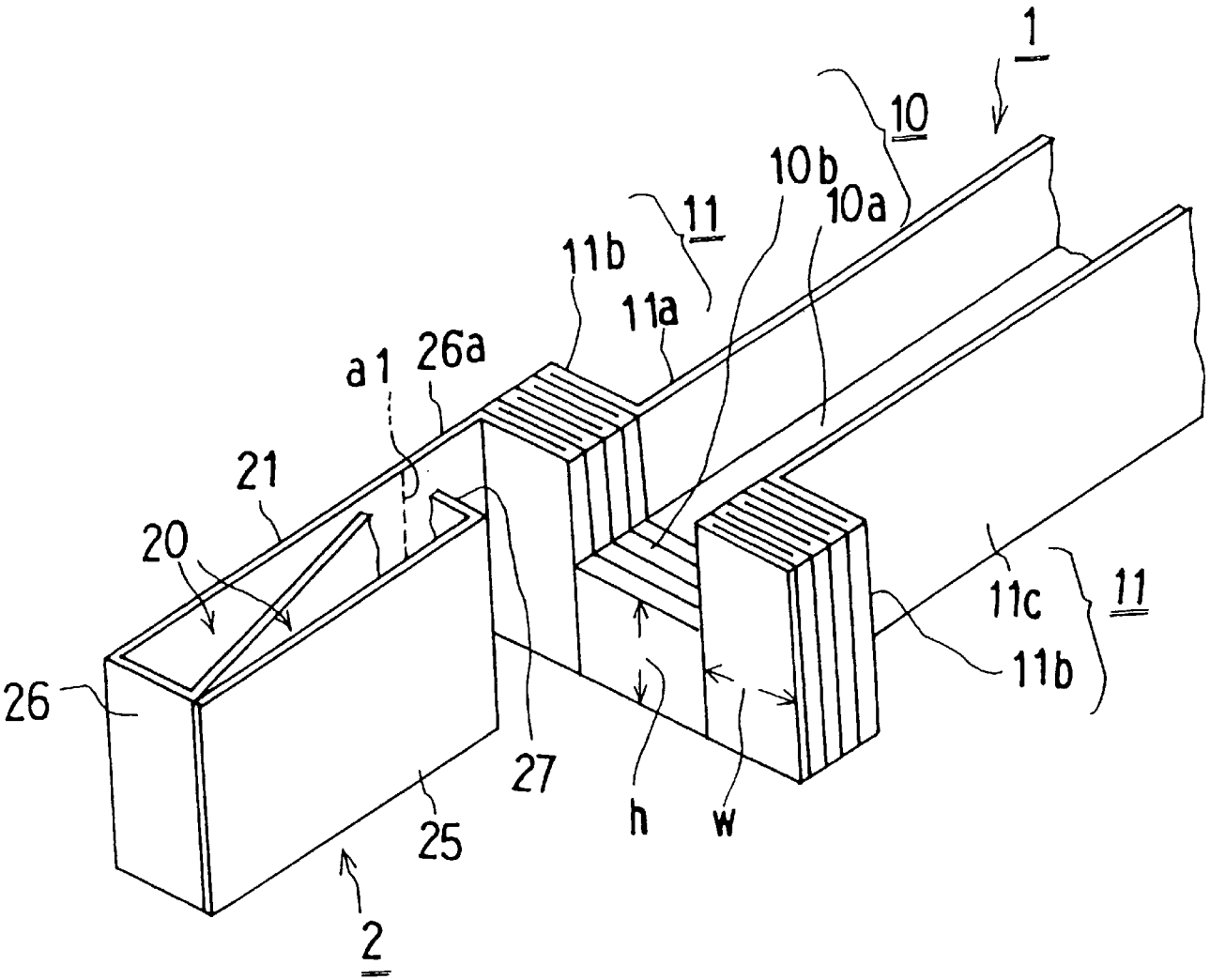
FIG. 36 is a perspective view of the cushioning material of FIG. 33, where a main part of the cushioning material has been fabricated into a solid body and the other part is developed.

Another embodiment of the cushioning material for packaging corresponding to the sixth aspect of the present invention is shown in FIGS. 33, 35 and 36.

FIG. 33 is a partial perspective view of the cushioning material of the 19th embodiment, FIG. 35 is a reduced partial plan view of the developed cushioning material of FIG. 33, and FIG. 36 is a partial perspective view of the cushioning material just before completion.

The end support members 2 of the cushioning material of the 19th embodiment are constructed similarly to those of the embodiment shown in FIG. 18.

Each end leg 10*b* of the raised bottom 10 is made of a multiple layered block which is formed by folding necessary portions of the sheet a in zigzag vertically along the width direction of the grooved retainer 1.

Each side reinforcing part 11*b* of the side wall 11 is made of a multiple layered block which is formed by folding necessary portions of the sheet a in zigzag in the width direction along the depth direction of the grooved retainer 1.

The end leg 10*b* and the side reinforcing part 11*b* are so designed that the height of the end leg 10*b* is equal to the width of the side reinforcing part 11*b* and the number of the folded layers of the end leg 10*b* is equal to that of the layers of the side reinforcing part 11*b*.

Each side reinforcing part 11*b* of one of the side walls 11 is continuous to the outside sheet part 21 of the corresponding end support member 2 via the connecting sheet part 26*a*. The lower end of the side wall sheet part 11*a* of each side wall 11 is continuous to the lower end of the corresponding side leg 10*c* of the raised bottom sheet 10*a*.

As shown in FIG. 35, in the support member forming portion 2*a* of the sheet a, sheet parts 25, 27, 23, 26, 21 and 26*a* are formed continuously in this order from its end via a ridge forming folding line a2 or valley forming folding line a1.

At the end of the retainer forming portion 1*a* of the sheet a, the side reinforcing parts 11*b* each having the length equal to that of the end leg 10*b* are formed on the opposite sides of the central end leg 10*b* via cut portions a4 each having the width corresponding to the height of the side leg 10*c*.

On the end leg 10*b* and the opposite side reinforcing parts 11*b*, there are formed ridge-forming folding lines a2 and valley-forming folding lines a1 alternately along the width direction at predetermined intervals. A ridge forming folding line a1 is formed between the connecting sheet part 26*a* of the retainer forming portion 2*a* and one of the side reinforcing parts 11*b*.

At the boundaries between the raised bottom sheet part 10*a* and the end legs 10*c*, and boundaries between the end legs 10*c* and the side wall sheet part 11*a*, there are formed a ridge forming folding line a2 and a valley forming folding line a1 respectively.

After directional permanency of folding has been imparted to the folding lines a1, a2, the end support members 2, end legs 10*b* and side reinforcing parts 11*b* are made into solid bodies and, at the same time, necessary portions are bonded. Thereafter, the cushioning material is finished as shown in FIG. 33.

In the 19th embodiment of the cushioning material, the end legs 10*b* of the raised bottom 10 and the side reinforcing parts 11*b* of the side wall 11 are each composed of the layered block having the same and plural number of layers and each formed by folding a part of the material sheet. Therefore, even a somewhat heavy article can be sufficiently supported by the cushioning material and greater cushioning effect can be obtained, when it is packed into the case 5 with the article 4 supported in the state shown in FIG. 4 and the load of the article is mainly applied to the raised bottom 10 or side wall 11.

In addition, the folding lines a1, a2 having the same folding direction can be formed in line over the width of the sheet a (width in the horizontal direction of FIG. 27) on the support member forming portion 2*a*, end legs 10*b* and side reinforcing parts 11*b*. Therefore, mechanical work can be conducted very smoothly in the manufacturing process.

In the cushioning material of this embodiment too, the inside wall sheet 25 of each end support member 2 may be composed of plural layers.

Figure 34:
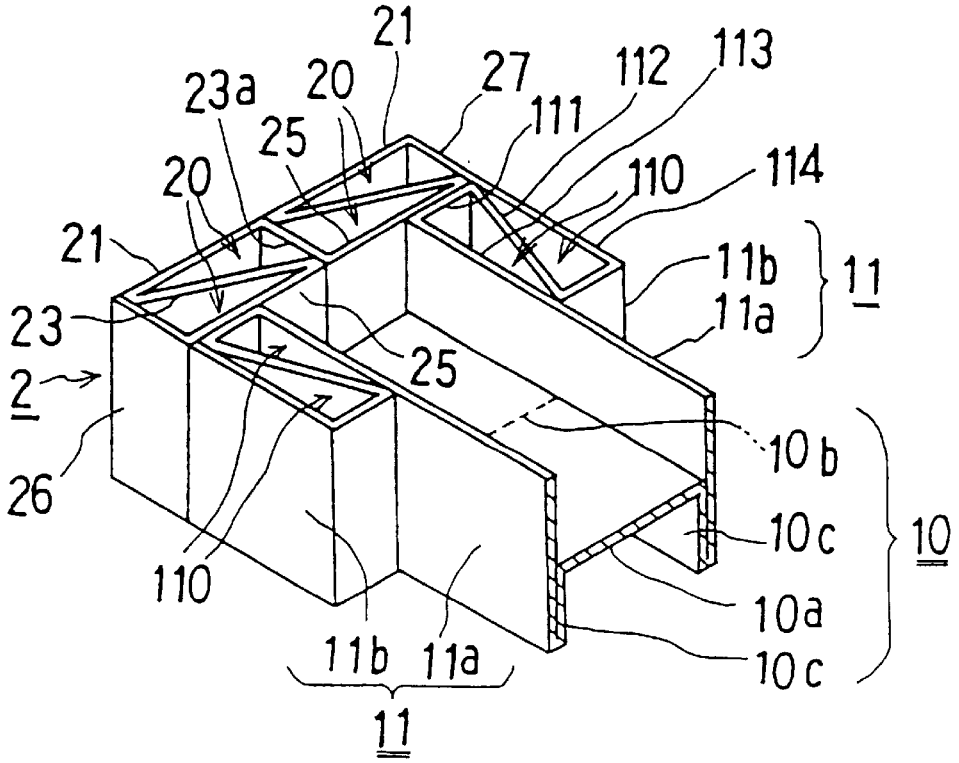
FIG. 34 is a partial perspective view of a 20th embodiment of the cushioning material for packaging according to the present invention.
Figure 37:
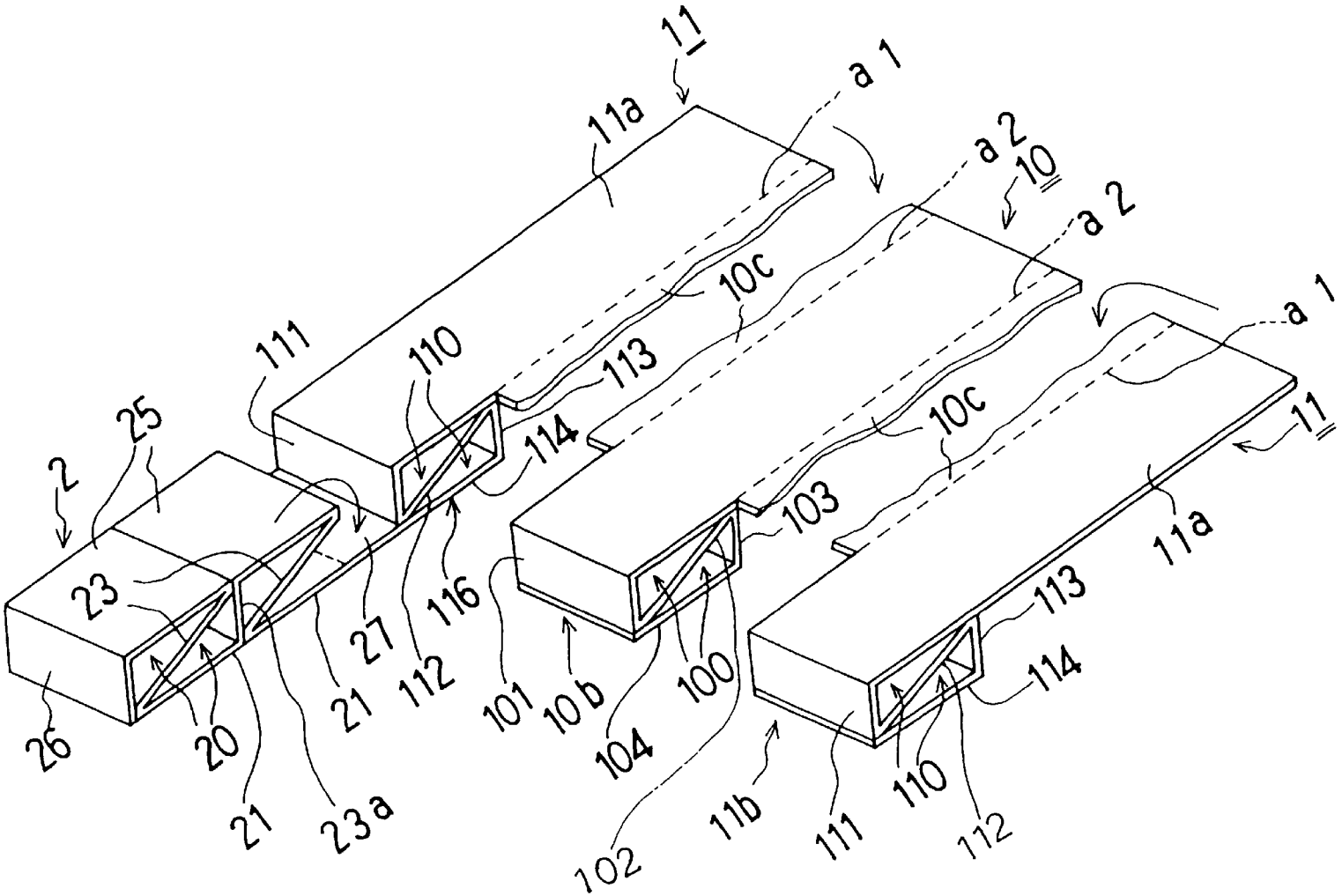
FIG. 37 is a perspective view of the cushioning material for packaging of FIG. 34, where a main parts of the cushioning material has been abricated into a solid body and the other part is developed.

Other functions, effects and configurations of this embodiment are similar to those of the first embodiment and explanation thereof is omitted 20th Embodiment Yet another embodiment of the cushioning material for packaging corresponding to the sixth aspect of the present invention is shown in FIGS. 34 and 37.

FIG. 34 is a partial perspective view of the cushioning material of the 20th embodiment and FIG. 37 is a partial perspective view of the cushioning material where a main part thereof has been built into a solid body and the rest is unfolded.

In the 20th embodiment of the cushioning material, each end support member 2 consists of a width sheet part 26, an inside sheet part 25, an inclined partition sheet part 23, an outside sheet part 21, a partition sheet part 23 having the same size as the width sheet part 26, another inside sheet part 25, another inclined partition sheet part 23, another outside sheet 21 and another width sheet part 27, which are arranged continuously in this order via folding line. And it has four hollow portions 20 having shapes similar to those of the end support member 2 of the embodiment shown in FIG. 10.

The end legs 10*b* of the raised bottom sheet 10 and the side reinforcing part 11*b* of each side wall 11 are each composed of a hollow block, which is formed similarly to that of the embodiment shown in FIGS. 28 and 31.

Specifically, the end leg 10*b* consists of a height sheet part 101, an inclined partition sheet part 102, another height sheet part 103, a bottom sheet part 104 and a raised bottom sheet part 10*a* serving also as a top sheet part, which are continuous to each other in the direction to extend the raised bottom sheet 10*a*. The end leg 10*b* has two opposed hollow portions 100 arranged in parallel to the width direction of the grooved retainer 1.

The side reinforcing part 11*b* consists of a width sheet part 111, an inclined partition sheet part 112, another width sheet part 113, an outside sheet part 114 and an end of the side wall sheet part 10*a* serving as an inside sheet part, which are continuous to each other in the direction to extend the side wall sheet part 1*a*. The side reinforcing part 11*b* has two opposed hollow portions 100 arranged in parallel to the depth direction of the grooved retainer 1.

In one of the side walls 11, the outside sheet part 114 of each the side reinforcing part 11*b* is continuous to the width sheet part 27 of the end support member, which serves as a connecting sheet part. The lower end of each side wall sheet part 11*a* is continuous to the lower end of the corresponding side leg 10*c* of the raised bottom sheet part 10*a*.

The end leg 10*b* and the side reinforcing parts 11*b* are so designed that the hollows 100 and 110 have the same sectional shapes and sizes, and in a state shown in FIG. 37 where the sheet is partially developed, the side reinforcing parts are superposed in the direction to extend the end leg 10*b*.

According to the 20th embodiment, since the end legs 10*b* of the raised bottom 10 and the side reinforcing parts 11*b* of the side wall 11 are composed of the hollow portions, even a somewhat heavy article can be sufficiently supported by the cushioning material and greater cushioning effect can be obtained, when it is packed into the case 5 with the article 4 supported in the state shown in FIG. 4 and the load of the article is mainly applied to the raised bottom 10 or side wall 11.

In addition, since the end leg 10*b* and the side reinforcing parts 11*b* are so designed that the hollows 100 and 110 have the same sectional shapes and sizes and, in the partially developed state shown in FIG. 37, the side reinforcing parts are superposed in the direction to extend the end leg 10*b*, mechanical work can be conducted very smoothly in manufacturing process of the cushioning material.

In the cushioning material of this embodiment too, the inside wall sheet 25 of each end support member 2 may composed of plural layers.

Other functions, effects and configurations of the 20th embodiment are similar to those of the first embodiment and explanation thereof is omitted.

21st Embodiment

Figure 38:
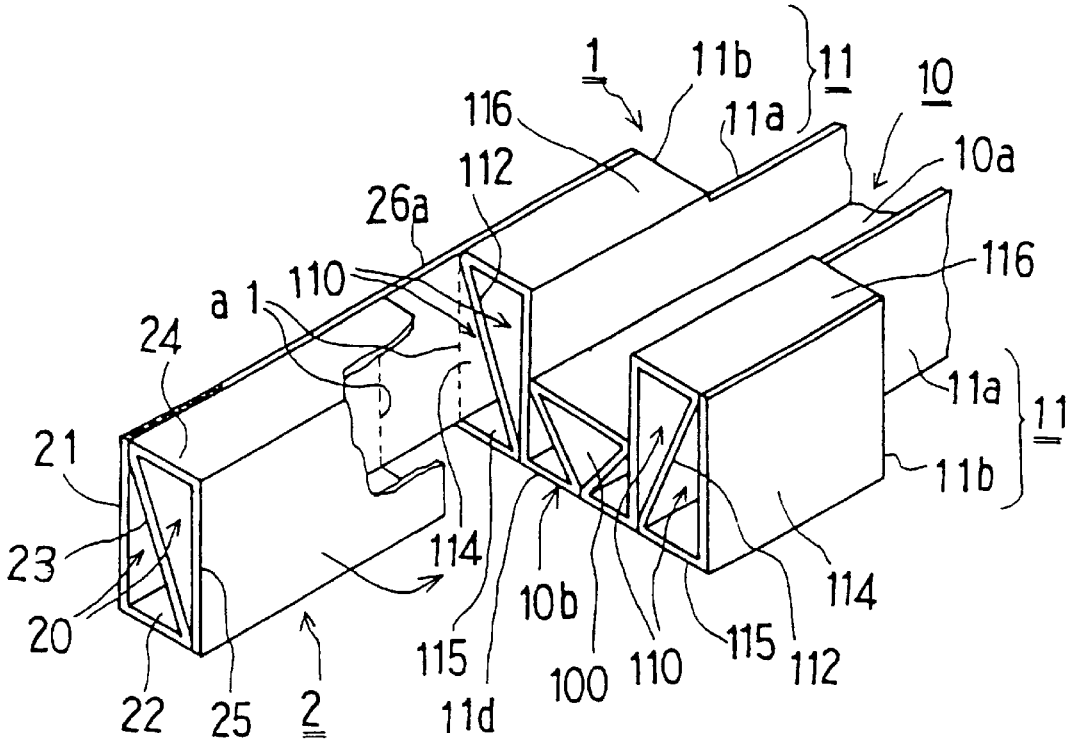
FIG. 38 is a partial, cutaway perspective view showing a state just before completion of the cushioning material for packaging according to the present invention.
Figure 39:
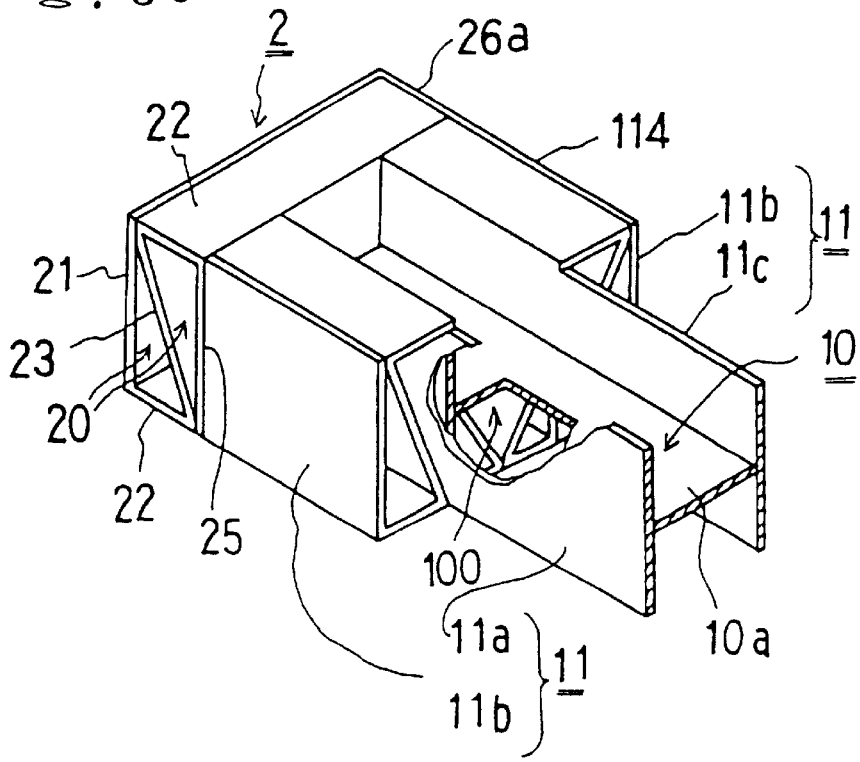
FIG. 39 is a partial, cutaway perspective view of the cushioning material of FIG. 38.

Yet another embodiment of the cushioning material for packaging corresponding to the sixth aspect of the present invention is shown in FIGS. 38 and 39.

FIG. 38 is a partial, cutaway perspective view of the cushioning material in a state, just before completed. FIG. 39 is a partial, cutaway perspective view of the fabricated cushioning material.

The end support members 2 of the cushioning material of the 21st embodiment are constructed almost similarly to those of the first embodiment. Each end support member 2 consist of an outside sheet part 21, a bottom sheet part 22, a partition sheet part 3, a top sheet part 24, and an inside sheet part 25, which are formed sequentially in this order via each folding line.

The hollow portions 20, 20 of each end support member 2 are arranged in parallel along the width direction of the grooved retainer 1 in opposed posture. Since they have sectional shapes of the opposed right-angled triangles, the end support member 2 has a rectangular sectional shape.

Each side wall 11 consists of a vertical side wall sheet part 11*a* and the side reinforcing parts 11*b* which are formed at the opposite sides of the side wall sheet 11*a*.

Each side wall reinforcing part 11*b* is so designed that the sectional shape and size thereof are the same as those of the end support member 2 in the partially developed state, where the end support members 2, the side reinforcing parts 11*b* and the end legs 10*b* are made into solid bodies and the rest of the sheet is developed.

Each side reinforcing part 11 consists of an outside sheet part 114, a bottom sheet part 115, a partition sheet part 112, a top sheet part 116, and an end of the side wall sheet part 11*a* serving as an inside sheet part, which are continuous to each other via a folding line. The opposed and parallel hollow portions 110, 110 are formed along the longitudinal direction of the grooved retainer 1.

One end of the outside sheet part 21 of each end support member 2 is continuous to the outside side sheet part 114 of each side wall reinforcing part 11*b* in one of the side walls 11 via the connecting sheet part 26*a*.

The raised bottom 10 consists of a horizontal raised bottom sheet part 10*a* and end legs 10*b* which are composed of hollow blocks and formed on the opposite lower sides of the raised bottom sheet part 10*a*. Each end leg 10*b* consists of a hollow block, which has a hollow portion 100 along the longitudinal direction of the grooved retainer 1 and a sectional shape of reversed triangle. Each lower end of the hollow portions is continuous to the end of each side wall sheet part 11*a*, which serves as the inside sheet part of the side reinforcing part, via connecting sheet part 11*d* continuous to the lower end.

According to the 21st embodiment, since the end legs 10*b* of the raised bottom 10 and the side reinforcing parts 11*b* of the side wall 11 are composed of the hollow blocks, even a somewhat heavy article can be sufficiently supported by the cushioning material and greater cushioning effect can be obtained, when it is packed into the case 5 with the article 4 supported in the state shown in FIG. 4 and the load of the article is mainly applied to the raised bottom 10 or side wall 11.

Since each side wall reinforcing part 11*b* is so designed that the sectional shape and size thereof are the same as those of the end support member 2 in the partially developed state, where the end support members 2, the side reinforcing parts 11*b* and the end legs 11*b* are made into solid bodies, and end support members 2 are superposed in the direction to extend the opposite ends of the side reinforcing part 11*b* of the side wall, mechanical process can be done very smoothly in the manufacturing process of the cushioning material.

In the cushioning material of this embodiment too, the inside wall sheet 25 of each end support member 2 may composed of plural layers.

Other functions, effects and configurations of the 21st embodiment are similar to those of the first embodiment and explanation thereof is omitted.

In the cushioning materials of the embodiments shown in FIGS. 13 and 15, the lower parts of the side reinforcing parts 11 are continuous to the opposite lower ends of the raised bottom 10 respectively. Accordingly, the side reinforcing parts 11*b* and the end legs 10*b* thereof can be constructed similarly to those of the cushioning material of the 21st embodiment.

22nd Embodiment

Figure 40:
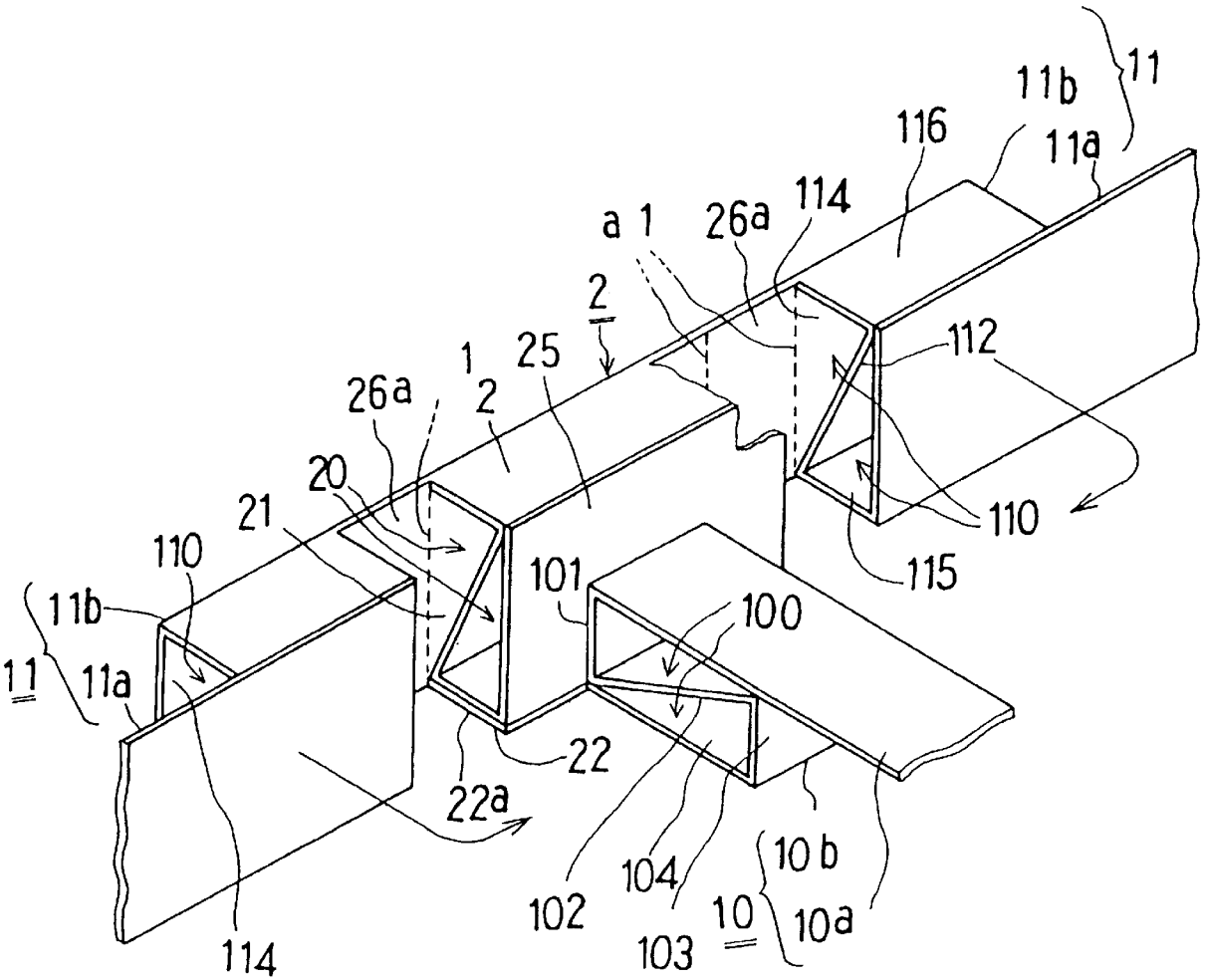
FIG. 40 is a partial perspective view of a 22nd embodiment of the cushioning material for packaging according to the present invention, where it is partially developed.

Yet another embodiment of the cushioning material for packaging corresponding to the seventh aspect of the present invention is shown in FIG. 40.

FIG. 40 is a partial perspective view of the cushioning material which is just before completed. The end support members 2 and the raised bottom 10 are constructed almost similarly to those of the cushioning material of the embodiment shown in FIGS. 28 and 31.

The side walls 11 have structure resemble to that of the embodiment shown in FIG. 38. Specifically, in this embodiment, the side reinforcing part 11*b* of the side wall 11 is composed of a hollow block but the direction of the partition sheet part 112 of the side reinforcing part 11*b* is opposite to that of the partition sheet part 112 of the side reinforcing part 11*b* of FIG. 38.

The opposite ends of the outside sheet part 21 of one of the end support members 2 are respectively continuous to the outside sheet part 114 of the side reinforcing part 11*b* in the corresponding side wall 11 via the connecting sheet part 26*a*. The lower part of each end support member 2 is continuous to the bottom sheet part 104 of the side leg 10*b* in the raised bottom 10 via the connecting sheet part 26*a*, which serves as the double layer bottom.

The sectional shape and size of the hollow portion 20 of the end support member 2 are approximately equal to those of the side reinforcing part 11*b*. In a state where the end legs 10*b*, side reinforcing parts 11*b* and the end support members 2 are built into solid bodies, the end support member 2 is superposed in the direction to extend the side reinforcing part 11*b* of one of the side walls 11.

According to the 22nd embodiment, since the end legs 10*b* of the raised bottom 10 and the side reinforcing parts 11*b* of the side wall 11 are composed of the hollow blocks, even a somewhat heavy article can be sufficiently supported by the cushioning material and greater cushioning effect can be obtained, when it is packed into the case 5 with the article 4 supported in the state shown in FIG. 4 and the load of the article is mainly applied to the raised bottom 10 or side wall 11.

In addition, since each side reinforcing part 11*b* is so designed that, in the partially developed state where the end support members 2, side reinforcing parts 11*b* and the end legs 11*b* are built into solid bodies, the sectional shape and size thereof are approximately equal to those of the end support member 2 and, in the partially developed state, the end support member 2 is superposed in the direction to extend the side reinforcing part 11*b* of the side walls 11, mechanical process can be done very smoothly in the manufacturing process of the cushioning material.

In the cushioning material of this embodiment too, the inside wall sheet 25 of each end support member 2 may composed of plural layers.

Other functions, effects and configurations of the 22nd embodiment are similar to those of the first embodiment and explanation thereof is omitted.

23rd Embodiment

Figure 41:
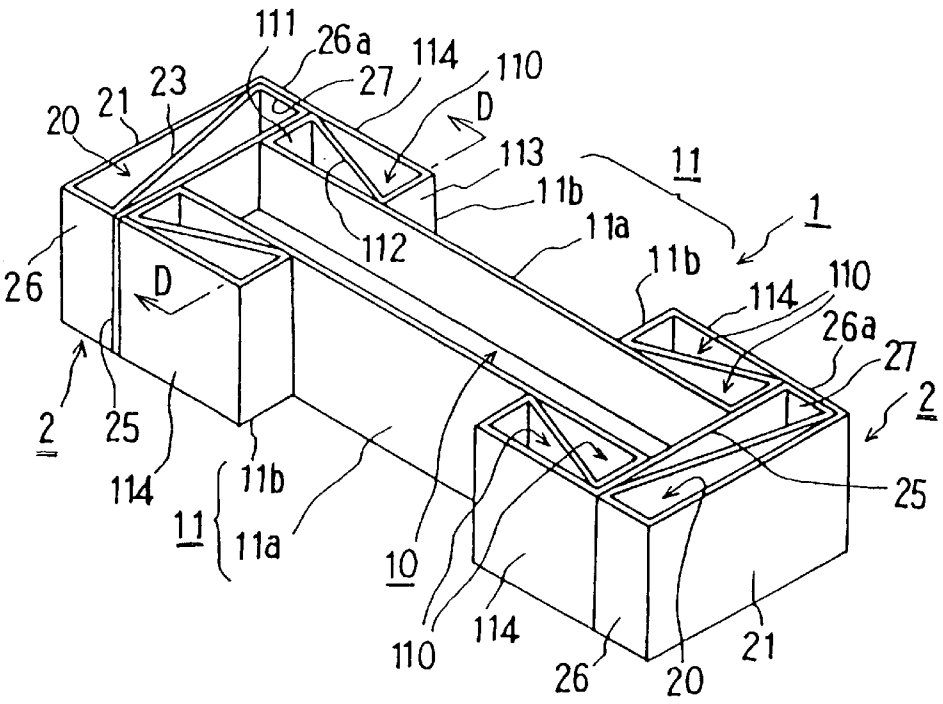
FIG. 41 is a perspective view of a 23rd embodiment of the cushioning material for packaging according to the present invention.
Figure 42:
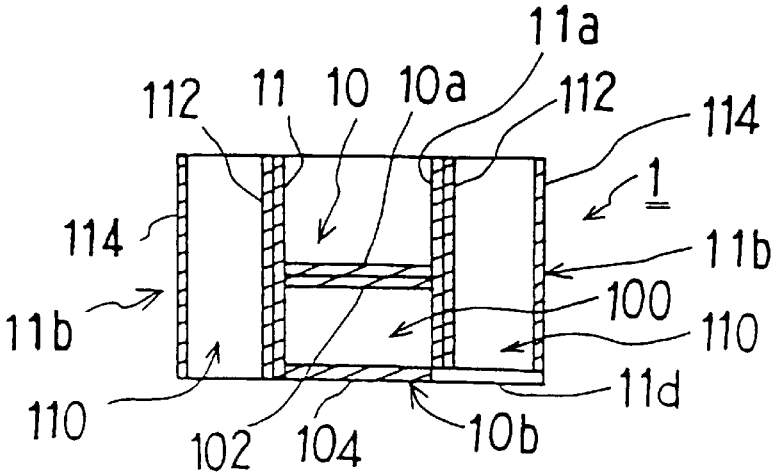
FIG. 42 is a cross sectional view along the arrow line D—D of FIG. 41.

Another embodiment of the cushioning material for packaging corresponding to the twelfth aspect of the present invention is shown in FIGS. 41 and 42.

The end support members 2 of this embodiment are constructed almost similarly to those of the cushioning material shown in FIG. 33.

The raised bottom portion 10 consists of an approximately horizontal raise bottom sheet part 10*a* and end legs 10*b* of hollow blocks which are formed at the opposite lower ends of the raised bottom sheet part 10*a*. Each side wall 11 consists of an approximately vertical side wall sheet parts 11*a* and side reinforcing parts 11*b* of hollow blocks which are formed at the opposite sides of the side wall sheet parts 11*a*.

The end legs 10*b* of the raised bottom 10 and the side reinforcing parts 11*b* of each side wall 11 are constructed similarly to those shown in FIG. 31.

The end legs 10*b* and the side reinforcing parts 11*b* arranged at the opposite sides of each end leg have the same shapes and sizes in the section orthogonal to their hollow portions 110, 100.

One end of the outside sheet part 21 of one of the end support members 2 (left side support member 2 of FIG. 41) is continuous to the outside sheet 114 of the side reinforcing part 11*b* positioned at one end (left end of the figure) of one of the side walls 11 (upper side wall in FIG. 41). One end of the outside sheet part 21 of the other end support member 2 is continuous to the outside sheet 114 of the side reinforcing part 11*b* positioned at the other end of the same side wall 11.

The other end of the other end support member 2 (right support member 2 of FIG. 41) is continuous to the outside sheet 114 of the side reinforcing part 11*b* positioned at one end of the other side wall 11 at the inside sheet part 25.

The outside sheet part 114 of each side reinforcing part 11*b* of the one side wall 11 is, as shown in FIG. 42, continuous to the bottom sheet 104 of the adjacent end leg 10*b* via the connecting sheet part 11*d*, which is continuous to the lower end of the outside sheet 114.

It is so designed that, in a state where the end legs 10*b*, side reinforcing parts 11*b* and the end support members 2 are built into solid bodies and the rest is unfolded (partially developed state), the side reinforcing parts 11*b* are superposed in the direction to extend the opposite sides of the end legs 10*b*.

According to the 23rd embodiment, since the end legs 10*b* of the raised bottom 10 and the side reinforcing parts 11*b* of the side wall 11 are composed of the hollow blocks, even a somewhat heavy article can be sufficiently supported by the cushioning material and greater cushioning effect can be obtained, when it is packed into the case 5 with the article 4 supported in the state shown in FIG. 4 and the load of the article is mainly applied to the raised bottom 10 or side wall 11.

In addition, since the end legs 10*b* and the side reinforcing parts 11*b* at the opposite sides thereof are so designed that they have the same shapes and sizes in the section orthogonal to their hollow portions 110, 100 and, in the partially developed state, the side reinforcing parts 11*b* are superposed in the direction to extend the end leg 10*b*, mechanical process can be done very smoothly in the manufacturing process of the cushioning material.

In the cushioning material of this embodiment too, the inside wall sheet 25 of each end support member 2 may composed of plural layers.

Other functions, effects and configurations of the 23rd embodiment are similar to those of the first embodiment and explanation thereof is omitted.

24th Embodiment

Figure 43:
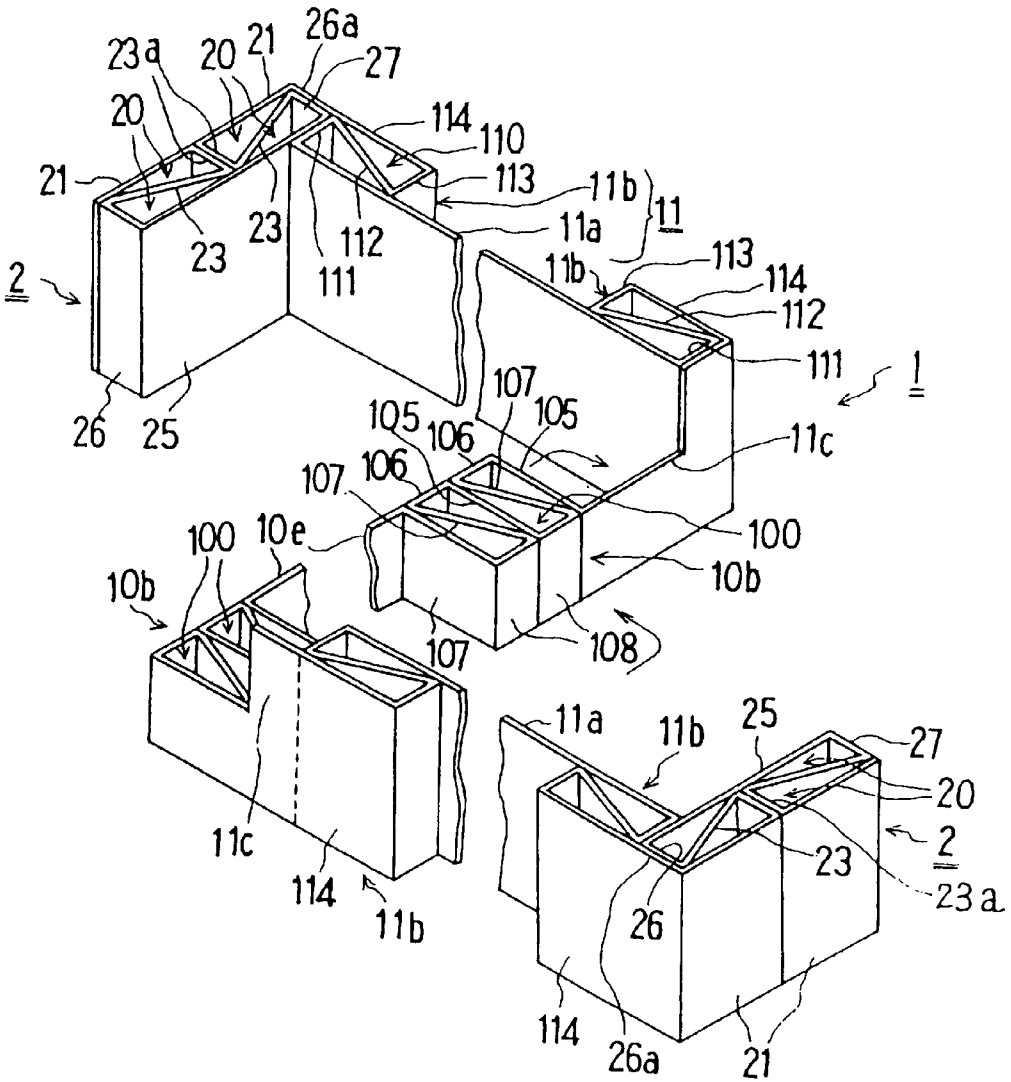
FIG. 43 is a partial perspective view of a 24th embodiment of the cushioning material for packaging according to the present invention, where it is partially developed.

Another embodiment of the cushioning material for packaging corresponding to the thirteenth aspect of the present invention is shown in FIG. 43.

FIG. 43 is a partial perspective view of the cushioning material which is being fabricated after the main parts have been built into solid bodies.

In the cushioning material of the 24th embodiment, each end support member 2 is formed of a support member forming part positioned at the end of a long and somewhat narrow sheet as a whole. In the support member forming part, there are formed, from the end thereof, an outside sheet part 21, a partition sheet part 23*a*, an inclined partition sheet part 23, a width sheet part 26, an inside sheet part 25, another width sheet part 27, another inclined partition sheet part 23, another partition sheet part 23*a*, another outside sheet part 21, and a connecting sheet part 26*a* continuous to the other outside sheet part 21 via valley forming folding line or ridge forming folding line along the width direction of the sheet.

Four hollow portions 20 of each end support member 2 are arranged in parallel to the depth direction of the grooved retainer 1 and alternately in opposed posture, and each has a sectional shape of the right-angled triangle. In arrangement where these hollows 20 are arranged alternately, the sectional shape of the end support member 2 becomes to be rectangular.

Each side wall 11 consists of an approximately vertical side wall sheet part 11*a* and the side reinforcing parts 11*b* formed continuously at the opposite sides of the side wall sheet part 11*a*. Each side reinforcing part 11*b* is composed of a hollow block similar to that of the side reinforcing part 11*b* of the embodiment shown in FIG. 41.

The raised bottom 10 consists of the opposite end legs 10*b* composed of hollow blocks and the connecting sheet part 10*e* which connects the sides of the opposite end legs 10*b*.

Each end leg 10*b* is constructed by repeatedly and continuously forming a width sheet part 105 along the width direction of the grooved retainer 1, a length sheet part 106 along the longitudinal direction of the grooved retainer 1, a partition sheet part 107 inclined relative to the width sheet part 105, and another length sheet part 108 from the end in this order via valley forming folding line or ridge forming folding line. The lines are formed along the width direction of the sheet.

In this configuration, the end leg 10*b* has four hollow portions 100, which are arranged in parallel along the depth direction of the end support member 1 in opposed posture.

At one end of one of the end support members 2 (left side of FIG. 43), the end of the outside sheet 21 is continuous to the outside sheet part 114 of the side reinforcing part 11*b* of one end (left side of FIG. 43) of the side wall sheet 11*a* via the connecting sheet part 26*a*.

The side reinforcing part 11*b* of the other end of the one side wall 11*a* is continuous to one end leg 10*b* of the raised bottom sheet 10 via the connecting sheet part 11*b*.

The other end leg 10*b* of the raised bottom sheet 10 is continuous to the outside sheet part 114 of the side reinforcing part 11*b* positioned at the corresponding end of the other side wall 11. The side reinforcing part 11*b* positioned at the other end of the other side wall 11 is continuous to the end of the outside part 21 of the other end support member 2 via the connecting sheet part 11*c*.

According to the cushioning material of the 24th embodiment, as above-mentioned, since one end support member 2, one side wall 11, the raised bottom 10 and the other end support member 2 are continuous in this order, and the hollow portion 20 of each support member 2, the hollow portion 110 of each side reinforcing part 11*b* and the hollow portion 100 of each end leg 10*b* are formed along the depth direction of the grooved retainer 1 so that the folding lines are formed on the sheet in parallel along the predetermined direction, forming of the folding lines on the sheet and folding of the sheet can be carried out smoothly by mechanical means.

Since the end legs 10*b* of the raised bottom 10 and the side reinforcing parts 11*b* of the side wall 11 are composed of the hollow blocks in the cushioning material of this embodiment, even a somewhat heavy article can be sufficiently supported by the cushioning material and greater cushioning effect can be obtained, when it is packed into the case 5 with the article 4 supported in the state shown in FIG. 4 and the load of the article is mainly applied to the raised bottom 10 or side wall 11.

In addition, since the end legs 10*b* and the side reinforcing parts 11*b* at the opposite sides thereof are so designed that they have the same shapes and sizes in the section orthogonal to their hollow portions 110, 100 and, in the partially developed state, the side reinforcing parts 11*b* are superposed in the direction to extend the end leg 10*b*, mechanical process can be done very smoothly in the manufacturing process of the cushioning material.

In the cushioning material of this embodiment too, the inside wall sheet 25 of each end support member 2 may composed of plural layers.

Other functions, effects and configurations of the 24th embodiment are similar to those of the first embodiment and explanation thereof is omitted.

25th Embodiment

Figure 44:
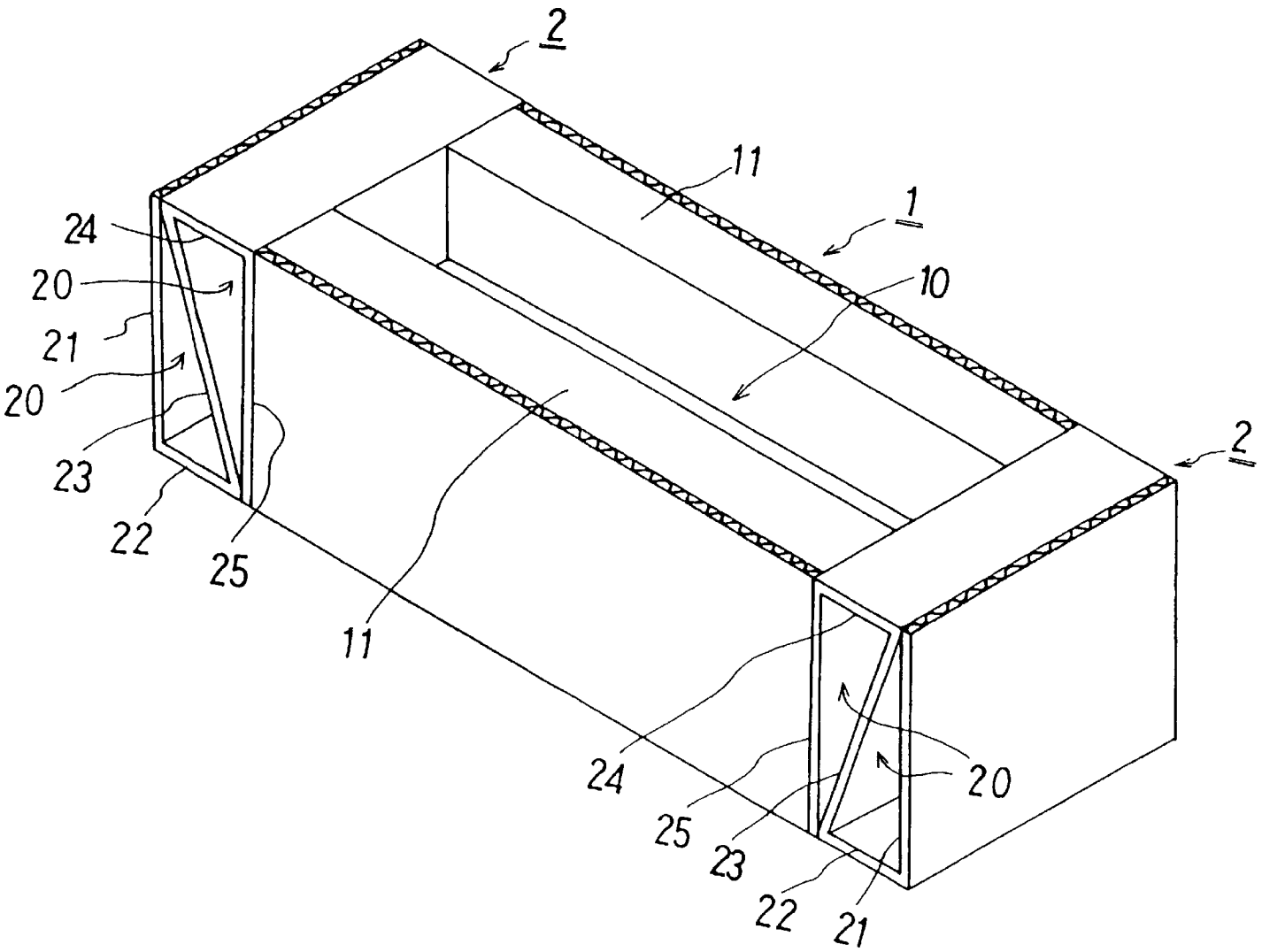
FIG. 44 is a perspective view of a 25th embodiment of the cushioning material for packaging according to the present invention.
Figure 45:
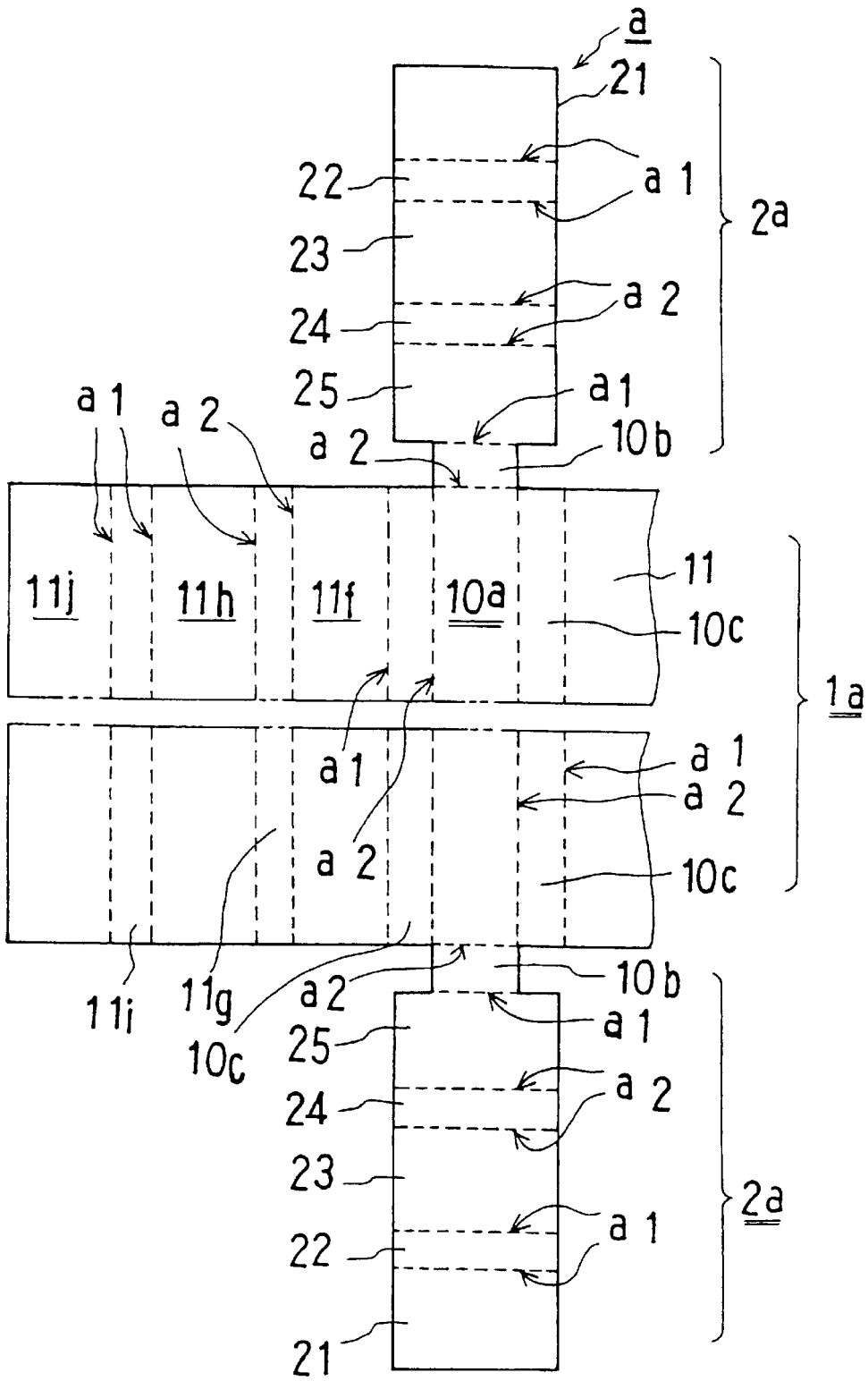
FIG. 45 is a partial plan of the developed cushioning material for packaging of FIG. 44.
Figure 46:
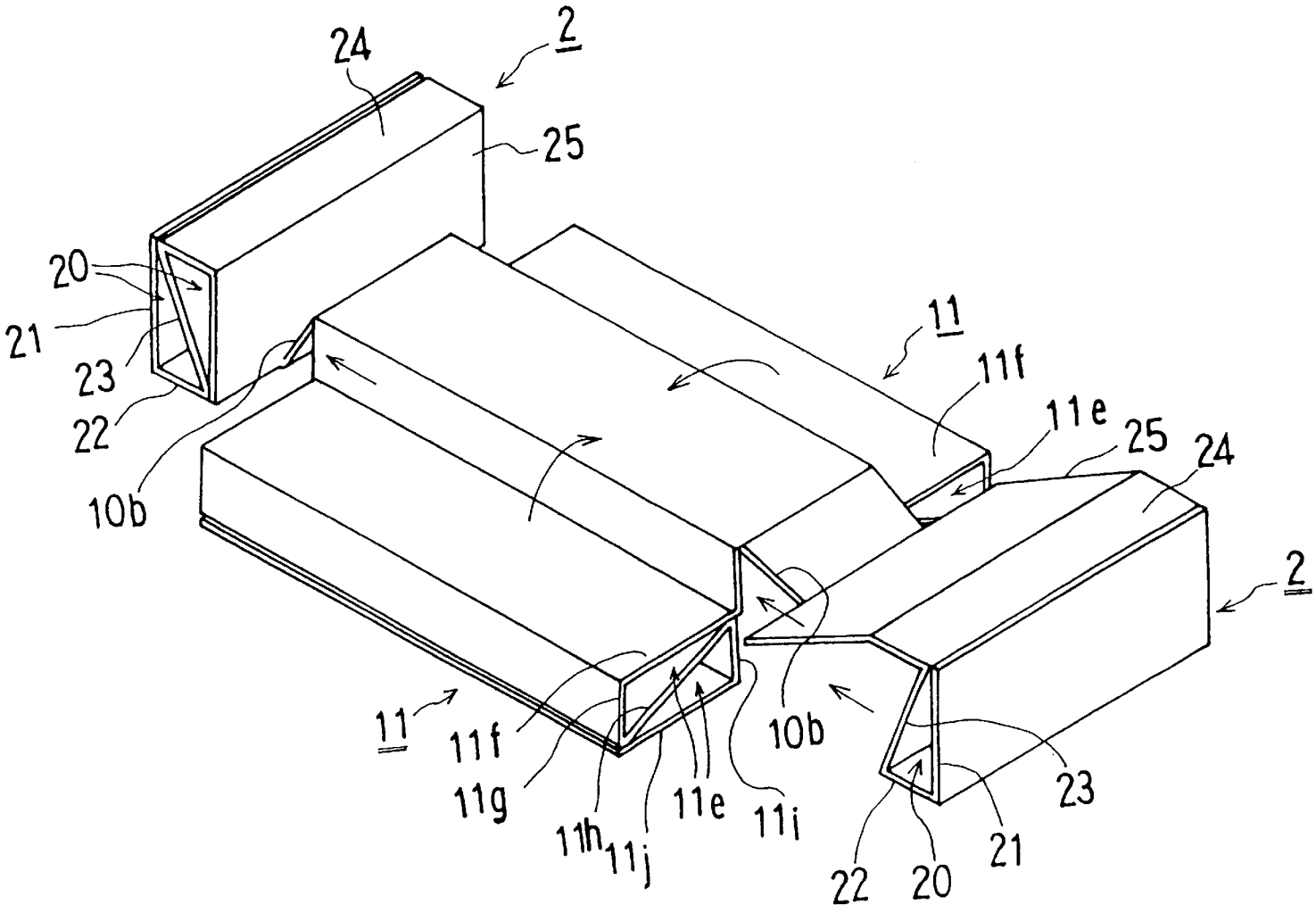
FIG. 46 is a perspective view explaining the fabrication of the cushioning material of FIG. 44.

Yet another embodiment of the cushioning material for packaging corresponding to the fifth aspect of the present invention is shown in FIGS. 44–46.

FIG. 44 is a perspective view of the cushioning material of the 25th embodiment. FIG. 45 is a reduced partial plan view of the developed cushioning material of FIG. 44. FIG. 46 is a perspective view of the cushioning material which is being fabricated.

In this embodiment, the end support members 2 and the raised bottom 10 are constructed approximately similarly to those of the cushioning material shown in FIG. 1.

Each side wall 11, which is continuous to the side of the raised bottom 10, is composed of a hollow body consisting of hollow portions 11*e* arranged along the longitudinal direction of the grooved retainer 1.

As shown in FIG. 45, on the sheet a, which is cut according to the design, there are formed a retainer forming portion 1*a* at the center in the vertical direction of the figure and the support member forming portions 2*a* at the centers of the opposite sides of the retainer forming portion 1*a* respectively.

The support member forming portions 2*a* are constructed similarly to those of the embodiment shown in FIG. 2.

At the center of the width direction of the support forming portion 1*a*, there is formed a raised bottom sheet part 10*a*. The raised bottom sheet part 10*a* has end legs 10*b* at the opposite ends thereof via ridge forming folding lines a2 and side legs 10*c* at the opposite sides thereof via ridge forming folding lines a2. Each end leg 10*b* is continuous to the center of the inside sheet part 25 of each support member forming portion 2 via valley forming folding line a1.

In the retainer forming portion 1*a*, an inside sheet part 11*f*, a top sheet part 11*g*, a partition sheet part 11*h*, a bottom sheet part 11*i* and an outside sheet part 11*j* are formed sequentially in this order at the side of each side leg 10*c* via valley forming folding line a1 or ridge forming folding line a2.

After imparting the directional permanency of folding along the folding lines a1, a2, the sheet a is folded along the folding lines a1, a2 by the folding apparatus (not shown in the figure). Then the end support members 2 and the side walls 11 are made into solid bodies and necessary portions are bonded. Further, the side walls 11 and end support members 2 are made erect so as to in contact with the raised bottom 10, whereby the cushioning material is fabricated. In this fabricated state, necessary and minimum portions are bonded or bound by the band 7 as shown in FIG. 1.

The hollow portions 11*e*, 11*e* of each side wall 11 are arranged along the longitudinal direction in opposed manner and have sectional shapes of the right angled triangles. Therefore, each side wall 11 has rectangular sectional shape.

According to the cushioning material of the 25th embodiment, since the side wall 11 is composed of a plurality of hollow portions 11*e*, it is not likely to deform. Especially, since the hollow portions 11*e* have sectional shapes of the opposed right angled triangles, the side wall 11 having the sectional shape of square or rectangular is readily machinable.

In addition, since each side wall 11 is composed of aforementioned hollow body, an article can be supported and protected steadily and excellent cushioning effect can be obtained, when the load of the article is mainly applied to the side wall 11.

In this embodiment, the inside sheet part 25 of the end support member 2 or the side leg 10*c* may be composed of plural layers.

Other functions, effects and configurations of the 25th embodiment are similar to those of the first embodiment and explanation thereof is omitted.

26th Embodiment

Figure 47:
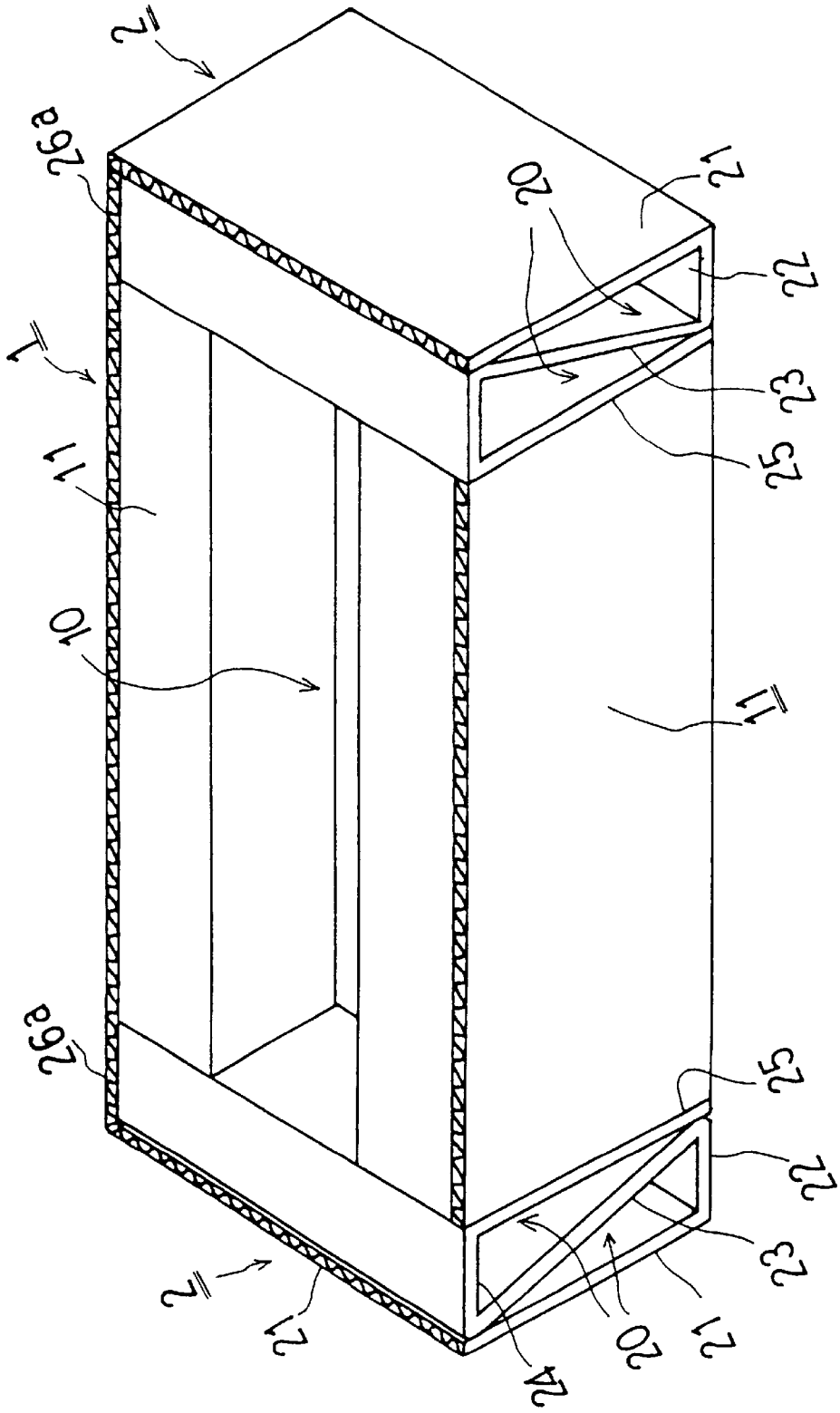
FIG. 47 is a perspective view of a 26th embodiment of the cushioning material for packaging according to the present invention.
Figure 48:
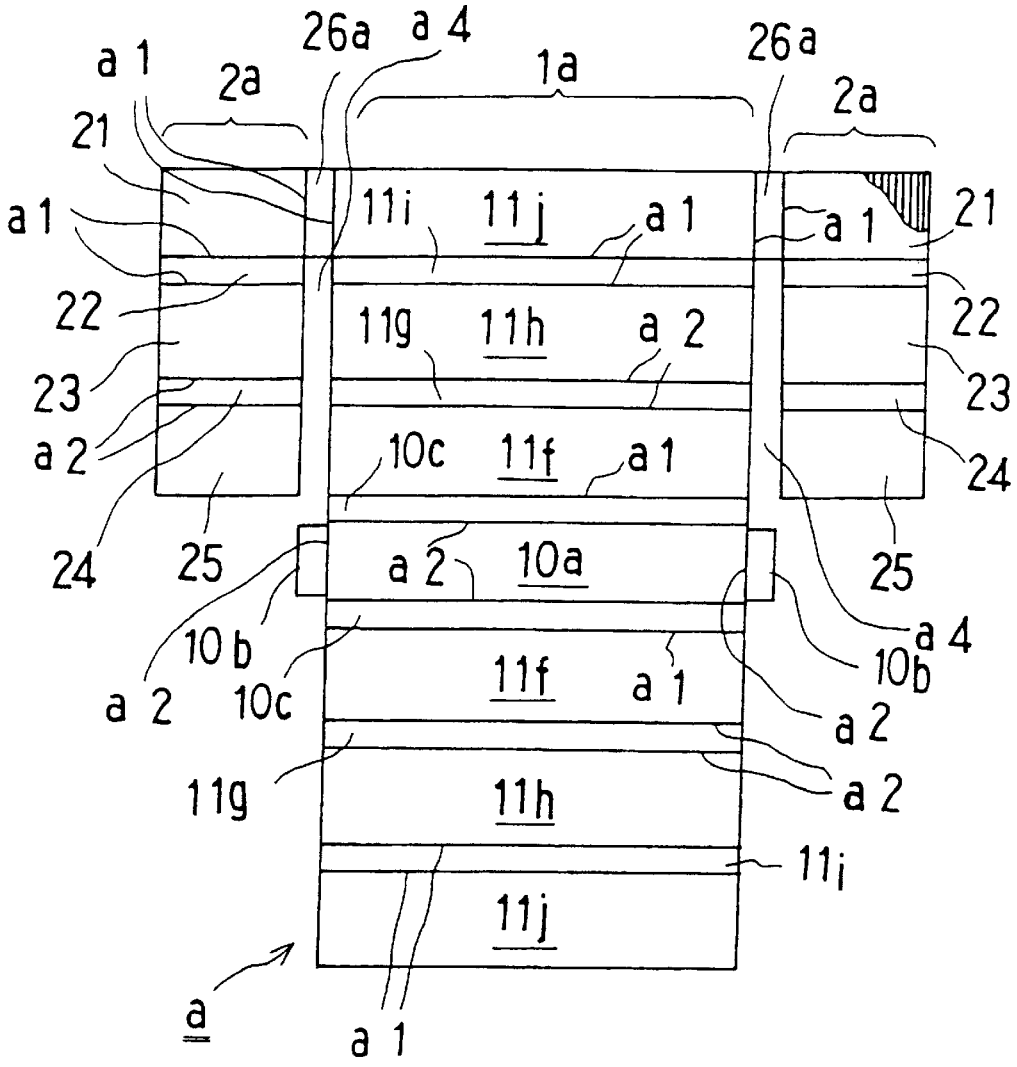
FIG. 48 is a reduced plan view of the developed cushioning material of FIG. 47.
Figure 49:
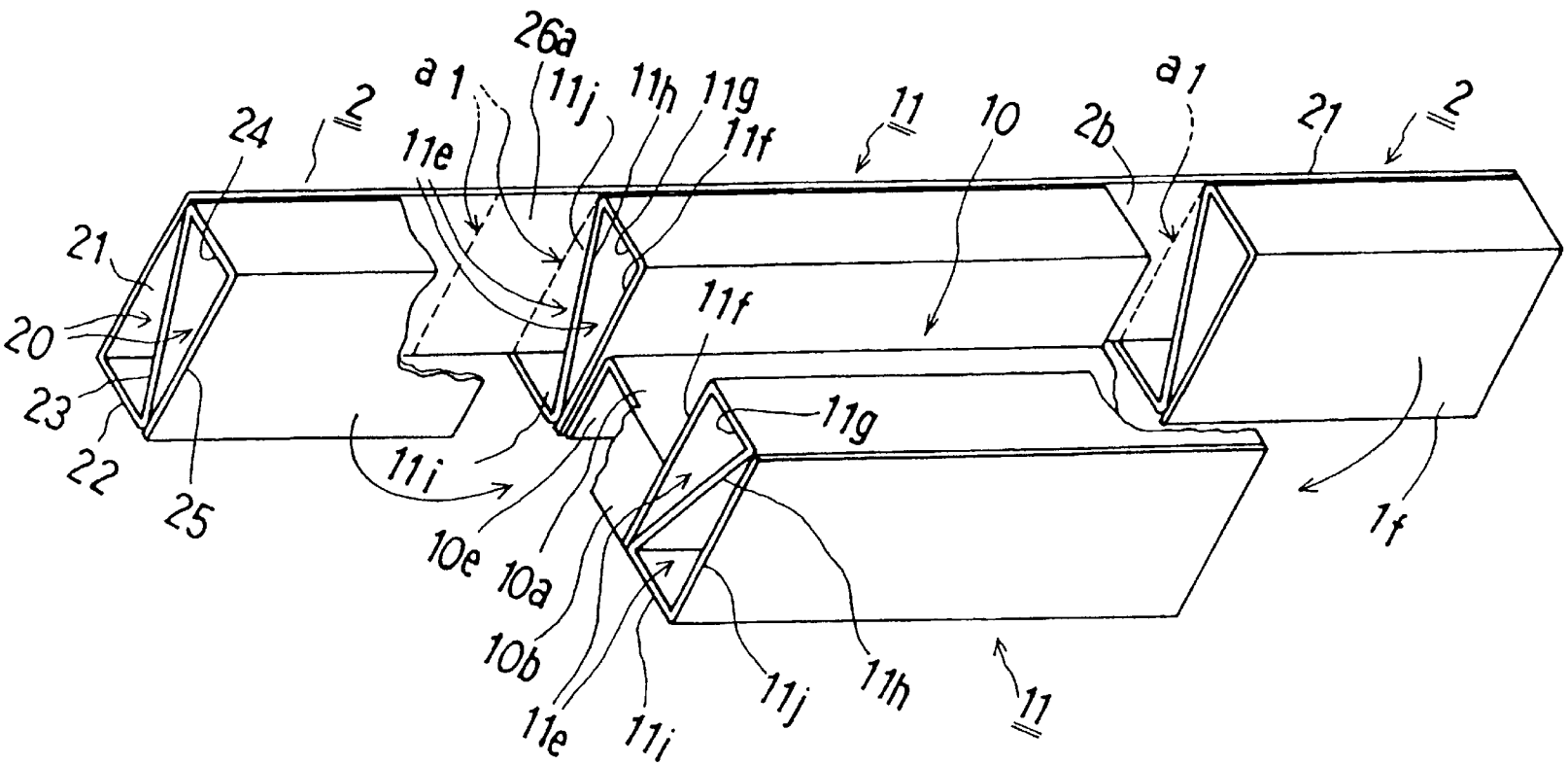
FIG. 49 is a perspective view explaining the fabrication of the cushioning material of FIG. 47.

Another embodiment of the cushioning material for packaging corresponding to the sixth aspect of the present invention is shown in FIGS. 47–49.

FIG. 47 is a perspective view of the cushioning material of the 26th embodiment. FIG. 48 is a reduced partial plan view of the developed cushioning material of FIG. 47. FIG. 49 is a partial, cut-away perspective view of the cushioning material of FIG. 47, which is being fabricated.

In the cushioning material of this embodiment, the end support members 2, the side walls 11 and the raised bottom 10 are constructed almost similarly to those of the cushioning material shown in FIG. 1. However, arrangement of each component is different and, therefore, the configuration of the developed sheet a is different.

As shown in FIG. 48, on the sheet a, which is cut according to the design, there are formed a retainer forming portion 1*a* at the center in the lateral direction (longitudinal direction) in the figure and a support member forming portions 2*a* at the center of one side of the retainer forming portion 1*a*.

On each support member forming portion 2*a*, there are formed, from the upper end of the figure, an outside sheet part 21, a bottom sheet part 22, a partition sheet part 23, a top sheet part 24 and an inside sheet part 25 in this order via valley forming folding line a1 or ridge forming folding line a2.

At the center in the vertical direction of the support forming portion 1*a*, there is formed a raised bottom sheet part 10*a*, which has end legs 10*b*, 10*b* at the opposite ends thereof via ridge forming folding lines a2 and side legs 10*c*, 10*c* at the opposite sides thereof via ridge forming folding lines a2.

In each side leg 10*c*, 10*c*, there are formed continuously an inside sheet part 11*f*, a top sheet part 11*g*, a partition sheet part 11*h*, a bottom sheet part 11*i* and an outside sheet part 11*j* via valley forming folding lines a1 or ridge forming folding lines a2 respectively.

The opposite ends of one of outside sheet parts 11*j* are each continuous to each outside sheet part 21 of the support member forming portion 2*a* via valley forming folding line a1, connecting sheet part 26*a* and valley forming folding line a1. Punched portions are designated by a4.

After the sheet a is thus prepared and the directional permanency of folding is imparted to the sheet along the folding lines a1, a2, the sheet a is folded along the folding lines a1, a2 by the folding apparatus (not shown in the figure). Then the end support members 2 and the side walls 11 are made into solid bodies and necessary portions are bonded. Further, the side walls 11 and end support members 2 are made erect so as to contact with the raised bottom 10, whereby the cushioning material is fabricated. In this state, necessary and minimum portions are bonded or the whole body is bound by a band 7 as shown in FIG. 1.

The hollow portions 11*e*, 11*e* of each side wall 11 are arranged reversely along the longitudinal direction and have sectional shapes of the opposed right-angled triangles. Therefore, each side wall 11 has a rectangular section.

It is so designed that the sectional shape and size of the end support member 2 are the same as those of the each side wall 11 and each end support member 2 is laid in the direction to extend the one of the side walls 11, in the partially developed state where the end support members 2 and the side walls 11 are made into solid bodies as shown in FIG. 49.

According to the cushioning material of the 26th embodiment, since each side wall 11 is composed of a plurality of hollow portions 11*e*, it is not likely to deform. Especially, since the hollow portions 11*e* have sectional shapes of the opposed right-angled triangles, the side wall having a square or rectangular sectional shape can be fabricated very easily.

In addition, since each side wall 11 is composed of the aforementioned hollow structure, even a somewhat heavy article can be sufficiently supported by the cushioning material and excellent cushioning effect can be obtained, when the load of the article is mainly applied to the side wall 11.

In the cushioning material of this embodiment, the inside wall sheet 25 of each end support member 2 or the side leg 10*c* may be composed of plural layers.

Other functions, effects and configurations of the 26th embodiment are similar to those of the first embodiment and explanation thereof is omitted.

27th Embodiment

Figure 50:
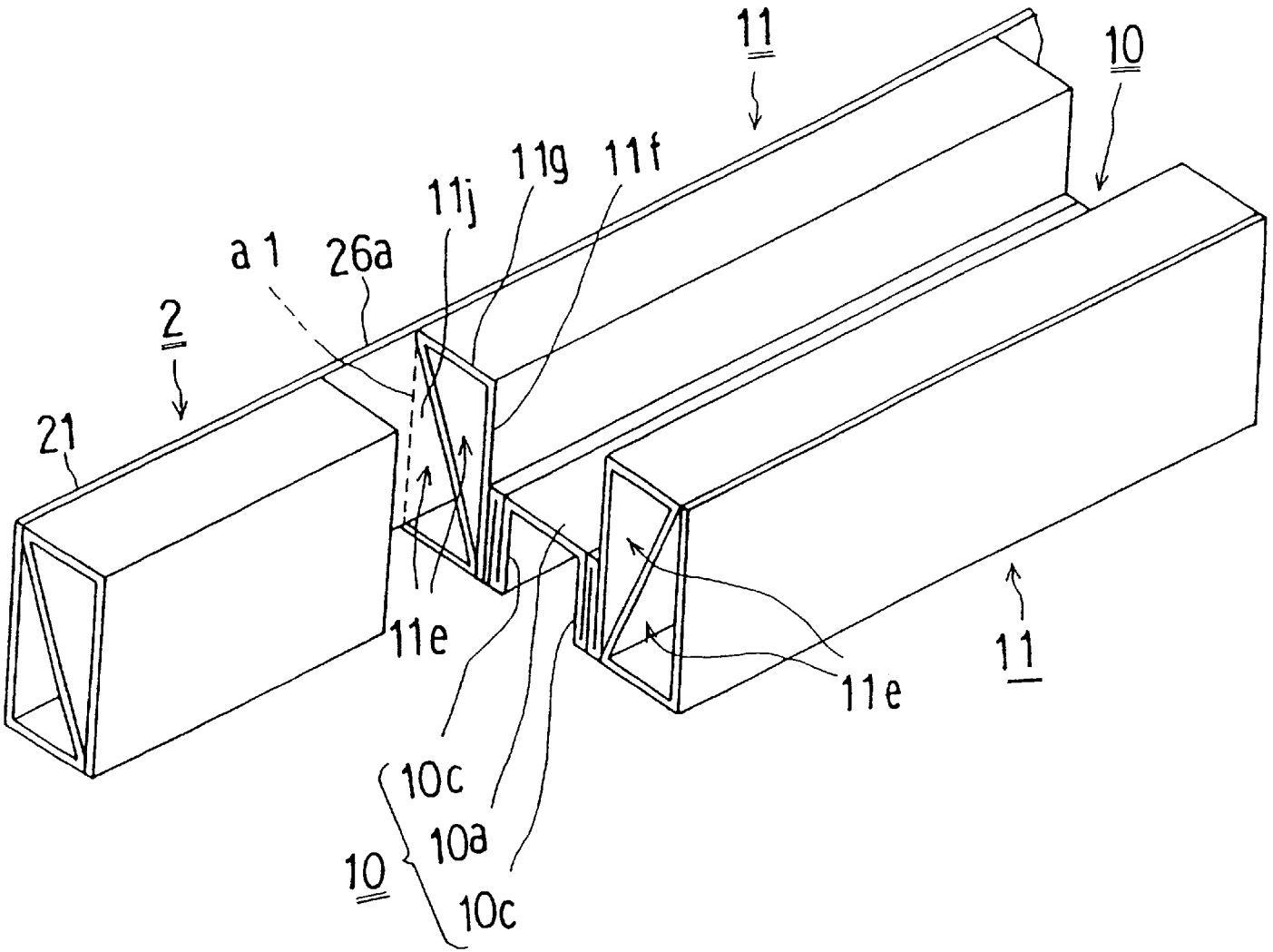
FIG. 50 is a partial perspective view of a 27th embodiment of the cushioning material for packaging according to the present invention.

Another embodiment of the cushioning material for packaging corresponding to the sixth aspect of the present invention is shown in FIG. 50.

A raised bottom portion 10 of the cushioning material of the 27th embodiment consists of a horizontal raised bottom sheet part 10*a* and side legs 10*c* formed downward at the opposite ends of the bottom sheet part 10*a*. Each end leg 10*c* is composed of a layered block which is formed by folding the necessary portion of the sheet upward or downward along the longitudinal direction.

In the cushioning material of this embodiment, as mentioned above, since each side leg 10*c* is composed of plural layers and reinforced thereby, even a somewhat heavy article can be sufficiently supported and protected by the cushioning material and greater cushioning effect can be obtained.

Other functions, effects and configurations of this embodiment are similar to those of the 26th embodiment and explanation thereof is omitted.

28th Embodiment

Figure 51:
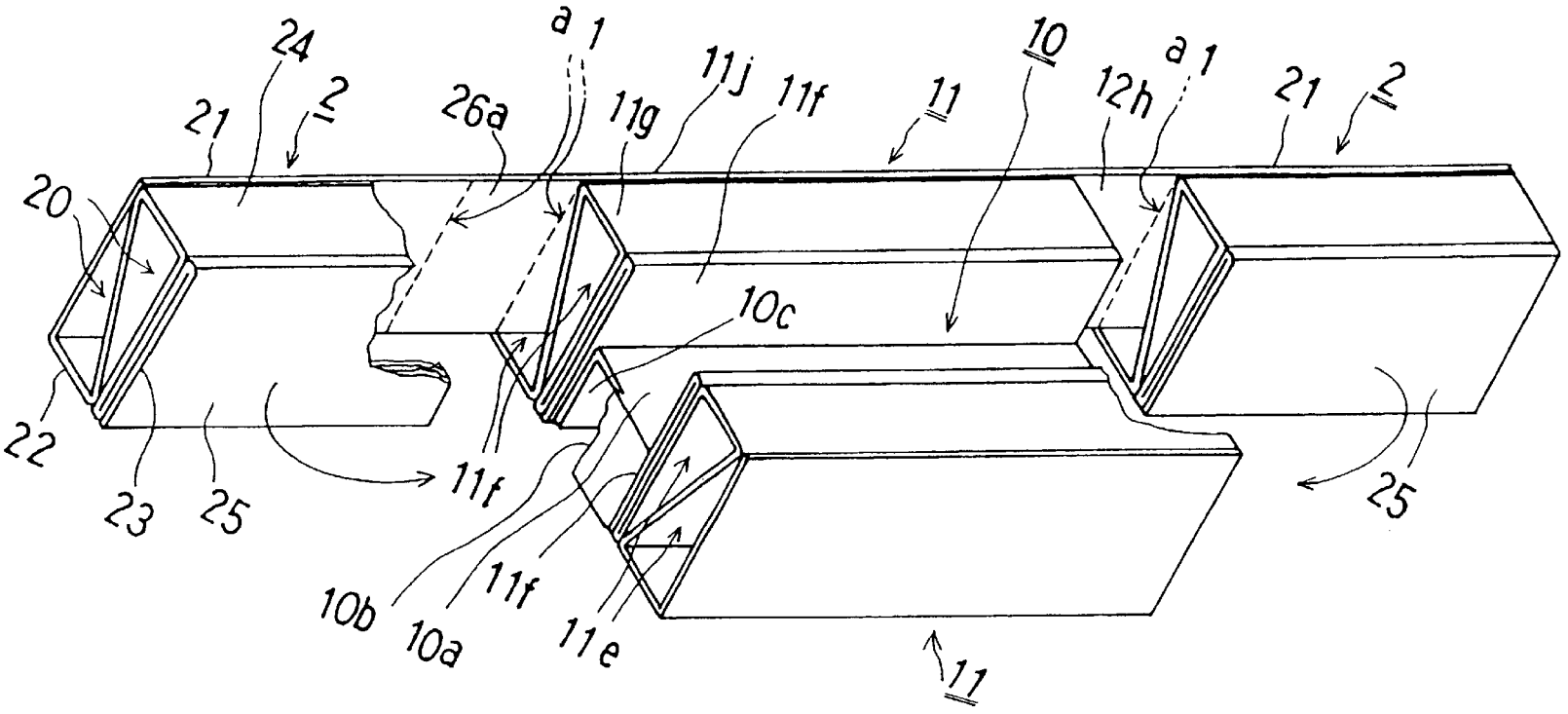
FIG. 51 is a partial, cutaway perspective view of a 28th embodiment of the cushioning material for packaging according to the present invention.

Another embodiment of the cushioning material for packaging corresponding to the sixth aspect of the present invention is shown in FIG. 51.

The side walls 11, end support members 2 and raised bottom portion 10 of the cushioning material of the 28th embodiment are constructed almost similarly to those of the embodiment shown in FIG. 49.

The 28th embodiment, however, is different from the embodiment of FIG. 49 in that the inside sheet part 25 of each end support member 2 and the inside sheet part 11*f* of each side wall 11 are each composed of plural layers, which are formed by folding the necessary portion of the sheet.

In the cushioning material of the 28th embodiment, since the inside sheet parts 25 and 11*f* are composed of plural layers and reinforced thereby, a somewhat heavy article can be sufficiently supported and protected by the cushioning material and greater cushioning effect can be obtained.

Other functions, effects and configurations are similar to those of the 26th embodiment and explanation thereof is omitted.

29th Embodiment

Figure 52:
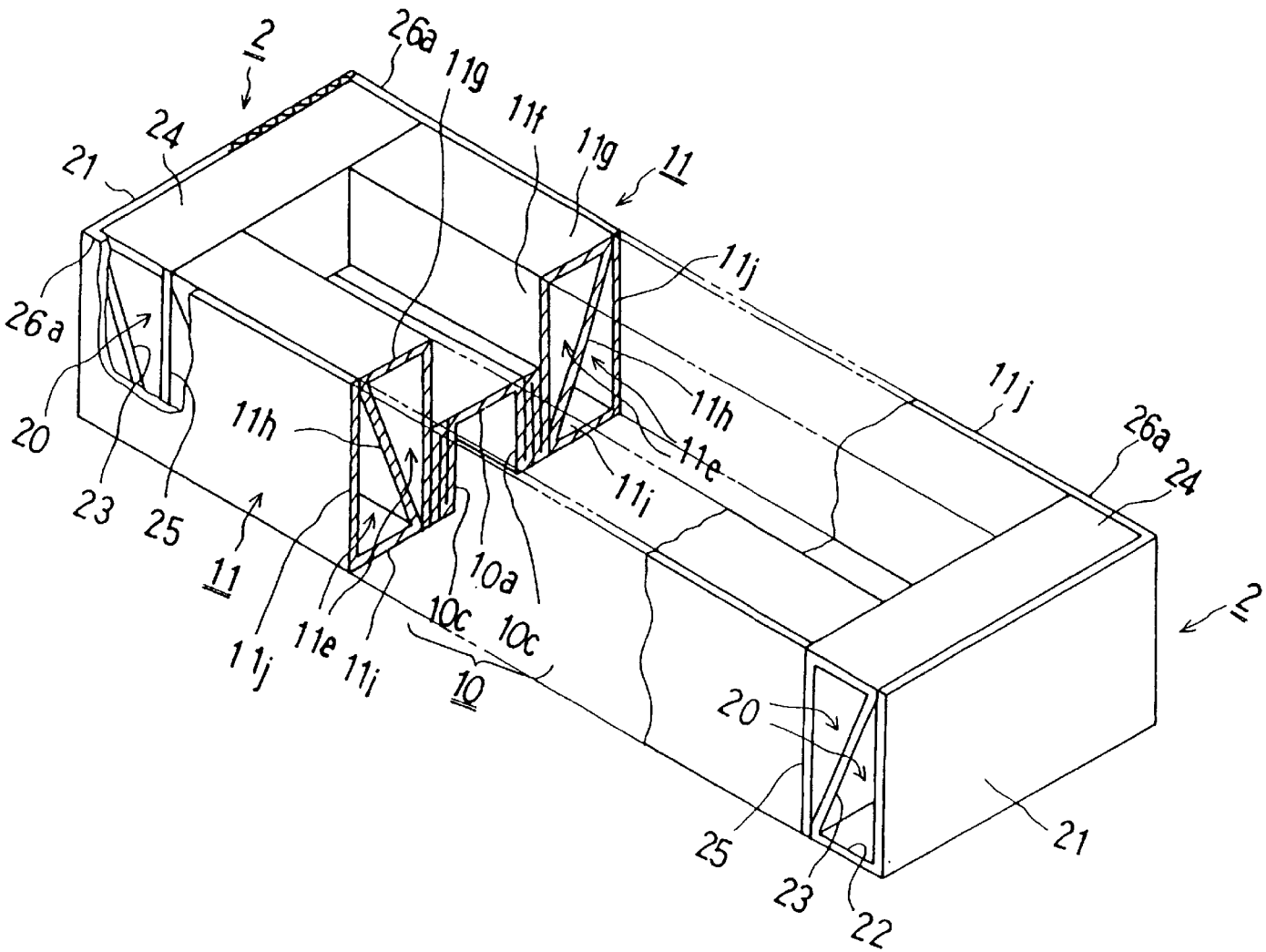
FIG. 52 is a partial, cutaway perspective view of a 29th embodiment of the cushioning material for packaging according to the present invention.

Another embodiment of the cushioning material for packaging corresponding to the twelfth aspect of the present invention is shown in FIG. 52.

The end support members 2 and the side walls 11 of the cushioning material of this embodiment are constructed almost similarly to those of the cushioning material of FIG. 49. The raised bottom 10 is constructed almost similarly to that of the cushioning material of FIG. 50.

In this embodiment, however, each of the opposite ends of the outside sheet part 21 in one of the end support members 2 is continuous to the outside sheet part 11*j* of the corresponding side wall 11 via the connecting sheet part 26*a*. The outside sheet part 11*j* at the other end of one of the side walls 11 is continuous to the outside sheet part 21 of the other end support member 2 via connecting sheet part 26*a*.

In addition, one of the side walls 11 (upper side wall in the figure) is continuous to the lower part of the corresponding side leg 10*c* of the raised bottom 10.

In the cushioning material of the 29th embodiment, in the partially developed state where the raised bottom 10, the side walls 11 and the end support members 2 are made into solid bodies, the side walls 2 and the end support members 2 are aligned in line and the raised bottom 10 is arranged in parallel to one of the side walls 11. Accordingly, mechanical processing of formation of the folding lines and fabrication of every components can be done very smoothly.

In this embodiment, the inside sheet part 25 of the end support member 2 may be composed of plural layers.

Other functions, effects and configurations of the 29th embodiment are similar to those of the embodiment of FIG. 50 and explanation thereof is omitted.

In the cushioning materials of the embodiments shown in FIGS. 13–17 and 19–21 too, the side wall 11 may be composed of a hollow body having the above-mentioned hollow portions 11*e*.

30th Embodiment

Figure 53:
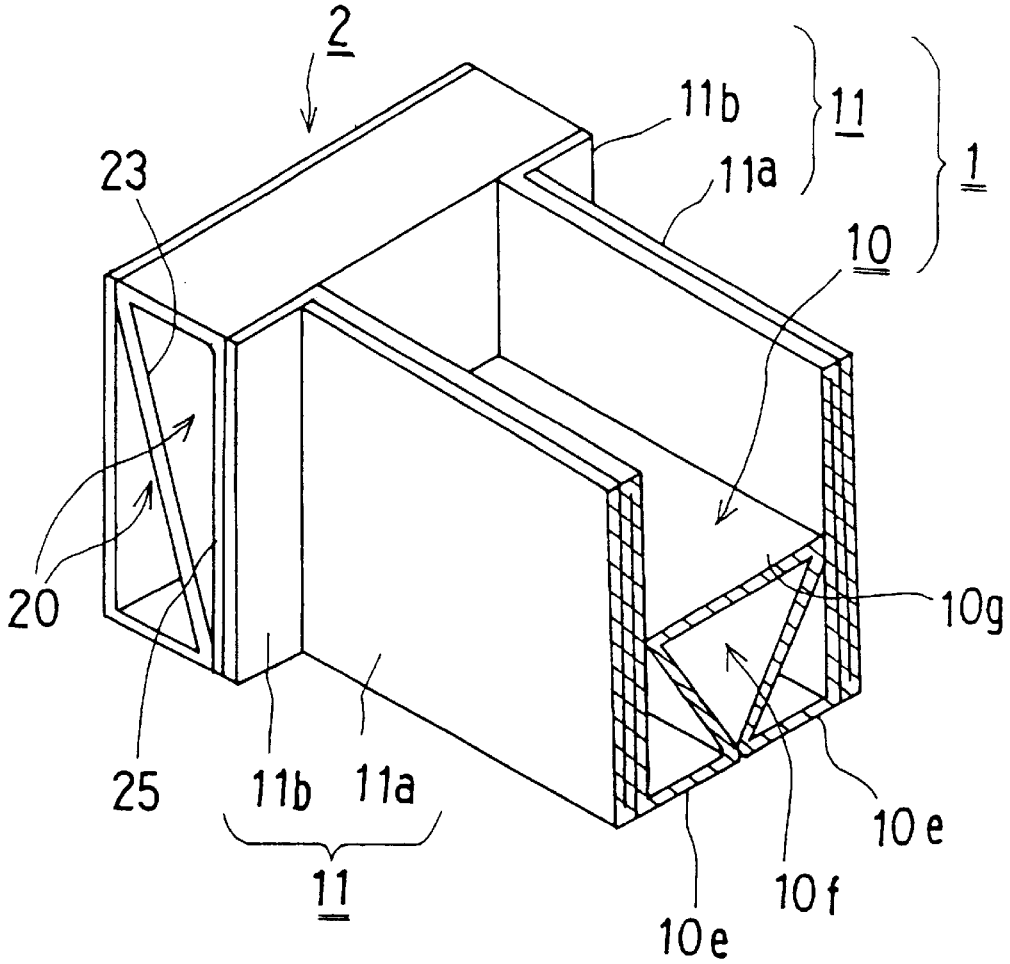
FIG. 53 is a partial perspective view of a 30th embodiment of the cushioning material for packaging according to the present invention.

Another embodiment of the cushioning material for packaging corresponding to the fifth aspect of the present invention is shown in FIG. 53.

The end support members 2 are constructed almost similarly to those of the embodiment of FIG. 1.

The side walls 11 are constructed almost similarly to those of the embodiment of FIG. 8. Each side wall consists of the side wall sheet part 11*a* made of a plurality of layers formed by folding the necessary portion of the sheet, and the side reinforcing parts 11*b*, each of which is continuous to the inside sheet part 25 of the corresponding end support member 2 at either side of the side wall sheet part 11*a*.

The raised bottom 10 consists of a hollow body, which has a hollow portion 10*f* along the longitudinal direction of the grooved retainer 1 and a sectional shape of a reversed triangle. At the opposite lower ends of the top sheet part 10*g* of the raised bottom 10, there are formed end legs 10*b* as will be shown in FIG. 57. The top sheet part 10*g* is continuous to the lower portion of each end support member 2 via the end leg 10*b*.

The opposite lower sides of the raised bottom 10 are respectively continuous to the lower ends of the side wall sheet parts 11*a* via connecting sheet parts 10*e*, which are formed laterally and continuously to each of the lower sides.

According to the 30th embodiment, since the raised bottom 10 is composed of the hollow body as mentioned above, even a somewhat heavy article can be supported and protected steadily and greater cushioning effect can be obtained, when it is used in a condition where the load of the article is mainly applied to the raised bottom 10.

In addition, since the side wall sheet part 11*a* is composed of plural layers, an article can be supported steadily and greater cushioning effect can be obtained even if the load is applied to the side wall 11.

In this embodiment, the inside sheet part 25 of the end support member 2 may be composed of plural layers.

Other functions, effects and configurations of this embodiment are similar to those of the first embodiment and explanation thereof is omitted.

31st Embodiment

Figure 54:
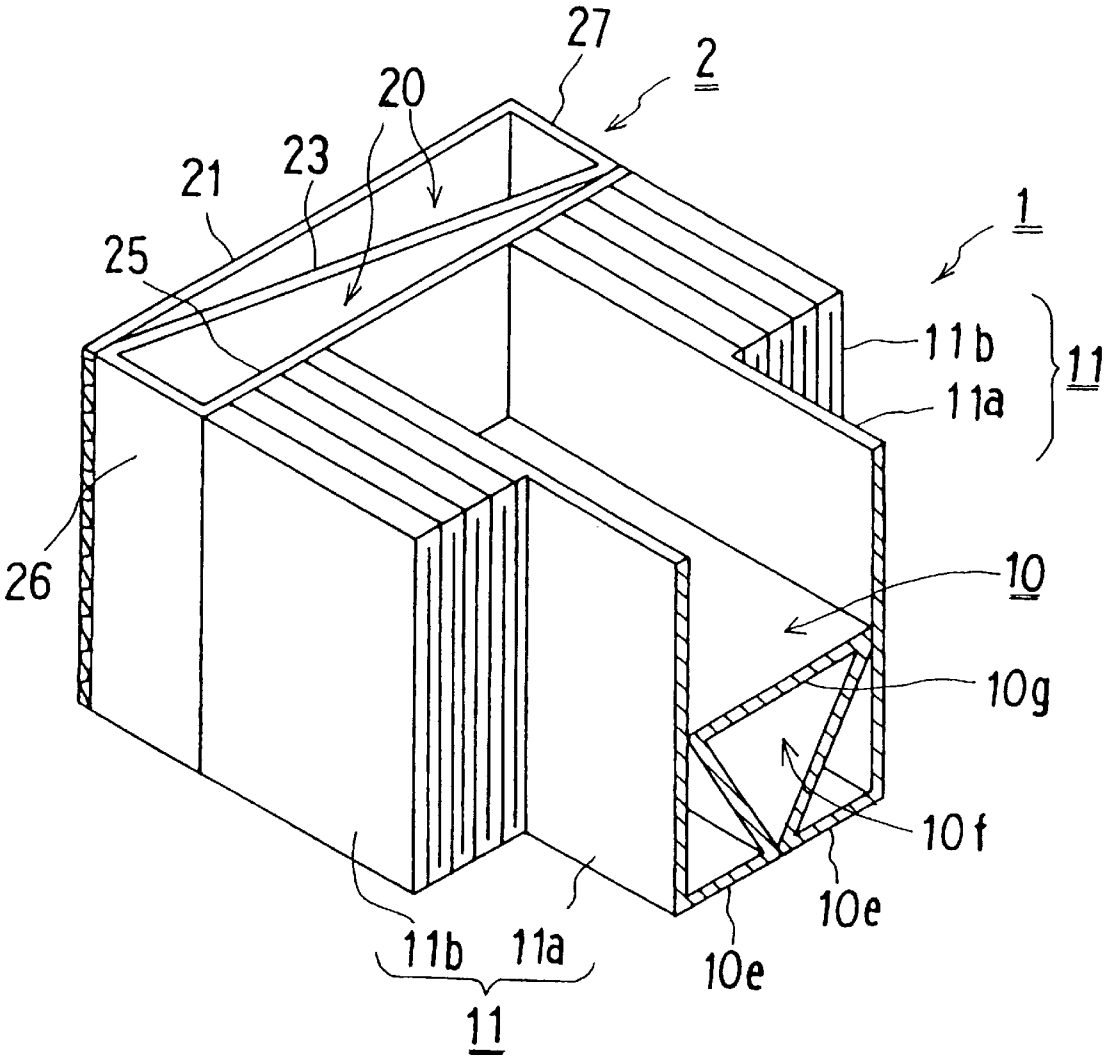
FIG. 54 is a partial perspective view of a 31st embodiment of the cushioning material for packaging according to the present invention.

Another embodiment of the cushioning material for packaging corresponding to the fifth aspect of the present invention is shown in FIG. 54.

Figure 20:
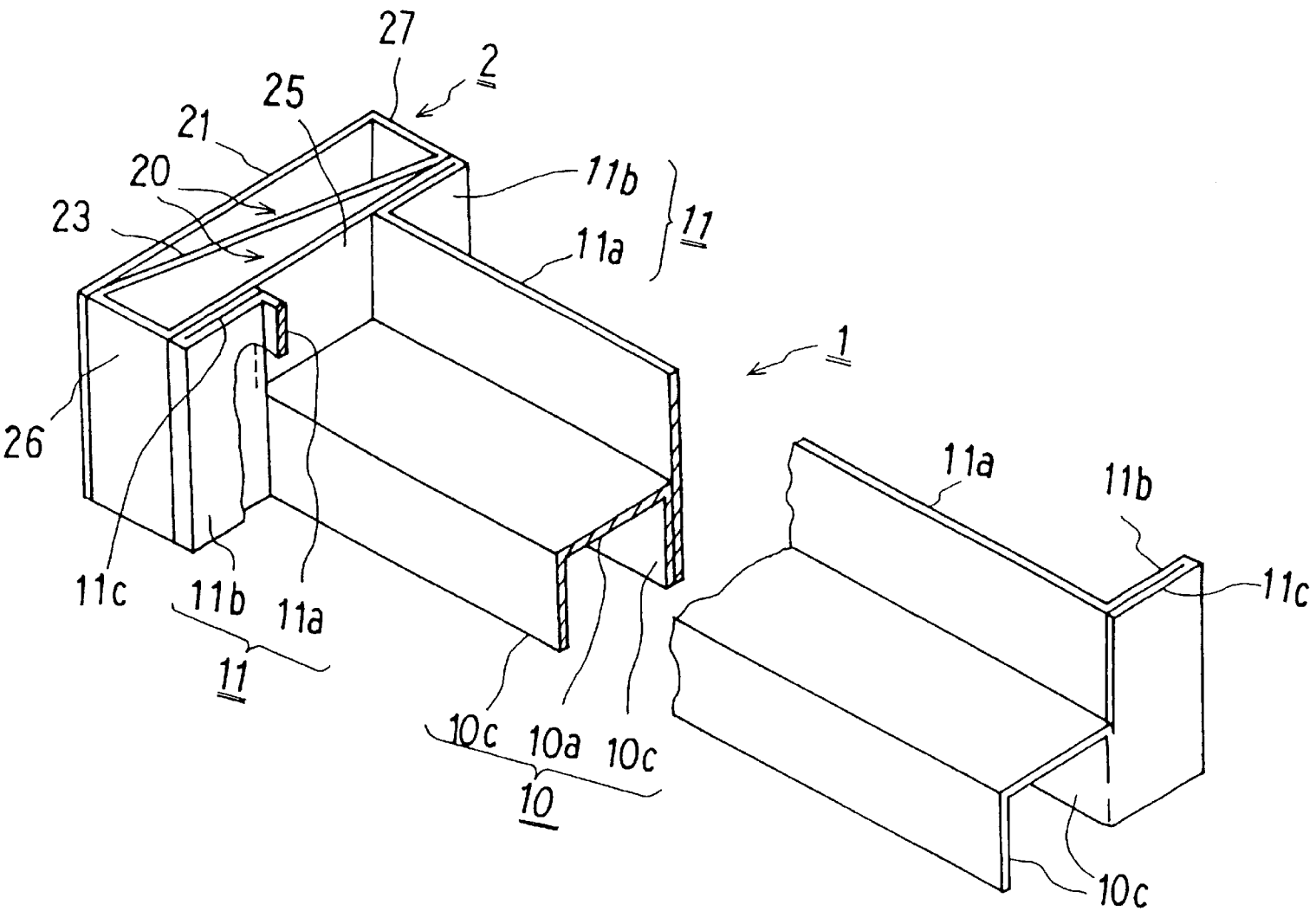
FIG. 20 is a partial, cutaway perspective view of the cushioning material of FIG. 19.

The end support members 2 are constructed almost similarly to those of the embodiment of FIG. 20 and the raised bottom 10 is constructed almost similarly to those of the embodiment of FIG. 53.

Figure 57:
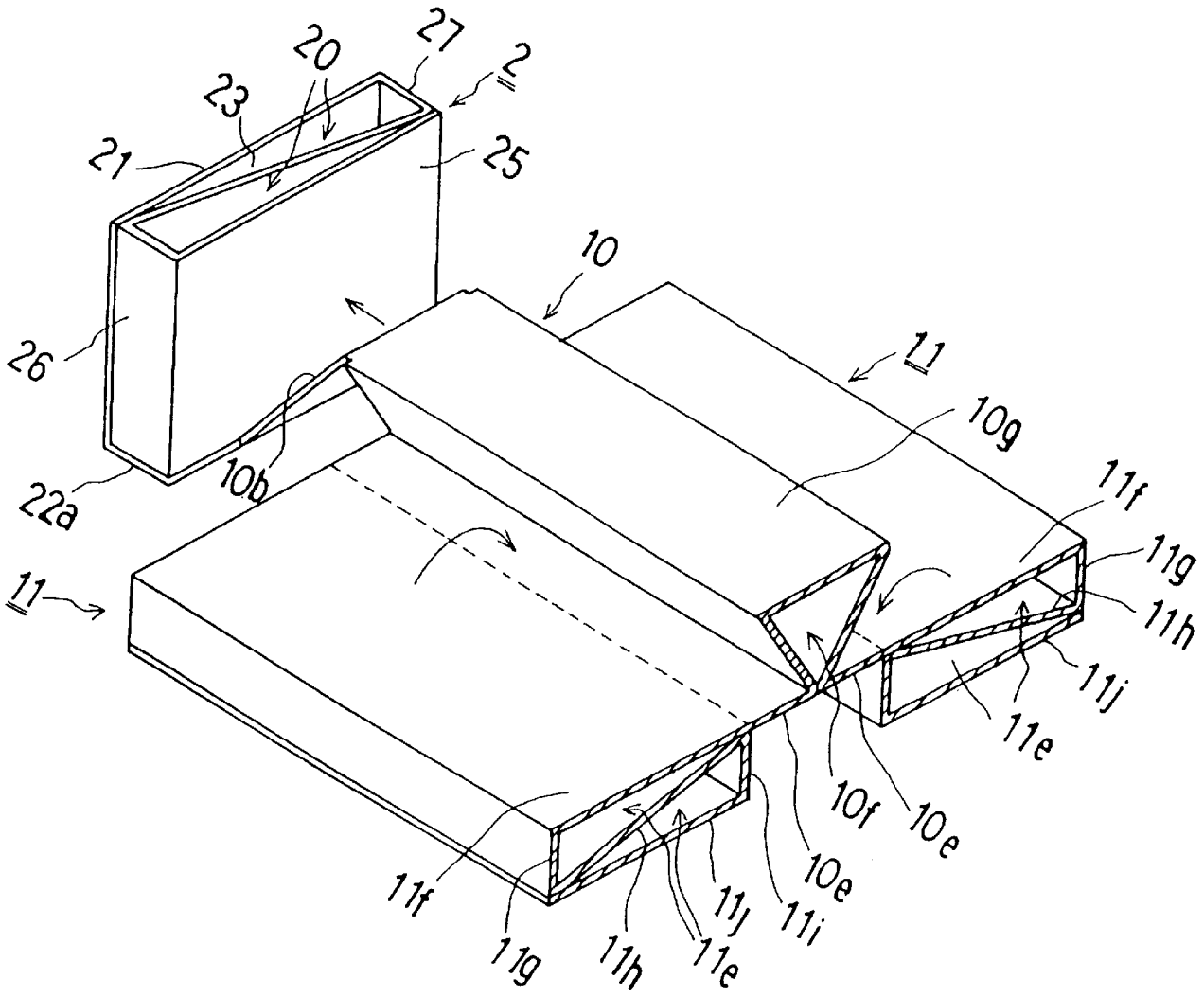
FIG. 57 is a partial perspective view explaining the fabrication of a 34th embodiment of the cushioning material for packaging according to the present invention.

At the opposite lower ends of the top sheet part 10*g*, there are formed continuously the end legs (10*b*) similarly to those as will be shown in FIG. 57. The lower part of the inside sheet part 25 of each end support member is continuous to the top sheet part 10*g* via the end leg.

Each side wall 11 consists of an approximately vertical side wall sheet part 11*a* and the side reinforcing parts 11*b* at the opposite sides of the side wall sheet part 11*a*. Each side reinforcing part 11*b* is composed of a layered block, which is formed by folding a necessary part of the sheet in zigzag in the vertical direction.

The lower end of each side wall sheet part 11*a* is continuous to the lower end of the raised bottom 10 via a connecting sheet part 11*e*, which is formed continuously and laterally to each lower side of the raised bottom 10.

According to the 31st embodiment, since the raised bottom 10 is composed of the hollow block as mentioned above and each side reinforcing part 11*b* is composed of the multiple-layered block, an article can be supported and protected by the cushioning material more steadily and greater cushioning effect can be obtained.

In this embodiment, the inside sheet part 25 of the end support member 2 may be composed of plural layers.

Other functions, effects and configurations of the 31st embodiment are similar to those of the first embodiment and explanation thereof is omitted.

32nd Embodiment

Figure 55:
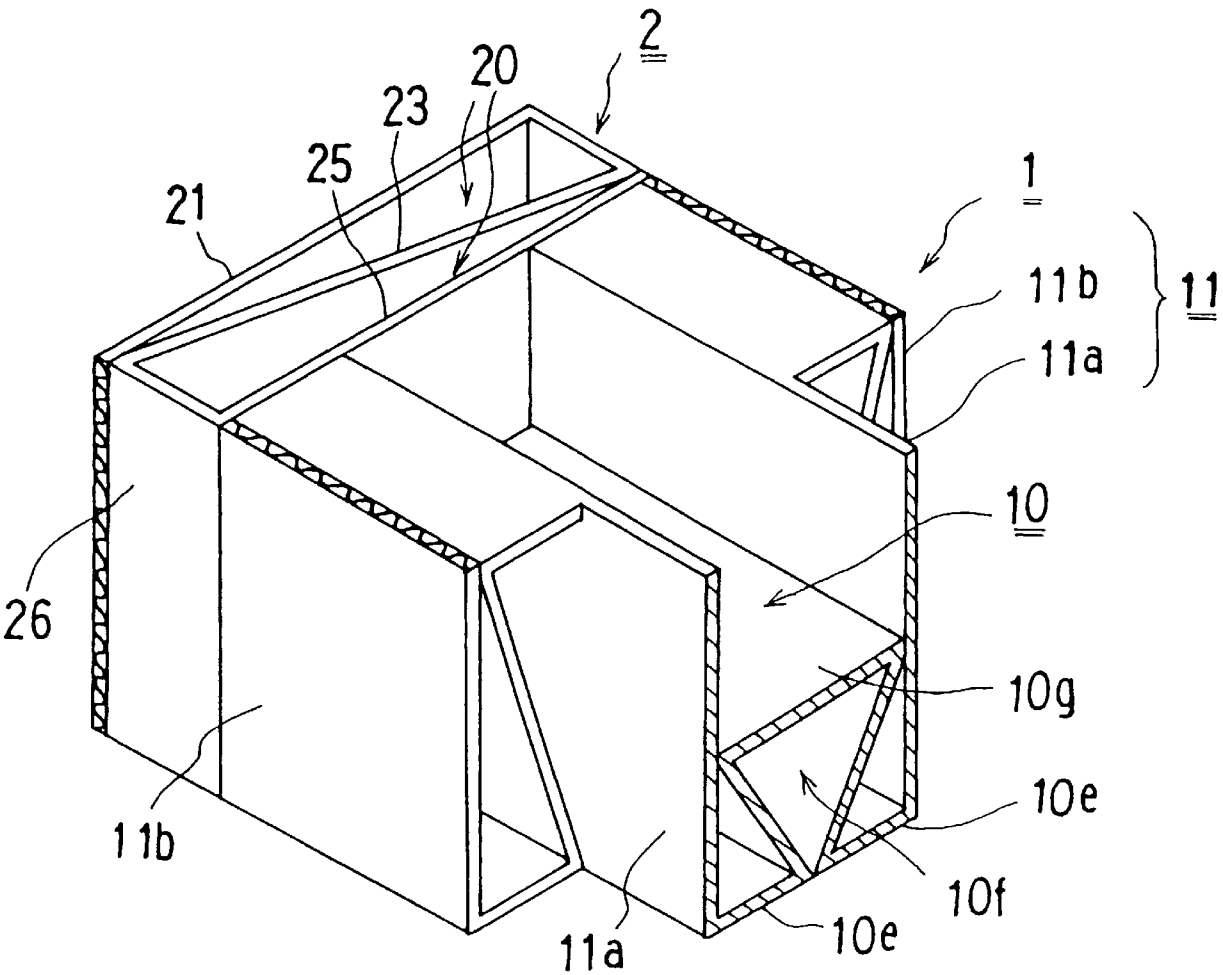
FIG. 55 is a partial perspective view of a 32nd embodiment of the cushioning material for packaging according to the present invention.

Another embodiment of the cushioning material for packaging corresponding to the fifth aspect of the present invention is shown in FIG. 55.

The end support members 2 and the raised bottom 10 are constructed almost similarly to those of the embodiment of FIG. 54 and the raised bottom 10 is constructed almost similarly to those of the embodiment of FIG. 53.

Each side wall 11 consists of an approximately vertical side wall sheet part 11*a* and the side reinforcing parts 11*b* formed at the opposite sides of the side wall sheet part 11*a*. Each side reinforcing part 11*b* is composed of a hollow block similarly to the side reinforcing parts 11*b* of the embodiment shown in FIG. 38.

The manner (structure) in which the raised bottom sheet 10 is continuous to the side walls 11 and that in which the raised bottom sheet 10 is continuous to the end support members 2 are the same as those of the embodiment shown in FIG. 54.

According to the 32nd embodiment, since the raised bottom 10 is composed of the hollow block as mentioned above and, in addition, each side reinforcing part 11*b* is composed of the hollow block, an article can be supported and protected by the cushioning material more steadily and greater cushioning effect can be obtained.

In this embodiment, the inside sheet part 25 of the end support member 2 may be composed of plural layers.

Other functions, effects and configurations of the 32nd embodiment are similar to those of the first embodiment and explanation thereof is omitted.

33rd Embodiment

Figure 56:
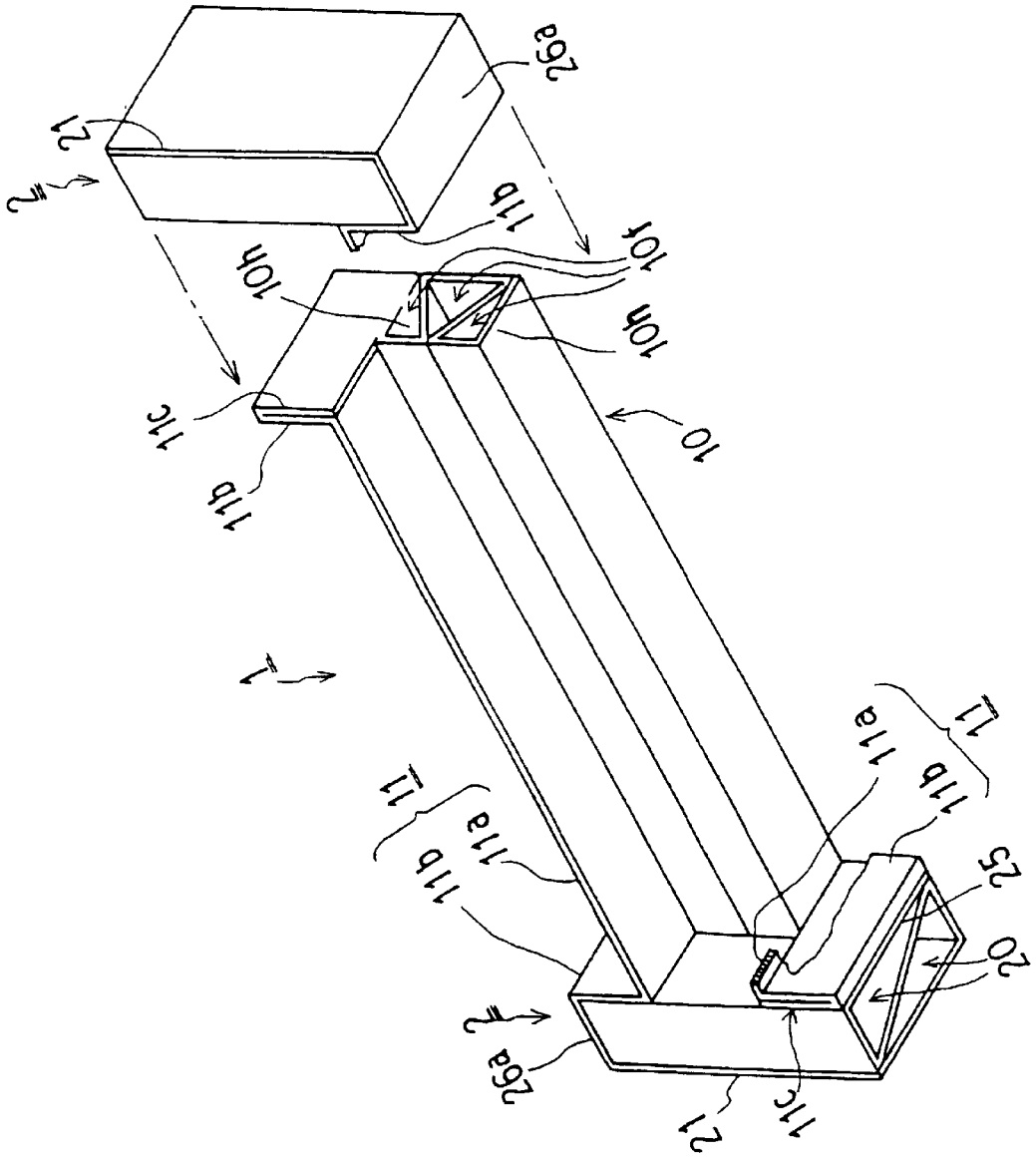
FIG. 56 is a partial, cutaway perspective view of a 33rd embodiment of the cushioning material for packaging according to the present invention.

Another embodiment of the cushioning material for packaging corresponding to the thirteenth aspect of the present invention is shown in FIG. 56.

In this embodiment, each end support member 2, 2 is constructed almost similarly to that of the cushioning material of FIG. 47 and each side wall 11 is constructed almost similarly to that of the cushioning material of FIG. 20.

The raised bottom 10 is composed of a hollow body, which has a hollow portion 10*f* of an equilateral or isosceles triangular section at the center thereof and hollow portions 10*g* at the opposite sides of the hollow portion 10*f*. The hollow portions 10*g*, each having a section of right-angled triangle, are arranged in parallel along the longitudinal direction of the raised bottom 10. The raised bottom 10 has length sheet parts 10*h* at the opposite sides thereof.

One end of the inside sheet part 25 of one of the end support members 2 is continuous to the side reinforcing part 11*b* at one end of one of the side wall sheet parts 11*a* via the connecting sheet part 26*a*. One end of one of the length sheet parts 10*h* of the raised bottom 10 is continuous to the side reinforcing part 11*b* of the other end of the one side wall 11 via the connecting sheet part 11*c*.

The other length sheet part 10*h* at the other end of the raised bottom 10 is continuous to the side reinforcing part 11*b* at the corresponding end of the other side wall 11 via the connecting sheet part 11*c*. The side reinforcing part 11*b* at the other end of the other side wall 11 is continuous to the outside sheet part 21 via the connecting sheet part 26*a* at the corresponding end of the other end support member 2.

According to the 33rd embodiment, since the raised bottom 10 is composed of the hollow block as mentioned above, even a somewhat heavy article can be supported and protected more steadily and greater cushioning effect can be obtained, when the cushioning material is used in condition where the load of the article is mainly applied to the raised bottom 10.

In this embodiment too, the inside sheet part 25 of the end support member 2 or the side wall sheet part 11*a* may be composed of plural layers.

In addition, the side reinforcing part 11*b* may be composed of the layered block or hollow block having a rectangular section.

Other functions, effects and configurations of this embodiment are similar to those of the embodiment of FIG. 53 and explanation thereof is omitted.

In the cushioning materials of the embodiments of FIGS. 10–18, the raised bottom 10 thereof may be composed of a hollow body having a proper number of hollow portions along the certain direction, for example, as the raised bottom of the 33rd embodiment.

In the cushioning materials of the embodiments of FIGS. 10–18, the raised bottom 10 may be composed of the above-mentioned hollow body and, in addition, the side reinforcing parts of the side wall 11 may be composed of a layered block or hollow block.

34th Embodiment

Yet another embodiment of the cushioning material for packaging corresponding to the fifth aspect of the present invention is shown in FIG. 57.

In this cushioning material, the end support members 2 and the raised bottom 10 are each composed of a hollow body similar to those of the embodiment of FIG. 55. Each side wall 11 is composed of a hollow body similar to that of the embodiment of FIG. 46.

Each end support member 2 is continuous to the end of the top sheet part 10*g* of the raised bottom 10 via the connecting sheet part 22*a*, which covers the bottom of the vertical hollow portion 20, and the end leg 10*b* formed at each lower end of the raised bottom 10.

The lower end of the inside sheet part 11*f* of each side wall 11 is continuous to the lower portion of the raised bottom 10 via the connecting sheet part 10*e*, which is formed continuously at each side of the raised bottom 10.

According to the cushioning material of this embodiment, since the raised bottom 10, the side walls 11 and the end support members 2 are each composed of a hollow body having hollow portions of triangular sections 10*f*, 11*e* or 20 respectively, an article can be supported more steadily and greater cushioning effect can be obtained.

In addition, since the hollow portions 10*g*, 11*e*, 20 are arranged in parallel along the longitudinal direction of the grooved retainer in a state where the side walls 11 and the end support members 2 are made into solid bodies and placed flatwise together with the rest of the sheet, mechanical work of forming the folding lines, imparting directional permanency of folding thereto and building the material can be done smoothly.

In this embodiment too, the inside sheet part 25 of each end support member 2 and the inside sheet 11*f* of each side wall 11 may be composed of plural layers to reinforce these parts.

Other functions, effects and configurations of the 34th embodiment are similar to those of the first embodiment and explanation thereof is omitted.

35th Embodiment

Figure 58:
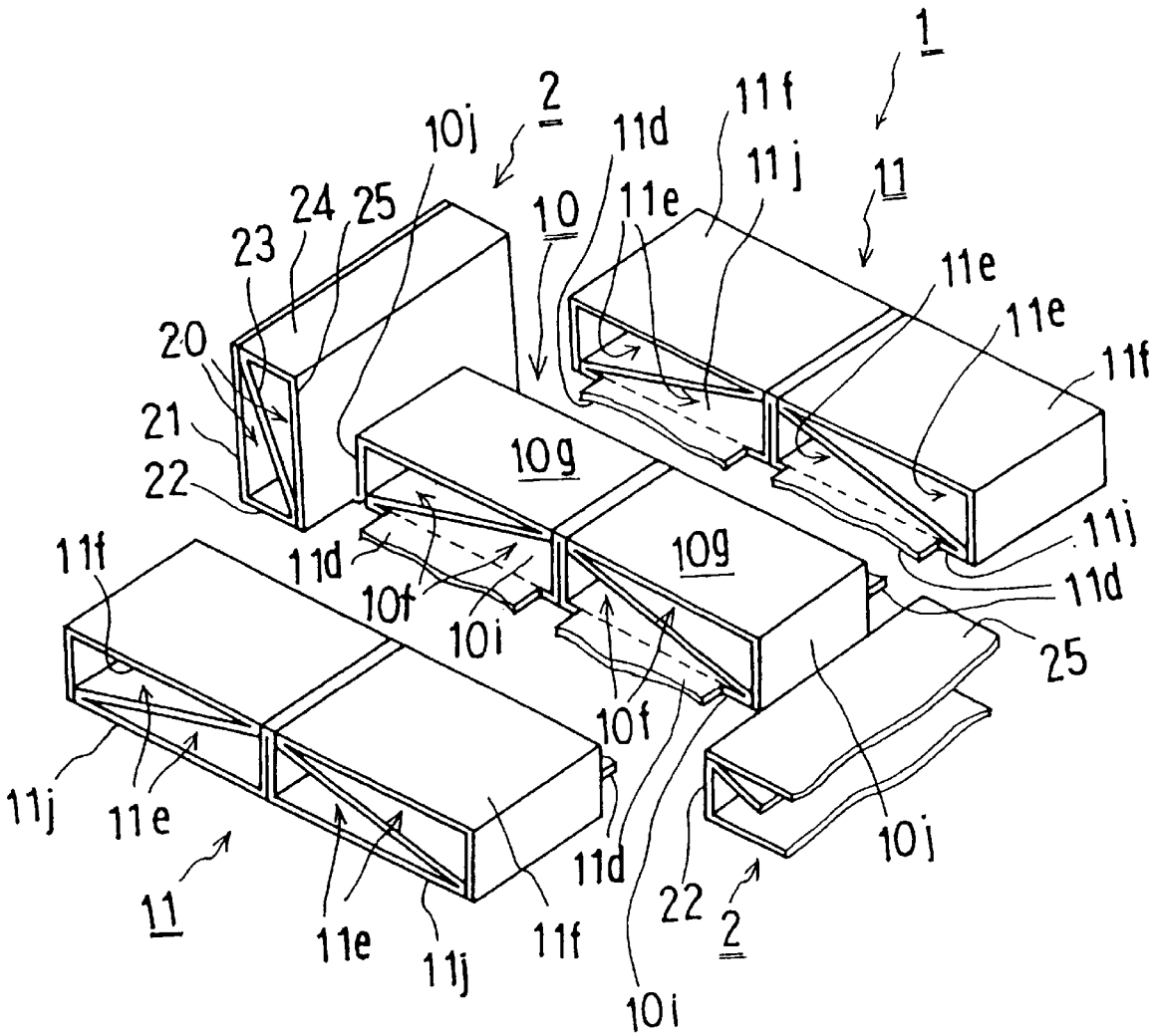
FIG. 58 is a partial perspective view explaining the fabrication of a 35th embodiment of the cushioning material for packaging according to the present invention.

Yet another embodiment of the cushioning material for packaging corresponding to the fifth aspect of the present invention is shown in FIG. 58.

FIG. 58 is a partial perspective view of the cushioning material, which is being fabricated. Each end support member 2 is composed of a hollow body which is almost similar to that of the end support member 2 of the embodiment of FIG. 56.

The raised bottom 10 is composed of a hollow body having two pairs of hollow portions 10*f*, 10*f* and 10*f*, 10*f*, which are arranged reversely and in parallel along the width direction of the raised bottom 10 and each of which has a section of a right-angled triangle.

A pair of the hollow portions 10*f*, 10*f* is so designed that it has a square section when arranged reversely. Therefore, the raised bottom 10 is made into a hollow panel as a whole by arranging the two pairs of the hollow portions 10*f*, 10*f*, 10*f*, 10*f*.

Each side wall 11 is composed of a hollow body. The hollow body has pairs of hollow portions 11*e*, 11*e* and 11*e*, 11*e*, arranged similarly to the hollow portions 10*f* of the raised bottom 10 and having the same sectional shape and size as those of hollow portion 10*f*.

The lower end of each height sheet part 10J at the opposite ends of the raised bottom 10 is continuous to the lower central part of the inside sheet part 25 at the corresponding end support member 2.

On the other hand, each bottom sheet part 10*i* of the raised bottom 10 is continuous to the lower end of each outside sheet part 11*j* of each side wall 11 via the connecting sheet 11*d*.

After cutting the sheet according to the design, forming necessary valley or ridge forming folding lines on the sheet and imparting directional permanency of folding to the folding lines, the raised bottom 10, the side walls 11 and the end support members 2 are build into solid bodies as shown in the figure. Then, the side walls 11 and the end support members 2 are made erect to fabricate the cushioning material.

In thus manufactured cushioning material, the hollow portions 10*f* of the raised bottom 10 and the hollow portions 20 of each end support member 2 are along the width direction of the grooved retainer 1 and the hollow portions 11*e* of each side wall 11 are along the depth direction of the grooved retainer 1.

Since the raised bottom 10 and the side walls 11 have the same sectional shapes and sizes in the direction orthogonal to their hollow portions 10*f*, 11*e*, the side walls 11 are laid in the direction to extend the opposite sides of the raised bottom 10 in the partially developed state shown in FIG. 58.

According to the cushioning material of the 35th embodiment, since the raised bottom 10, the side walls 11 and the end support members 2 are composed of hollow bodies, an article can be supported steadily and greater cushioning effect can be obtained.

In the cushioning material of this embodiment, since the hollow portions 10*f*, 11*e* and 20 are aligned in the same direction in the partially developed state, and the hollow portions 10*f* of the raised bottom 10 and the hollow portions 11*e* of each of the side walls 11 are superposed on each other in the direction to extend them, mechanical works of forming the folding lines on the sheet, imparting directional permanency of folding to the sheet along the folding lines and folding can be carried out very smoothly.

In this embodiment too, the inside sheet part 25 of each end support member 2 may be composed of plural layers to reinforce the end support member 2.

Other functions, effects and configurations of this embodiment are similar to those of the first embodiment and explanation thereof is omitted.

36th Embodiment

Figure 59:
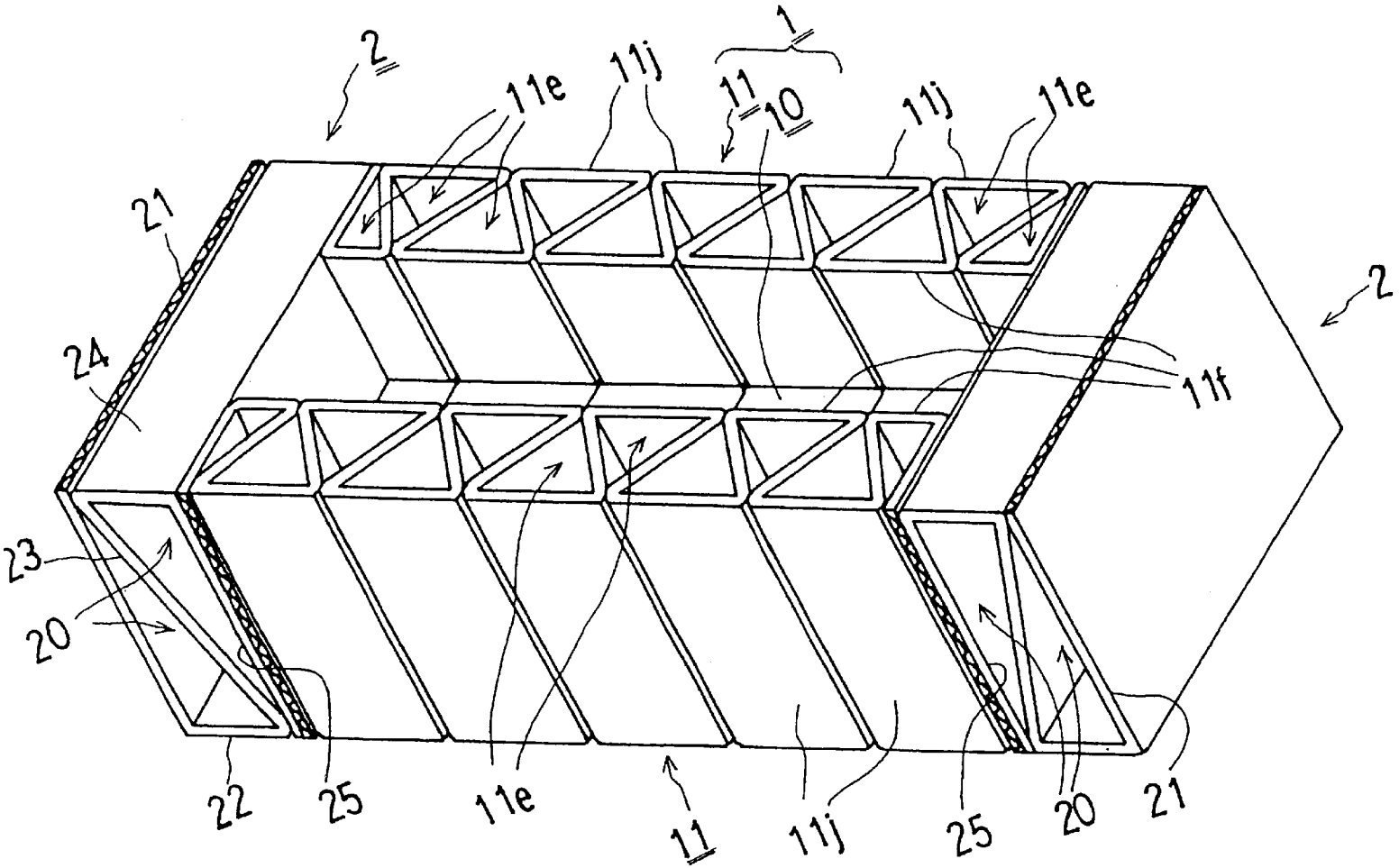
FIG. 59 is a perspective view of a 36th embodiment of the cushioning material for packaging according to the present invention.
Figure 60:
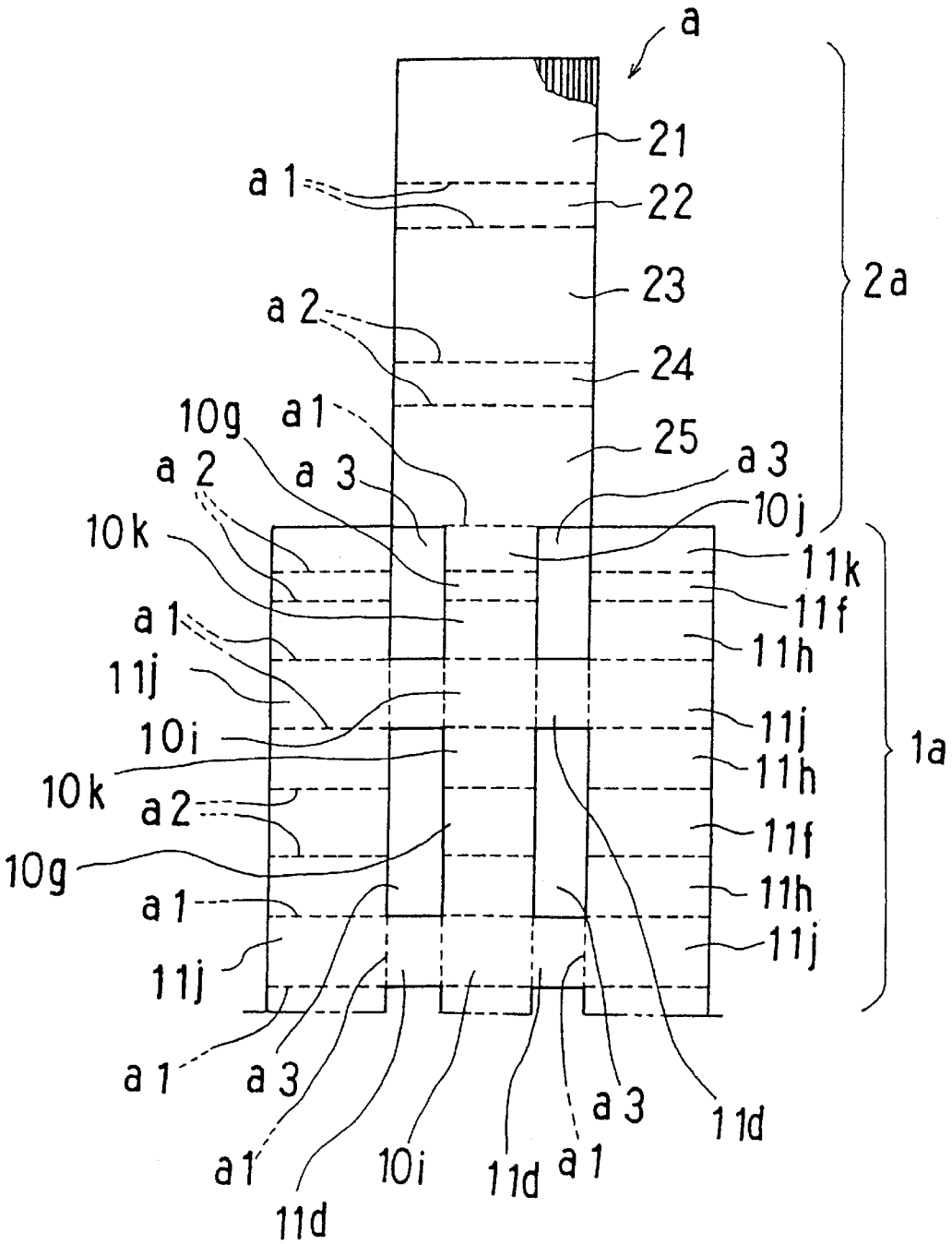
FIG. 60 is a reduced, partial plan view of the developed cushioning material of FIG. 59.
Figure 61:
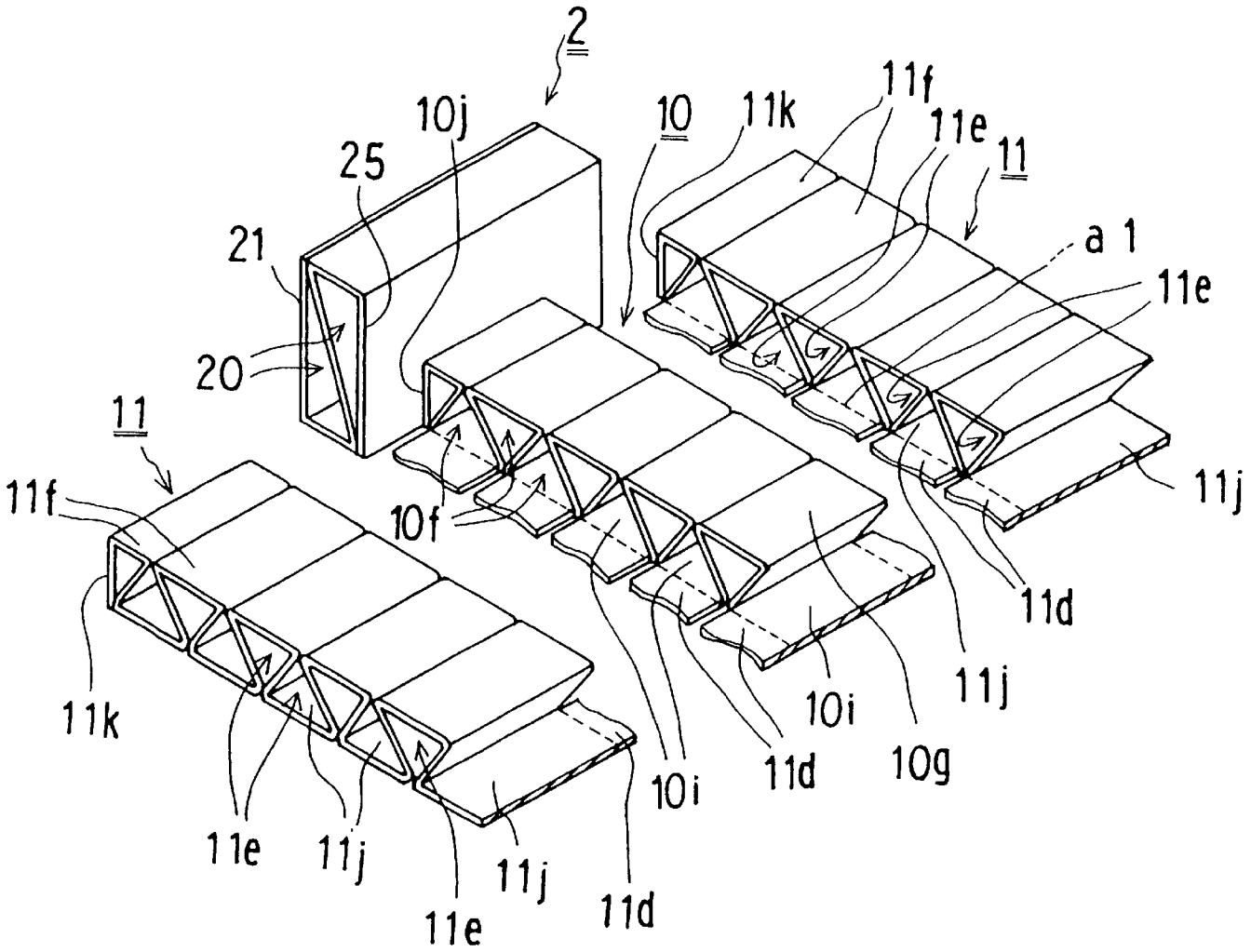
FIG. 61 is a partial perspective view explaining the fabrication of the cushioning material of FIG. 59.

Another embodiment of the cushioning material for packaging corresponding to the fifth aspect of the present invention is shown in FIG. 59–FIG. 61.

FIG. 59 is a perspective view of the cushioning material. FIG. 60 is a reduced partial plan view of the developed cushioning material. FIG. 61 is a partial perspective view showing a state where a main part of the cushioning material is made into solid bodies from the state shown in FIG. 60.

Each end support member 2 is composed of a hollow body which is almost similar to that of the end support member 2 in the embodiment of FIG. 58.

As shown in FIG. 61, the raised bottom 10 is composed of a hollow body consisting of many hollow portions 10*f* along the width direction of the raised bottom 10.

The hollow portions 10*f* have sectional shapes of isosceles triangles of the same size, except the opposite side portions. By arranging the hollow portions reversely and alternately, the raised bottom 10 is formed to be a hollow panel having many hollow portions 10*f*.

Each side wall 11 is composed of a hollow body consisting of a plurality of hollow portions 11*e* along the depth direction of the side wall 11.

Since the hollow portions 11*e* have the same sectional shapes and sizes as those of the hollow portions 10*f* of the raised bottom 10 and are arranged similarly to the hollow portions 10*f*, each side wall 11 is also formed to be a hollow panel similarly to that of the raised bottom 10.

The height sheet part 10*j* positioned at the end of the raised bottom 10 is continuous to the lower central part of the inside sheet part 25 of each of the end support member 2.

On the other hand, each outside sheet part 11*j* of each side wall 11 is continuous to the corresponding bottom sheet part 10*i* of the raised bottom 10 via the connecting sheet part 11*d*.

As shown in FIG. 60, on the support member forming portion 2*a* of the sheet, which is composed of corrugated cardboard cut into to the designed shape, there are formed the outside sheet part 21—the inside sheet part 25 from its end via the valley forming folding line a1 or ridge forming folding line a2 similarly to that of FIG. 2. At the boundary between the support forming portion 2*a* and the retainer forming portion 1*a*, there is formed a valley forming folding line a1.

In the retainer forming portion 1*a*, in the direction to extend the center part of the support member forming portion 2*a*, in order to form the raised bottom 10 of the hollow body, there are formed a height sheet part 10*j* positioned at the end, a ridge forming folding line a2, a top sheet part 10*g*, a folding line a2, a partition sheet part 10*k*, a valley forming folding line a1, a bottom sheet part 10*i*, a folding line a1, a partition sheet part 10*k* in this order repeatedly.

On the side wall forming part of the retainer forming portion 1*a*, there are formed a width sheet part 11*k* at the corresponding position to the height sheet part 10*j*, an inside sheet part 11*f* at the corresponding position to the top sheet part 10*g*, a partition sheet part 11*h* at the corresponding position to the partition sheet part 10*k* and an outside sheet part 11*j* at the corresponding position to the bottom sheet part 10*i* via the valley forming folding line a1 or ridge forming folding line a2 repeatedly.

The raised bottom 10 and each side wall 11 are continuous to each other at the top sheet part 10*i* and the outside sheet part 11*j* by the connecting sheet 11*d*. The other parts thereof are separated by the punched hole a3.

As aforementioned, after the sheet a is demarcated into to the components by the folding lines a1, a2, directional permanency of folding is imparted to the sheet along the folding lines and the components of the sheet a are built into solid bodies as in the same manner as that of the above-mentioned embodiments.

After the components are built into solid bodies as shown in FIG. 61, the side walls 11 and the end support members are made erect to fabricate the cushioning material of FIG. 59.

As shown in FIG. 61, the hollow portions 11*e* of the side walls 11 are laid in the direction to extend the hollow portions 10*f* of the raised bottom 10, in a state where the raised bottom 10, the side walls 11 and the end support members 2 are built into solid bodies. Accordingly, in the finished state shown in the FIG. 59, each inside sheet part 11*f* of each side wall 11 is erect at the side of the corresponding top sheet part 10*g* of the raised bottom 10.

In the cushioning material of this embodiment, the raised bottom 10 and the side walls 11 are strengthened because they are each composed of a hollow body having many hollow portions. Accordingly, an article can be supported steadily and greater cushioning effect can be obtained In the cushioning material of this embodiment, since the hollow portions 10*f*, 11*e* and 20 are aligned in the same direction in the partially developed state, and the hollow portions 10*f* of the raised bottom 10 and the hollow portions 11*e* of each side walls 11 are superposed on each other in the direction to extend them, mechanical works of forming the folding lines on the sheet, imparting directional permanency of folding to the sheet along the folding lines and folding the sheet can be carried out very smoothly.

In this embodiment too, the inside sheet part 25 of each end support member 2 may be composed of plural layers to reinforce the end support members 2.

Other functions, effects and configurations of this embodiment are similar to those of the first embodiment and explanation thereof is omitted.

37th Embodiment

Figure 62:
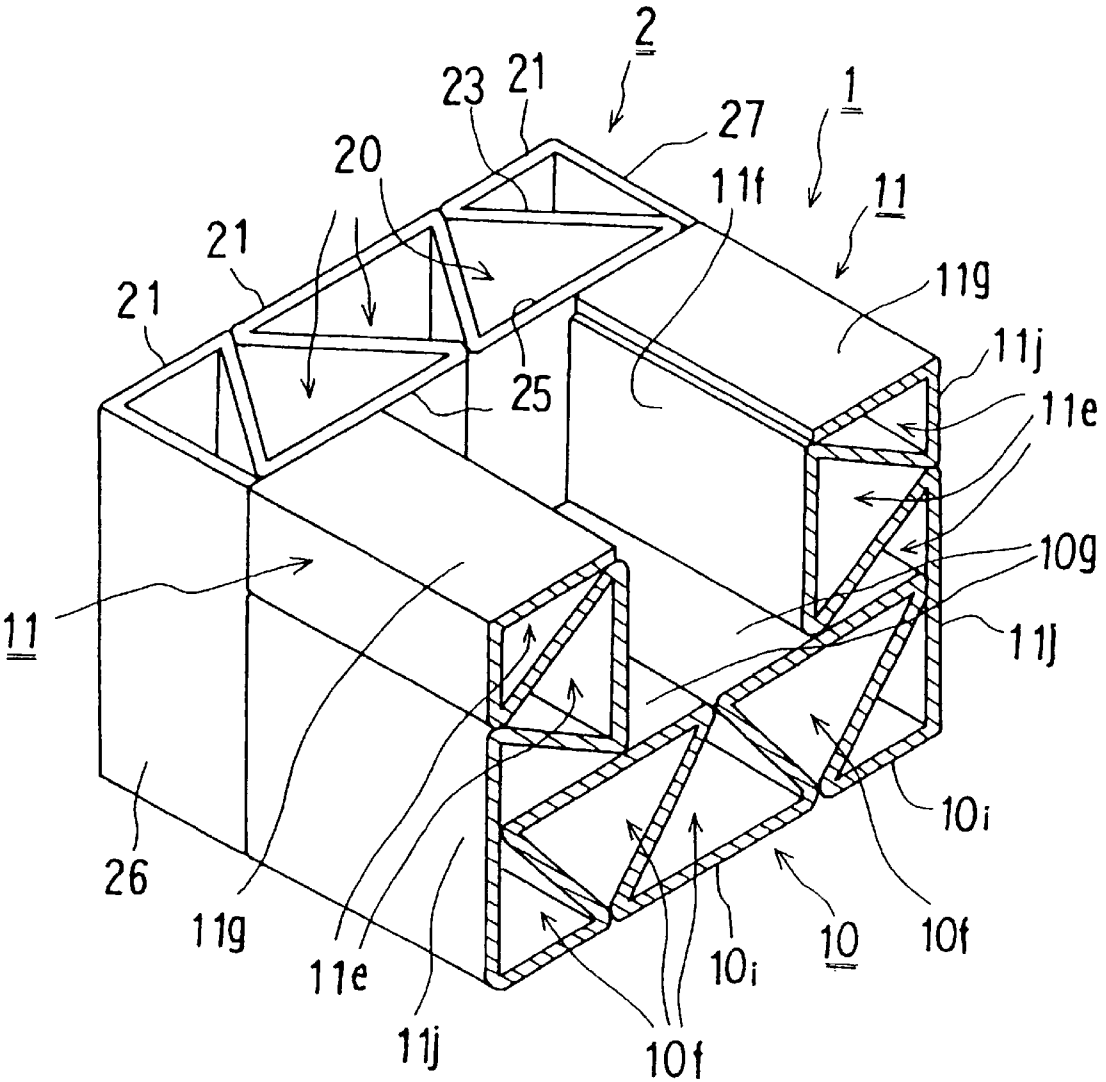
FIG. 62 is a partial perspective view of a 37th embodiment of the cushioning material for packaging according to the present invention.
Figure 63:
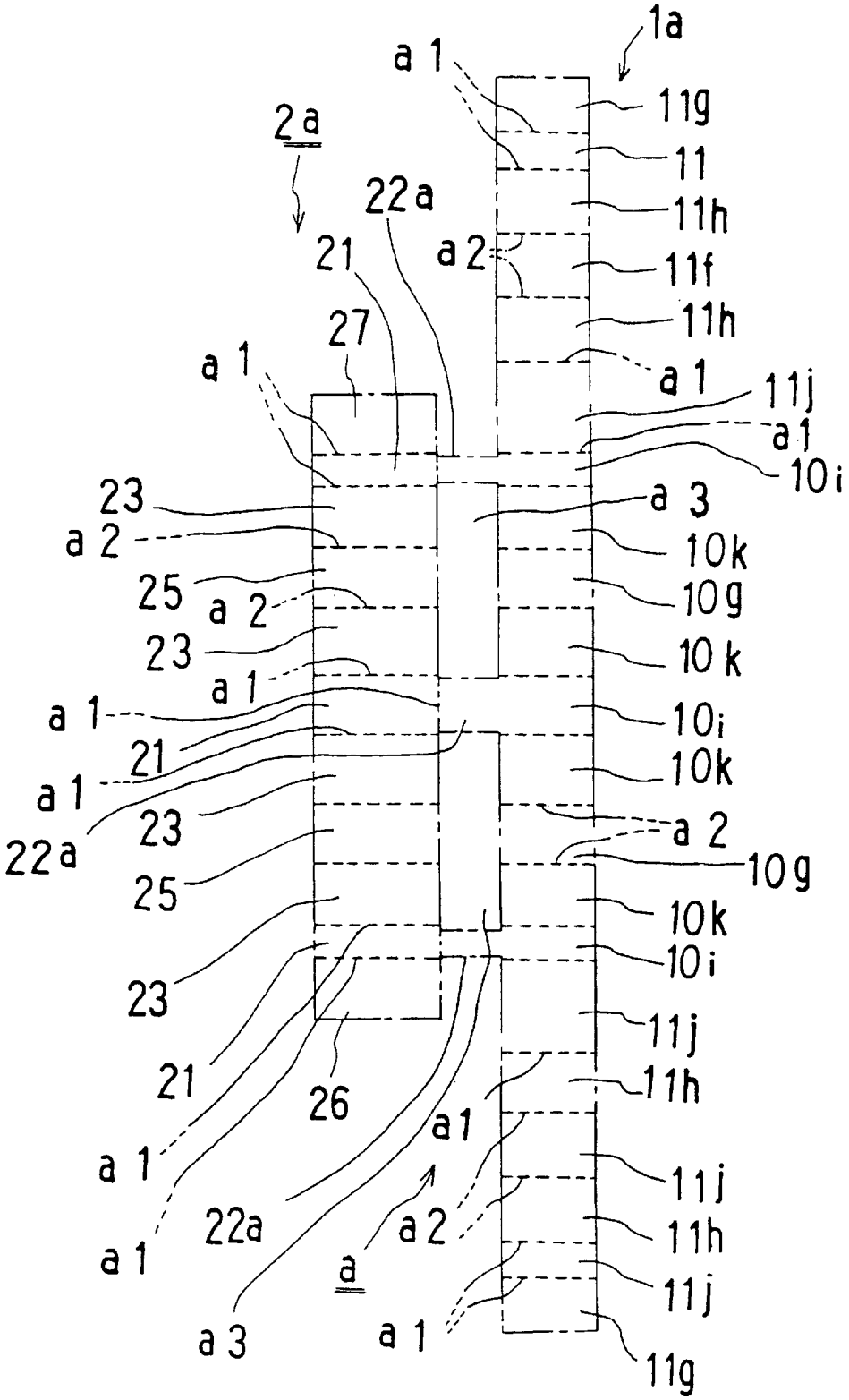
FIG. 63 is a reduced, partial plan view of the developed cushioning material of FIG. 62.
Figure 64:
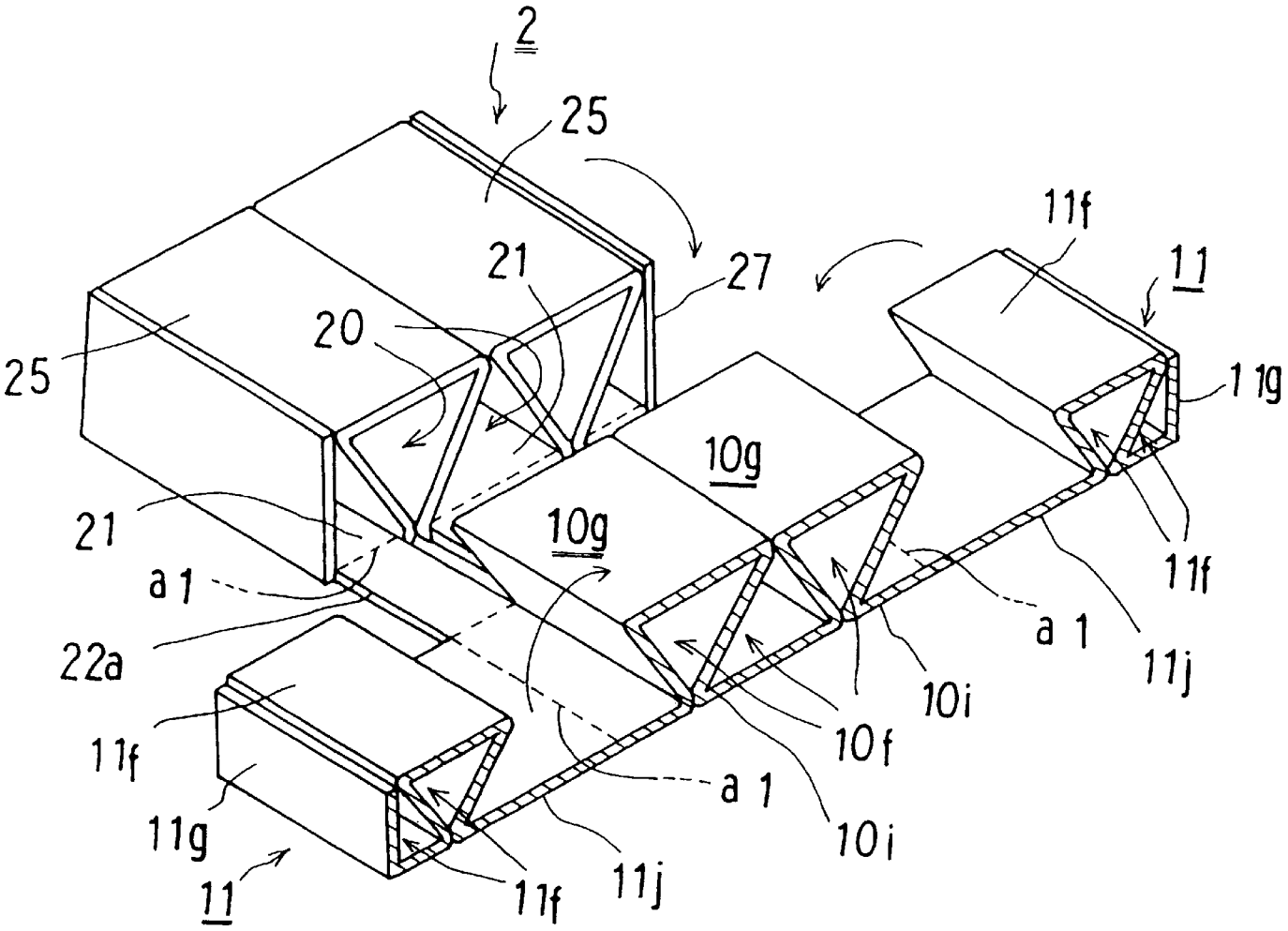
FIG. 64 is a partial perspective view explaining the fabrication of the cushioning material of FIG. 62.

Another embodiment of the cushioning material for packaging corresponding to the fifth aspect of the present invention is shown in FIGS. 62–64.

The raised bottom 10 is composed of a hollow body, which has hollow portions 10*f* at the opposite sides thereof and hollow portions 10*f* between the opposite sides. Each hollow portion 10*f* at the side has a section of a right-angled triangle and each hollow portion 10*f* between the sides has an isosceles triangular section. The raised bottom 10 is so designed that it has a rectangular section by arranging the hollow portions 10*f* having different sectional shapes, and that the hollow portions 11*f* are in parallel along the longitudinal direction of the grooved retainer 1.

Each end support member 2 is composed of a hollow body which has plural hollow portions 20 having the same sectional shapes and sizes as those of the hollow portions 10*f* of the raised bottom 10 and arranged similarly to the hollow portions 10*f*. The hollow portions 20 are in parallel along the depth direction of the grooved retainer 1.

Each side wall 11 is composed a hollow body, which has hollow portions 11*e* each having a section of a right-angled triangle and a top sheet part 11*g* at the top thereof, and a hollow portion of an isosceles triangular section. The side walls 11 are arranged to be put on the opposite upper ends of the top sheets 10*g*, 10*g* of the raised bottom 10.

As shown in FIG. 63, on the support member forming portion 2*a* and a part of the retainer forming portion 10 corresponding to the support member forming portion 2*a* of the sheet a, which is prepared for manufacturing the cushioning material of this embodiment, there are formed valley forming folding lines a1, a1 and ridge forming folding lines a2, a2 alternately and selectively at predetermined intervals. Thereby, on the support member forming portion 2*a* and the part of the retainer forming portion 10 corresponding to the support member forming portion 2*a*, there are formed a width sheet part 27 of the support member 2 and an outside sheet part 11*j* of the side wall 11, an outside sheet part 21 and a bottom sheet part 10*i* of the raised bottom 10, a partition sheet part 23 and a partition sheet part 10*k*, and an inside sheet part 25 and a top sheet part 10*g* at the corresponding positions respectively.

On the side wall forming part of the retainer forming portion 1*a*, there are formed from the opposite ends valley forming folding line a1 or ridge forming folding line a2 selectively at the predetermined interval. Thereby, a top sheet part 11*g*, an outside sheet part 11*j*, a partition sheet part 11*h*, and an inside sheet part 11*f* are formed in this order.

Punched holes a3 are formed between the support member forming portion 2*a* and the corresponding part of the retainer forming portion 1*a*, except the connecting sheet parts 22*a* which connect the bottom sheet part 10*i* of the raised bottom 10 and the outside sheet 21 of the end support member 2.

As mentioned above, after the sheet a is demarcated into the components by the folding lines a1, a2, directional permanency of folding is imparted to the sheet along the folding lines and the components of the sheet a are built into solid bodies in the same manner as those of the above-mentioned embodiments.

After the components are built into solid bodies as shown in FIG. 64, the side walls 11 and the end support members are made erect to fabricate the cushioning material of FIG. 62.

As shown in FIG. 64, the hollow portions 20 of the end support member 2 are laid in the direction to extend the hollow portions 10*f* of the raised bottom 10, in a state where the raised bottom 10, the side walls 11 and the end support members 2 are built into solid bodies. Accordingly, in the finished state shown in the FIG. 62, each inside sheet part 25 of the end support member 2 is erect at the side of the corresponding top sheet part 10*g* of the raised bottom 10.

In the cushioning material of this embodiment, the raised bottom 10 and side walls 11 are strengthened because they are composed of hollow bodies, each having many hollow portions. Accordingly, an article can be supported steadily and greater cushioning effect can be obtained.

In the cushioning material of this embodiment, since the hollow portions 10*f*, 11*e* and 20 are aligned in the same direction in the partially developed state, and the hollow portions 10*f* of the raised bottom 10 and the hollow portions 20 of the end support member 2 are superposed on each other in the direction to extend them, mechanical works of forming the folding lines on the sheet, imparting directional permanency of folding to the sheet along the folding lines and folding the sheet can be carried out very smoothly.

Other functions, effects and configurations of this embodiment are similar to those of the first embodiment and explanation thereof is omitted.

In the 37th embodiment, the hollow portions 10*f* of the raised bottom 10, hollow portions 11*e* of each side walls 11 and hollow portions 20 of each end support member 2 are arranged in parallel along the longitudinal direction of the grooved retainer 1, in partially developed state. However, even in a case that the hollow portions 10*f*, 11*e* and 20 are arranged along the width direction of the grooved retainer 1 in the partially developed state, the side walls can be put on the opposite sides of the raised bottom 10 by widening the width of the raised bottom 10 and heightening the height of the side walls 11.

38th Embodiment

Figure 65:
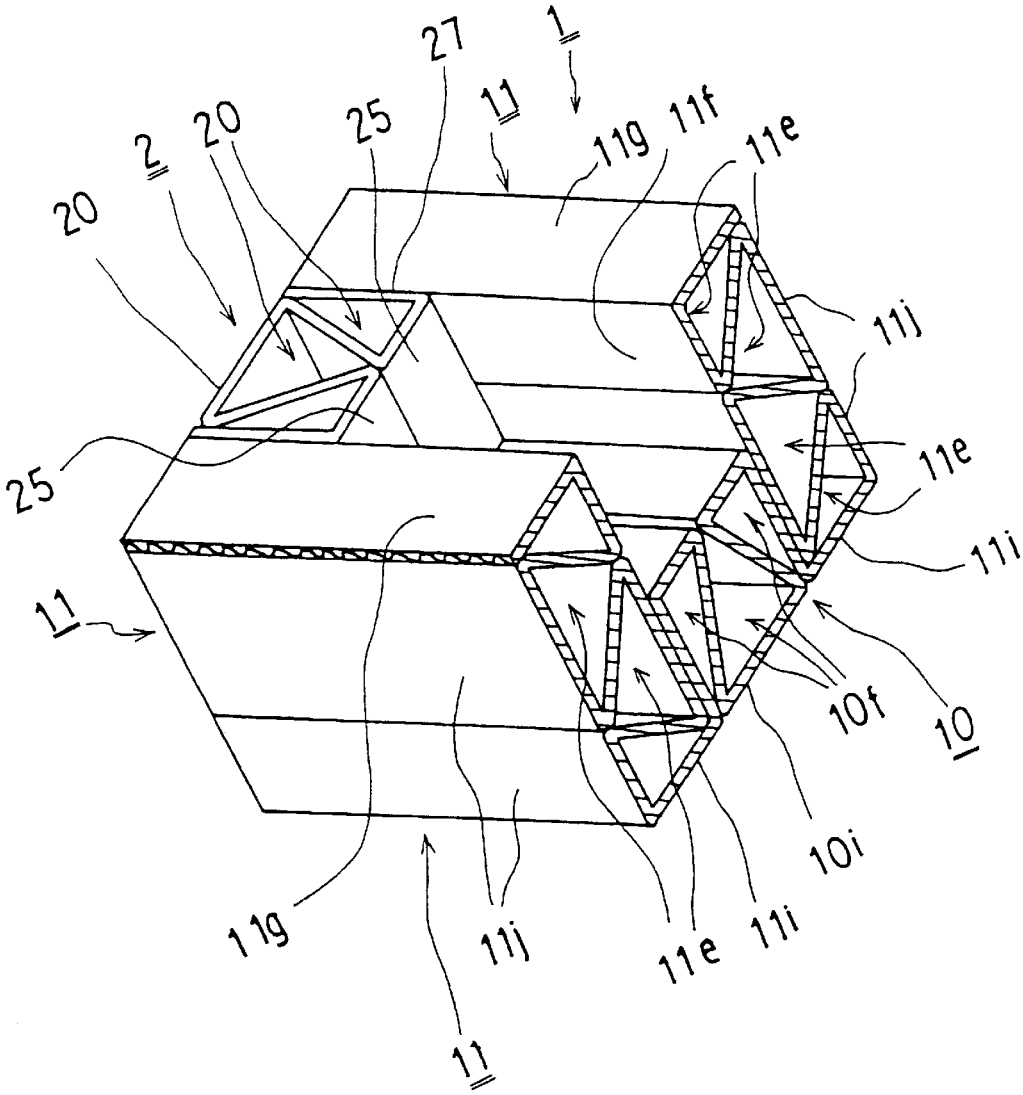
FIG. 65 is a partial perspective view of a 38th embodiment of the cushioning material for packaging according to the present invention.
Figure 66:
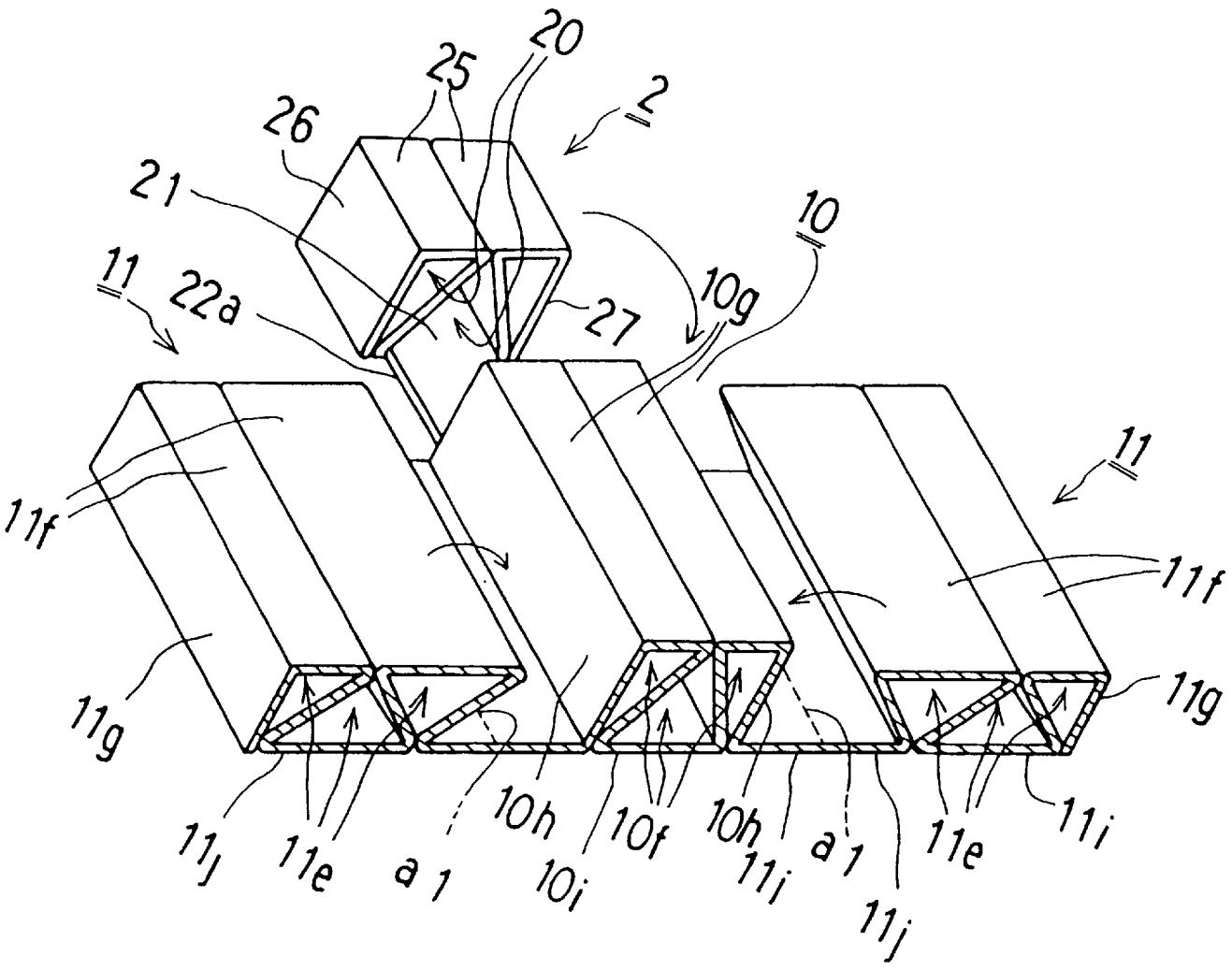
FIG. 66 is a partial perspective view of the partially developed cushioning material of FIG. 65.

Another embodiment of the cushioning material corresponding to the fifth aspect of the present invention is shown in FIGS. 65 and 66.

FIG. 65 is a partial perspective view of the cushioning and FIG. 66 is a partial perspective view of the cushioning material FIG. 65, in which a main part has been built into a solid body and the rest is developed.

The raised bottom 10 is composed of a hollow body, which has hollow portions 10*f* having sections of reversed right-angled triangles at the opposite sides thereof and a hollow portion 10*f* having an isosceles triangular section at the center thereof. The raised bottom 10 is so designed that it has a square section when the hollow portions 10*f* of different sectional shapes are combined, and that the hollow portions 10*f* are arranged in parallel along the longitudinal direction of the groove retainer 1.

Each end support member 2 is composed of a hollow body having plural hollow portions 20 and is put on each end of the raised bottom 10. The sectional shape, size and arrangement of the hollow portions 20 are the same as those of the hollow portion 10*f* of the raised bottom 10. Each hollow portion 20 of the end support member 2 is in parallel to the depth direction of the grooved retainer 1.

In arrangement of the end support member 2 and the raised bottom 10, the outside sheet part 21 of the former corresponds to the bottom sheet part of the latter. Similarly, the width sheet parts 26, 27 of the former corresponds to the length sheet part 10*f* of the latter, and the inside sheet parts 25, 25 of the former corresponds to the top sheet part 10*g*, 10*g* of the latter. The outside sheet part 21 of the former is continuous to the bottom sheet part 10*i* of the latter via the connecting sheet part 22*a*.

Each side wall 11 is composed of a hollow body having hollow portions 11*e*. One of the hollow portions 11*e* has a top sheet part 11*g* at the top thereof and a section of a right-angled triangle. Other two hollow portions 11*e*, 11*e* have section of isosceles triangles and another hollow portion 11*e* has the bottom sheet part 11*i* at the bottom thereof and a section of a right-angled triangle.

The bottom sheet part 11*i* of each side wall 11 is continuous to the lower part of the corresponding length sheet part 10*h* of the raised bottom 10.

Although the figure showing the developed sheet of this embodiment has not been provided, after the sheet is cut according to the design, directional permanency of folding is imparted thereto along the folding lines and each component is built into a solid body as shown in the aforementioned embodiment.

After the components have been built into solid bodies as shown in FIG. 66, the side walls 11 and the end support portions 2 are made erect along the valley forming folding lines a1, which have been formed at the boundary between the outside sheet 11*j* and the bottom sheet part 11*i* of each side wall 11 and the boundary between the connecting sheet part 22*a* and the bottom sheet part 10*i* of the raised bottom 10. Thereby, the cushioning material as shown in FIG. 65 is manufactured.

As shown in FIG. 66, in a state where the raised bottom 10, the side walls 11 and the end support members 2 are built into solid bodies, the hollow portions 20 of the end support member 2 are laid in the direction to extend the hollow portions 10*f* of the raised bottom 10. Accordingly, in the finished state shown in FIG. 65, the inside sheet parts 25 of the end support member 2 become to be erect corresponding to the end of each top sheet part 10*g* of the raised bottom.

In the cushioning material of this embodiment, since the raised bottom 10, the side walls 11 and the end support members 2 are each composed of a hollow body having plural hollow portions, the raised bottom 10 and the side walls 11 are reinforced and even a somewhat heavy article can be supported steadily and greater cushioning effect can be obtained.

In the cushioning material of this embodiment, since, in the partially developed state, the hollow portions 10*f*, 11*e* and 20 are aligned in the same direction and the hollow portion 10*f* of the raised bottom 10 and the hollow portions 20 of the end support members 2 are superposed on each other in the direction to extend them, mechanical work of forming the folding lines on the sheet, imparting directional permanency of folding to the sheet along the folding lines and folding the sheet can be carried out very smoothly.

Other functions, effects and configurations of the cushioning material of this embodiment are similar to those of the first embodiment and explanation thereof is omitted.

In the 38th embodiment, the cushioning material is so designed that the size of the end support member 2 along the width direction of the grooved retainer 1 is smaller than the width of the grooved retainer 1 and the end support member 2 is continuous to the raised bottom 10 so as to be put on the upper end thereof. Therefore, arrangement of this embodiment can be applied to the case in which the hollow portions 10*f*, 11*e* and 20 are along the width direction of the grooved retainer.

39th Embodiment

Figure 67:
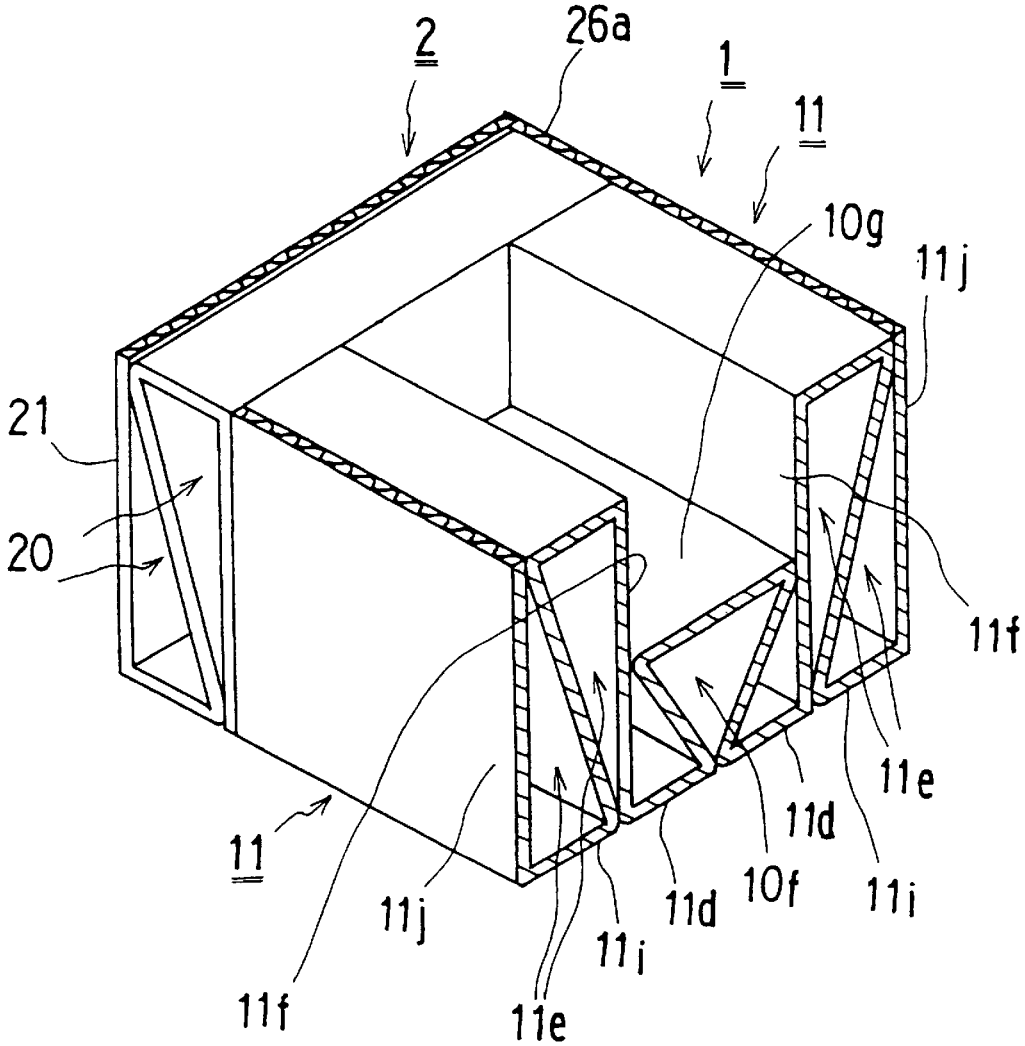
FIG. 67 is a partial perspective view of a 39th embodiment of the cushioning material for packaging according to the present invention.

Another embodiment of the cushioning material corresponding to the sixth aspect of the present invention is shown in FIG. 67.

FIG. 67 is a partial perspective view of the cushioning material, in which the end support members 2, side walls 11 and raised bottom 10 are each composed of a hollow body.

The end support members 2 and side walls 11 are constructed similarly to those of the embodiment of FIG. 49 (the 26th embodiment).

The raised bottom 10 is composed of a hollow body, which has a hollow portion 10*f* having a reversed triangular section. The connecting sheets 11*d*, 11*d* are formed laterally at the opposite lower sides of the hollow body and the lower end of the inside sheet part 11*f* of each side wall 11 composed of the hollow body is continuous to either of the connecting sheet parts 11*d*, 11*d*.

The opposite edges of the top sheet part 10*g* of the raised bottom 10 are in contact with the inside sheet parts 11*f* of the opposite side walls 11 respectively.

The outside sheet part 21 of the end support member 2 is continuous to the outside sheet part 11*j* of one of the side walls 11 via the connecting sheet part 26*a*.

The sectional shape and size of each end support member 2 are the same as those of each side wall 11. In a state where the end support members 2, the side walls 11 and the raised bottom 10 are made into solid bodies, one of the side walls 11 and the end support members 2 are superposed on each other in the direction to extend them.

In the cushioning material of this embodiment, the raised bottom 10 and the side walls 11 are strengthened because all of the raised bottom 10, the side walls 11 and the end support members 2 are composed of the hollow bodies having the hollow portions. Accordingly, even a somewhat heavy article can be supported steadily by the cushioning material and greater cushioning effect can be obtained.

In the cushioning material of this embodiment, since the hollow portions 10*f*, 11*e* and 20 are aligned in the same direction and the hollow portions 20 of the end support member 2 and the hollow portion 11*e* of the side wall 11 continuous to the end support member 2 are superposed on each other in the direction to extend them, mechanical work of forming the folding lines on the sheet, imparting directional permanency to the sheet along the folding lines and folding the sheet can be carried out very smoothly.

Other functions, effects and configurations of the cushioning material of this embodiment are similar to those of the first embodiment and explanation thereof is omitted.

40th Embodiment

Figure 68:
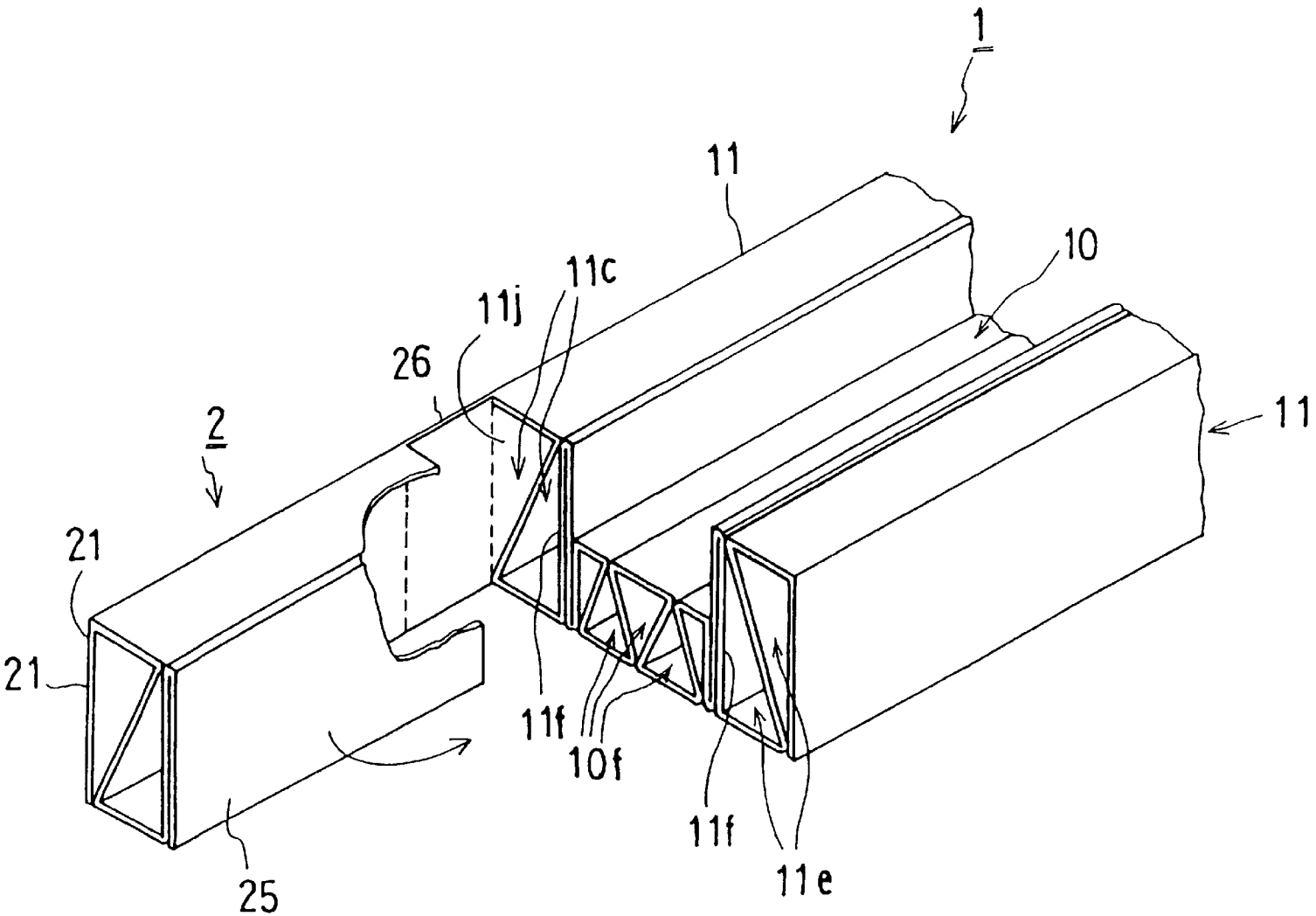
FIG. 68 is a partial perspective view explaining the fabrication of a 40th embodiment of the cushioning material for packaging according to the present invention.

Yet another embodiment of the cushioning material corresponding to the sixth aspect of the present invention is shown in FIG. 68.

FIG. 68 is a partial perspective view of the cushioning material, which is just before completed. All of the end support members 2, side walls 11 and raised bottom 10 is composed of a hollow body.

The end support members 2 and side walls 11 are constructed almost similarly to those of the 39th embodiment, but in this embodiment the inside sheet part 25 of the end support member 2 and the inside sheet part 11*f* of the side wall 11 are composed of plural layers.

The raised bottom 10 is composed of a hollow body, which has three hollow portions 10*f* arranged reversely and having isosceles triangular sections, and hollow portions 10*f* having right-angled triangles at opposite sides. The raised bottom 10 is formed to have a square section by arranging these hollow portions 10*f* of different sectional shapes.

The outside sheet part 21 of the end support member 2 is continuous to the outside sheet part 11*j* of one of the side walls 11 via the connecting sheet part 26*a*. The lower end of inside sheet part 11*f* of each side wall 11 is continuous to the lower side of the raised bottom 10.

In the cushioning material of this embodiment, the raised bottom 10 and the side walls 11 are strengthened because all of the raised bottom 10, the side walls 11 and the end support members 2 are composed of the hollow bodies having the hollow portions. Accordingly, even a somewhat heavy article can be supported steadily by the cushioning material and greater cushioning effect can be obtained.

In the cushioning material of this embodiment, since the hollow portions 11*f*, 11*e* and 20 are aligned in the same direction and the end support member 2 and the hollow portions 11*e* of one of the side walls 11, to which the end support member 2 is continuous, are superposed on each other in the direction to extend them, mechanical work of forming the folding lines on the sheet, imparting directional permanency to the sheet along the folding lines and folding the sheet can be carried out very smoothly.

41st Embodiment

Figure 69:
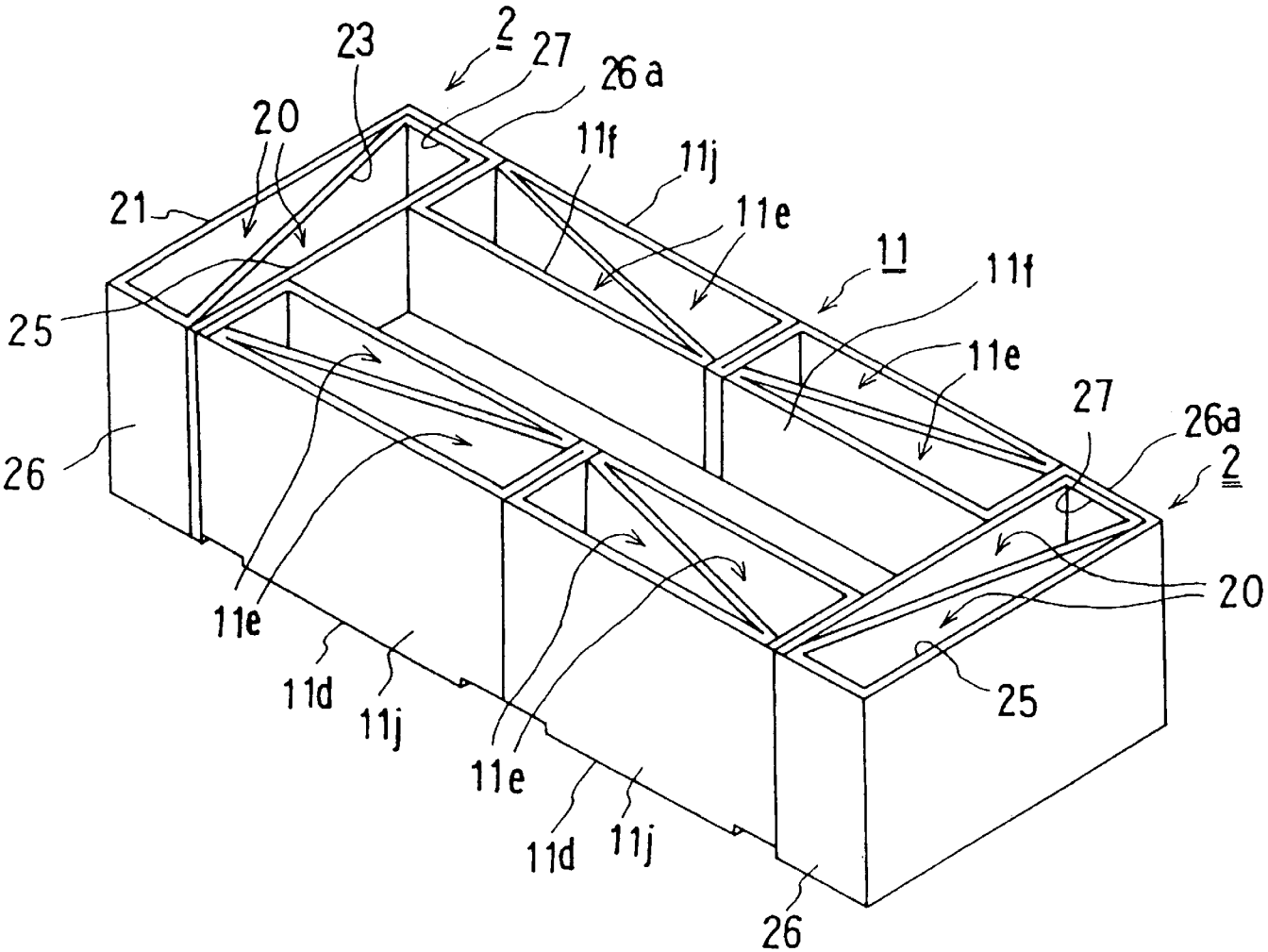
FIG. 69 is a perspective view of a 41st embodiment of the cushioning material for packaging according to the present invention.
Figure 70:
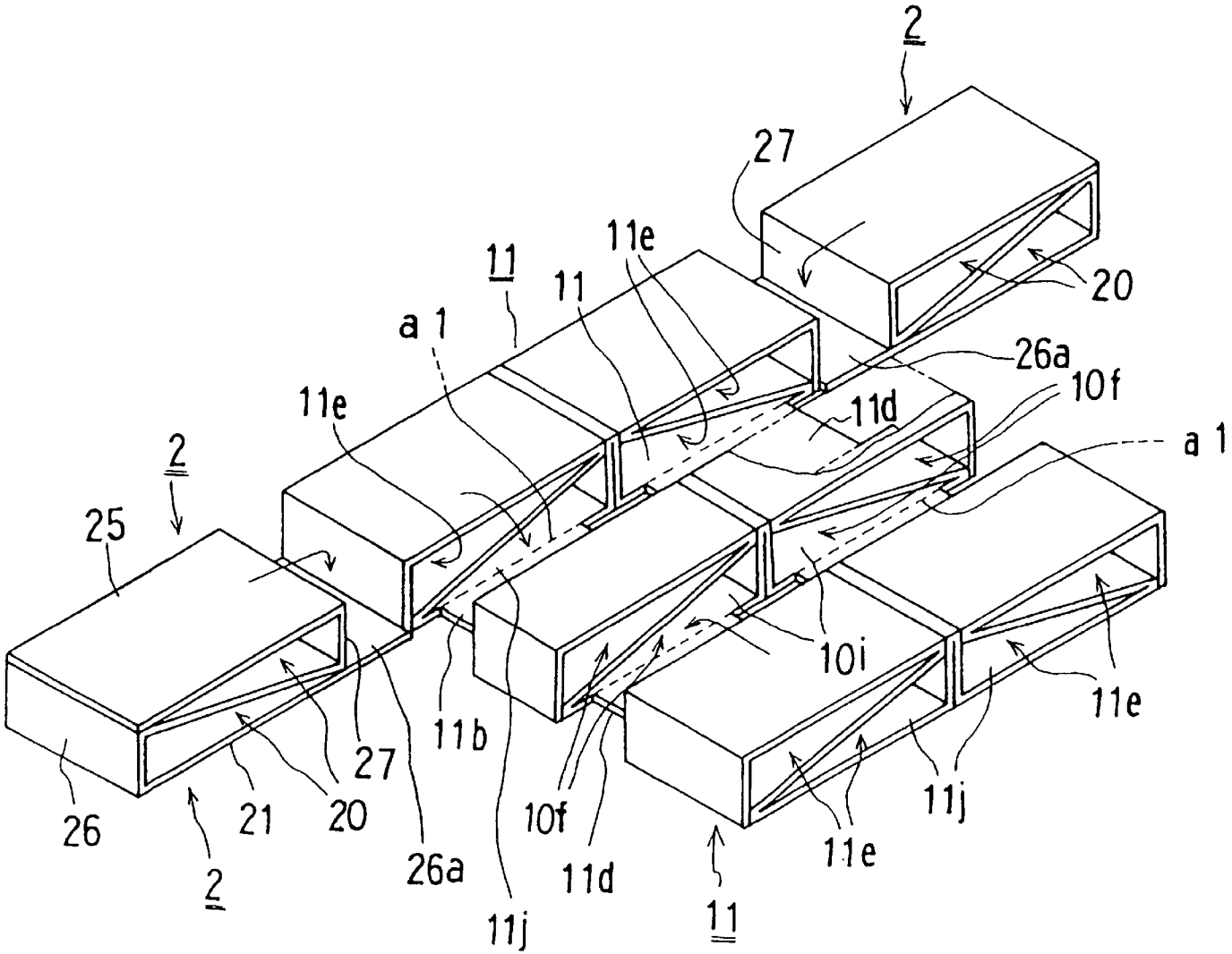
FIG. 70 is a partial perspective view of the partially developed cushioning material of FIG. 69.

Yet another embodiment of the cushioning material corresponding to the sixth aspect of the present invention is shown in FIGS. 69 and 70.

Figure 79:
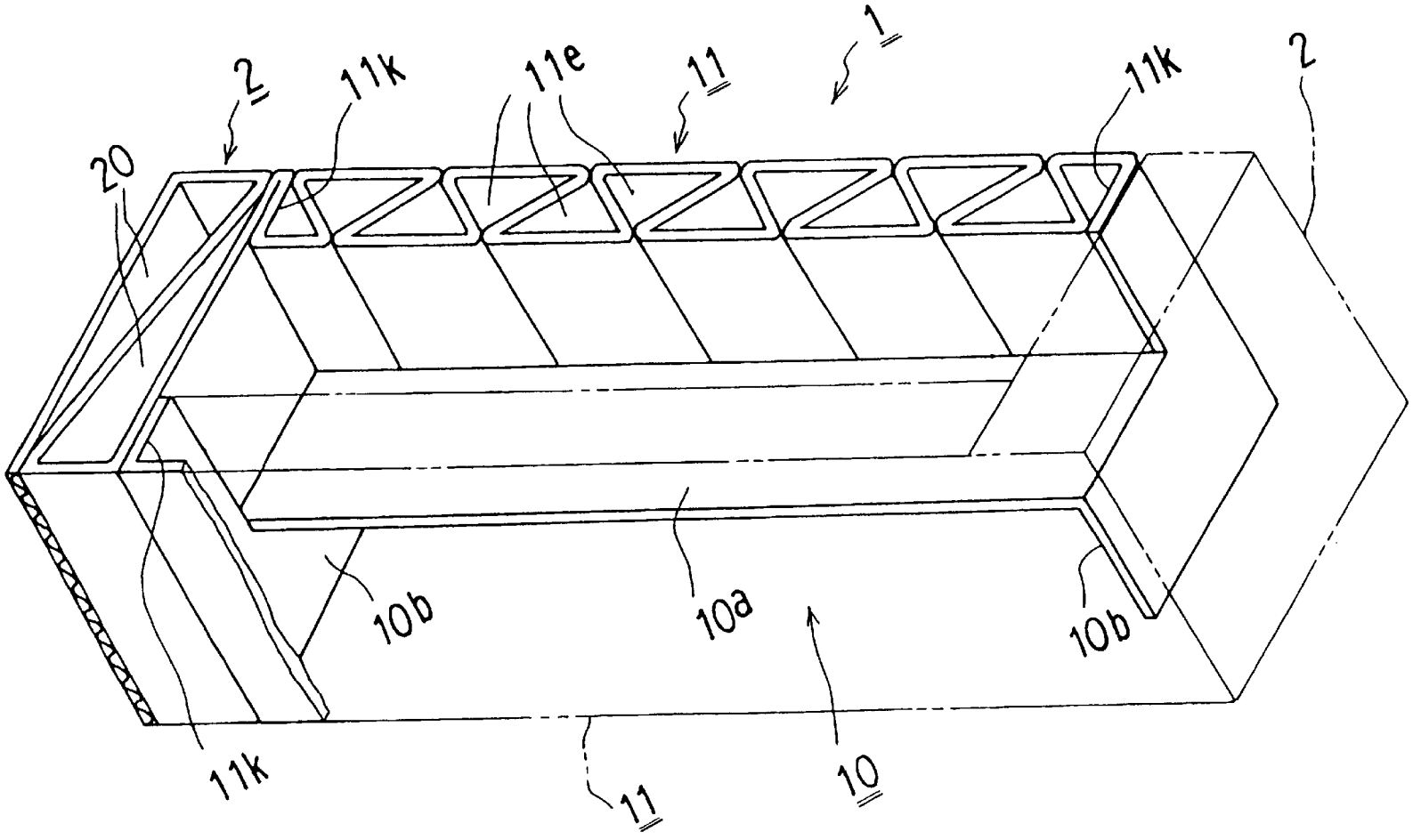
FIG. 79 is a partial, cutaway perspective view of a 49th embodiment of the cushioning material for packaging according to the present invention.

FIG. 69 is a perspective view of the cushioning material and FIG. 79 is a perspective view of the cushioning material, in which main components are built into solid bodies and placed flatwise.

Each end support member 2 is composed of a hollow body which has two hollow portions 20, 20 in parallel along the depth direction of the grooved retainer 1. The end support member 2 is so designed that it has a square section by reversely arranging the hollow portions 20, 20 of right-angled triangular sections.

The raised bottom 10 is composed of the hollow body, which has two pairs of hollow portions 10*f*, 10*f* and 10*f*, 10*f* of right-angled triangular sections. As shown in FIG. 70, the hollow portions are arranged reversely and in parallel along the width direction of the raised bottom 10.

The pair of hollow portions 10*f*, 10*f* is so designed that it has a square section by arranging the hollow portions reversely. Therefore, the raised bottom 10 becomes to be a hollow panel as a whole by arranging the two pairs of the hollow portions 10*f*, 10*f* and 10*f*, 10*f*.

Each side wall 11 is composed of a hollow body having pairs of hollow portions 11*e*, 11*e* and 11*e*, 11*e*, which have the same sectional shapes and sizes as those of the hollow portions 10*f* of the raised bottom 10 and are arranged similarly to them.

The outside sheet part 21 of each end support member 2 is continuous to the inside sheet part 11*f* of one (or either) of the side walls 11 via the connected sheet part 26*a*, which is overlapped on the width side sheet part 27.

As shown in FIG. 70, each bottom sheet part 10*i* of the raised bottom 10 is continuous to the lower end of the outside sheet part 11*j* of each side wall 11 via the connected sheet part 11*d*.

As mentioned above, since each end support member is continuous to either of the side walls 11 and each side wall 11 is continuous to the raised bottom 10, the cushioning material is developed to be a single sheet.

After cutting the sheet according to the design, forming necessary valley forming folding lines and ridge forming folding lines on the sheet and imparting directional permanency of folding to the folding lines, the raised bottom 10, side walls 11 and end support members 2 are built into solid bodies as shown in FIG. 70. Then the side walls 11 and end support members 2 are made erect along the valley forming folding lines a1 to manufacture the cushioning material.

In thus manufactured cushioning material, each hollow portion 10*f* of the raised bottom 10 is along the width direction of the grooved retainer 1, the hollow portion 20 of each end support member 2 is along the width direction of grooved retainer 1 and the hollow portion 11*e* of each side wall 11 is along the depth direction of the grooved retainer 1.

Since the sectional shape and size of the hollow portion 10*f* of the raised bottom 10 are the same as those of the hollow portion 11*e* of the side wall 11, in the partially developed state shown in FIG. 70, the side walls 11 are laid at the opposite sides of the raised bottom 10 in the direction to extend it.

In the cushioning material of 41st embodiment, since all of the raised bottom 10, the side walls 11 and the end support members 2 is composed of a hollow body, an article can be supported steadily and greater cushioning effect can be obtained.

In the cushioning material of this embodiment, since the hollow portions 10*f*, 11*e* and 20 are aligned in the same direction and the hollow portion 10*f* of the raised bottom 10 and the hollow portions 11*e* of the side walls 11 are superposed on each other in the direction to extend them, mechanical work of forming the folding lines on the sheet, imparting directional permanency of folding to the sheet along the folding lines and folding the sheet can be carried out very smoothly.

In this embodiment too, the inside sheet part 25*f* each end support member 2 may be composed of plural layers to reinforce the end support member 2.

Other functions, effects and configurations of the cushioning material of this embodiment are similar to those of the first embodiment and explanation thereof is omitted.

42nd Embodiment

Figure 71:
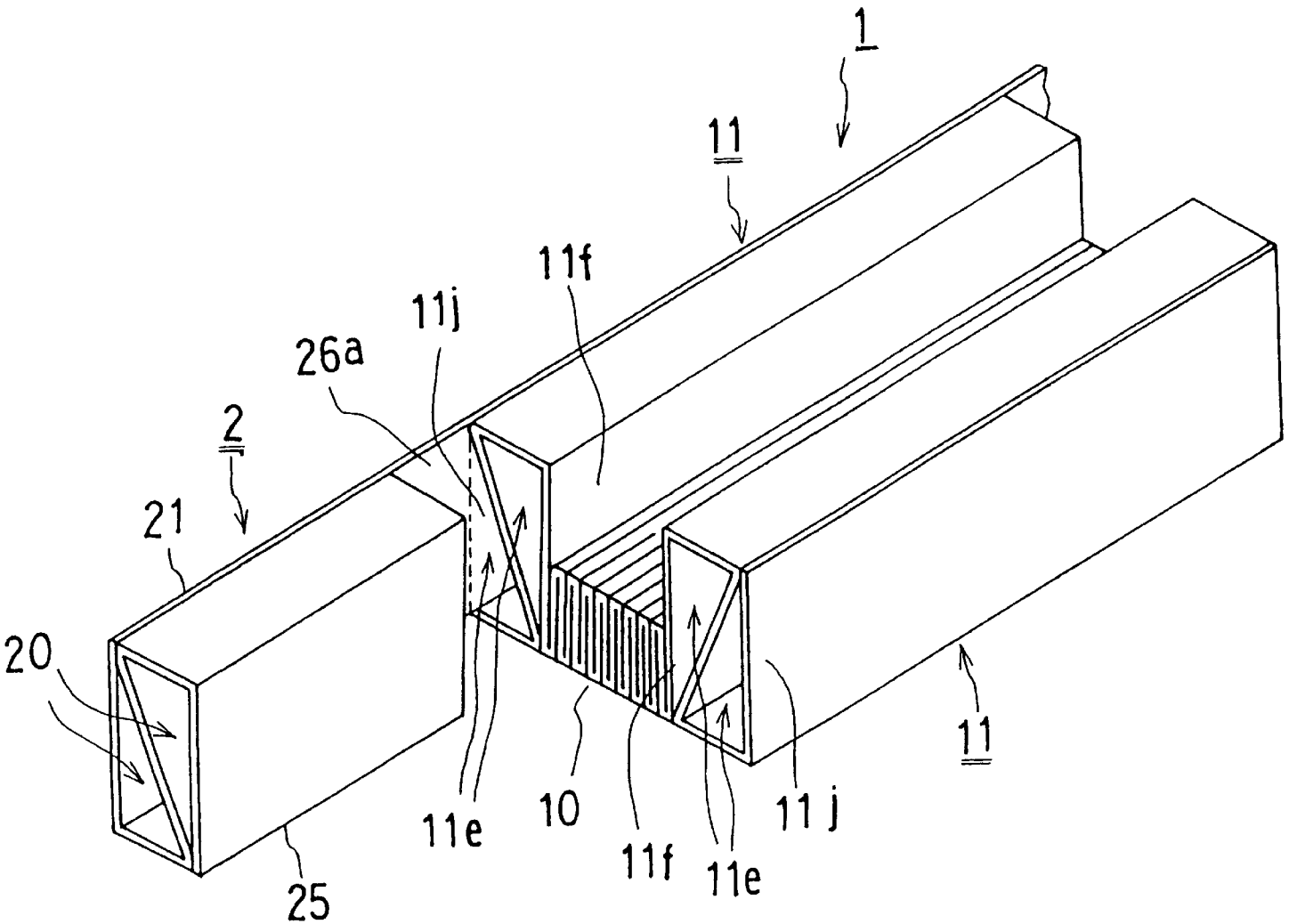
FIG. 71 is a partial perspective view explaining the fabrication of a 42nd embodiment of the cushioning material for packaging according to the present invention.

Another embodiment of the cushioning material corresponding to the sixth aspect of the present invention is shown in FIG. 71.

FIG. 71 is a partial perspective view of the cushioning material, which is just before completed. In this cushioning material, the end support members 2 and side walls 11 are constructed almost similarly to those of the 39th embodiment (FIG. 67).

The raised bottom 10 is composed of a layered body, which is formed by folding the material sheet in zigzag in the vertical direction along the longitudinal direction of the grooved retainer 1.

Each of the opposed lower ends of the raised bottom 10 is continuous to the lower end of the inside sheet part 11*f* of the corresponding side wall 11. The outside sheet part 11*j* of one of the side wall 11 is continuous to the outside sheet part 21 of each end support member 2 via the connecting sheet part 26*a*.

The cushioning material is manufactured by building the end support members 2 from the state shown in the figure so as to be in contact with the ends of the grooved retainer 2.

In the cushioning material of 42nd embodiment, since the side walls 11 and the end support members 2 are each composed of a hollow body and the raised bottom 10 is composed of a layer body formed by folding a necessary part of the sheet, an article can be supported steadily and greater cushioning effect can be obtained.

In the cushioning material of this embodiment, since the hollow portions 20 of each end support member 2 and the hollow portions 11*e* of each side wall 11 are superposed on each other in the direction to extend them in the partially developed state and all folding lines for forming the raised bottom 10, side walls 11 and the end support members 2 are along the same direction, mechanical work of forming the folding lines on the sheet, imparting directional permanency of folding to the sheet along the folding lines and folding the sheet can be carried out very smoothly.

In this embodiment too, the inside sheet part 25*f* each end support member 2 may be composed of plural layers to reinforce the end support member.

Other functions, effects and configurations of the cushioning material of this embodiment are similar to those of the first embodiment and explanation thereof is omitted.

43rd Embodiment

Figure 72:
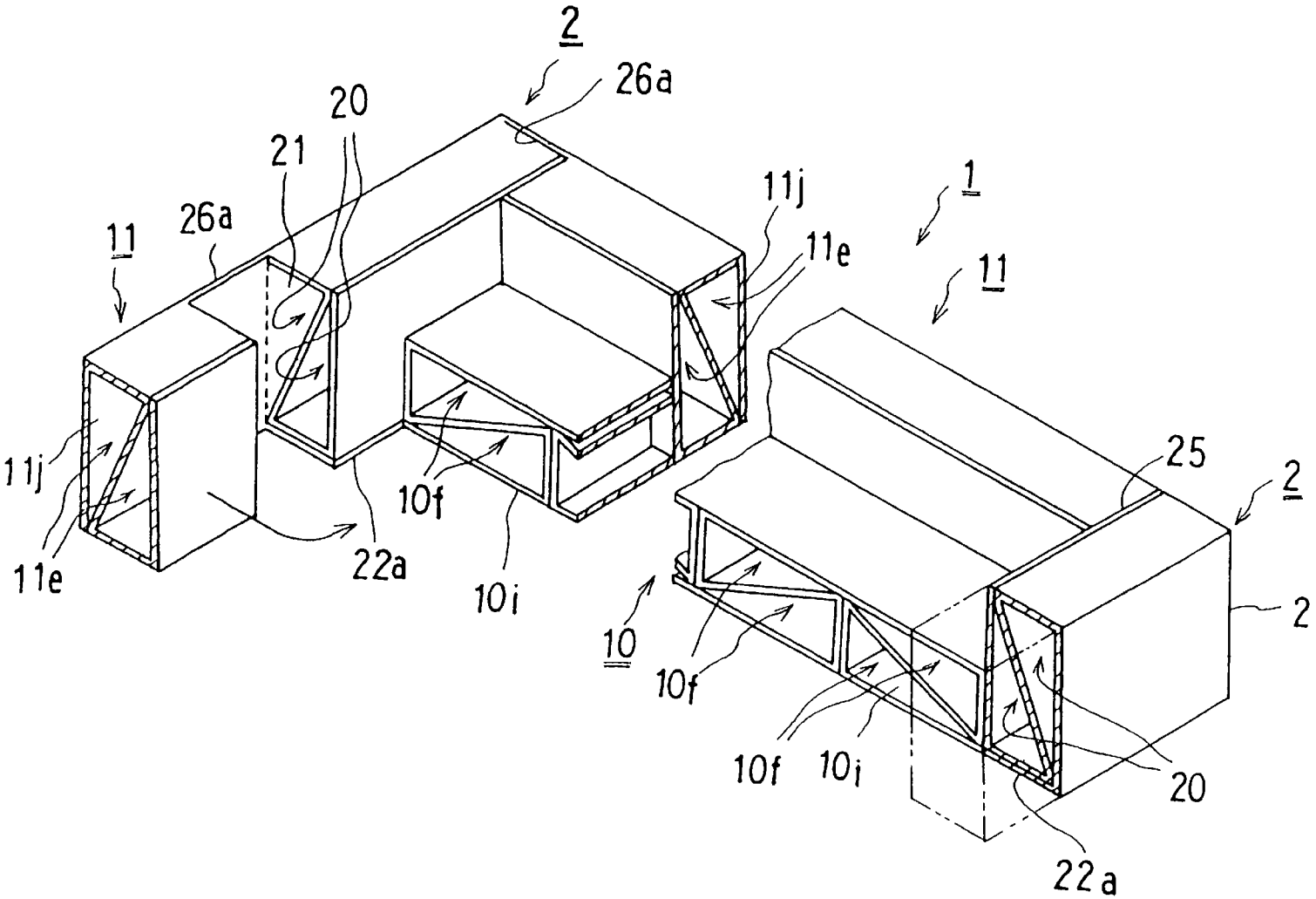
FIG. 72 is a partial, cutaway perspective view explaining the fabrication of a 43rd embodiment of the cushioning material for packaging according to the present invention.

Another embodiment of the cushioning material corresponding to the seventh aspect of the present invention is shown in FIG. 72.

This figure is a partial, cut-away perspective view of the cushioning material, which is just before completed. Each end support member 2 is composed of a hollow body which has two hollow portions 20, 20 in parallel along the depth direction of the grooved retainer 1. The end support member 2 is so designed that it has a square section by reversely arranging the hollow portions 20, 20 each having a right-angled triangular section.

The raised bottom 10 is composed of a hollow body, which has an even number of pairs of hollow portions 10*f*, 10*f*, which are arranged reversely and in parallel along the width direction of the raised bottom 10 and each have a right-angled triangular section.

The pair of hollow portions 10*f*, 10*f* is so designed that it has a square section by arranging the hollow portions reversely. The raised bottom 10 becomes to be a hollow panel as a whole by arranging these even pairs of the hollow portions 10*f*, 10*f*.

Each side wall 11 is composed of a hollow body having pairs of hollow portions 11*e*, 11*e*, which have the same sectional shapes and sizes as those of the hollow portions 20 of the end support members 2 and are arranged similarly to them.

The opposite ends of the outside sheet part 21 of one of the end support members 2 (left side of FIG. 72) are respectively continuous to the outside sheet part 11*j* of each side wall 11 via the connected sheet part 26*a*.

The bottom sheet part 10*i* at each end of the raised bottom 10 is continuous to the lower end of each end support member 2 via the connected sheet part 22*a*, which functions as the surface sheet of the double layered bottom of the end support member 2.

As mentioned above, the end support members 2 are continuous to the opposite ends of the raised bottom 10 and the side walls 11 are continuous to the opposite sides of one of the end support members 2. Therefore, the cushioning material is developed to be a single sheet.

After cutting the sheet according to the design, forming necessary valley forming folding lines and ridge forming folding lines on the sheet and imparting directional permanency of folding to the folding lines, the raised bottom 10, side walls 11 and end support members 2 are built into solid bodies as shown in FIG. 70. Then the side walls 11 and end support members 2 are made erect along the valley forming folding lines a1 to manufacture the cushioning material.

In thus manufactured cushioning material, each hollow portion 10*f* of the raised bottom 10 and the hollow portion 20 of each end support member 2 are along the width direction of the grooved retainer 1, and the hollow portion 11*e* of each side wall 11 is along the longitudinal direction of the grooved retainer 1.

Since the sectional shapes and sizes of the end support members 2 are the same with the side walls 11, in the partially developed state where the raised bottom 10, the side walls 11 and the end support members 2 have been built in solid bodies, one of the end support member 2 and the side walls 11 are superposed on each other in the direction to extend them.

In the cushioning material of 43rd embodiment, since the raised bottom 10, the side walls 11 and the end support members 2 are each composed of a hollow body, an article can be supported steadily and greater cushioning effect can be obtained.

In the cushioning material of this embodiment, since the hollow portions 10*f*, 11*e* and 20 are aligned in the same direction in the partially developed state and the hollow portion 20 of one of the end support members 2 and the hollow portions 11*e* of the side walls 11 are superposed on each other in the direction to extend them, mechanical work of forming the folding lines on the sheet, imparting directional permanency of folding to the sheet along the folding lines and folding the sheet can be carried out very smoothly.

In this embodiment too, the inside sheet part 25*f* each end support member 2 may be composed of plural layers to reinforce the end support member.

Other functions, effects and configurations of the cushioning material of this embodiment are similar to those of the first embodiment and explanation thereof is omitted.

44th Embodiment

Figure 73:
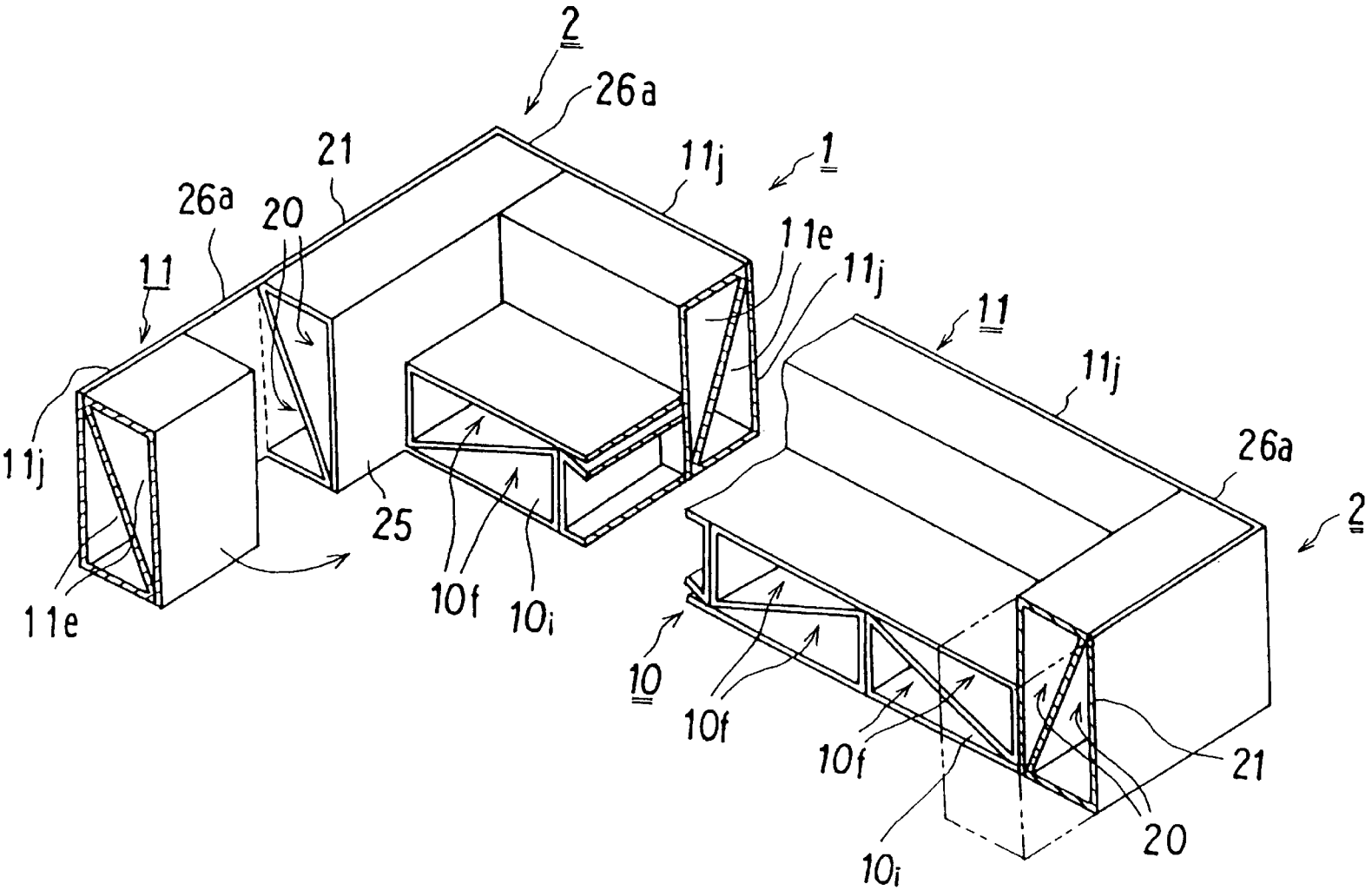
FIG. 73 is a partial, cutaway perspective view explaining the fabrication of a 44th embodiment of the cushioning material for packaging according to the present invention.

Another embodiment of the cushioning material corresponding to the eleventh aspect of the present invention is shown in FIG. 73.

This figure is a partial, cut-away perspective view of the cushioning material, which is just before completed. Each end support member 2 is composed of a hollow body which has two hollow portions 20, 20 in parallel along the depth direction of the grooved retainer 1. The end support member 2 is so designed that it has a square section by reversely arranging the hollow portions 20, 20 each having a right-angled triangular section.

The raised bottom 10 is composed of a hollow body, which has an even number of pairs of hollow portions 10*f*, 10*f*. In the pair, hollow portions each having a right-angled triangular section are arranged reversely and in parallel along the width direction of the raised bottom.

The pair of hollow portions 10*f*, 10*f* is so designed that it has a square section by arranging the hollow portions reversely. Therefore, the raised bottom 10 becomes to be a hollow panel as a whole by arranging these even pairs of the hollow portions 10*f*, 10*f*.

Each side wall 11 is composed of a hollow body having pairs of hollow portions 11*e*, 11*e*, which have the same sectional shapes and sizes as those of the hollow portions 20 of the end support member 2 and are arranged similarly to them.

One end of the outside sheet part 11*j* of each side wall 11 is continuous to the opposite ends of the outside sheet part 21 of one of the end support members 2 (left side of FIG. 73) via the connected sheet part 26*a*. The outside sheet 21 of the other end support member 2 is continuous to the other end of the outside sheet 11*j* of either of the side walls 11 (in this embodiment, the side wall positioned at the upper part of the figure).

The bottom sheet part 10*i* at one end of the raised bottom 10 is continuous to the lower central part of the inside sheet part 25 of one of the end support members 2.

As mentioned above, one end of each side wall 11 is continuous to the opposite ends of one of the end support member 2 and the other end support member 2 is continuous to the other end of either of the side walls 11. Therefore, the cushioning material is developed to be a single sheet.

After cutting the sheet according to the design, forming necessary valley forming folding lines and ridge forming folding lines on the sheet and imparting directional permanency of folding to the folding lines, the raised bottom 10, side walls 11 and end support members 2 are built into solid bodies as shown in FIG. 73. Then the side walls 11 and end support members 2 are made erect along the valley forming folding lines a1 to manufacture the cushioning material.

In thus manufactured cushioning material, each hollow portion 10*f* of the raised bottom 10 and the hollow portions 20 of each end support member 2 are along the width direction of the grooved retainer 1, and the hollow portions 11*e* of each side wall 11 are along the longitudinal direction of the grooved retainer 1.

Since the sectional shapes and sizes of the end support members 2 are the same with the side walls 11, in the partially developed state where the raised bottom 10, the side walls 11 and the end support members 2 have been built in solid bodies, each end support member 2 and each side wall 11 are superposed on each other in the direction to extend them.

In the cushioning material of 44th embodiment, since the raised bottom 10, the side walls 11 and the end support members 2 are each composed of a hollow body, an article can be supported steadily and greater cushioning effect can be obtained.

In the cushioning material of this embodiment, since, in the partially developed state, the hollow portions 10*f*, 11*e* and 20 are aligned in the same direction and the hollow portion 20 of one of the end support members 2 and the hollow portions 11*e* of the side walls 11 are superposed on each other in the direction to extend them, mechanical work of forming the folding lines on the sheet, imparting directional permanency of folding to the sheet along the folding lines and folding the sheet can be carried out very smoothly.

In this embodiment too, the inside sheet part 25*f* each end support member 2 may be composed of plural layers to reinforce the end support member.

Other functions, effects and configurations of the cushioning material of this embodiment are similar to those of the first embodiment and explanation thereof is omitted.

45th Embodiment

Figure 74:
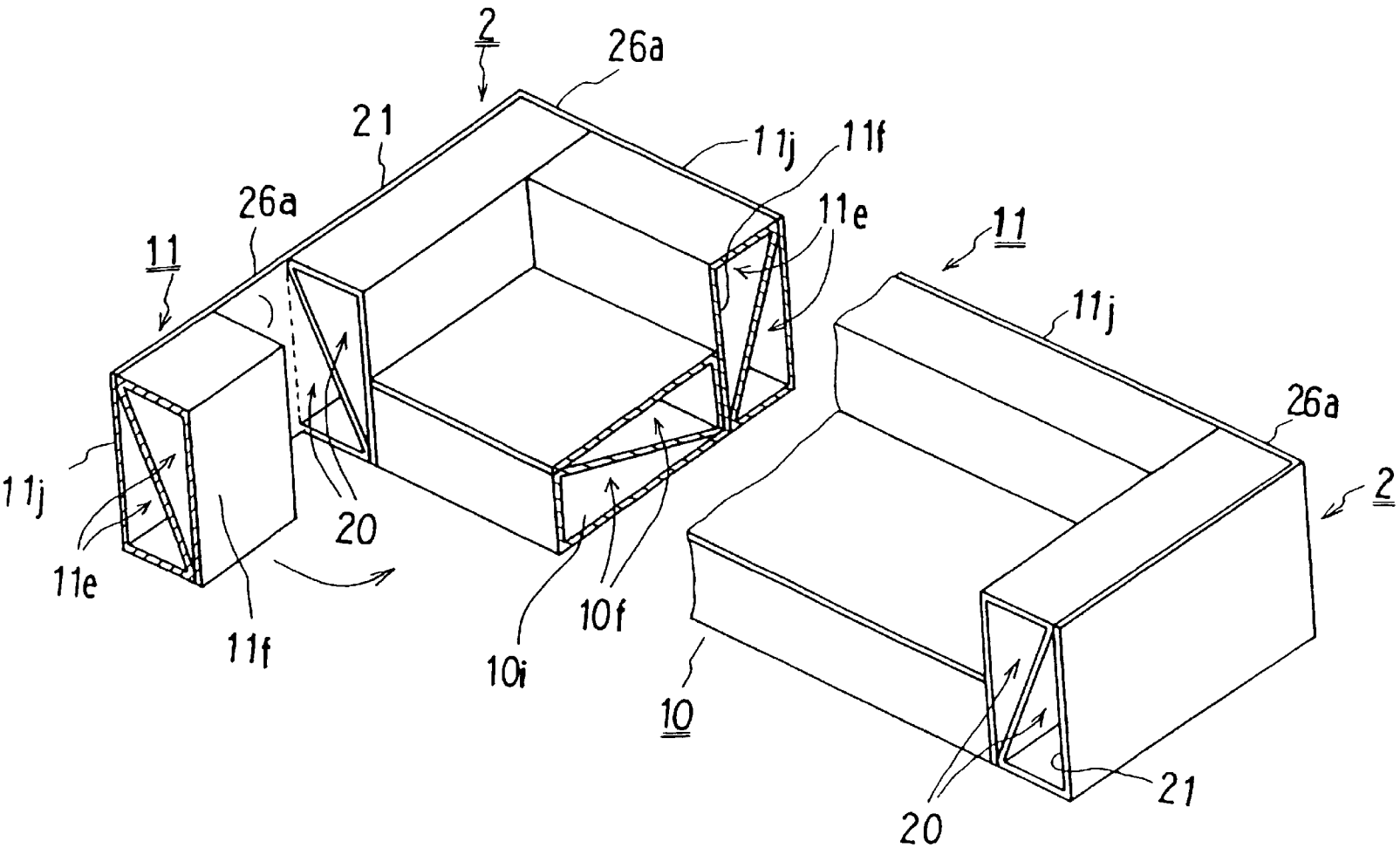
FIG. 74 is a partial, cutaway perspective view explaining the fabrication of a 45th embodiment of the cushioning material for packaging according to the present invention.

Another embodiment of the cushioning material corresponding to the twelfth aspect of the present invention is shown in FIG. 74.

This figure is a partial, cut-away perspective view of the cushioning material, which is just before completed. Each end support member 2 is composed of a hollow body which has two hollow portions 20, 20 in parallel along the depth direction of the grooved retainer 1. The end support member 2 is so designed that it has a square section by reversely arranging the hollow portions 20, 20 each having a right-angled triangular section.

The raised bottom 10 is composed of a hollow body, which has a pair of hollow portions 10*f*, 10*f*, which are arranged reversely and in parallel along the longitudinal direction of the raised bottom 10 and each has a right-angled triangular section.

The pair of hollow portions 10*f*, 10*f* is so designed that it has a square section by arranging the hollow portions reversely. The raised bottom 10 becomes to be a hollow panel as a whole by lengthening the pair of the hollow portions 10*f*, 10*f*.

Each side wall 11 is composed of a hollow body having a pair of hollow portions 11*e*, 11*e*, which have the same sectional shapes and sizes as those of the hollow portions 20 of the end support members 2 and are arranged similarly to them.

One end of the outside sheet part 11*j* of each side wall 11 is continuous to the opposite ends of the outside sheet part 21 of one of the end support members 2 (left side of FIG. 74) via the connected sheet part 26*a*. The outside sheet 21 of the other end support member 2 is continuous to the other end of the outside sheet 11*j* of either of the side walls 11 (in this embodiment, the side wall positioned at the upper part of the figure).

The lower inside part of this side wall 11 is continuous to one of the lower sides of the raised bottom 10. In this embodiment, the lower end of the inside sheet part 11*j* of one of the side walls 11 is continuous to the bottom sheet part 10*i* of the raised bottom 10.

As mentioned above, one end of each side wall 11 is continuous to the opposite ends of one of the end support member 2, the other end support member 2 is continuous to the other end of either of the side walls 11 and one of the lower sides of the raised bottom 10 is continuous to the lower inside part of this side wall 11. Therefore, the cushioning material is developed to be a single sheet.

After cutting the sheet according to the design, forming necessary valley forming folding lines and ridge forming folding lines on the sheet and imparting directional permanency of folding to the folding lines, the raised bottom 10, side walls 11 and end support members 2 are built into solid bodies as shown in the figure. Then the side walls 11 and end support members 2 are made erect along the valley forming folding lines a1 to manufacture the cushioning material.

In thus manufactured cushioning material, each hollow portion 10*f* of the raised bottom 10 and the hollow portions 11*e* of each side wall 11 are along the longitudinal direction of the grooved retainer 1. And the hollow portions 20 of each end support member 2 are along the width direction of the grooved retainer 1.

Since the sectional shape and size of each end support member 2 are the same with the side walls 11, in the partially developed state where the raised bottom 10, the side walls 11 and the end support members 2 have been built in solid bodies, the end support members 2 and the side walls 11 are superposed on each other in the direction to extend them.

In the cushioning material of 45th embodiment, since the raised bottom 10, the side walls 11 and the end support members 2 are each composed of a hollow body, an article can be supported steadily and greater cushioning effect can be obtained.

In the cushioning material of this embodiment, since, in the partially developed state, the hollow portions 10*f*, 11*e* and 20 are aligned in the same direction and the hollow portion 20 of each end support member 2 and the hollow portions 11*e* of each side wall 11 are superposed on each other in the direction to extend them, mechanical work of forming the folding lines on the sheet, imparting directional permanency of folding to the sheet along the folding lines and folding the sheet can be carried out very smoothly.

In this embodiment too, the inside sheet part 25*f* each end support member 2 may be composed of plural layers to reinforce the end support member.

Other functions, effects and configurations of the cushioning material of this embodiment are similar to those of the first embodiment and explanation thereof is omitted.

In the embodiment of FIG. 74 (essential concept thereof is included in the twelfth aspect of the invention), the raised bottom 10 is continuous to the lower inside part of one of the side walls 11 at one of the lower sides thereof and is not continuous to the end support members 2.

Accordingly, instead of composing the raised bottom 10 of the hollow body, for example as in the cushioning material of the 42nd embodiment (FIG. 71), the raised bottom 10 may be composed of a multiple-layered body formed by folding a necessary portion of the material sheet along the vertical direction.

46th Embodiment

Figure 75:
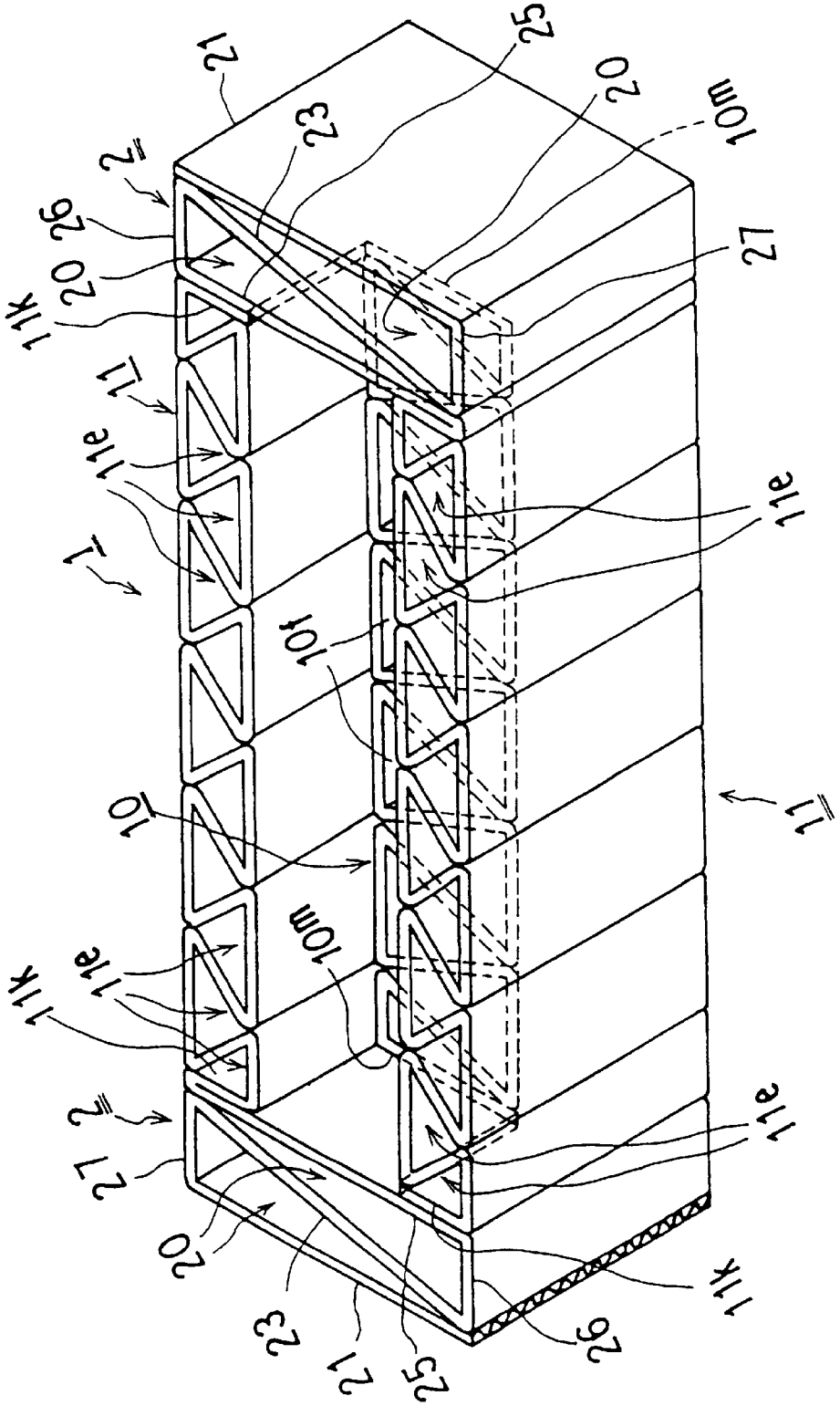
FIG. 75 is a schematic perspective view explaining the fabrication of a 46th embodiment of the cushioning material for packaging according to the present invention.
Figure 76:
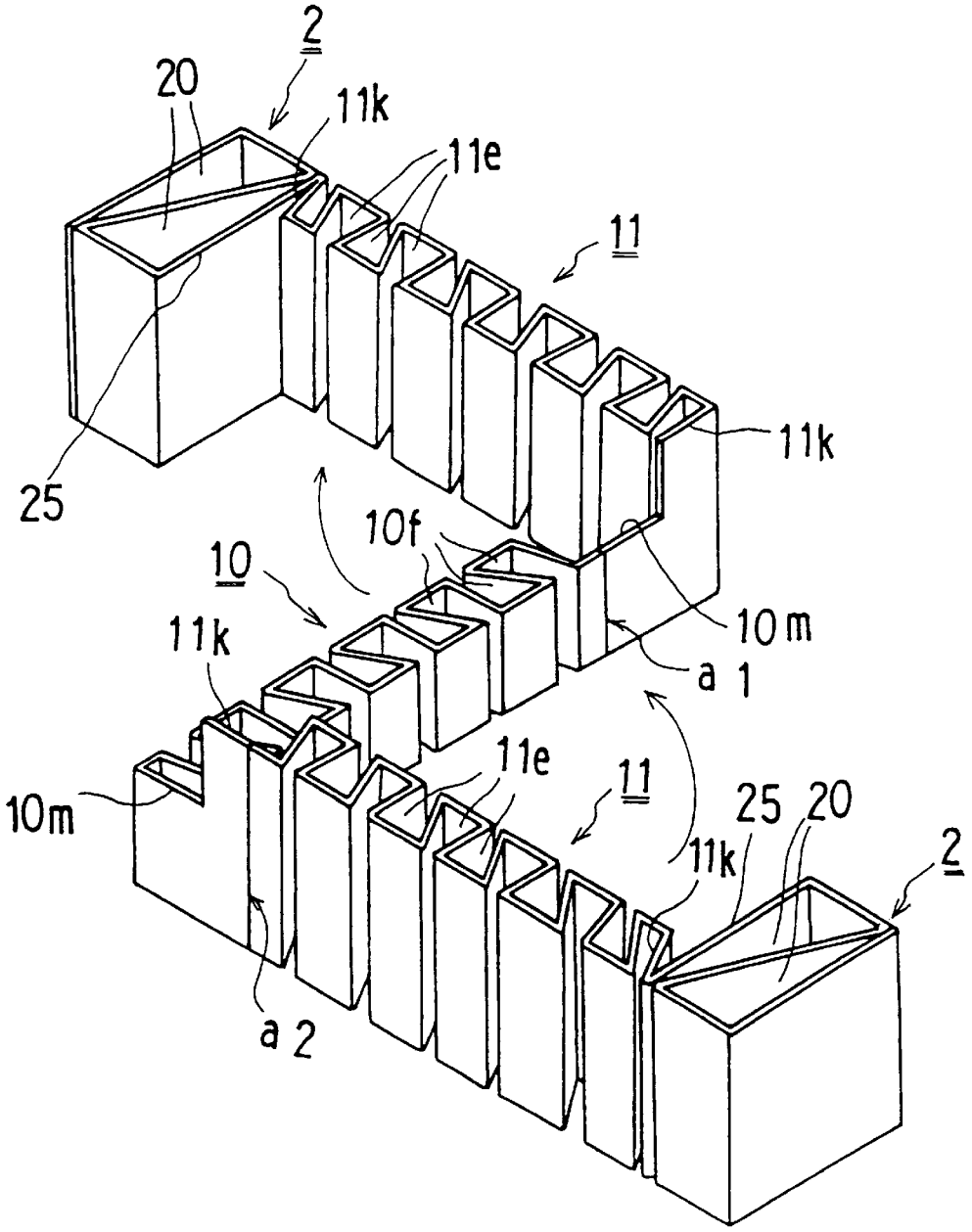
FIG. 76 is a perspective view explaining the fabrication of the cushioning material of FIG. 75.

An embodiment of the cushioning material corresponding to the thirteenth aspect of the present invention is shown in FIGS. 75 and 76.

FIG. 75 is a perspective view of the cushioning material and FIG. 76 is the cushioning material of FIG. 75, which is partially developed in course of fabrication thereof.

Each end support member 2 is composed of a hollow body which has two hollow portions 20, 20 in parallel along the depth direction of the grooved retainer 1 similarly to the end support member 2 in the 34th embodiment (FIG. 57).

The end support member of this embodiment consists of an outside sheet part 21 facing the outside of the grooved retainer 1, a width sheet part 27, an partition sheet part 23 inclined diagonally, another width sheet part 26 and an inside sheet part 25 facing the inside of the grooved retainer 1.

The rectangular solid is formed of these sheet parts except the partition sheet part 23 and the partition sheet part 23 is arranged diagonally in the solid. Therefore, each hollow portion 20, 20 has a section of a right-angled triangle and they are arranged reversely and in parallel.

Each side wall 11 is formed by folding the material sheet according to the design and composed of a hollow body, which has many hollow portions 11*e* of triangular section arranged in parallel along the depth direction of the grooved retainer 1.

The hollow portions 11*e* except those at the opposite ends are arranged in parallel and alternately in reversed posture and each has a section of an isosceles triangle. Each of the hollow portions 11*e* at the opposite ends has a section of a right-angled triangle so as to make a right angle at the corner of the side wall 11.

The triangles of the hollow portions 11*e* of the side wall 11 have almost the same height and, therefore, the side wall 11 becomes to be a hollow panel having a plurality of hollow portions 11*e*.

The raised bottom 10 is formed by folding the material sheet according to the design and composed of a hollow body which has many hollow portions 10*f* each having a triangular section, which are arranged in parallel along the depth direction of the grooved retainer 1.

Detailed construction of the raised bottom 10 is similar to that of the side walls 11 and explanation thereof is omitted.

One end of the inside sheet part 25 of one of the end support members 2 (left side of FIG. 75) is continuous to the width sheet part 11*k* at one end of one of the side walls 11 (upper side of FIG. 75). The forward end of the width sheet part 11*k* of the other end of the one side wall 11 is continuous to one end of the raised bottom 10 (width sheet part 10*m*, in this embodiment).

The forward end of the width sheet part 10*m* of the other end of the raised bottom 10 (left end in FIG. 75) is continuous to the width sheet part 11*k* of one end (left end in FIG. 75) of the other side wall 11. The forward end of the width sheet part 11*k* of the other end of the other side wall 11 is continuous to the end of the inside sheet part 25 of the other end support member 2.

In the cushioning material of this embodiment, the sheet parts are continuous to each other as mentioned above, whereby it becomes a single sheet when developed.

After cutting the sheet according to design, forming the valley forming or ridge forming folding lines on the sheet and imparting directional permanency of folding to the sheet along the folding lines, the raised bottom 10, the side walls 11 and the end support members 2 are build into solid bodies as shown in FIG. 76. Then the raised bottom 10 and the lower side wall 11 are moved toward the direction shown by arrow lines by folding the sheet at the valley forming folding line a1 and the ridge forming folding line a2 respectively. Thus, the cushioning material of this embodiment is manufactured.

In the cushioning material of the 46th embodiment, since the raised bottom 10, the side walls 11 and the end support members 2 are each composed of a hollow body having many hollow portions, an article can be supported steadily and greater cushioning effect can be obtained.

In the cushioning material of this embodiment, since every hollow portions 20, 10*f* and 11*e* are along the depth direction of the grooved retainer 1, mechanical work of forming the folding lines on the sheet, imparting directional permanency of folding to the sheet along the folding lines and folding the sheet can be carried out very smoothly.

In the cushioning material of this embodiment, the edges of the hollow portions 10*f* of the raised bottom 10 are exposed inside in the finished state of FIG. 75. Depending on the kind of a subject article, it is preferred to put a sheet (not show in the figure) on the raised bottom in order to prevent an article from being damaged by the edges.

The cushioning material of this embodiment, however, is convenient for an article having a protrusion or projection at its end to be inserted into the grooved retainer 1. Since the edges of the hollow portions 10*f* of the raised bottom 10 are exposed inside as mentioned above, the protrusion or projection of the article can be accomodated in the hollow portions 10*f*.

In this embodiment too, the inside sheet part 25*f* each end support member 2 may be composed of plural layers to reinforce the end support member.

Other functions, effects and configurations of the cushioning material of this embodiment are similar to those of the first embodiment and explanation thereof is omitted.

47th Embodiment

Figure 77:
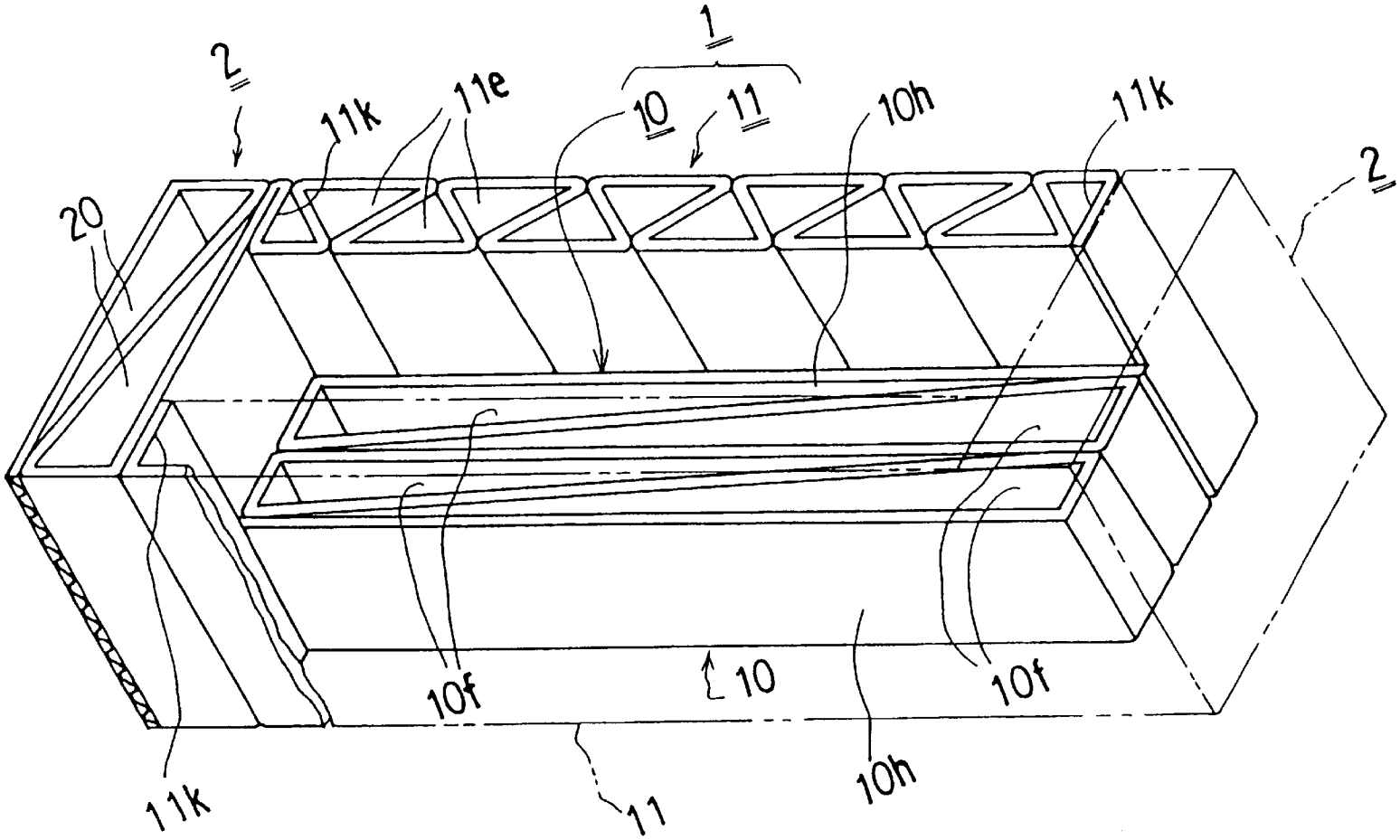
FIG. 77 is a partial, cutaway perspective view of a 47th embodiment of the cushioning material for packaging according to the present invention.

Another embodiment of the cushioning material corresponding to the thirteenth aspect of the present invention is shown in FIG. 77.

In this embodiment, the raised bottom 10 of the cushioning material of the 46th embodiment is modified.

In this embodiment, the raised bottom 10 has plural hollow portions 10*f* each of which has a lengthened triangular section along the longitudinal direction of the grooved retainer 1. The width sheet part 11*k* of one end of one of the side walls 11 is continuous to one end of the longitudinal sheet part 10*h* of the raised bottom 10. One end of the other longitudinal sheet part 10*h* of the raised bottom 10 is continuous to the width sheet part 11*k* of one end of the other side wall 11.

Such configuration of the raised bottom 10 is advantageous because an amount of the sheet required can be reduced compared to the 46th embodiment.

Other functions, effects and configurations of the cushioning material of this embodiment are similar to those of the 46th embodiment and explanation thereof is omitted.

48th Embodiment

Figure 78:
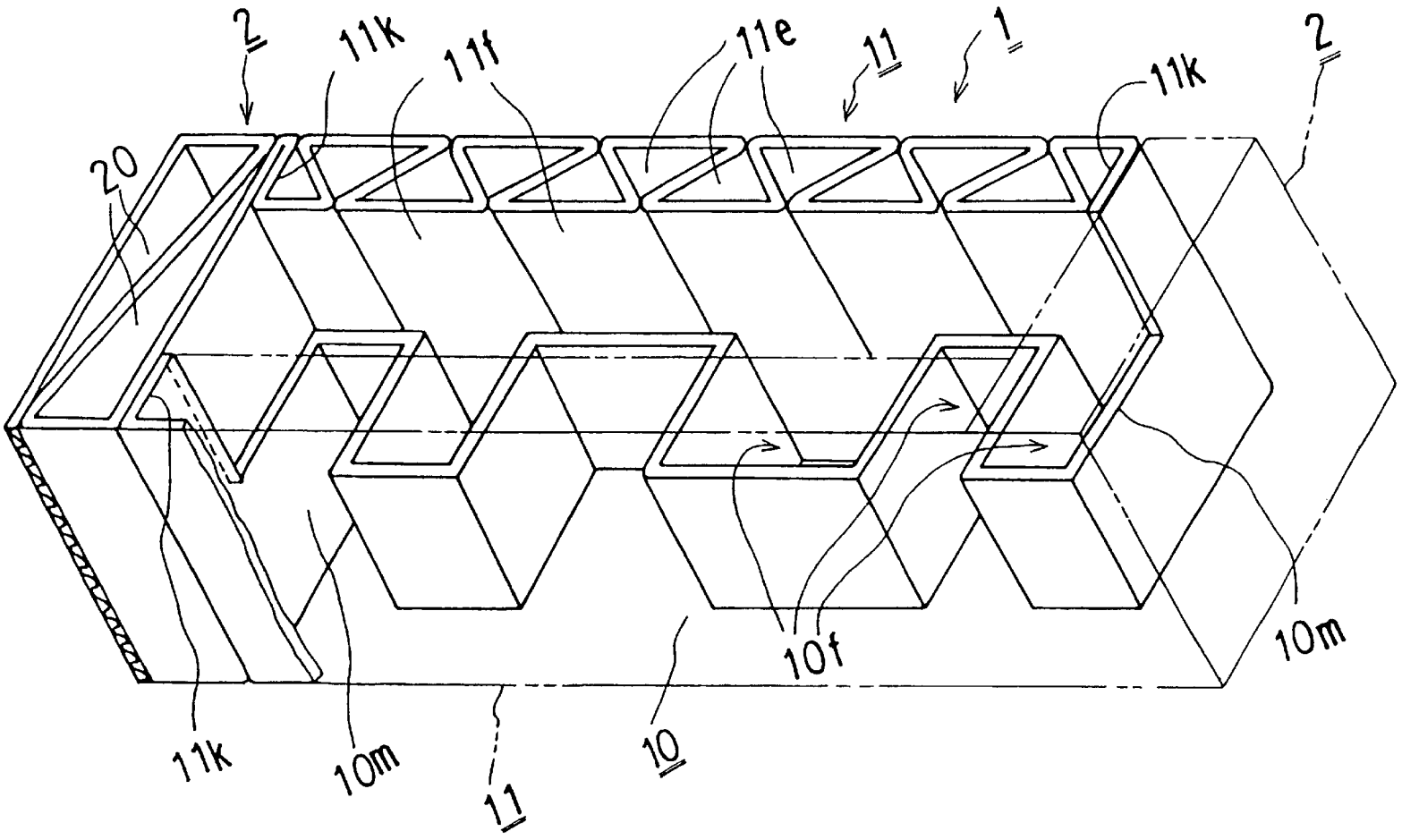
FIG. 78 is a partial, cutaway perspective view of a 48th embodiment of the cushioning material for packaging according to the present invention.

Yet another embodiment of the cushioning material corresponding to the thirteenth aspect of the present invention is shown in FIG. 78.

In this embodiment too, the raised bottom 10 of the cushioning material of the 46th embodiment is modified.

In this embodiment, a necessary part of the sheet is folded in zigzag (at right angle) with the predetermined width in a plan view and protruded ends are made in contact with the inside sheet parts 11*f* of each side wall 11 to form the raised bottom 10 having a plurality of hollow portions 10*f*.

Such configuration of the raised bottom 10 is advantageous because an amount of the sheet required can be reduced compared to the 46th embodiment.

Other functions, effects and configurations of the cushioning material of this embodiment are similar to those of the 46th embodiment and explanation thereof is omitted.

49th Embodiment

Yet another embodiment of the cushioning material corresponding to the thirteenth aspect of the present invention is shown in FIG. 79.

In this embodiment, the end support members 2 and the side walls 11 are constructed similarly to those of the 46th embodiment.

The raised bottom 10 consists of an approximately horizontal raised bottom sheet part 10*a* and the end legs 10*b*, which are formed at the opposite lower ends thereof.

The width sheet part 11*k* of one end of one of the side walls 11 is continuous to one end of the end leg 10*b* at one end of the raised bottom 10. One end of the end leg 10*b* at the other of the raised bottom 10 is continuous to the width sheet part 11*k* of one end of the other side wall 11.

Other configurations are similar to those of the 46th embodiment.

Such configuration of the raised bottom 10 is advantageous because an amount of the sheet required can be reduced compared to the 46th embodiment.

The cushioning material of this embodiment is preferably used in condition where the load of an article is mainly applied to the side wall 11, since the side walls 11 are greatly reinforced by many hollow portions.

Other functions, effects and configurations of the cushioning material of this embodiment are similar to those of the first embodiment and explanation thereof is omitted.

50th Embodiment

Figure 80:
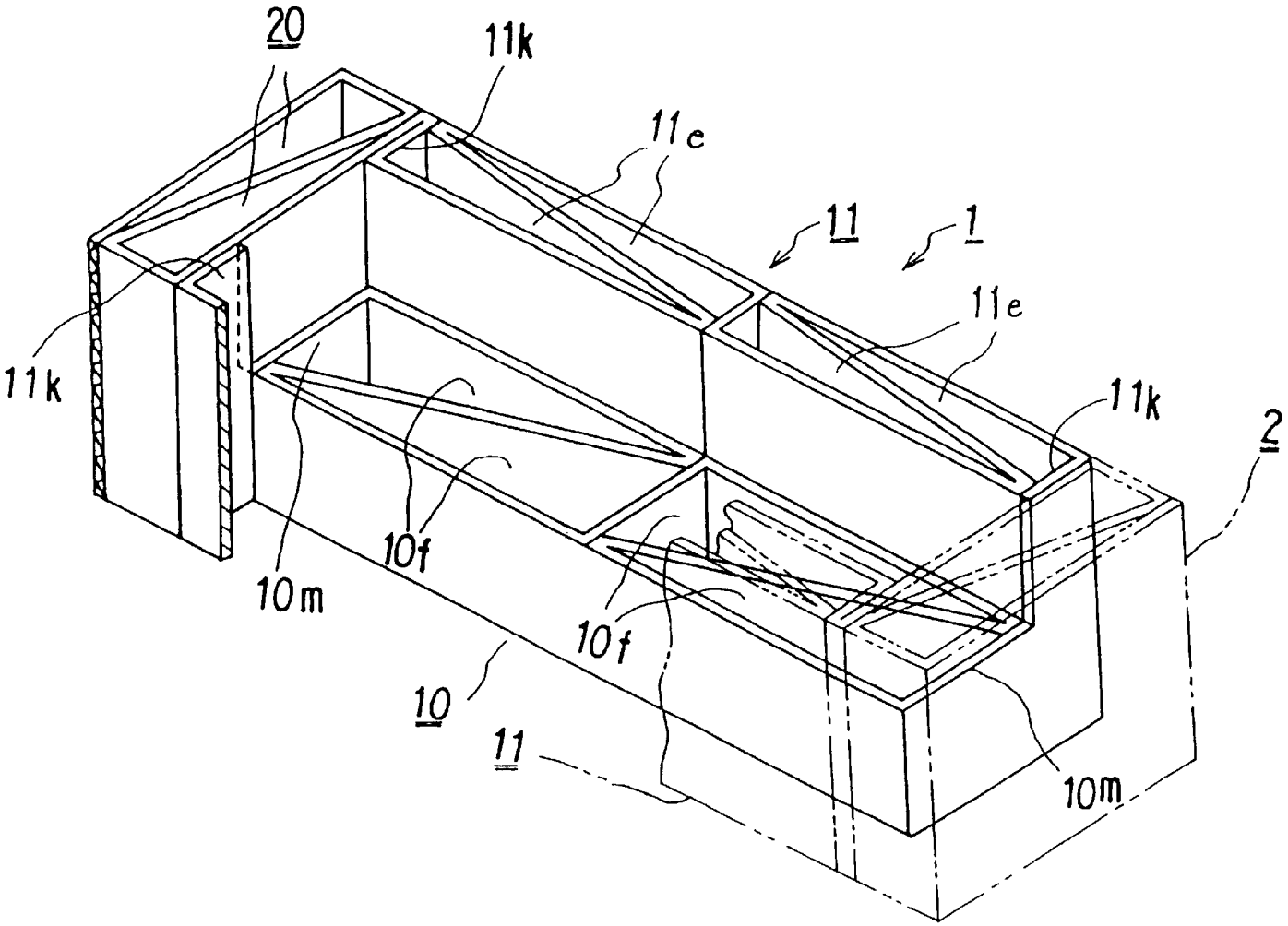
FIG. 80 is a partial, cutaway perspective view of a 50th embodiment of the cushioning material for packaging according to the present invention.

Yet another embodiment of the cushioning material corresponding to the thirteenth aspect of the present invention is shown in FIG. 80.

In this embodiment, the side walls 11 and the raised bottom 10 of the cushioning material of the 46th embodiment are modified.

Each side wall 11 is composed of hollow bodies each having a pair of hollow portions 11*e*, 11*e*, which are arranged in parallel and reversely along the vertical direction, and have a section of opposed right-angled triangles.

The pair of hollow portions 11*e*, 11*e* is so designed that it has a rectangular section by arranging the hollow portions in reversed posture. The side wall 11 is formed to be a hollow panel as a whole by arranging even pairs of the hollow portions 11*e*, 11*e*.

The raised bottom 10 is composed of hollow bodies each having plural pairs of hollow portions 11*e*, 11*e*, which are arranged along the vertical direction in parallel and reversely, and have a section of opposed right-angled triangles.

Other configurations are similar to those of the 46th embodiment.

Such configuration of the raised bottom 10 is advantageous because an amount of the sheet required can be reduced compared to the 46th embodiment.

Other functions, effects and configurations of the cushioning material of this embodiment are similar to those of the 46th embodiment and explanation thereof is omitted.

51st Embodiment

Figure 81:
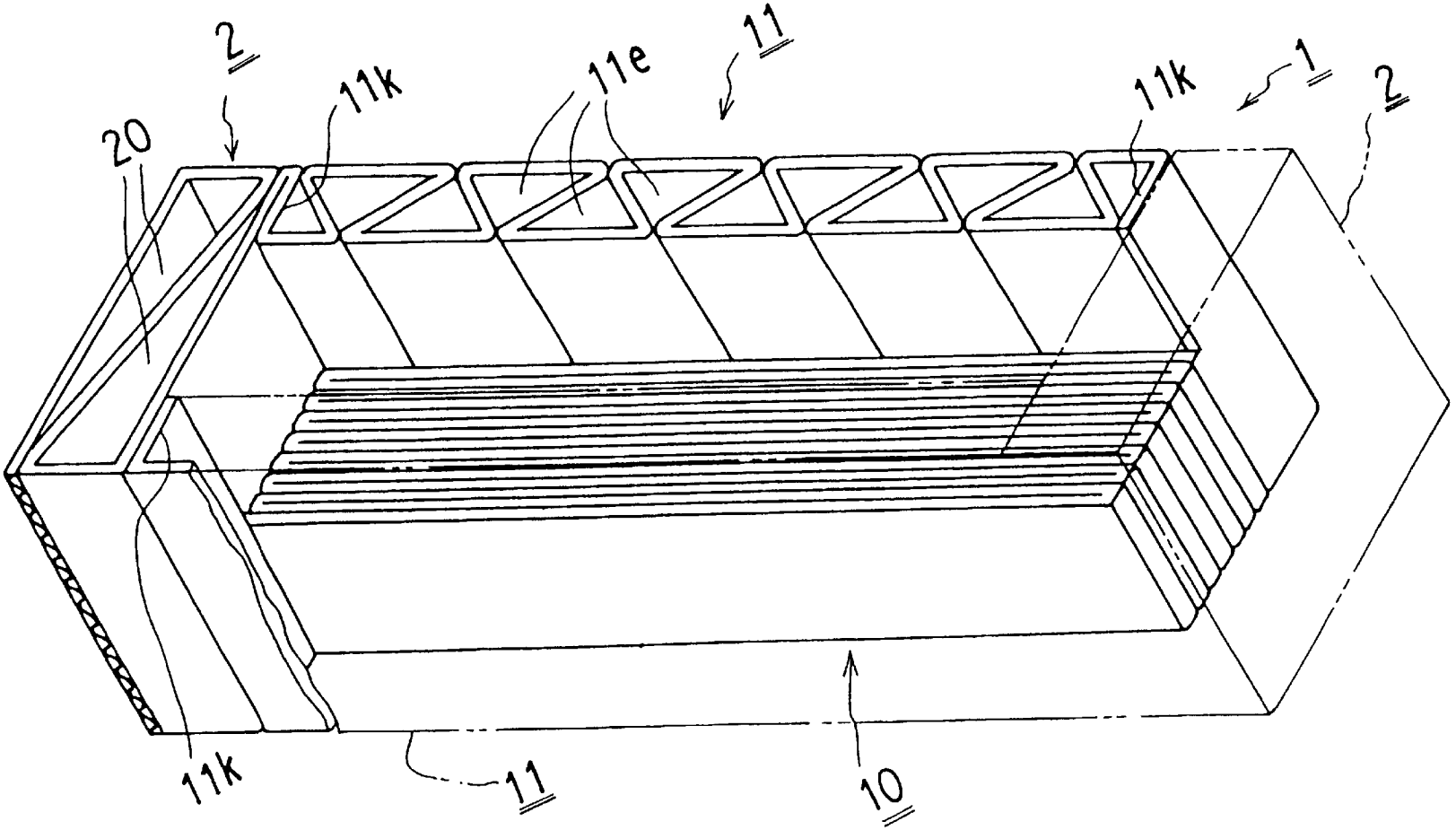
FIG. 81 is a partial, cutaway perspective view of a 51st embodiment of the cushioning material for packaging according to the present invention.

Yet another embodiment of the cushioning material corresponding to the thirteenth aspect of the present invention is shown in FIG. 81.

In this embodiment, the end support members 2 and the side walls are constructed similarly to those of the 46th embodiment.

In this embodiment, the raised bottom 10 is composed of a layered block, which is formed by folding a necessary portion of the material sheet along the longitudinal direction and in zigzag so that the layers are along the vertical direction.

In the raised bottom 10, an end of the layers is continuous to the width sheet part 11*k* at one end of one of the side walls 11. The other end of the layers is continuous to the width sheet 11*k* at the other end of the other side wall 11.

According to the cushioning material of the 51st embodiment, since the side walls 11 and the end support members 2 are each composed of a hollow body having many hollow portions and the raised bottom 10 is composed of a layered block, an article can be supported steadily and greater cushioning effect can be obtained.

In the cushioning material of this embodiment, since all of the hollow portions 20, 11*e* is along the depth direction of the grooved retainer 1 and the folded lines of the raised bottom 10 are also along the same direction as the hollow portions 20, 11*e*, mechanical work of forming the folding lines on the sheet, imparting directional permanency of folding to the sheet along the folding lines and folding the sheet can be carried out very smoothly.

Other functions, effects and configurations of the cushioning material of this embodiment are similar to those of the 46th embodiment and explanation thereof is omitted.

52nd Embodiment

Figure 82:
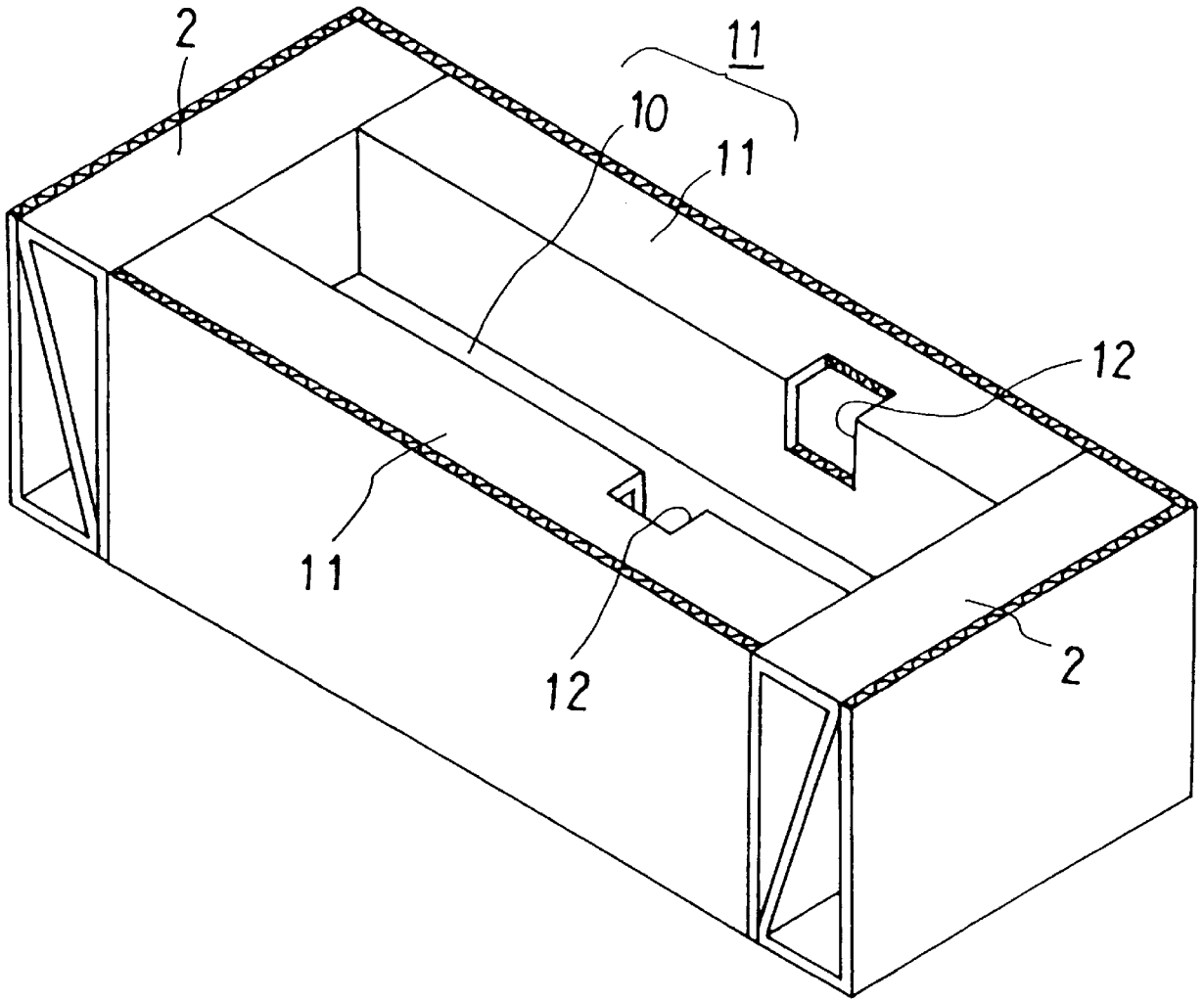
FIG. 82 is a perspective view of a 52nd embodiment of the cushioning material for packaging according to the present invention.
Figure 85:
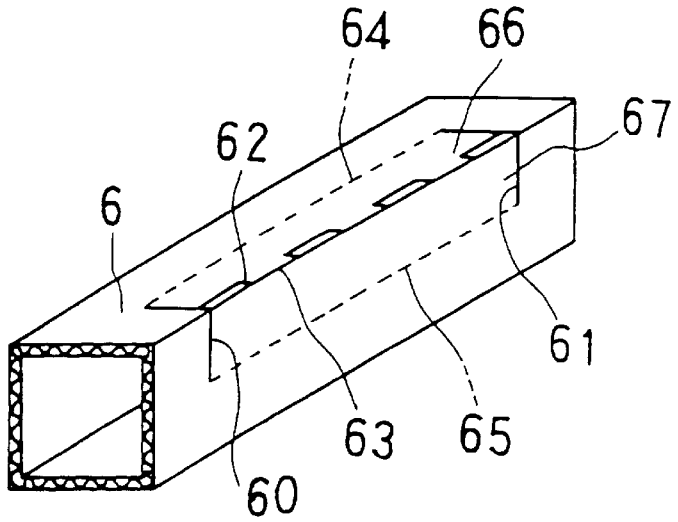
FIG. 85 is a perspective view of a conventional cushioning material for packaging.
Figure 86:
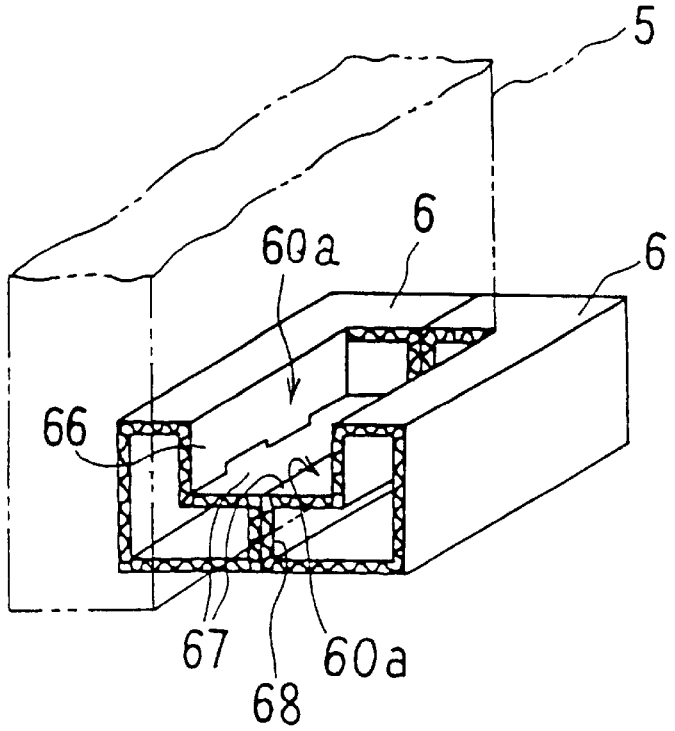
FIG. 86 is a partial perspective view showing the use of the cushioning material of FIG. 85.

Another embodiment of the cushioning material corresponding to the sixth aspect of the present invention is shown in FIGS. 82 and 83.

The cushioning material is designed for an article (not shown in the figure) having a protrusion or projection at the part to be inserted to the grooved retainer 1. The cushioning material has hole or cut portions (or recesses) 12 at the corresponding portion of the inside of the grooved retainer 1 or end support member 2.

The cut portion 12 can be formed whether the side wall 11 and raised bottom 10 are composed of hollow structure or layered blocks.

The cut portion 12 may be a hole formed by cutting or punching the necessary portion of the cushioning material 1. Alternatively, in a case that the portion to be cut has hollow structure, it may be a recess formed without removing the cut portion as shown in FIG. 83.

By forming the cut portion as mentioned above, the article having a protrusion or projection at the end can be accommodated smoothly.

Other Embodiments

In mechanical work, the partition sheet part 23 in the end support member 2 of a hollow body is preferably arranged so as to form hollow portions 20 having sectional shapes of right-angled triangles or other triangles. However, the partition sheet part 23 may be formed, for example as shown in FIG. 84. Any end support member 2 having a plurality of hollow portions 20 is prevented from deformation and, even if deformed temporarily, is liable to restore to its original state.

This is similarly applied to the side walls 11 or raised bottom composed of a hollow body.

(A) of FIG. 84 shows a hollow structure, where each hollow portion 20 has a trapezoid section. The opposite ends of the partition sheet part 23 are respectively fixed at a point somewhat apart from the diagonal angle.

In a structure shown in (B), a sectional shape of each hollow portion 20 is quadrangle or pentagon and the ends of the partition sheet part 23 are not positioned at the diagonal angle.

In (C), a sectional shape of each hollow portion 20 is square and each end of the partition sheet part 23 is positioned in the middle between two angles.

In these embodiments, another end support member having the same configuration may be continuously formed outside of one or both of the end support members 2 (in the embodiment shown in FIG. 1, right side of the right end support member 2 or left side of the left end support member 2).

When the side wall 11 is composed of the hollow body, another side wall having a similar configuration may be formed outside of one or both of the side walls 11.

By duplicating the end support member 2 or side wall 11, resistance to a shock or impact can be improved.

What is claimed is:

1. A cushioning material for packaging comprising:

an open trough, having an open interior with a rectangular cross-section, a raised bottom, and two side walls, for receiving an end section of an article having one of a hexahedral or rectangular shape, at least a pair of end members extending in a longitudinal dimension across opposing ends of the trough, wherein each end member has a hollow interior divided into a plurality of parallel hollow sections and a rectangular cross-section orthogonal to the longitudinal dimension of the hollow sections, wherein each of said hollow sections is triangular in cross-section perpendicular to the longitudinal dimension;

wherein one hollow section in each of said end members presents a wall surface coextensive with said hollow interior and extending continuously along said longitudinal dimension, across and closing a respective end of said trough; and wherein the raised bottom, the side walls and the end members are integrally formed by folding a single sheet of a recyclable cardboard along preformed folding line grooves.

2. The cushioning material for packaging of claim 1, wherein a portion of each end member is continuous with only a corresponding end of the raised bottom and each side wall is continuous with only a corresponding side of the raised bottom.

3. The cushioning material for packaging of claim 1, wherein each side wall is continuous with only a corresponding side of the raised bottom, wherein one of the end members is continuous with only the corresponding end of one of the side walls and wherein the other end member is continuous with only the corresponding end of the other side wall.

4. The cushioning material for packaging of claim 1, wherein a portion of each end member is continuous with only a corresponding end of the raised bottom, wherein one end of one of the side walls is connected to a corresponding end of one of the end members and wherein one end of the other side wall is connected to a corresponding end of other of the end members.

5. The cushioning material for packaging of claim 1, wherein a portion of each end member is continuous with only a corresponding end of the raised bottom, wherein one end of one of the side walls is continuous with only a corresponding end of one of the end members and wherein the other side wall is continuous with only a corresponding side of the raised bottom.

6. The cushioning material for packaging of claim 1, wherein each side wall is continuous with only a corresponding side of the raised bottom, wherein a portion of one of the end members is continuous with only a corresponding end of the raised bottom and wherein the other end member is continuous with only a corresponding end of one of the side walls.

7. The cushioning material for packaging of claim 1, wherein one end of one of the side walls is continuous with only a corresponding end of one of the end members, wherein a portion of the one end member is continuous with only the corresponding end of the raised bottom, wherein the other side wall is continuous with only a corresponding side of the raised bottom, and wherein an end of the other side wall is continuous with only a corresponding end of the other end member.

8. The cushioning material for packaging of claim 1, wherein one end of each side wall is continuous with only a corresponding end of one of the end members, wherein the other end of one of the side walls is continuous with only a corresponding end of the other end member and wherein one end of the raised bottom is continuous with only a portion of either of the end members.

9. The cushioning material for packaging of claim 1, wherein one end of each side wall is continuous with only a corresponding end of one of the end members, wherein the other end of one of the side walls is continuous with only a corresponding end of the other end member and wherein either of the side walls is continuous with only a corresponding side of the raised bottom.

10. The cushioning material for packaging of claim 1, wherein one of the end members is continuous with only a corresponding end of one of the side walls, wherein one end of the raised bottom is continuous with only the other end of said one side wall, wherein the other end of the raised bottom is continuous with only a corresponding end of the other side wall, and wherein the other end member is continuous with only the other end of the other side wall.

11. The cushioning material for packaging according to claim 1 wherein a second dimension of said wall surface is equal to a dimension of said triangular cross-section.

* * * * *